US006220311B1

(12) United States Patent
Litto

(10) Patent No.: US 6,220,311 B1
(45) Date of Patent: Apr. 24, 2001

(54) PRESERVATION AND DISPENSATION BY VOLUMETRIC DISPLACEMENT

(76) Inventor: Claude R. Litto, P.O. Box 7, New Baltimore, NY (US) 12124

( * ) Notice: Subject to any disclaimer, the term of this patent is extended or adjusted under 35 U.S.C. 154(b) by 0 days.

(21) Appl. No.: 09/194,622

(22) PCT Filed: Jun. 7, 1997

(86) PCT No.: PCT/US97/09934

§ 371 Date: Dec. 1, 1998

§ 102(e) Date: Dec. 1, 1998

(87) PCT Pub. No.: WO97/46446

PCT Pub. Date: Dec. 11, 1997

Related U.S. Application Data

(63) Continuation-in-part of application No. 08/659,820, filed on Jun. 7, 1996, now abandoned.

(51) Int. Cl.[7] ..... B65B 1/04

(52) U.S. Cl. ..... 141/67; 141/98; 141/114; 220/403

(58) Field of Search ..... 141/18, 65, 67, 141/73, 82, 114, 98; 220/403, 404, 412, 460, 461, 470, 500; 215/11.3, 12.1; 222/146.6, 131, 386.5; 53/445, 449; 62/457.3, 457.4, 457.7, 457.8

(56) References Cited

U.S. PATENT DOCUMENTS 262,773 * 8/1882 Hohl .
5,284,028 * 2/1994 Stuhmer .

* cited by examiner

*Primary Examiner*—Steven O. Douglas
(74) *Attorney, Agent, or Firm*—Jay R. Yablon

(57) ABSTRACT

An apparatus and method including providing a container (12) containing a given quantity of usable material (50). A full container (12) is maintained by providing displacement matter (52) separated from the usable material (50) by a mobile partition (28).

141 Claims, 30 Drawing Sheets

PRESERVATION AND DISPENSATION BY VOLUMETRIC DISPLACEMENT

This application is a CIP of 08/659,820, filed Jun. 7, 1996, now abandoned, and is a 371 of PCT/US97/09934, filed Jun. 7, 1997.

TECHNICAL FIELD

The present invention relates to the field of storing and dispensing materials, with particular application to containers with contents that are partially consumed.

BACKGROUND ART

Containers, when partially emptied of their contents, exhibit a wide range of undesirable characteristics. Unless special and often expensive procedures are used, atmosphere enters the container and pollutes it with undesirable elements such as water vapor, air born contaminates, or unwanted oxygen. Containers that are emptied in water baths, space, or in other material baths are damaged or difficult to pour in those environmental elements. The contaminants can pre-maturely cure or damage the product or cause unwanted water condensation, as air sensitive paints and glues harden the skin, fine wines and other preparations oxidize, dry wheat crackers get soggy, or liquid fuel tanks gather water. These are just a few examples. Another undesirable characteristic of a partially emptied container is the tendency for the usable material in the container to loose gas, off gassing to the air space left in the container. Off gassing results in premature curing or damaging of products. It results in loss of material. Materials with water content, when frozen in partially full containers, loose moisture to the air by sublimation and exhibit "freezer burn". Off gassing can cause safety concerns as a mixture of fuel or other flammable vapor and oxygen in a partially full fuel tank can explode. A half full container of a dusty material imposes increased fire hazard if the dust air mixture is combustible, especially if that container is large such as in a storage silo. Containers that are partially filled with toxic or unpleasant material that evaporates emit more or unpleasant odors when opened then full containers do, polluting the environment and creating health risks. Waste disposal and septic system holding tanks under certain conditions emit foul odors. One particularly poignant example of off gassing damage is that which occurs to partially consumed portions of effervescent beverages. Effervescent beverages such as soda, champagne, sparkling wines, coolers, beer and the like, have $CO^2$ gas dissolved in them, at pressure. Unfortunately the carbonated beverage is stored under pressure in the bottle and after the bottle is opened, the best part of the gas is free is escape the beverage, and the drink goes flat. Even if the cap is replaced, the gas is free to go into the air above the drink, and the bigger that space gets as the drink is "used up", the more gas can escape and the poorer the drink tastes. A second opening of the container compounds the problem and accelerates the damage to the beverage. Leaving a very small amount of beverage at the bottom of the container, will yield in a day, a drink that is almost devoid of effervescence and foremost people, worthless. A problem that the invention deals with as a side benefit is that ice when used to cool a drink, waters down the drink as the ice melts. That is, the water derived as the ice melts contaminates the drink and dilutes it. Management of materials in containers that are only partially full creates a number of management difficulties. For example a characteristic of a partially emptied container is that in many cases, it is more difficult to remove material from it. A half empty tube of toothpaste is harder to squeeze. Rolling up the bottom of a metal squeeze tube can cause the metal to crack if rolling is done improperly. As the mustard or glue in the squeeze bottle is used up, it becomes more difficult to dispense, requiring bottle inverting and shaking. Delicate applications that require the material to be dispensed in a prescribed manner, such as decorative application by artists, precise glue or calk application, and cake icing, become more difficult as the tube or bottle has less usable material in it. Trying to squeeze the usable material in an upward direction, such as encountered when under a car and trying to make the squeeze can of penetrating oil shoot in an upward direction, or putting material from a squeeze bottle onto the underside of a horizontal surface such as a ceiling, is difficult. Containers with simple taps, spigots, petcocks, or fittings must generally have the tap at a low location in the container so that gravity will bring the liquid to the exit opening of the container. Trying to get the last bit out of a squeeze tube is near imposable. Cylinders of expensive gasses can not be completely emptied in easy fashion. When the internal pressure of the gas is equal to the external atmospheric pressure, unless a vacuum is applied, no more gas will come out of the cylinder. Another undesirable characteristic of partially emptied containers is that the contents can move about or splash. In vehicles, this leads to an uneven load that moves about disrupting the smoothness of the ride. Baffles in liquid fuel tanks are currently used to reduce sloshing. In other instances, sloshing causes the material in the container to froth up. For example, a shaken and frothed effervescent beverage sprays all over when opened. Containers in some instances require venting. Air must be let into the container via another opening so that the usable material can exit. The vent often must be manually opened and closed, a labor consuming activity. Air coming in the vent can pollute or damage the usable material in the container. It is difficult to deliver a metered or specific amount of material from a container with out introducing air to the container. A half full container is not as stable as a full container with less weight, can tip over more easily. There is a psychological effect on the user that is different for a full container and a partially emptied one. Taking paint from a can and putting it into other containers for brush dipping or rolling is a messy affair. So is putting the unused portion back into the can. Pumping material requires apparatus of various degrees of complexity. Pumping materials that are environmentally sensitive, in that they are volatile and pollute or in that they are damaged by contact with the atmosphere requires expensive apparatus. Some containers contain usable material and a propellant gas packed under pressure. The compressed propellant gas is used to drive the material out at the push of a button or to spray the usable material. These generally disposable containers loose pressure as the usable material and the gas are used up. In the production and use of containers there are environmental considerations. Because of the problems associated with partially filled containers, products are frequently shipped in smaller containers. While one container is opened and in use, the remaining material is kept fresh in the remaining unopened containers. This technique requires more container wall material per unit of stored usable material because in general, the surface area of the container increases in proportion to the square of of the container's radius, while the volume increases as the cube. Since the surface area of the container is directly related to the amount of material it takes to make the container, in general the greater the number of containers a given amount of usable material is stored in, the more container wall material will be needed to make those containers. Also, more containers generally take more human and machine effort to make. In all, it is more economical as well as more conservative of energy and natural resources to make large containers. The down side is that large containers can lead to increased amounts of spoilage of the unused contents of the containers. Even in small containers, damaged unused material causes loss of energy and natural resources. Utilization of extra energy and natural resources is detrimental to our environment. These losses lead to financial loss. Containers whose contents are packaged under pressure for spray tube delivery, have in the past, used propellant gasses that may be damaging to the environment. In general, it is a difficult problem to remove material from a container without allowing air to contact the remaining portions. It is even more difficult to remove the material under these conditions in metered portions.

Preserving the unused portion of effervescent beverages has also over time proved to be a difficult problem to address economically. Pumps have been developed which will repressurize opened bottles of effervescent material as exemplified by the device disclosed in U.S. Pat. No. 5,322,094 to Janesko. These cumbersome to use as each time the container is opened, the entire container must be repressurized. In addition, $CO^2$, the gas used for carbonating drinks will transfer, in part, to the air pumped into the container, as the air has too low a partial pressure of $CO^2$ as it is pumped from the atmosphere into the container. The beverage still goes flat despite all the pumping.

The concept of filling a container with alternate material to keep it full and preserve the contents has been embodied in previous patents. Hohl, U.S. Pat. No. 262,773, patented 1882, shows an apparatus for insertion into a beer keg, the apparatus having a bladder attached that is filled with water from a reservoir mounted above the keg. The reservoir is utilized to fill the bladder with water as beer is removed from the keg via a tap mounted in the keg. A pipe is fitted between the reservoir and the keg. Water flows down a pipe from the reservoir and fills the bladder. A similar device is described by Kish, U.S. Pat. No. 2,762,534, patented 1956. Fluid is forced into a pipe which runs into the keg and into a bladder, that pressure causing beer to flow out another pipe with connection to the inside of the beer keg. Valves are used to regulate that pressure flow. This prior art has not seen wide spread utilization because it is expensive to purchase and extremely cumbersome to use especially in the home environment.

OBJECTS AND ADVANTAGES

What has not been fully exploited, is the fact that for many types of left over materials, instant preservation is not required. Recognition and application of this, allows for an extreme simplification of the volumetric displacement devices for preservation. No pumps, pipes, air or water reservoirs, spigots or even valves of any sort are required to preserve many materials, including effervescent beverages. Material may be removed from the container by actions as simple as picking up the container and pouring. Air allowed to enter the container is automatically dispelled as alternate matter is poured back into the container, filling it. As many materials, including effervescent beverages, need a period of exposure of some duration to be damaged, allowing them to be exposed for a relatively short period of time doesn't hurt them too much. If they are reprotected within a relatively short period of time, they survive well enough. This allows for extremely inexpensive and simple containers to the produced which are cost effective, even on a disposable basis. The containers often provide for adequate long term storage of materials. The new volumetric displacement devices are very easy to operate as they need no external hook ups or alternate apparatus. In addition, if the user decides that they want flawless air free or pressurized deliver, easy hook up of pumps or taps allow for this option while still utilizing the same afore mentioned container. Accordingly, besides the objects and advantages of the volumetric displacement devices described in the above patent, several objects and advantages of the present invention are:

(1) to successfully provide an inexpensive and easy means to dispense usable material from containers with out the remaining unused portion of the usable material being exposed to atmospheric air either during or after the dispensing operation. Air contains oxygen, water vapor and contaminates which can damage usable materials.

(2) to successfully provide a means to dispense usable material from containers underwater, in space or in other material baths from being exposed to those environments.

(3) as a result of the above, to greatly extend the life of materials stored in opened and partially used containers, in preventing premature curing, degradation, oxidation, hardening, or skinning, for atmospherically cured materials.

(4) to prove a means to prevent moisture condensation in fuel tanks and other storage containers.

(5) to provide a means for limiting the absorption of atmospheric water by materials exemplified by dried food stuffs, crackers, dry cereal, snack chips, dried fruit, candy, and organic materials.

(6) to successfully provide a means to limit evaporation of usable materials stored in partially consumed containers, so as to prevent premature curing or aging damage.

(7) to successfully provide a means to limit evaporation of usable materials stored in partially consumed containers.

(8) to provide a means for limiting freezer burn to usable materials stored in partially emptied containers that are frozen.

(9) to successfully provide a means to prevent dangerous air fuel mixtures from developing in partially empty fuel tanks and to prevent flammable air mixtures from developing in other partially emptied flammable volatile liquid containers.

(10) to provide a means to eliminate combustible dust air mixtures.

(11) to provide a means to reduce the amount of toxic or unpleasant smelling vapors that are emitted from containers by reducing the amount of air space in the container and the surface area of the material exposed to the atmosphere, reducing environmental pollution and health risks.

(12) to provide a means to reduce odors in waste disposal and septic systems with holding tanks.

(13) to successfully provide an inexpensive and easy means to prevent effervescent beverages from going flat after their container has been opened and partially consumed.

(14) to provide a means to replenish effervescence in valuable beverages that have already gone flat.

(15) to provide a means to conveniently cool drinks with ice, while the ice does not dilute the drink with water.

(16) to provide a means to make squeeze tubes and bottles deliver usable material as if they were full.

(17) to provide a means for easier and more controllable delivery of liquid or semi-liquid decorations and material administrations such as cake icing, artist's preparations, and glue.

(18) to provide a means for squeeze tubes (such as those commonly used for toothpaste) and squeeze bottles (such as those commonly used for glue or mustard) to deliver contents readily in an upward direction, even when the container is near empty of usable material.

(19) to provide a means for containers with simple taps, spigots, cocks, stopcocks, petcocks, or fittings to have the tap at any location in the container eliminating the need to have gravity bring the usable material to the bottom of the tank for exit at that low point.

(20) to provide a means to nearly empty a squeeze tube without undo effort.

(21) to provide a means to almost completely empty valuable gas stored in cylinders.

(22) to provide a means to prevent fuel in tanks from sloshing (shifting) without baffles.

(23) to provide a means to reduce frothing of liquids in containers caused by sloshing.

(24) to reduce labor in opening and closing air vents on containers in some instances.

(25) to successfully provide a means for the dispensation of usable material in metered (measured) allotments without exposing the unused material to the atmosphere.

(26) to prove a means for extra stability by providing full containers which don't tip over so easily, even when the contents are partially consumed.

(27) to provide a means to achieve positive human psychological effects from using containers that seem full.

(28) to provide a means to take paint, and other materials out of a can, use it for brush dipping or paint rolling, and to return the pain neatly to the can.

(29) to provide a simple inexpensive pump device, that also provides isolation of the usable material from the atmosphere, pollutants in the atmosphere, and water vapor in the atmosphere; extended life of the stored material by isolation from the atmosphere; reduced pollution of the environment by toxic volatile material stored in the container of the pump device; and vapor free of storage of volatile flammable liquids.

(30) to provide a means to deliver material from pressurized containers generally at a uniform pressure, even as the usable material in the container is depleted.

(31) to provide means to conserve natural resource and energy by making larger containers which have a greater usable material to container material ratio, and to make fewer containers.

(32) to provide means to serve natural resource and energy through increased product life.

(33) to provide a means to deliver material form pressurized containers generally at a uniform pressure, even as the usable material in the container is depleted, with non-environmentally damaging propellant gas.

BRIEF DESCRIPTION OF THE DRAWINGS

FIG. 2C shows the device shown in FIG. 2A with a cup that fills with paint and is suitable for dipping a brush in.

FIG. 1A, FIG. 1B, FIG. 1C, FIG. 1D, FIG. 1E, {FIG. 1I, FIG. 1J, FIG. 1K, FIG. 1L, FIG. 1O, FIG. 1P, FIG. 1Q, FIG. 1R, FIG. 1S, FIG. 1T, FIG. 1U, FIG. 1W, FIG. 1X, FIG. 1Y}. Soda Saver 1, Beer Saver 1*c*, Wine Saver 1*d* {, Cap Controlled Soda Saver 1.1, Air Pump Soda Saver Fountain 1.2, Free Floating Retro-Fit Soda Saver 1.3, Retro Fit Tube Fit Soda Saver 1.4, Concentric Soda Saver 1.5}. Reference Numerals in Drawings.

Figures 1A, 1B:
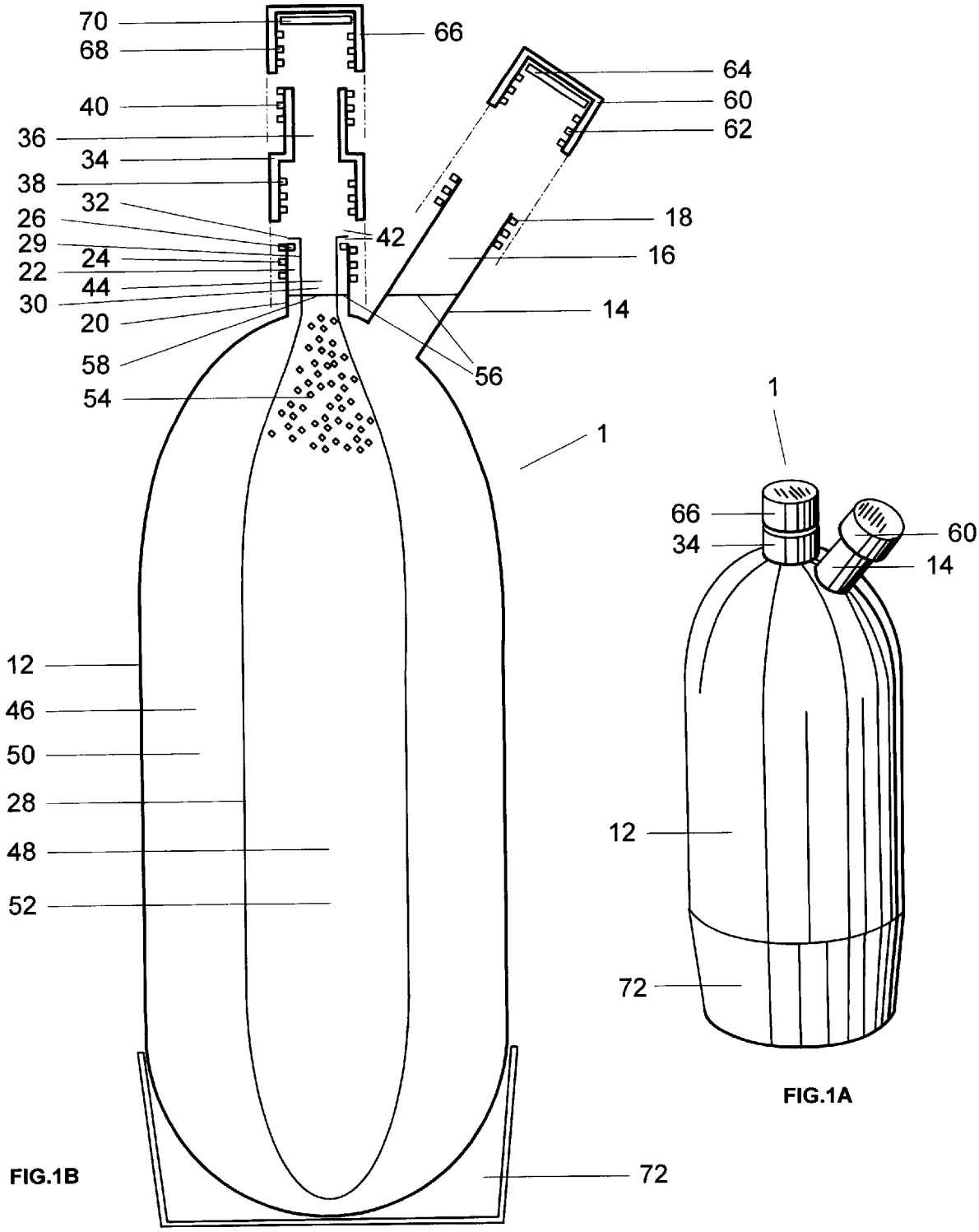
FIG. 1A shows a device for storing of effervescent beverages, soda saver 1, in a manner that prevents loss of carbonation.
FIG. 1B shows a cross sectional view of the device shown in FIG. 1A.

1 soda saver
1*c* beer saver
1*d* wine saver
1.1 Cap Controlled Soda Saver
1.1*a* Cap Controlled Soda Saver by Interference Lip
1.2 Air Pump Soda Saver Fountain
1.3 Free Floating Retro-Fit Soda Saver
1.4 Retro Fit Tub Fit Soda Saver
1.5 Concentric Soda Saver
12 container
14 usable material neck
16 usable material passageway
18 usable material neck male threads
18*c* usable material female neck threads
20 displacement matter neck
22 displacement matter neck passageway
24 displacement matter neck male threads
26 displacement matter neck lip
28 displacement partition
29 displacment partition neck
30 displacement partition passageway
31 displacement partition seam
32 displacement partition flange
34 displacement partition clamp
36 displacement partition clamp passageway
38 displacement partition clamp female threads
40 displacement partition clamp male threads
42 displacement partition flange adhesive
44 displacement matter passageway
46 usable material chamaber
48 displacement matter chamber
50 soda
50*c* beer
50*d* wine
52 water
52*a* air
52*d* conventional glass marbles
54 crushed ice
56 usable material full level
57 $CO^2$ gas bubble
58 displacement matter full level
60 usable material cap
60*c* conventional petcock
62 usable material cap female threads
64 usable material cap seal
66 displacement matter cap
66*d* cork
68 displacement matter cap female threads
69 cap interference lip
70 displacement matter cap seal
72 boot
90 conventional drinking glass
95 conventional faucet
200 conventional soda bottle at pump
205 conventional soda bottle air pump plunger
210 soda bottle fountain adaptor
215 soda bottle fountain adaptor female threads

Figure 1C:
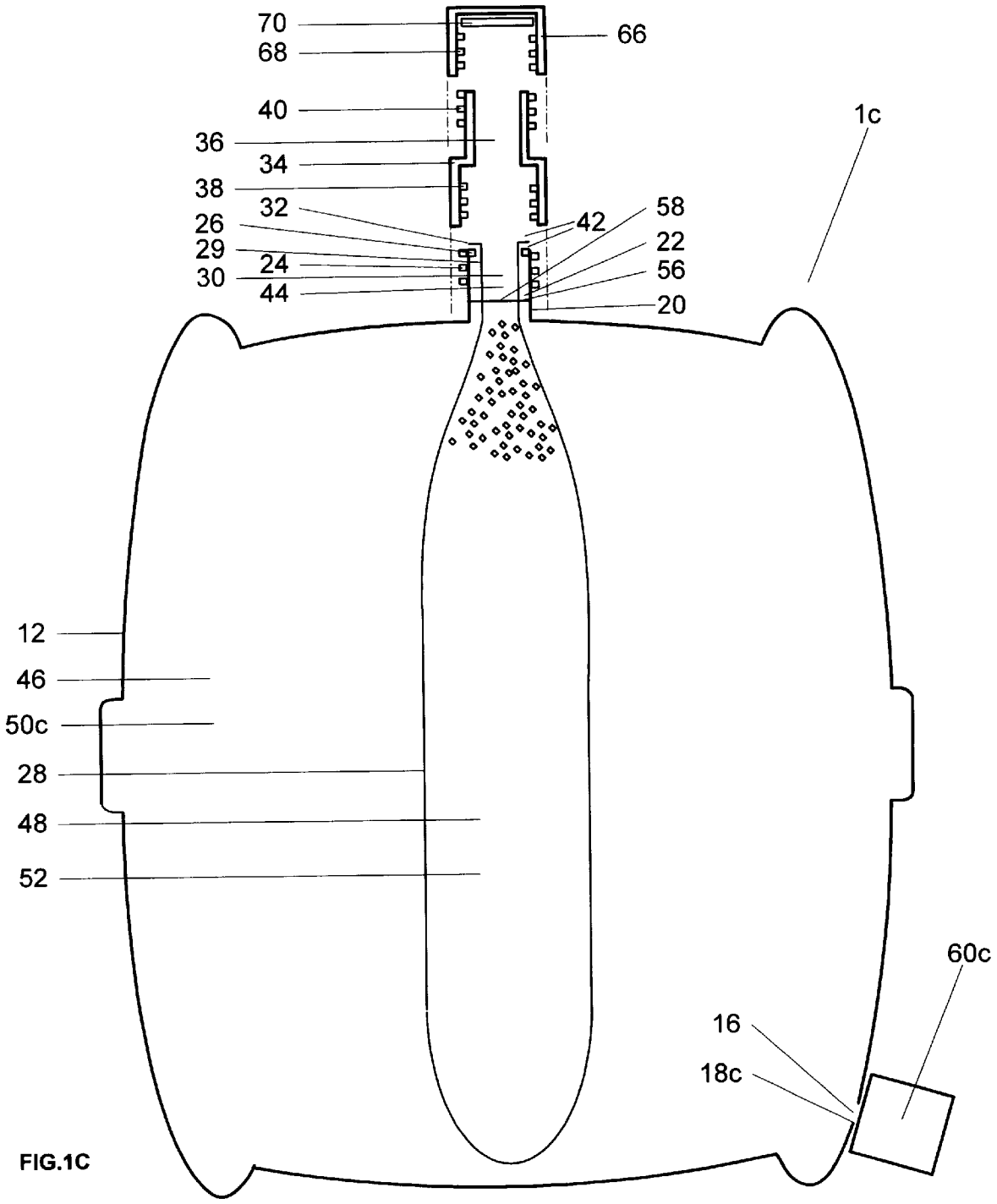
FIG. 1C shows a cross sectional view of a device for storage of effervescent beverages, beer keg 1*c*, in a manner that prevents loss of effervescence.
Figures 1D, 1E:
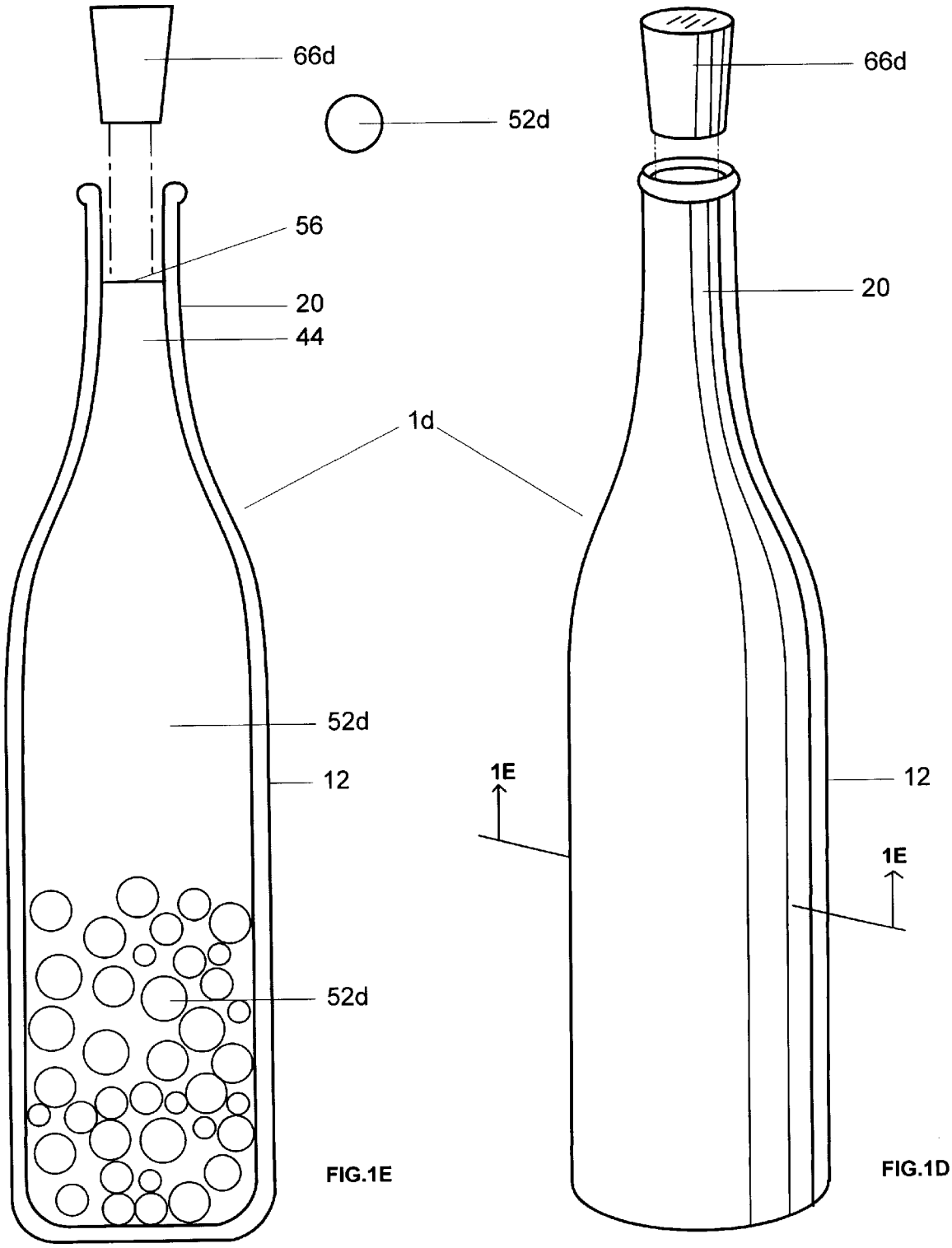
FIG. 1D shows a device for storage of wine, wine saver 1*d*, in a manner that prevents contamination by the atmosphere.
FIG. 1E shows a cross sectional view of the devices shown in FIG. 1D.
Figures 1F, 1G:
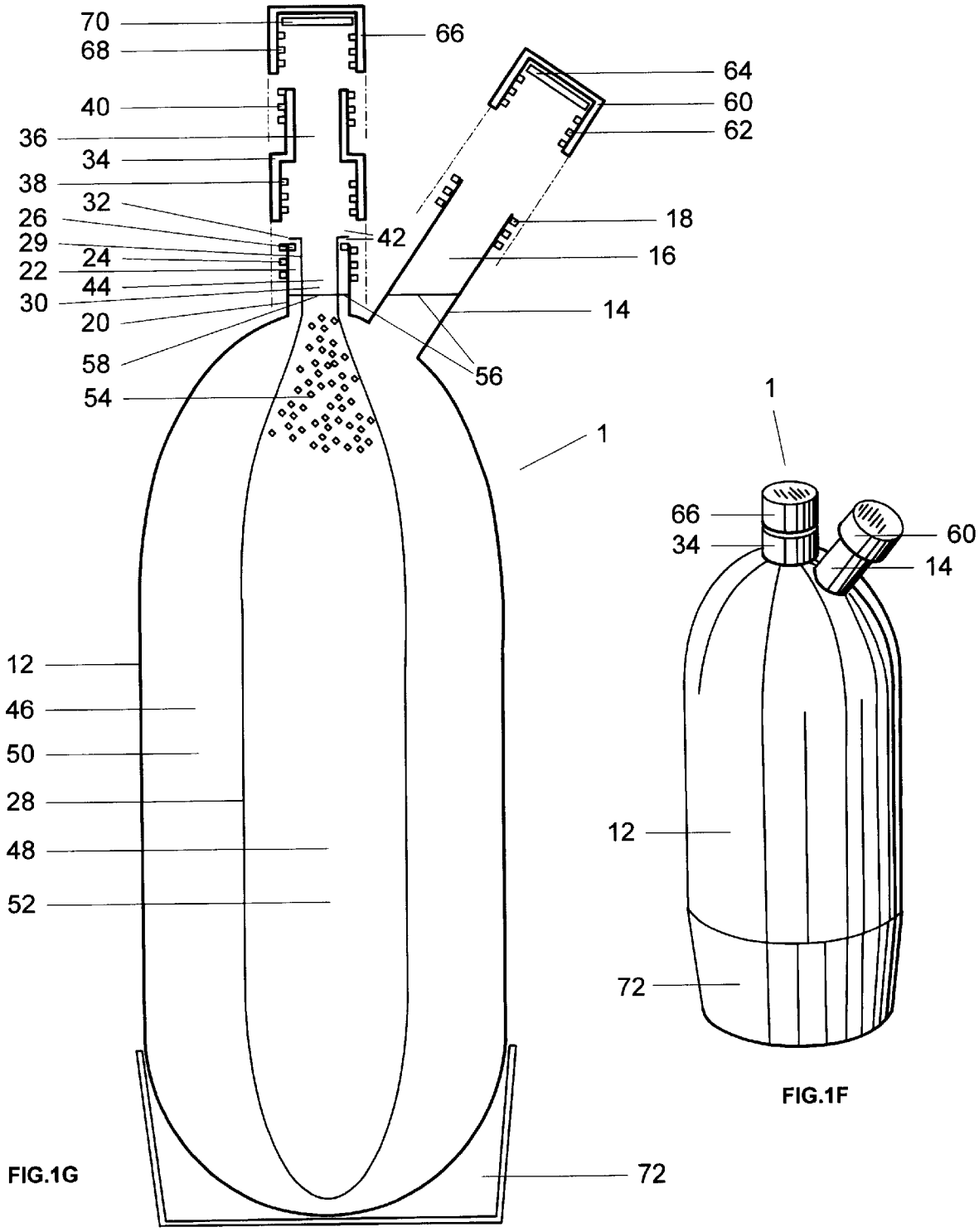
FIG. 1F shows a reversed soda saver 1, the device of FIG. 1A, with reversed usable material and displacement matter chambers.
FIG. 1G shows a cross sectional view of the device shown in FIG. 1F.
Figure 1H:
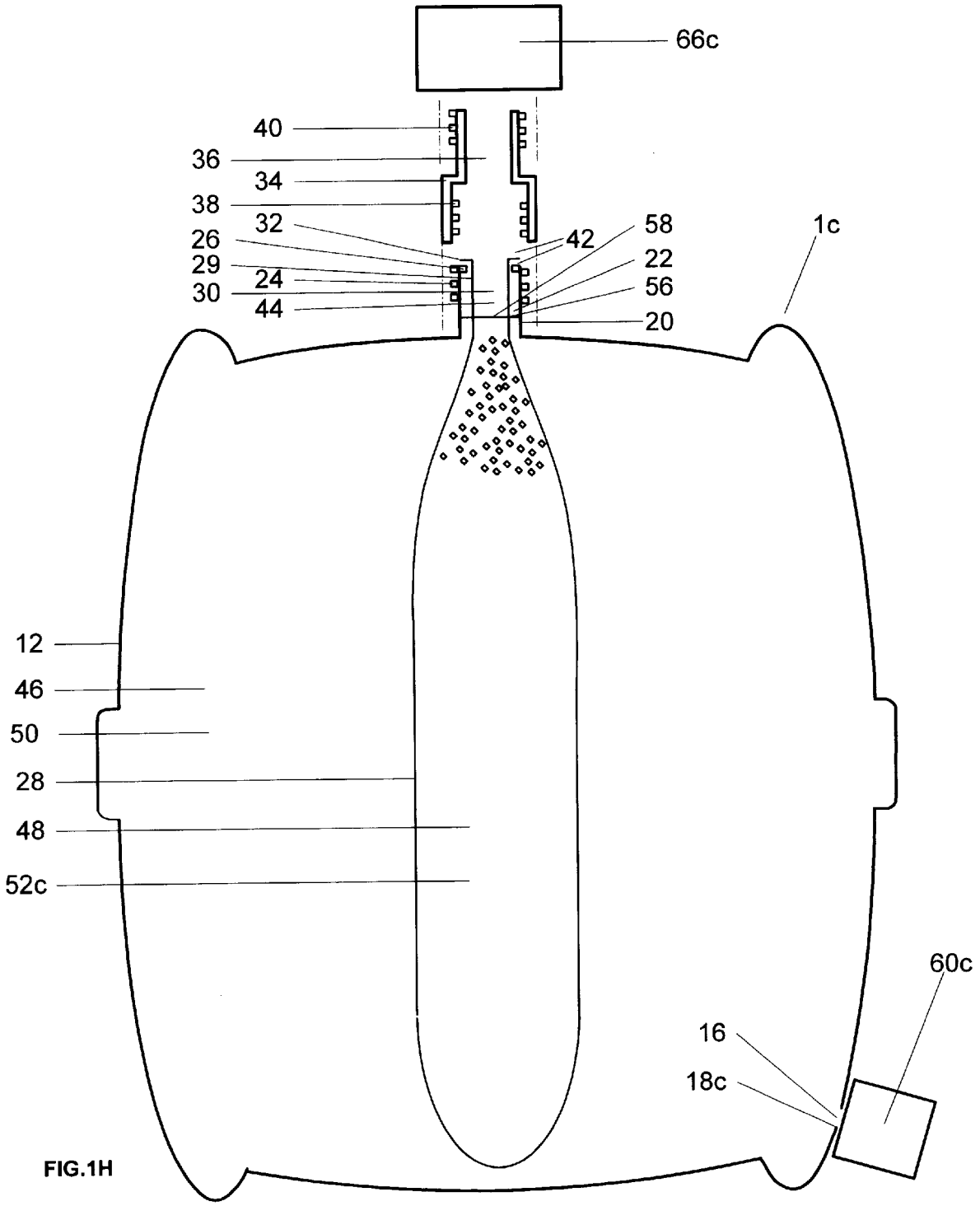
FIG. 1H shows a reversed beer saver 1*c*, the device of FIG. 1C, with reversed usable material and displacement matter chambers.

220 soda bottle fountain adaptor seal
225 soda bottle fountain adaptor barb
230 soda bottle fountain adaptor passageway
235 conventional vinyl hose
240 conventional hose clamp
245 conventional soda fountain faucet nozzle
300 vent
305 vent tube
400 tube to bottle adaptor
405 tube to bottle adaptor female threads
410 tube to adaptor seal
420 displacement matter neck to partition male threads
425 displacement matter neck to partition coupler
430 displacement matter neck to partition coupler female threads
435 displacement matter neck to partition coupler seal
500 displacement matter neck stabilizing member FIG. 1F, FIG. 1G, FIG. 1H. Reversed Soda Saver 1, Reversed Beer Saver 1*c*, Reversed usable material, displacement matter chambers. Reference Numerals in Drawings.

1 reversed soda saver
1*c* reversed beer saver
12 container
14 displacement matter neck
16 displacement matter passageway
18 displacement matter neck male threads
18*c* displacement matter neck female threads
20 usable material neck
22 usable material neck passageway
24 usable material neck male threads
26 usable material neck lip
28 displacement partition
30 displacement partition passageway
32 displacement partition flange
34 displacement partition clamp
36 displacement partition clamp passageway
38 displacement partition clamp female threads
40 displacement partition clamp male threads
42 displacement partition flange adhesive
44 usable material passageway
46 displacement matter chamber
48 usable material chamber
50 water
52 soda
52*c* beer
54 crushed ice
56 displacement matter full level
58 usable material full level
60 displacement matter cap
60*c* conventional water tap
62 displacement matter cap female threads
64 displacement matter cap seal
66 usable material cap
66*c* conventional beer tap
68 usable material cap female threads
70 usable material cap seal
72 boot FIG. 2A, FIG. 2B, FIG. 2C, FIG. 2D, FIG. 2E. Paint Dispenser 2, Simplified Paint Dispenser 2*d*, Paint Dispenser Pump 2*c*. Reference Numerals in Drawings.

Figure 2B:
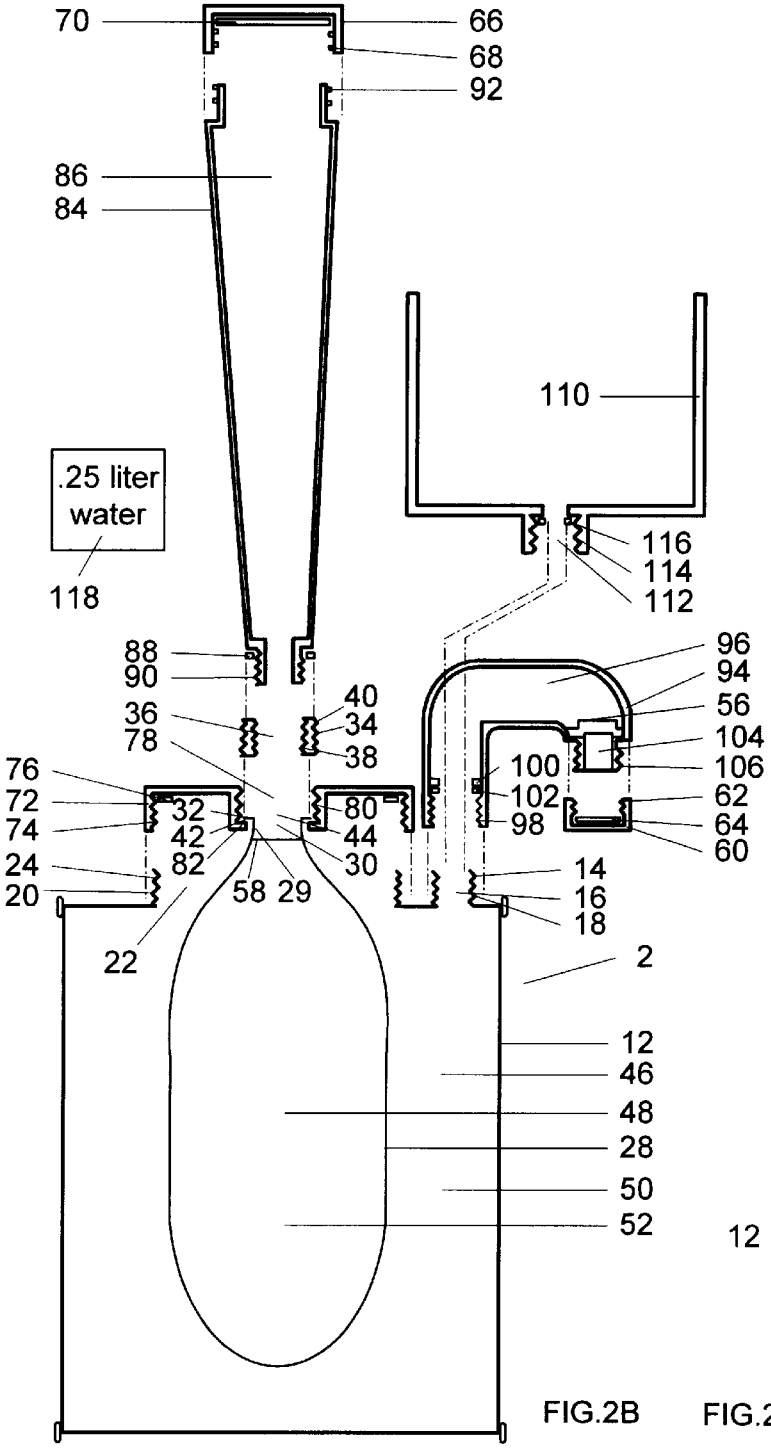
FIG. 2B shows a cross sectional view of the device shown in FIG. 2A.
Figure 2C:
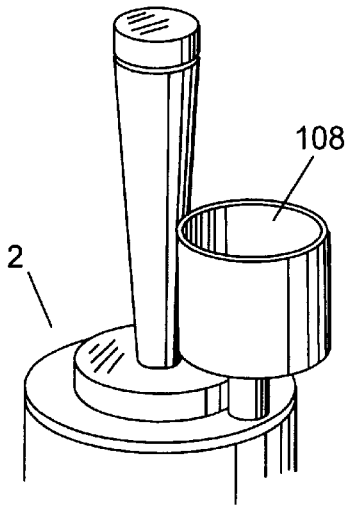
Figure 2A:
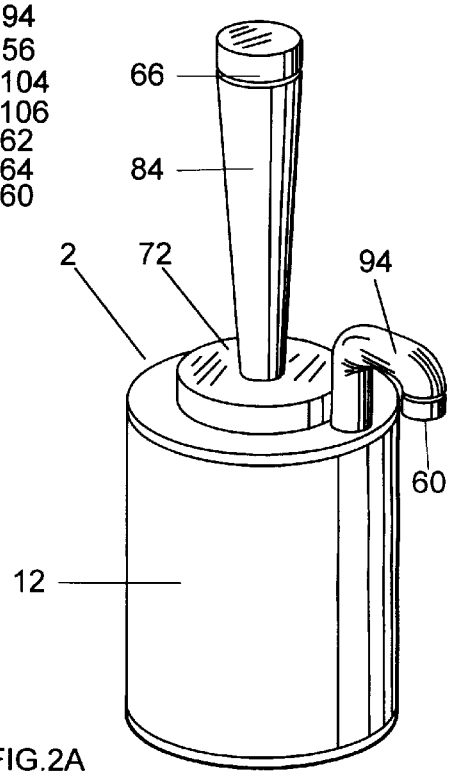
FIG. 2A shows a device for the storage and dispensation of paint, paint dispenser 2 which prevents the paint form drying out or being contaminated when it is opened, and allows for metered dispensation of the paint.
Figure 2D:
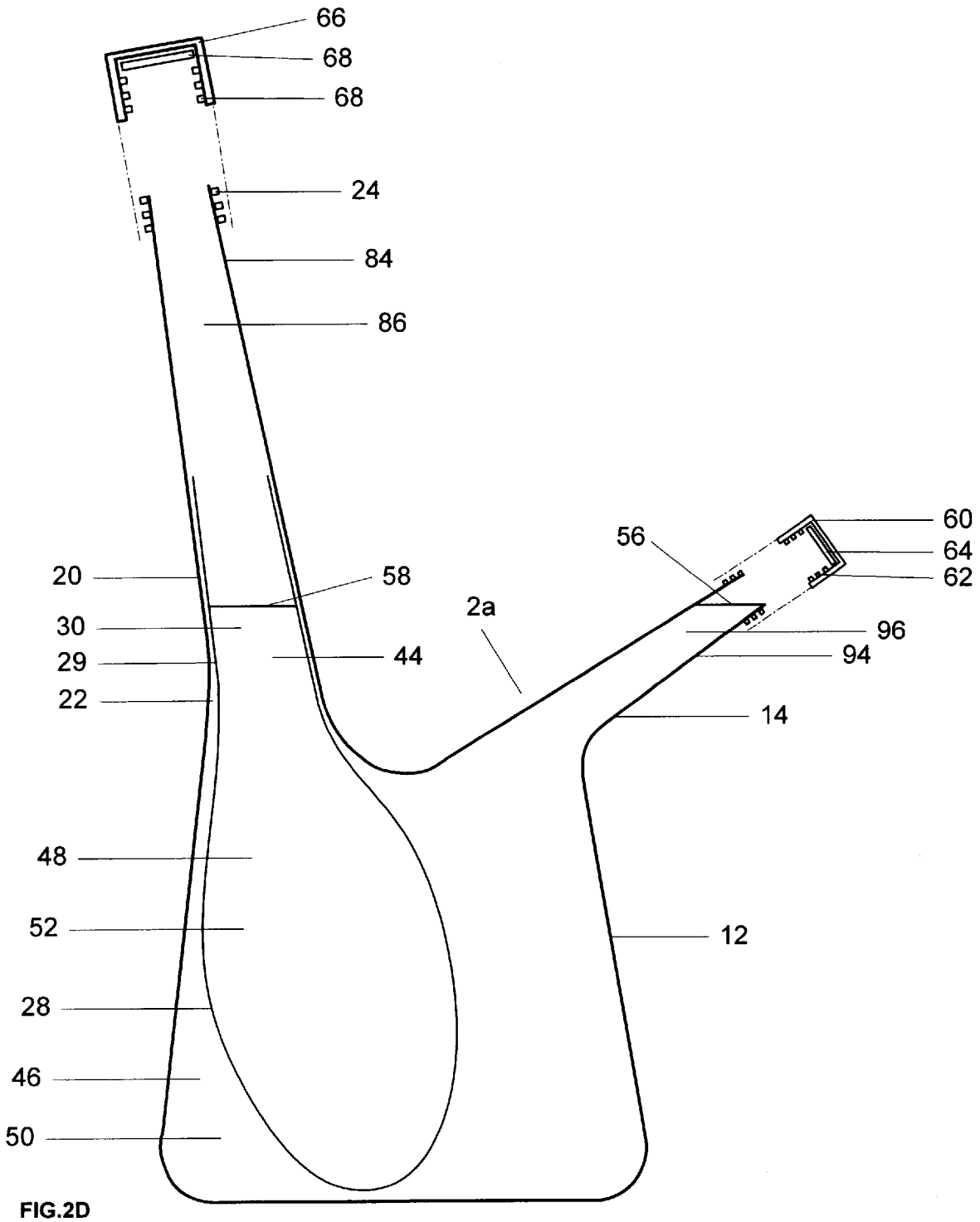
FIG. 2D shows cross sectional view of a simplified device for the storage and dispensation of paint, simplified paint dispenser 2*d*, which prevents the paint from drying out or being contaminated when it is opened, and allows for metered dispensation of the paint.
Figure 2E:
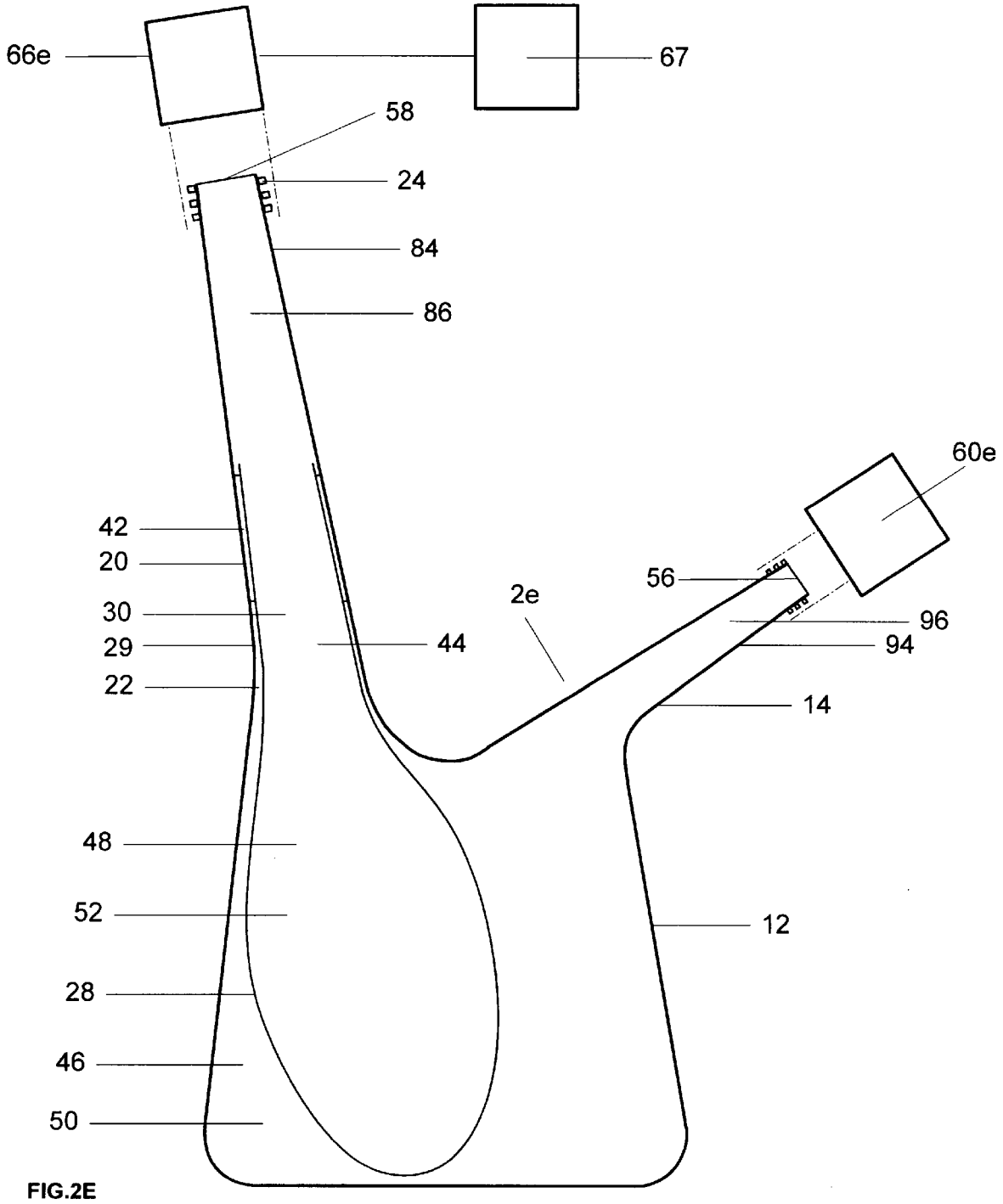
FIG. 2E shows a cross sectional view of a simple pump dispenser device, paint dispenser pump 2*e*, for the storage and dispensation of paint which prevents the paint from drying out or being contaminated when it is opened.
Figure 2F:
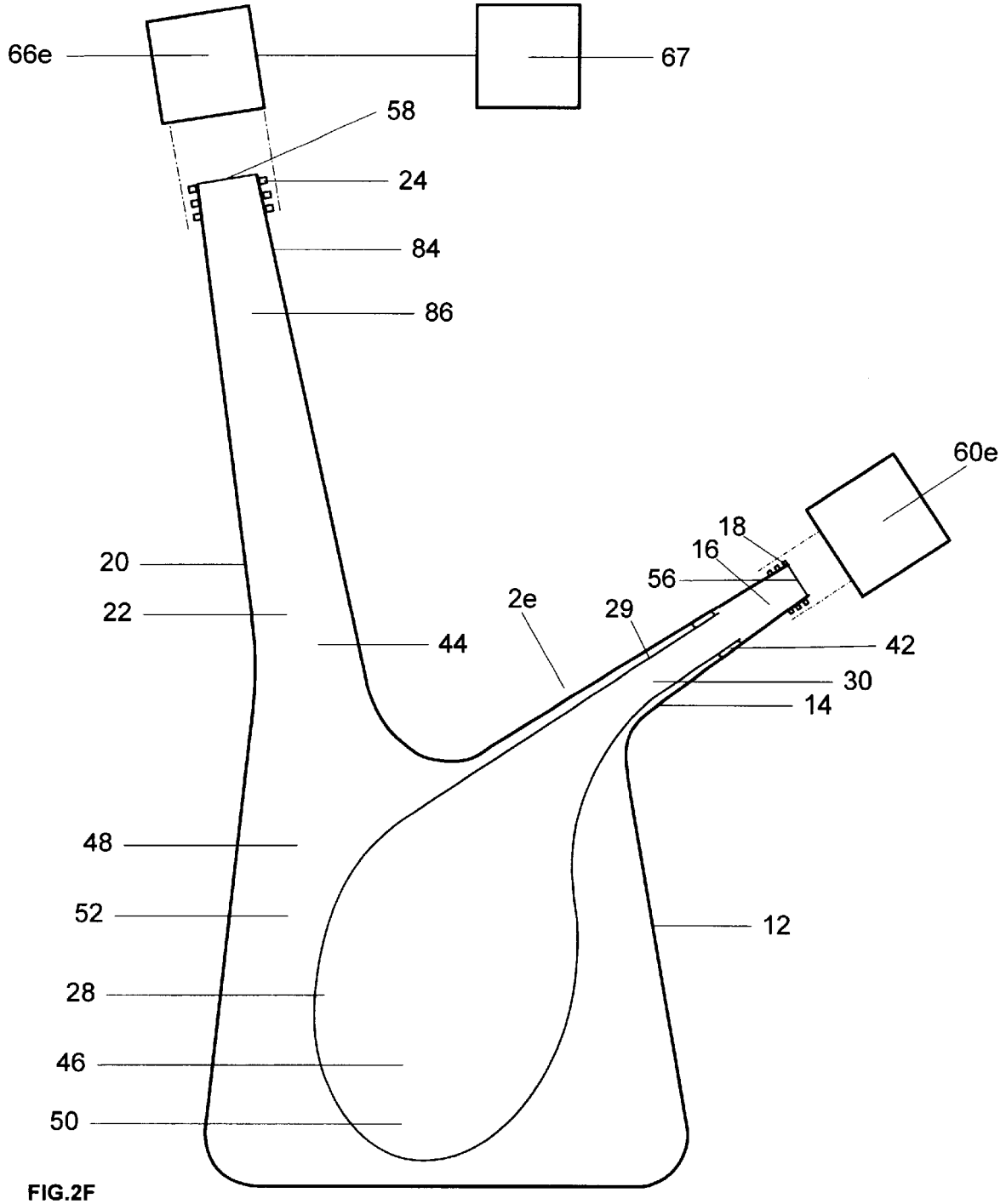
FIG. 2F shows a reversed paint dispenser pump 2*e*, the device of FIG. 2E, with reversed usable material and displacement matter chambers.

2 paint dispenser
2*d* simplified paint dispenser
2*c* paint dispenser pump
12 container
14 usable material neck
16 usable material passageway
18 usable material neck male threads
20 displacement matter neck
22 displacement matter neck passageway
24 displacement matter neck male threads
28 displacement partition
29 displacement partition neck
30 displacement partition passageway
32 displament partition flange
34 displacement partition clamp
36 displacement partition clamp passageway
38 displacement partition clamp female threads
40 displacement partition clamp male threads
42 displacement partition flange adhesive
44 displacement matter passageway
46 usable material chamber
48 displacement matter chamber
50 paint
52 water
56 usable material full level
58 displacement matter full level
60 usable material cap
60*e* conventional faucet
62 usable material cap female threads
64 usable material cap seal
66 displacement matter cap
66*e* conventional water tap
67 conventional pressurized tap water system
68 displacement matter cap female threads
70 displacement matter cap seal
72 access lid
74 access lid female threads
76 access lid seal
78 access lid passageway
80 access lid clamp female threads
82 access lid lip
84 displacement tube
86 displacement tube passageway
88 displacement tube seal
90 displacement tube male threads
92 displacement tube cap male threads
94 spout
96 spout passageway
98 spout female threads
100 spout lip
102 spout seal
104 conventional valve
106 spout male threads
110 paint brush cup
112 cup passageway
114 cup female threads
116 cup seal
118 25 liter water FIG. 2F. Paint Dispenser, Simplified Paint Dispenser, Paint Dispenser Pump with Reversed Usable Material and Displacement Matter Chambers, Reference Numerals in Drawings.

2*e* reversed paint dispenser pump
12 container
14 usable material neck
16 usable material passageway
18 usable material neck male threads
20 displacement matter neck
22 displacement matter neck passageway
24 displacement matter neck male threads
28 displacement partition
29 displacement partition neck
30 displacement partition passageway
42 displacement partition adhesive

44 displacement matter passageway
46 usable material chamber
48 displacement matter chamber
50 paint
52 water
56 usable material full level
58 displacement matter full level
60*e* conventional faucet
66*e* conventional water tap
67 conventional pressurized tap water system
84 displacement tube
86 displacement tube passageway FIG. 3A, FIG. 3B, FIG. 3C, FIG. 3D. Improved Toothpaste Tube 3. More Convenient Improved Toothpaste Tube 3*c*. Reference Numerals in Drawings.
3 improved toothpaste tube
3*c* more convenient improved toothpaste tube
12 container
14 usable material neck
16 usable material passageway
18 usable material neck male threads
20 displacement matter neck
22 displacement matter neck passageway
24 displacement matter neck male threads
26 displacement matter neck lip
28 displacement partition
29 displacement partition neck
30 displacement partition passageway
32 displacement partition flange
34 displacement partition clamp
36 displacement partition clamp passageway
38 displacement partition clamp female threads
40 displacement partition clamp male threads
42 displacement partition flange adhesive
44 displacement matter passageways
46 usable material chamber
48 displacement matter chamber
50 toothpaste
52 water
56 usable material full level
58 displacement matter full level
60 usable material cap
62 usable material cap female threads
64 usable material cap seal
66 displacement matter cap
68 displacement matter cap female threads
70 displacement matter cap seal
72 tube bottom seal
74 conventional syringe FIG. 4A, FIG. 4B. Cereal Saver 4. Reference Numerals in Drawings.
4 cereal saver
12 container
14 usable material neck
16 usable material passageway
18 usable material neck male threads
20 displacement matter neck
22 displacement matter neck passageway
28 displacement partition
29 displacement partition neck
30 displacement partition passageway
34 grommet
36 grommer passageway
42 displacement partition adhesive
44 displament matter passageway
46 usable material chamber
48 displacement matter chamber
50 dry cereal
52 air
56 usable material full level
60 usable material cap
62 usable material cap female threads
64 usable material cap seal
66 conventional clamp
74 vent FIG. 5A, FIG. 5B. Oil Dispenser 5. Reference Numerals in Drawings.
5 oil dispenser
11 container neck
12 container
13 container neck passageway
14 usable material neck
15 container stopper usable material passageway
16 usable material passageway
17 container stopper
19 container stopper displacement matter passageway
20 displacement matter neck
22 displacement matter neck passageway
24 displacement matter neck male threads
26 displacement matter neck lip
28 displacement partition
29 displacement partition neck
30 displacement partition passageway
32 displacement partition flange
34 displacement partition clamp
36 displacement partition clamp passageway
38 displacement partition clamp female threads
40 displacement partition clamp fitting female threads
42 displacement partition flange adhesive
44 displacement matter passageway
46 usable material chamber
48 displacement matter chamber
50 penetrating oil
52 grease
58 displacement matter full level
60 usable material convention valve
61 nozzle
62 nozzle passageway
66 conventional grease fitting
72 conventional clamp FIG. 6A, FIG. 6B. Calk Dispenser 6. Reference Numerals in Drawings.
6 calk dispenser
12 container
14 usable material neck
16 usable material passageway
28 displacement partition
32 displacement partition seal
44 displacement matter passageway
46 usable material chamber
48 displacement matter chamber
50 calk
52 grease
60 usable material cap
66 conventional grease fitting
72 container end
74 adhesive FIG. 7A, FIG. 7B. Fuel Device 7. Reference Numerals in Drawings.
7 fuel device
12 container
14 usable material neck
16 usable material passageway
18 usable material neck male threads

Figure 8B:
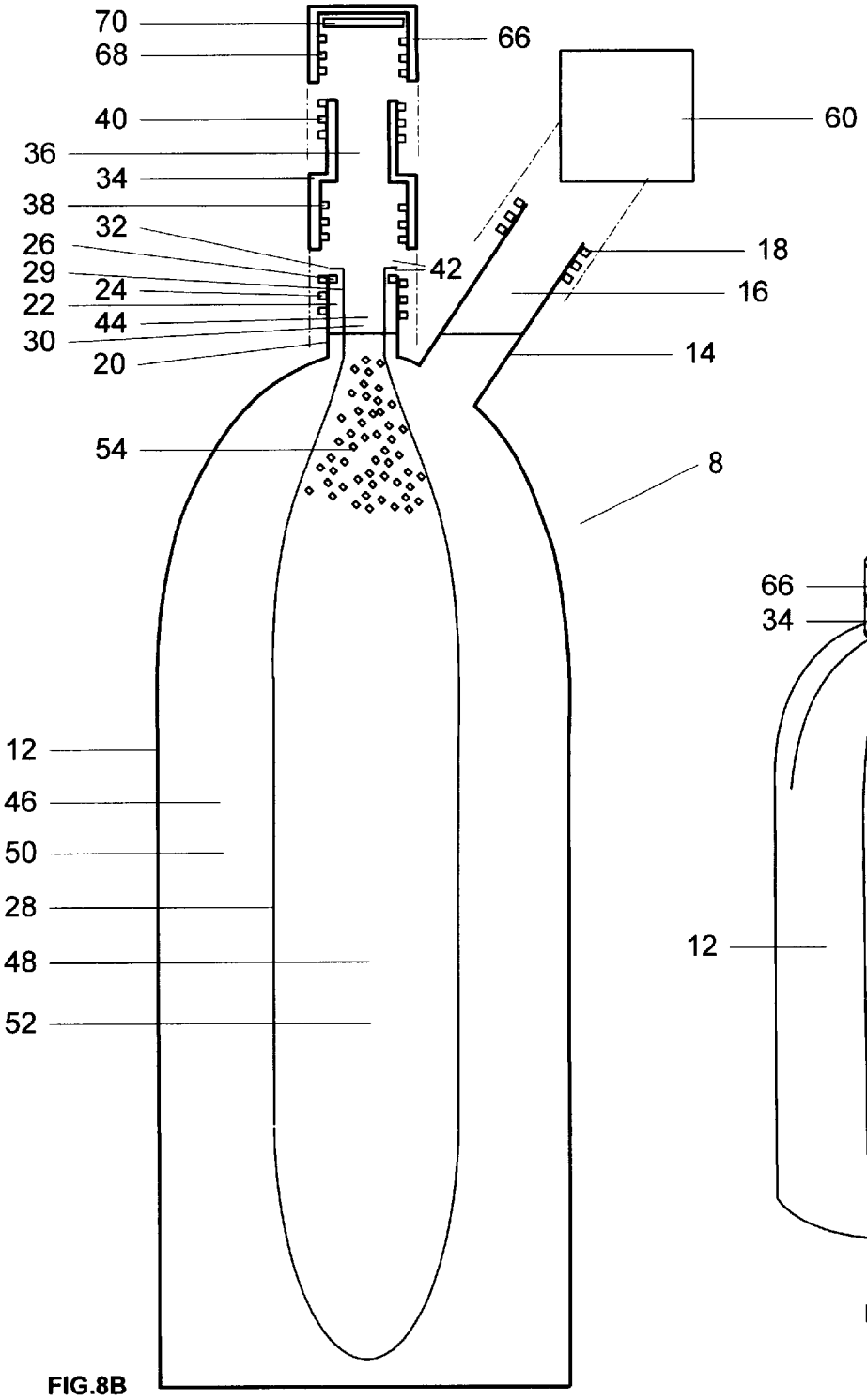
FIG. 8B shows a cross sectional view of the device show in FIG. 8A.
Figure 8A:
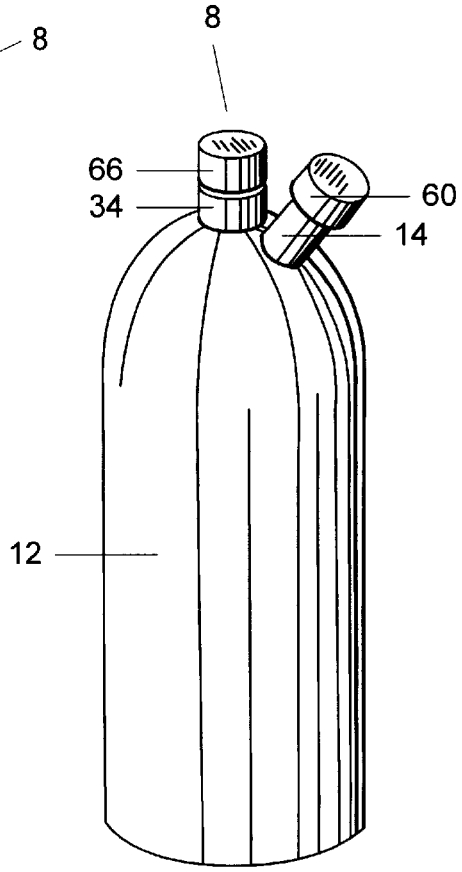
FIG. 8A shows a device for gasses, emptying gas cylinder 8, that can be almost completely emptied of gas.

20 displacement matter neck
22 displacement matter neck passageway
24 displacement matter neck male threads
26 displacement matter neck lip
28 displacement partition
29 displacement partition neck
30 displacement partition passageway
32 displacement partition flange
34 displacement partition clamp
36 displacement partition clamp passageway
38 displacement partition clamp female threads
40 displacement partition clamp male threads
42 displacement partition flange adhesive
44 displacement matter passageway
46 usable material chamber
48 displacement matter chamber
50 gasoline
52 air
56 usable material full level
60 usable material cap
62 usable material cap female threads
64 usable material cap seal
66 conventional air pump
conventional fuel line attachment FIG. 8A, FIG. 8B. Emptying Gas Cylinder 8. Reference Numerals in Drawings.
8 emptying gas cylinder
12 container
14 usable material neck
16 usable material passageway
18 usable material neck male threads
20 displacement matter neck
22 displacement matter neck passageway
24 displacement matter neck male threads
26 displacement matter neck lip
28 displacement partition
29 displacement partition neck
30 displacement partition passageway
32 displacement partition flange
34 displacement partition clamp
36 displacement partition clamp passageway
38 displacement partition clamp female threads
40 displacement partition clamp male threads
42 displacement partition flange adhesive
44 displacement matter passageway
46 usable material chamber
48 displacement matter chamber
50 gas
52 water
60 conventional regulator
66 displacement matter cap
68 displacement matter cap female threads
70 displacement matter cap seal FIG. 9A, FIG. 9B. Industrial Vat 9. Reference Numerals in Drawings.
9 industrial vat
12 container
14 usable material neck
16 usable material passageway
18 usable material neck male threads
20 displacement matter neck
22 displacement matter ncek passageway
24 displacement matter neck male threads
6 displacement matter neck lip
28 displacement partition
29 displacement partition neck
30 displacement partition passageway
32 displacement partition flange
34 displacement partition clamp
36 displacement partition clamp passageway
38 displacement partition clamp female threads
40 displacement partition clamp male threads
42 displacement partition flange adhesive
44 displacement material passageway
46 usable material chamber
48 displacement matter chamber
50 pharmaceutical preparation
51 solid capsules
52 water
56 usable material full level
58 displacement matter full level
60 conventional material pump
66 conventional one way valve
68 conventional water reservoir
70 conventional petcock
72 access lid
74 access lid female threads
76 access lid seal
78 access neck
80 access neck passageway
82 access neck male threads
92 conventional submersible impeller
94 conventional submersible heater
96 conventional cooling device
98 conventional through container wire fitting and wires
99 conventional through container pipe fittings and pipes FIG. 10A, FIG. 10B. Retrofit Volumetric Displacement Device 10. Reference Numerals in Drawings.
10 retrofit volumetric displacement device
11 tank cap female threads
12 tank cap
13 tank cap seal
14 usable material neck
16 usable material passageway
18 usable material neck male threads
20 displacement matter neck
22 displacement matter neck passageway
28 displacement partition
29 displacement partition neck
30 displacement partition passageway
32 displacement partition connector
34 conventional hose clamp
36 displacement partition connector passageway
38 displacement partition extension
40 displacement partition extension passageway
44 displacement matter passageway
48 displacement matter chamber
52 air
60 usable material cap
62 usable material cap female threads
64 usable material cap seal
72 conventional fuel tank The following terms are introduced of the purpose of making the invention easier to understand.

"Container" generally refers to the outer storage vessel that holds contents.

"Environment" generally refers to the universe external to the container, typically atmospheric air although other environments are possible.

"Usable Material" generally refers to the typically valuable contents of the container that are generally usable and consumed. It can also refer to waste in a waste disposal system.

"Volumetric Displacement Matter, Displacement Matter" generally refers to matter that is added to the contents of the bottle for the purpose of altering the characteristics of the container's fill state, generally in such a manner so as to not contaminate the usable material.

"Volumetric Displacement Device" generally refers to embodiment of the invention described in this application.

"Fill State" generally refers to the nature of the container's contents, generally in terms of the amount of material and or matter the container holds. For example a container may be thought of as full, partially full, or empty. The word generally is used because scientifically speaking, the container is always full of something. For example, when describing a container containing half air and half water by volume, the container is said to be, and behaves as if, it were half full. Filling a container, in this instance, generally means to replace something not wanted in the container, that came into the container form the environment (air for example), with something that is more desirable, such as more usable material or displacement matter.

"Full Fill State" generally refers to a condition of a container where the void of the container is devoid of unwanted matter. In general, the container is said to have a "full fill state" when for practical purposes, the container is full of either usable material or displacement matter, the latter which may be contained in an displacement matter chamber within the container. In general, the container will hold no more at this point.

"Displacement Partition, Mobile Displacement Partition" generally refers to a partition that physically separates the container into regions, one that contains the displacement matter, and one that contains the usable material, hereby referred to as the displacement matter chamber and the usable material chamber, respectively. "Mobile" refers to the displacement partition that can move relative to the container. Such motion generally could cause a change in the volume of the displacement matter chamber and the usable material chamber, while the overall volume of the container remained constant.

"Contents" generally refers to the sum of all matter in the container including usable material, displacement matter, and the displacement partition.

"Displacement Matter Chamber" generally refers to the region of the container that contains the displacement matter.

"Usable Material Chamber" generally refers to the region of the container that contains the usable material.

"Immiscible" generally refers to two or more materials, matter which of the most part do not mix and do not significantly react with each other.

"Rigid" generally refers to matter, material used either as contents or in structure, that does not deform.

"Flexible" generally refers to matter, material used either as contents or in structure, that will bend, but that does not stretch appreciably. A flexible container has relevance to the volumetric displacement device because it has a maximum internal volume which, unless the container is deformed by an external force, will remain constant. For example, a one liter plastic soda bottle will not attain an internal volume greater than one liter regardless of the internal pressure applied to it, within the pressure limits that deform the plastic, although squeezing the bottle could diminish the volume. A toothpaste tube when squeezed has a diminished volume, which is what causes the paste to be dispensed.

"Elastic" generally refers to matter, material either as contents or in structure, that will change size under tension, stress or pressure. Containers made of elastic material will not have a fixed volume.

"Non-Elastic" generally refers to matter, material that will not stretch, and can be either rigid or flexible.

"Non-rigid Solid" generally refers to matter, material in the solid phase that is broken up, such as grains, toasted cereals, potato chips, spices, crushed ice or powders.

"Multiple Components" generally refers to matter, material that is made up of two or more different matters or materials, either in the same physical state or in different physical states, those states being liquid, gas, and solid.

"Effervescent Liquid" generally refers to a liquid that has a gas, typically $CO^2$, dissolved in it.

"Gas Impermeable" generally refers to material typically forming the displacement partition, which generally can not be penetrated by gas, or that slows the transfer of gas to a degree from one side of the material to the other side of the material. A gas impermeable partition serves as a barrier to the movement of gas across that partition.

"Metering" generally refers to the process of measuring out a specific amount of material.

"Bi-directional Transfer", "Transferred in a Bi-directional Manner" generally refers to moving material from one location to another in either direction. Bi-directional transfer of usable material between container and environment would allow for both putting usable material into a container and taking it out of a container.

"Valved Flow control" generally refers to the ability to variably regulate the flow of material through a point, such control being exemplified generally by the use of a valve, tap, or faucet.

"Directional Flow Control" refers to the ability to direct the flow of a material through material casings such as pipes, tubes or fluid reserviours which are generally external to the container. "Directional flow control"0 devices generally direct the flow of material as input or output to the displacement matter chamber or the usable material chamber by physically connecting, directly or indirectly, to the container.

"Environmentally Sensitive" generally refers to usable material or environment that benefits from the condition of the usable material being isolated from the environment, which can be the atmosphere for example, either because the environment is damaged by contact with the usable material, or the usable material is damaged by contact with the environment. The environment can be other baths such as water, or space. By way of illustration, volatile toxic chemicals pollute our atmosphere and are said to be "environmentally sensitive". Air sensitive usable material can be damaged by exposure to air in the atmosphere and thus the air sensitive usable material is also said to be "environmentally sensitive".

DISCLOSURE OF INVENTION

The volumetric displacement device generally provides a means to fill a container with alternate matter so as to provide the benefits of a full container when the contents of that container have been partially consumed, utilized or emptied. Such benefits include longevity of the remaining contents, better management and dispensing of the contents, resource conservation, and hazard, environmental pollution and health risk reduction.

MODES FOR CARRYING OUT INVENTION

Effervescent Beverage Storage and Dispensing. A Soda Saving Device. Soda Saver 1. Component Description of Soda Saver 1.

FIG. 1A shows a perspective view of a volumetric displacement device, an effervescent beverage storage device, soda saver 1, constructed as an embodiment of the volumetric displacement device, that prevents soda or other carbonated, effervescent beverages from going flat after their container has been opened. FIG. 1B shows a cutaway view of the device shown in FIG. 1A. Referring to FIG. 1A and FIG. 1B except where noted, the soda saver 1 is constructed.

A bottle, container 12 of one piece, is formed of non-stretching plastic. The container 12 is similar in construction in both size and material to a conventional plastic soda bottle except that it has two necks.

A usable material neck 14 is formed from the material of the container 12, as part of the container 12, so that the plastic forms a usable material passageway 16 within the usable material neck 14.

A set of usable material neck male threads 18 are formed from the plastic of, and as part of, the usable material neck 14.

A displacement matter neck 20 is formed from the material of the container 12, as part of the container 12, so that the plastic forms a displacement matter neck passageway 22 within the displacement matter neck 20.

A set of displacement matter neck male threads 24 are formed form the plastic of, and as part of, the displacement matter neck 20.

A displacement matter neck lip 26 is formed from the plastic of, as part of, and at the top of, the displacement matter neck 20.

A displacement membrane, bladder, displacement partition 28 of one piece is constructed of an aluminized polyester membrane, the same material typically found in Mylar® balloons. The displacement partition 28 is constructed as an air tight bag, similar in construction to a conventional Mylar® balloon, in a shape that is roughly the same size and shale as the interior of the container 12. The shape of of the usable material neck 14 is not imitated.

A displacement partition neck 29 is formed from the material of, and as part of, the displacement partition 28. The size of the displacement partition neck is such that it will fit within the displacement matter neck passageway 22.

The Mylar® for the displacement partition neck 29 forms a displacement partition passageway 30 within the displacement partition neck 29.

A displacement partition flange 32 is formed from the plastic of, as part of, and at the top of, the displacement partition neck 29. The displacement partition flange 32 has roughly the same diameter, inside and outside, as the top of the displacement matter neck lip 26.

The displacement partition neck 29 is inserted into the displacement matter neck passageway 22 and the displacement partition flange 32 comes to rest on the displacement matter neck lip 26, as shown.

A displacement partition clamp 34 of one piece is formed from plastic. The displacement partition clamp 34 is similar in construction in both size and material to a conventional plastic soda bottle cap, except that it has a passageway through it and two sets of threads.

The plastic for the displacement partition clamp 34 forms the displacement partition clamp passageway 36 within the displacement partition clamp 34.

A set of displacement partition clamp female threads 38 are formed from the plastic of, and as part of, the displacement partition clamp 34. The threads are formed in such a manner that they mate securely with the displacement matter neck male threads 24.

A set of displacement partition clamp male threads 40 are formed from the plastic of, and as part of, the displacement partition clamp 34.

The displacement partition clamp 34 is securely screwed onto the displacement matter neck 20, as the displacement partition clamp female threads 38 firmly engage the displacement matter neck male threads 24.

In so doing, the displacement partition flange 32 is securely clamped between the displacement partition clamp 34 and the displacement matter neck lip 26. The joint is permanently sealed with the silicon cement, displacement partition flange adhesive 42, which is applied to both sides of the displacement partition flange 32, and contacts both the displacement matter neck lip 26, and the displacement partition clamp 34, creating a secure, air tight junction.

A bottle top, usable material cap, 60 of one piece, is formed of non-stretching plastic. The usable material cap 60 is similar in construction in both size and material to a conventional plastic soda bottle cap.

A set of usable material cap female threads 62 are formed from the plastic of, and as part of, the usable material cap 60. The threads are formed in such a manner that they mate securely with the usable material neck male threads 18.

The usable material cap 60 is fitted with a usable material cap seal 64, which is a thin disk of silicon rubber. The usable material cap seal 64 serves to tightly seal the usable material passageway 16 when the usable material cap 60 is securely screwed onto the usable material neck 14, as the usable material cap female threads 62 firmly engage the usable material neck male threads 18.

A bottle top, displacement matter cap, 66 of one piece, is formed of non-stretching plastic. The displacement matter cap 66 is similar in construction in both size and material to a conventional plastic soda bottle cap.

A set of displacement matter cap female threads 68 are formed from the plastic of, and as part of, the displacement matter cap 66. The threads are formed in such a manner that they mate securely with the displacement partition clamp male threads 40.

The displacement matter cap 66 is fitted with a displacement matter cap seal 70, which is a thin disk of silicon rubber. The displacement matter cap seal 70 serves to tightly seal the displacement matter neck passageway 22 when the displacement matter cap 66 is securely screwed onto the displacement partition clamp 34, as the displacement matter cap female threads 68 firmly engage the displacement partition clamp male threads 40.

A boot 72 of one piece is formed from plastic. The boot 72 is similar in construction in both size and material to a conventional plastic soda bottle boot, and is permanently bonded to the container 12 in conventional fashion. The boot serves as a stand for the soda saver 1, allowing it to stand on a horizontal surface without falling.

Assembly Description of Soda Saver 1.

A displacement matter passageway 44, is now defined which is composed of the displacement partition passageway 30, and the displacement partition clamp passageway 36.

The displacement partition 28 divides the container 12 into two chambers. The first chamber is a usable material chamber 46 which will hold usable material, in this case an effervescent beverage, soda 50. The second chamber is a displacement matter chamber 48 which will hold displacement matter, non-compressible matter, water 52.

The usable material chamber 46 is accessed by the usable material passageway 16, which is used to put soda 50 into and to take soda 50 out of the usable material chamber 46. The volume of space contained in the usable material passageway 16, is part of the space defined by the usable material chamber 46.

The displacement matter chamber 48 is accessed by the displacement matter passageway 44, which is used to put water 52 and crushed ice 54 into and out off the displacement matter chamber 48. The volume of space contained in the displacement matter passageway 44, is part of the space defined by the displacement matter chamber 48.

Device Description of Soda Saver 1.

The container 12, and the soda saver 1, must have a fixed maximum internal volume. If the material of the container 12, displacement partition clamp 34, and the caps is rigid, the soda saver 1 will have an internal volume that will not change appreciably. If the material is flexible, but not elastic, the soda saver 1 will have a maximum attainable volume, even if the internal pressure in the bottle rises above atmospheric pressure. Furthermore, the maximum volume should be attained in the normal position of the material of the container. This means that the container can not be made of an elastic material or the container will expand (blow up) as the $CO^2$ gas is released from the soda. Conventional plastic soda bottles, in fact all effervescent storage vessels, conform to the rules of this paragraph. Fixed internal volume is critical in preventing the release of the $CO^2$ gas from the soda 50.

The construction of the soda saver 1 dictates that the displacement matter chamber 48 be completely isolated from the usable material chamber 46 by the displacement partition. No matter of any sort, solid, liquid or gas can traverse the barrier between the chambers. With the caps, usable material cap 60 and displacement matter cap 66 in place, the displacement matter chamber 48 and the usable material chamber 46 are also isolated from the environment. No matter of any sort, solid, liquid or gas, can enter or leave either chamber. The caps can be removed and replaced to operate the soda saver 1.

It is imperative that the displacement matter be non-compressible in this particular embodiment. It is a well known fact that Water 52 is virtually non-compressible. If the displacement matter were to compress, gas would be allowed to escape the soda 50 as the space became available for the $CO^2$ gas. The soda 50, being primarily water with other material dissolved, is already relatively non compressible. Crushed ice will shrink just a bit if it melts thereby reducing the efficiency of the soda saver, just a bit. This effect is negligible.

FIG. 1B depicts the displacement partition 28 that is partially collapsed, being only partially filled with water 52. The usable material chamber 46 is also depicted as being partially filled with soda 50. In all, the soda 50, the water 52, and the displacement partition 28, completely fill the container 12. A usable material full level 56, is shown which demonstrates where the level of the soda 50 will be when the soda saver 1 is in a full fill state. A displacement matter full level 58, is shown which demonstrates where the level of water 52 will be when the container is in a full fill state. With the caps off the soda saver 1, the level of the soda and the level of the water will equilibrate as the mobile partition moves in response to gravitational forces on the water and soda. After soda 50 has been removed from the soda saver 1, if enough water 52 is added to the displacement matter chamber 48, the level of fluid will rise in both chambers, until the soda saver 1 is in a "full fill state". It is only in this full fill state that the effervescence in the soda 50 will be preserved. Soda 50 is preserved in the container having a full fill state although the container is only partially filled with Soda 50.

How the Soda Saver 1 Works, Theory of Operation.

The Devise, Soda Saver 1, as shown in FIG. 1A and FIG. 1B, prevents a portion of soda 50, beer, champagne or other effervescent liquid, of any quantity that can be physically contained in the usable material chamber 46, from loosing its carbonation, and going flat in the next couple of days. The device provides for a means to fill the void in the container 12, after the soda 50, is partially consumed, so that the effervescent gas can no longer escape to the void above the soda 50, as there no longer exists a void. Non-compressible matter, displacement matter, water 52, is introduced via the displacement matter passageway 44 in a manner that fills the void, does not contaminate the soda 50, does not absorb the $CO^2$ gas, and allows the effervescence in the soda 50 to be preserved for extended periods of time, thereby conserving the effervescent beverage and allowing for its enjoyable consumption at a latter time.

As an alternative technology, presented at this time to make this presentation clearer as well as to show alternate technology, non-compressible solid matter could be introduced to the container 12 as shown via the usable material passageway 16, or even to conventional soda bottles (conventional soda bottles are currently sold, without two necks or displacement matter chambers) in a number of ways. For example, dropping conventional glass marbles into a conventional soda bottle until the bottle was almost "full" again, (the top of the soda level is brought almost to the top of the soda bottle,) would leave no place for $CO^2$ gas to escape the soda, and would allow the resealed bottle to properly store the soda again. This would prove to be inconvenient as the marbles must be cleaned, are difficult to manage, do not pour well, are heavy, and unless they are chilled, drive the $CO^2$ from the beverage very quickly as they heat it up before the top can be secured.

The volumetric displacement device's approach is more convenient for the consumer as all the consumer has to do is to put water into the displacement matter chamber 48 via the displacement matter neck 20. Water is inexpensive, easily available, and non-compressible. The displacement partition 28, a flexible, water tight, gas impermeable bladder, prevents the water from contaminating (diluting) the soda. The displacement partition 28 is secured in such a way that no water can enter the usable material chamber 46, and no soda 50 can pass into the displacement matter chamber 48. No $CO^2$ gas can get out of the usable material chamber 46. The displacement matter 52 and the displacement partition 28 becomes an impermeable mass of matter in the container 12 and works just as the marbles did. After each partial consumption of the soda 50, from the soda saver 1, if enough water is added to the displacement matter chamber 48, the container 12 will again be full, there will be little space for the $CO^2$ to re-pressurize, therefor it can not escape from the soda 50, and the soda 50 will last for extended periods of time.

Ramifications of Soda Saver 1.

As an additional benefit, the soda 50 will be prevented from sloshing as easily in the container. Shaking a conventional bottle of soda causes the soda to "froth up" and to spill out of the bottle when opened. A partially filled container sloshes more and froths to a greater extent. The displacement matter chamber 48 fills the soda saver 1, reducing sloshing and frothing. Full soda bottles are more stable and tip over less easily.

The ability to add crushed ice 54 to the displacement matter chamber 48 is a benefit. The ice now can cool the soda 50 without diluting it with water. The unused portion of soda can be cooled with ice for extended periods of time and as the ice melts, the water so derived will not make the soda 50 "watery", as would occur in conventional soda serving vessels.

Variation of Soda Saver 1.

The soda saver 1 would work with virtually any effervescent beverage, carbonated drink. Beer, ale, lager, pilsner, champagne, seltzer, sparkling wines, sparkling waters, mineral waters, hard apply cider, carbonated wine coolers, spritzers, carbonated fruit drinks and punch, quinine water, root beer and effervescent beverages sold or known by other names would be protected from going flat in the soda saver and its variations.

Variations of the soda saver 1 would work with many different sized containers. A large application would be a beer keg which would readily accept the described technology. Large volumes of the effervescent beverages listed above such as beer, champagne, and soda could be dispensed in small portions for retail sale or distribution while the portions remaining in the container would be protected from decarbonation.

The container can be made in shapes currently found with existing soda, beer, champagne, wine, cooler and other effervescent beverages. Material that could be used include plastic, glass, metal and ceramic.

It would also be possible to replace the non-compressible matter with compressible matter such as air, and apply pressure to the displacement matter chamber at appropriate intervals by injection of more air into the displacement matter chamber 48 through the displacement matter passageway 44, via a pump. For example, air pumped into the displacement matter chamber 48 in a beer keg would allow the beer to stay under pressure, would serve as a pressure source for dispensing the beer out the usable material passageway 16 fitted with a spigot, tap or valve, prevent the pressurized air pumped into the displacement matter chamber from being absorbed by the beer, prevent the $CO^2$ in the beer from mixing with the pumped in air, and prevent the $CO^2$ from dissipating from the beer, leaving the beer in a proper effervescent state, ready to deliver a good head, for extended periods of time. The beer is also easily dispensed via the valve, tap in the usable material passageway. In use, air at sufficient pressure in the displacement matter chamber, would function in similar fashion as compressible matter, thereby preserving the beer.

The addition of multiple materials to the displacement matter chamber 48, for example water 52 and crushed ice 54, will provide a tilling volume of displacement matter. The crushed ice will cool the soda. Furthermore, the cooled displacement partition 28 will inhibit the dissolution of the $CO^2$ gas into the beverage adjacent to the displacement partition 28, as the displacement partition 28 is filled, and before the caps are placed back on the container 12. This is an improvement because warmed soda can not hold in solution as much $CO^2$ gas, so if the soda is warmed by the bladder without the container sealed, extra gas will escape the soda. An additional benefit is that the drink can now be cooled without diluting it with water, a boon for beer and fine wine drinkers as well as others who want pure drinks. The use of a wide mouth displacement matter passageway 44 and displacement matter cap 66 would allow for easy insertion of the crushed ice 54. If the beverage device was relatively small, the consumer could drink right from the soda saver 1, undiluted, chilled beverage. If the consumer then decided to save a portion of the drink for latter consumption, the consumer could fill the displacement partition 28 with water, tightly cap the soda saver 1, and store it.

The addition of insulation to the container would provide an effervescent beverage storage device that would maintain cold, undiluted, effervescent beverages for extended periods of time. Such insulation could be provided by a layer of insulation surrounding the container. It could also be proved by insulation material, or an evacuated vacuum space built into the walls of the container, such as those found on and in conventional thermal mugs and glasses. A portable, cooling, effervescent beverage saver could be brought to desk or picnic.

It is noted that one material suitable for the displacement partition would be a gas impermeable membrane such as Mylar® or other aluminized plastic. Mylar® prevents the escape of helium from balloons for extended periods of time, while a larger molecule, such as $CO^2$, is prevented from crossing the membrane in superior fashion. Simple plastic membranes without aluminum coatings, when used to make the displacement partition 28, allow $CO^2$ gas to cross between the chambers, thus leaving the effervescent beverage 50, and carbonating the water serving as the displacement matter 52. The use of an effervescent liquid as the displacement matter 52 does allow the displacement partition 28 to be made of gas permeable material. Furthermore, with such a gas permeable displacement partition, flat beverage could be rejuvenated by pouring the flat beverage into the usable material chamber 46 and pouring a relatively inexpensive effervescent liquid such as seltzer water, carbonated water, into the displacement matter chamber 48. Rejuvenation of the flat beverage occurs because $CO^2$ passes from the displacement matter chamber 48, across the gas permeable displacement partition, to the flat beverage stored in the usable material chamber 46. An expensive beverage, such as a rare champagne, could be rejuvenated by putting an inexpensive champagne into the displacement matter chamber. In fact, in general, any beverage or water based liquid could be made effervescent with this technique.

Effervescent Beverage Storage and Dispensing. A Soda Saving Device, with Usable Material and Displacement Matter Chambers Reversed. Reversed Soda Saver 1. Description of Reversed Soda Saver 1.

FIG. 1F shows a perspective view of a volumetric displacement device, an effervescent beverage storage device, reversed soda saver 1, constructed as an embodiment of the volumetric displacement device, that prevents soda or other carbonated, effervescent beverages from going flat after their container has been opened. FIG. 1G shows a cutaway view of the device shown in FIG. 1F.

The construction of the Reversed Soda Saver 1, is identical to the Soda Saver 1 of FIG. 1A and FIG. 1B. It is exactly the same device. However, in operation, the effervescent beverage, soda 52, is put into what was the displacement matter chamber 48, of the soda saver 1 of FIG. 1A,B and the displacement matter, water 50, is put into what was the usable material chamber 46, of the soda saver 1 of FIG. 1A,B.

Because the function of the chambers is now reversed as compared to the chambers of the soda saver 1 of FIG. 1A,B, by necessity, the name of the chambers are now reversed. What was entitled the usable material chamber is now the displacement matter chamber. The components of these chambers also have their names reversed as follows:

The usable material neck 14 of Soda Saver 1, of the device depicted in FIG. 1A,B, becomes the displacement matter neck 14, of the device depicted in FIG. 1G,F.

The usable material neck passageway 16 of Soda Saver 1, of the device depicted in FIG. 1A,B, becomes the displacement matter neck passageway 16, of the device depicted in FIG. 1G,F.

The usable material neck male threads 18 of Soda Saver 1, of the device depicted in FIG. 1A,B, becomes the displacement matter neck male threads 18, of the device depicted in FIG. 1G,F.

The displacement matter neck 20 of Soda Saver 1, of the device depicted in FIG. 1A,B, becomes the usable material neck 20, of the device depicted in FIG. 1G,F.

The displacement matter neck passageway 22 of Soda Saver 1, of the device depicted in FIG. 1A,B, becomes the usable material neck passageway 22, of the device depicted in FIG. 1G,F.

The displacement matter neck male threads 24 of Soda Saver 1, of the device depicted in FIG. 1A,B, becomes the usable material neck male threads 24, of the device depicted in FIG. 1G,F.

The displacement matter neck lip 26 of Soda Saver 1, of the device depicted in FIG. 1A,B, becomes the usable material neck lip 26, of the device depicted in FIG. 1G,F.

The displacement matter passageway 44 of Soda Saver 1, of the device depicted in FIG. 1A,B, becomes the usable material passageway 44, of the device depicted in FIG. 1G,F.

The usable material chamber 46 of Soda Saver 1, of the device depicted in FIG. 1A,B, becomes the displacement matter chamber 46, of the device depicted in FIG. 1G,F.

The displacement matter chamber 48 of Soda Saver 1, of the device depicted in FIG. 1A,B, becomes the usable material chamber 48, of the device depicted in FIG. 1G,F.

The usable material full level 56 of Soda Saver 1, of the device depicted in FIG. 1A,B, becomes the displacement matter full level 56, of the device depicted in FIG. 1G,F.

The displacement matter full level 58 of Soda Saver 1, of the device depicted in FIG. 1A,B becomes the usable material full level 58, of the device depicted in FIG. 1G,F.

The usable material cap 60 of Soda Saver 1, of the device depicted in FIG. 1A,B becomes the displacement matter cap 60, of the device depicted in FIG. 1G,F.

The usable material cap female threads 62 of Soda Saver 1, of the device depicted in FIG. 1A,B, becomes the displacement matter cap female threads 62, of the device depicted in FIG. 1G,F.

The usable material cap seal 64 of Soda Saver 1, of the device depicted in FIG. 1A,B, becomes the displacement matter cap seal 64, of the device depicted in FIG. 1G,F.

The displacement matter cap 66 of Soda Saver 1, of the device depicted in FIG. 1A,G, becomes the usable material cap 66, of the device depicted in FIG. 1G,F.

The displacement matter cap female threads 68 of Soda Saver 1, of the device depicted in FIG. 1A,B, becomes the usable material cap female threads 68, of the device depicted in FIG. 1G,F.

The displacement matter cap seal 70 of Soda Saver 1, of the device depicted in FIG. 1A,B, becomes the usable material cap seal 70, of the device depicted in FIG. 1G,F.

Operation of Reversed Soda Saver 1.

The reversed soda saver is operated in identical fashion to the Soda Saver 1 of FIG. 1A,B. Following the directions given for that device will enable the user to operate the reversed soda saver 1.

Ramifications of Reversed Soda Saver 1.

The ramification of the reversed soda saver 1 is that the device can be operated in two fashions. The usable material can be either outside the displacement partition bladder or alternatively it can be inside the displacement partition bladder. In either case, filling the other chamber with non-compressible displacement matter, water, will put the entire container into the full fill state and the effervescent beverage will be protected.

Variations of Reversed Soda Saver 1.

A wide variety of volumetric displacement device, including the ones to be presented in this patent application, will work with reversed chambers. Some require modifications, others do not.

Beer Saver 1*c*, Device Variation.

Component Description of Beer Save 1*c*.

FIG. 1C shows a cutaway view of a volumetric displacement device, modified soda saver 1, beer saver 1*c*, constructed as an embodiment of the volumetric displacement device that accomplishes objectives similar to soda saver 1. Referring to FIG. 1C, except where noted, a beer saver 1*c* is constructed.

A container 12, of one piece, is formed from glass or aluminum, a rigid material. The container 12 is similar in construction in both size and material to a conventional beer keg except that it is tapped at the lower side to accommodate a conventional petcock 60*c*. Construction of the beer saver 1*c* and its various parts is done in similar fashion to the soda saver 1 already described and depicted in FIG. 1A and FIG. 1B except as noted.

The material of the container 12 forms usable material neck 14 which is located near the bottom of the container 12, so that usable material in the keg can readily flow out of the usable material passageway 16, which is formed from the material of the usable material neck 14. Usable material neck female threads 18*c* are formed from the material of the usable material neck 14.

A spigot and valve, tap, cock, stopcock, conventional petcock 60*c* is firmly fit and sealed to the container 12 in the usable material passageway 16.

The usable material is beer 50*c*.

Ramifications of Beer Saver 1*c*.

The beer saver 1*c* has advantages over a standard conventional keg.

No air is introduced into the beer saver 1*c* as beer 50*c* is removed from it. Air contains oxygen and contaminates which can oxidize or otherwise damage beer. In a conventional beer keg, air is pumped into the keg. Specific gases dissolved in the beer such as $CO^2$ will diffuse into the pumped in air, as initially the air will have a lower partial pressure of the specific gases than the air would have after a period of time, that is, as the partial pressures of gas within the conventional keg moves towards a state of equilibrium. In the beer saver 1*c*, water is stored in a sealed, gas impermeable displacement matter chamber, which will not damage the beer.

The beer saver 1*c*, in its simplest configuration, is simpler than a conventional beer keg as it requires no pump.

The beer saver 1*c* has some advantages over conventional cans and bottles as they are used to store beer. When conventional cans and bottles are opened, the entire contents of the container must be used, typically, within a few hours or the beer will deteriorate. Unused beer will not deteriorate when some of the beer is removed from the beer saver 1*c*. It will not be contaminated with air. When the container is properly refilled with displacement matter or water, the effervescence will not be lost from the unused beer.

The ramification of the last paragraph is that beer 50*c* can be packaged more economically. Instead of storing a quantity of beer in a series of individually sized, single portion bottles, beer can be stored in a larger single container. For example, one gallon of beer is currently shipped in more than ten (10) bottles of twelve (12) ounces each. With the beer save 1*c*, this quantity could be shipped in a single container that need not be completely used at a single sitting. Two gallon, or even larger containers, would result in even greater savings. They would take less storage and refrigeration space as well, in comparison to conventional single portion beer containers, which are not as compact, as a whole, when stored.

Kegs of many fractional sizes would be inexpensive to produce. Kegs are currently made in half keg and quarter keg sizes. These and even smaller sizes could be produced. Convenient fractional sizes that fit in a conventional refrigerator would make consumption convenient, and reduce the cost to the consumer of drinking beer. In general, virtually any reasonable size could be made, reasonable determined by material strength, engineering limitations, and economic factors.

Use of different materials in the construction of the container would blur the boundary between keg and bottle or can definitions. Formed from glass, ceramic, metal or plastic, the containers could be constructed in a wide variety of shapes.

Additional internal pressure can be developed in variations of the beer saver 1*c*. A conventional pump can be used to force air and/or water into the displacement partition. If the beer at a certain temperature has more gasses than it can hold, the added pressure will increase its protection from carbonation loss. The pressure might also be used to pump the beer to a higher elevation, relative to the earth, than the top level of the beer in the container, or to pump the beer faster. This still provides an advantage over a conventional keg with a pump in that the unused beer will not be contaminated with air containing oxygen and contaminates.

Pressure to the displacement matter could be supplied by a conventional pump, by electric pump, by hand pump, by a conventional pressurized tap water system, by a gravity driven displacement tube as discussed in detail for the paint dispenser 2, by a conventional compressed gas cylinder, tank, canister or $CO^2$ cartridge, or other pressure source.

Such pressure can also be supplied to the usable material chamber by fitting the usable material chamber with a pressure supplying device, pump, gas cylinder, gas cartridge, standard beer keg tap pump device or other pressure source. There is still advantage over conventional beer kegs as there would be less air or gas introduced to the beer, and less opportunity to spoil the beer. With a conventional beer tap/pump fitted to the usable material chamber, the beer would be pressurized and delivered in a conventional manner from a single opening in the keg. The filled or partially filled displacement matter chamber would still give benefit if properly utilized. For example, at the end of the day, when all the beer has not been used and its preservation is desired for future use, the displacement partition could be filled with water as the compressed air gas is removed from the usable material chamber.

A vent equipped with a controllable valve or cap at the top of the usable material chamber would provide enhanced storage capability. A small amount of effervescent gas can be expected to leave the effervescent liquid do to minor and uncontrollable expansions of an otherwise non-stretching container, and during the period of time when the displacement matter cap is off. This unwanted gas could be vented off through a sealable passageway that connects the top of the usable material chamber to the environment. With this vent open, pouring water into the displacement matter chamber would fill the container and drive off the unwanted gas. When the entire container, including vent, usable material passageway and displacement matter passageway, are resealed, the container will again be full of non-compressible matter and usable material, and the effervescent liquid will have its effervescence protected.

The beer saver 1*c* could be steam cleaned prior to the introduction of beer to sterilize its interior. With the beer saver variation with enough openings, steam would be run through the keg or around the keg to accomplish this purpose.

Virtually any effervescent beverage can be stored in the beer saver 1*c* including beer, ale, lager, champagne, seltzer, sparkling wines, sparkling water, mineral water, hard apple cider, carbonated wine coolers, spritzers, carbonated fruit drinks and punch, quinine water, root beer and effervescent beverages sold or known by other names.

There are a number of options available for filling the beer saver 1*c* with beer at the manufacturing facility. The beer could be transferred into the container 12 before the displacement partition 28 and the partition clamp 34 are installed. An alternate access neck and passageway could be formed from the material of the container and sealed with another cap, valve or flow control device. Thus beer can be introduced into the container through alternate openings in the container.

Effervescent Beverage Storage and Dispensing. A Beer Saving Device, with Usable Material and Displacement Matter Chambers Reversed. Reversed Beer Saver 1*c*. Description of Reversed Beer Saver 1*c*.

FIG. 1H shows a cutaway view a volumetric displacement device, an effervescent beverage storage device, reversed beer saver 1*c*, constructed as an embodiment of the volumetric displacement device, that prevents soda or other carbonated, effervescent beverages from going flat after their container has been opened.

The construction of the Reversed Beer Saver 1*c*, is similar to the Beer Saver 1 of FIG. 1*c*. However, in operation, the effervescent beverage, beer 52*c*, is put into what was the displacement matter chamber 48, of the beer saver 1*c* of FIG. 1C and the displacement matter, water 50, is put into what was the usable material chamber 46, of the beer saver 1*c* of FIG. 1C.

Because the function of the chambers is now reversed as compared to the chambers of the beer saver 1*c* of FIG. 1C, by necessity, the names of the chambers are now reversed. What was entitled the usable material chamber is now the displacement matter chamber. The name changes are similar to the changes described above for the reversed soda saver 1.

Water is introduced into the displacement matter chamber 46 via the displacement matter passageway 16 by a conventional water tap 60*c*. Beer is removed from the usable material chamber 48 via the usable material passageway 44 by a conventional beer tap 66*c*.

Wine Saver 1*d*, Device Variation.

Component Description of Wine Saver 1*d*.

FIG. 1D shows a perspective view of a volumetric displacement device, chemical saver, wine saver 1*d*, constructed as an embodiment of the volumetric displacement device, that protects its contents from being exposed to atmospheric air. FIG. 1E shows a cutaway view of the device shown in FIG. 1D. Referring to all of FIG. 1D and FIG. 1E except where noted, a wine saver 1*d* is constructed.

A container 12, of one piece, is formed from glass, a rigid material. The container 12 is a conventional wine bottle with no modification. Cork 66*d*, a conventional wine bottle cork with no modification, is used to seal the container 12 in conventional fashion. Wine 50*d* is the usable material stored in the container 12.

After partial consumption of wine 50*d* conventional glass marbles 52*d* are put into the container until the usable material fill level 56 comes to near the top of the usable material passageway 40. The cork 66*d* is reinserted into the container 12. The wine is protected from the atomosphere. There is little oxygen in the container 12 to oxidize the wine 50*d*.

Ramifications of Wine Saver 1*d*.

The wine saver 1*d* can be used to store virtually any liquid in its original container providing that the container will reasonably seal out the atmosphere. The material will have a reduced exposure to the atmosphere as the conventional glass marbles displace the air that comes into the container.

Conventional glass marbles of any size that will fit into the container will work, as will most matter that is immiscible with the wine or the particular usable material that is to be saved. A partially filled container of vinegar could have oil poured into it until the container was full. The sealed vinegar container would now be protected from the atmosphere.

Operation of Soda Saver 1.

The beverage company, bottling company, fills the container with soda 50 via the usable material passageway 16. Both caps, the usable material cap 60 and the displacement matter cap 66 must be removed from the container 12 during this process. This displacement partition 28 is not inflated prior to this operation and residual air left in the displacement matter chamber 48 will be expelled via the displacement matter passageway 44, as the container 12 is filled. When the container is completely full of soda 50, and the displacement matter chamber 48 is collapsed and devoid of most air, the soda 50 will surround the displacement partition 28 on all sides except near its point of attachment to the container 12. In this condition the container 12 is tightly capped at both necks, and shipped to the consumer.

The preferred embodiment looks to the consumer like a regular soda or wine bottle except that it has two necks and container openings. A double necked bottle if you will. The usable material passageway 16, usable material neck 14, and usable material cap 60 function exactly the way a regular bottle would. The user removes the usable material cap 60, leaving the displacement matter cap 66 in place and pours out or drinks directly from the soda saver 1, the desired portion of soda 50. After this partial consumption, the consumer removes the displacement matter cap 66, does not replace the usable material cap 60, and with both caps off, puts the container in a relatively vertical position. The consumer then fills the displacement matter chamber 48 with water 52, and optionally, some crushed ice 54, via the displacement matter passageway 44 until the container 12 is full. The displacement partition 28 is mobile, will move, and the level of liquids in both chambers will equilibrate. When the user observes that the level of liquid is near the top of both necks, as shown by the full displacement matter level 58 and the full usable material level 56, the two necks of the container 12 are tightly capped, the contents possible refrigerated, and the soda 50 stored until the next utilization.

Operation of Beer Saver 1*c*.

The beer brewer fills a sterile beer saver 1*c* at the manufacturing facility. The displacement matter cap 66 is removed. An attachment is made to the conventional petcock 60*c* which is opened. Beer is pumped through the usable material passageway 16 into the usable material chamber 46. Air that is in the displacement matter chamber 48 will be forced out as the beer 50*c* fills the usable material chamber 46. After filling, any residual air left in the displacement matter chamber 48 will be replaced with water 52 that is poured into the displacement matter passageway 44. The displacement matter cap 66 is securely screwed back onto the displacement partition clamp 34 as it seals the displacement matter passageway 44. The beer may be shipped to the consumer.

In use, the consumer first removes the displacement matter cap 66 from the cooled beer saver 1*c*. The consumer opens the conventional petcock 60*c* to let beer flow into a drink holding device, beer mug or glass. The petcock 60*c* is closed when enough drink is poured. The user pours enough water into the displacement matter passageway 44 to fill the displacement matter chamber 48 with water 52. The displacement matter cap 66 is securely screwed back onto the beer saver 1*c* and the beer saver 1*c* is returned to the refrigerator for storage.

Effervescent Beverage Storage and Dispensing. A Cap Controlled Soda Saving Device 1.1, modified so that the displacement matter chamber may not be opened without the usable material chamber being opened first.

Component Description of Cap Controlled Soda Saver 1.1.

Figure 1J:
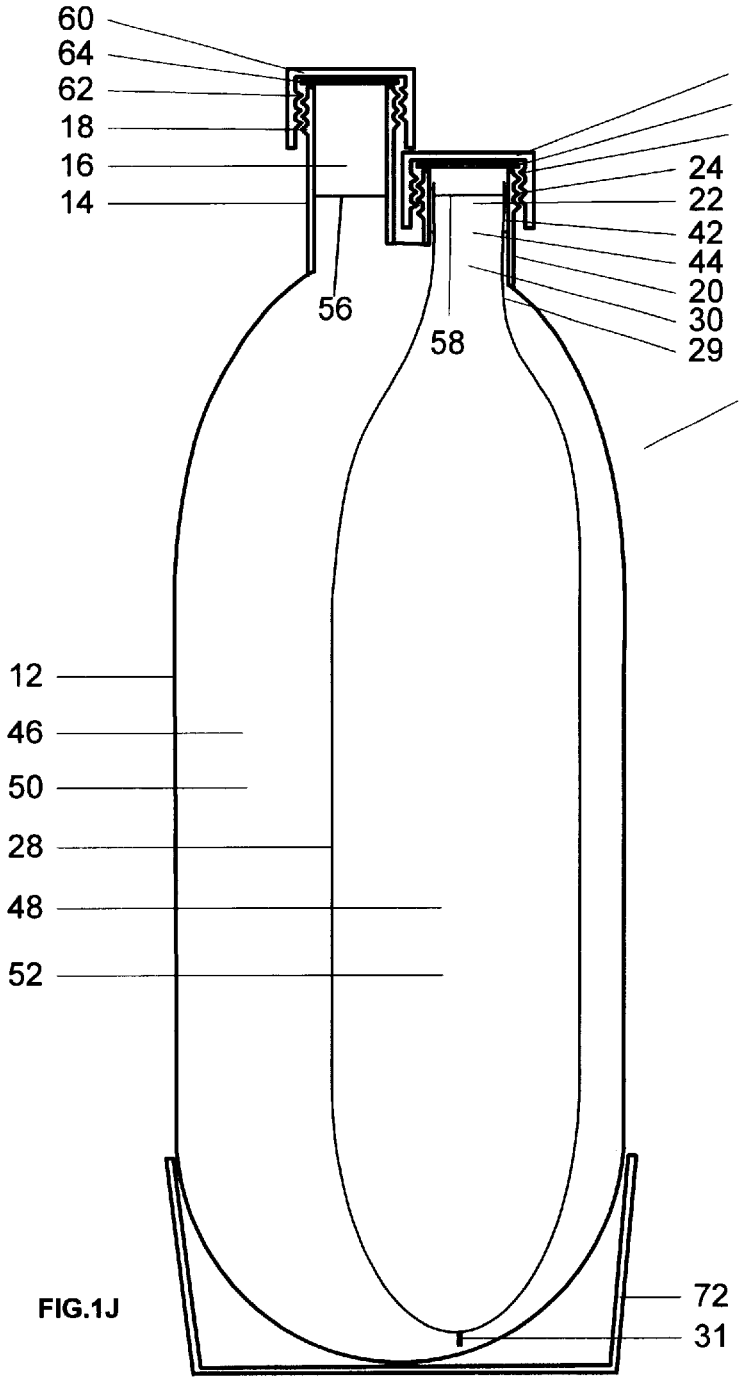
FIG. 1J shows a cross sectional view of the device shown in FIG. 1I.
Figure 1I:
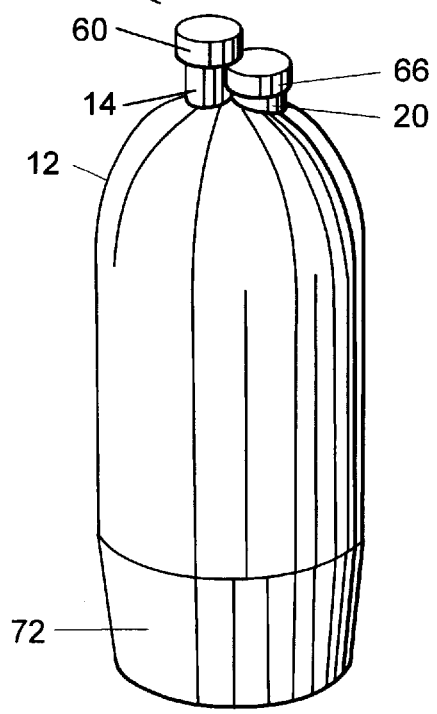
FIG. 1I shows a cap controlled soda saver 1, the device of FIG. 1A, modified so that the displacement matter chamber may not be opened without the usable material chamber being opened first.

FIG. 1I shows a perspective view of a volumetric displacement device, an effervescent beverage storage device, cap controlled soda saver 1.1, constructed as an embodiment of the volumetric displacement device, that prevents soda or other carbonated, effervescent beverages from going flat after their container has been opened. The usable material chamber must be opened before the displacement material chamber can be opened because of cap interference. FIG. 1J shows a cutaway view of the device shown in FIG. 1I. Referring to FIG. 1I and FIG. 1J except where noted, the soda saver 1.1 is constructed.

The construction of the soda saver 1.1 is similar to the construction of the soda saver 1 except as noted.

The displacement partition clamp 34 is eliminated and instead, the displacement partition neck 29, is bonded directly to the inside of the displacement matter neck 20. The bond is made using Loctite "Quick Tite" Super glue. The seal is completed with Eclectic Products Inc. "Plumber's Goop".

The necks, displacement matter neck 20 and usable material neck 14 are formed so that they are parallel to each other in the positions shown in FIG. 1.1. The side walls of the usable material cap 60 are thicker than those of a standard cap so that the cap interferes with the removal of the displacement matter cap 66 by its position.

Device Description of Cap Controlled Soda Saver 1.1.

Soda Saver 1.1 has some advantages over Soda Saver 1. The location of the two necks at the very top of the container 12 prevents an air bubble from being trapped at the top of the container as the caps are being closed. This increases the efficiency of the container as there is less air space above the liquids that has to be compressed.

Another advantage is that the usable material cap 60 overlaps the top edge of the displacement matter cap 60. Pressure built up in the container from the release of $CO^2$ gas from the Soda can cause problems if the displacement matter cap 66 is removed while the usable material cap 60 is still in place.

In some instances, the user of the container might not elect to fill the displacement matter chamber 48 with water. If the displacement matter cap 66 is removed before the usable material cap 60, the pressure built up in the usable material chamber 46 could force water out the displacement matter neck 20 creating an unwanted mess. In extreme cases that pressure could break the displacement partition 28, burst the seal between the displacement partition and the displacement matter neck 42, or even blow the displacement partition 28 out the displacement matter neck passageway 22. Each of these events is undesirable.

If, however, the displacement matter cap 66 can not be removed because of the position of the unstable material cap 60, these undesirable events can not occur. In addition, the displacement matter cap 66 must be put into place before both chambers can be sealed. This also prevents the $CO^2$ gas from forcing water to be expelled from the displacement matter chamber 48.

Operation of Cap Controlled Soda Saver 1.1.

The operation of the Soda Saver 1.1 is the same as for the Soda Saver 1. The user is forced to operate the caps in the correct sequence with the Soda Saver 1.1.

Cap Controlled Soda Saving Device with Interference Lip 1.1*a* Variation.

Figure 1L:
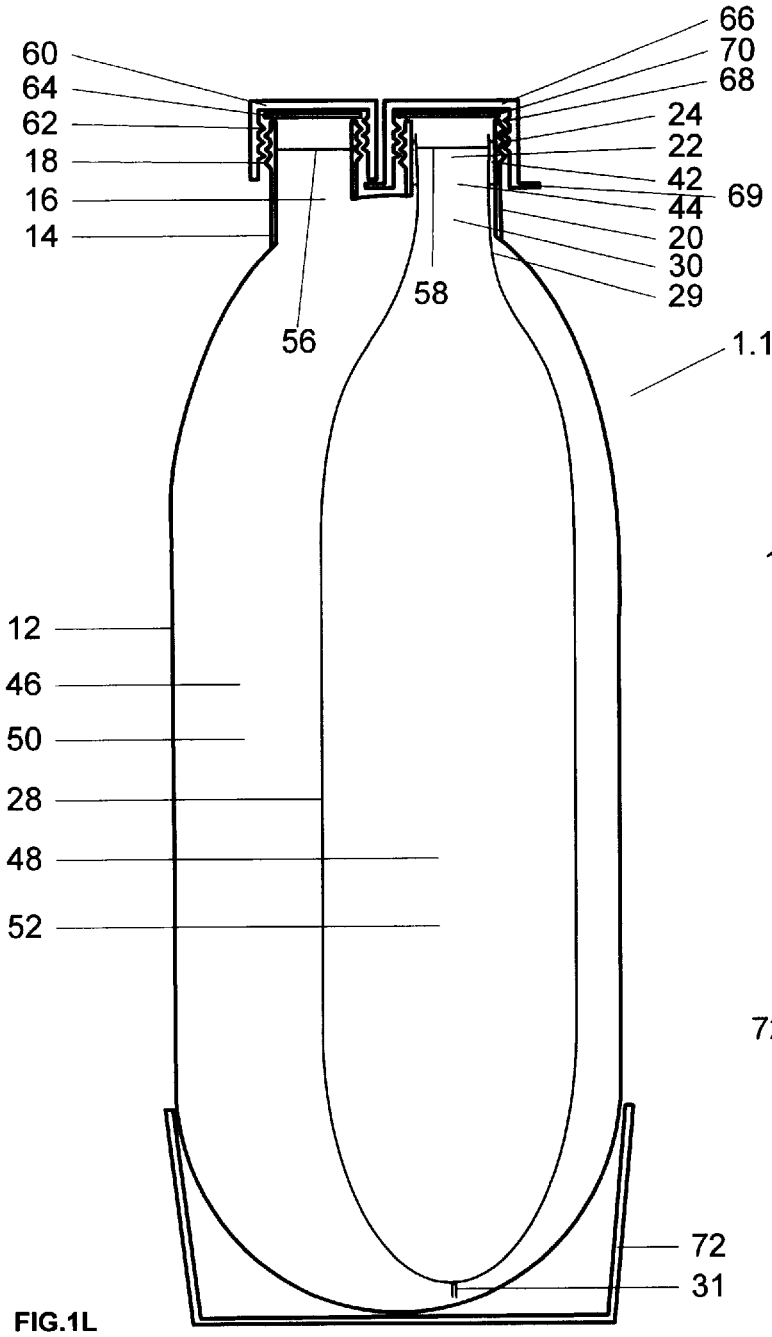
FIG. 1L shows a cross sectional view of the device shown in FIG. 1K.
Figure 1K:
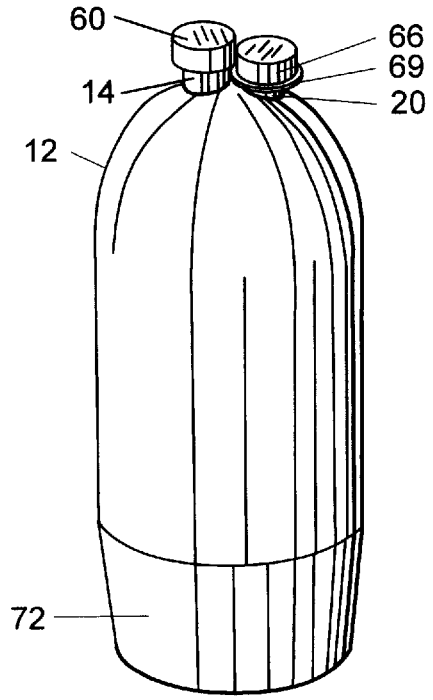
FIG. 1K shows a modified cap controlled soda saver 1, the device of FIG. 1I, modified so that the caps interfere because of a lip on the displacement matter cap.

FIG. 1K shows a perspective view of a volumetric displacement device, modified cap controlled soda saver with interference lip 1.1*a,* constructed as an embodiment of the volumetric displacement device that accomplishes objectives similar to cap controlled soda saver 1.1. FIG. 1L shows a cutaway view of the device depicted in FIG. 1K. Referring to FIG. 1K and FIG. 1L, except where noted, a cap controlled soda saver with interference lip 1.1*a* is constructed.

The construction and operation of the cap controlled soda saver with interference lip 1.1*a* is identical to that of the cap controlled soda saver 1.1 except as noted. The usable material neck 14 of the cap controlled soda saver with interference lip 1.1*a* is constructed so that it is at the same height as the displacement matter neck 20 when the soda saver 1.1*a* is in a vertical position as shown in FIG. 1L and FIG. 1K. With the two necks at an even height, no air bubble will form in either chamber as a result of air being trapped in one neck as the level of the fluids in the soda saver 1.1*a* equilibrates and the chambers are sealed.

An interference lip 69, is formed at part of the displacement matter cap 66. This lip prevents the displacement matter cap 66 from being removed before the usable material cap 60 in the same way that the positions of the caps in the cap controlled soda saver 1.1. controlled the opening and closing of that container. Operation of cap controlled soda saver with interference lip 1.1*a* is identical to the operation of the cap controlled soda saver 1.1.

Method of Use of Soda Saver 1.1

FIG. 1I and FIG. 1J show a soda save 1.1 as it would be used for storage of soda. The soda saver 1.1 is in the full fill state and the soda is protected from going flat. Both the usable material cap 60 and the displacement cap 66 are securely screwed onto their appropriate necks, and the container 12 is sealed.

Figure 1M:
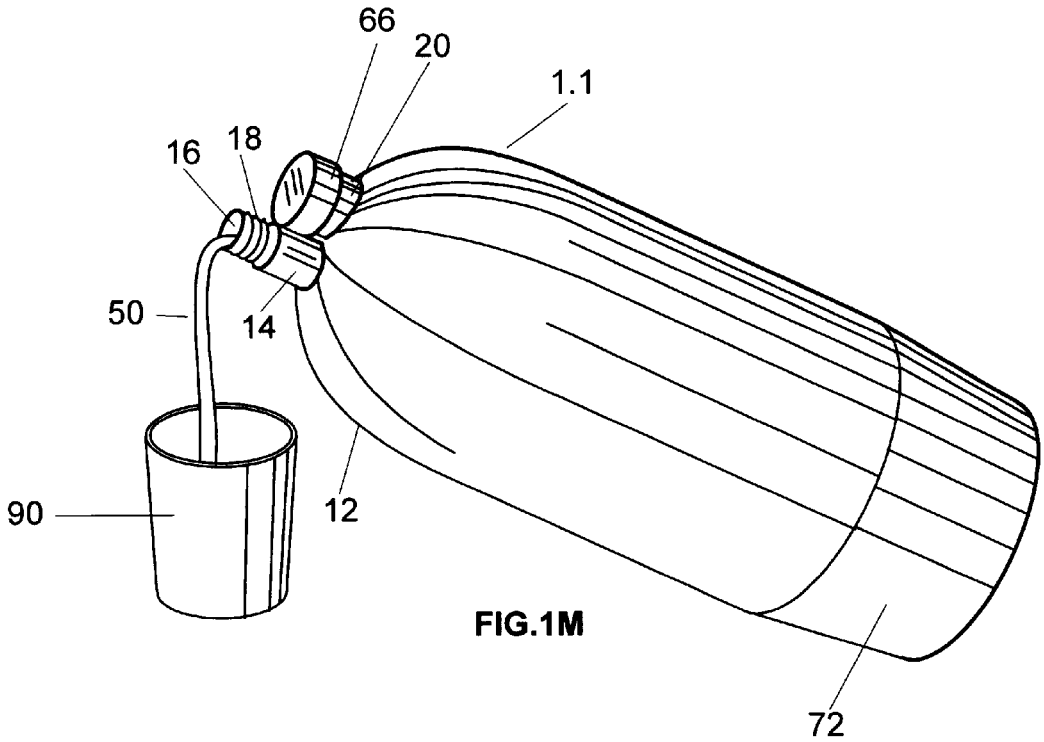
FIG. 1M shows a cap controlled soda saver 1, the device of FIG. 1I, with usable material cap removed, pouring out soda.

FIG. 1M shows the soda save 1.1 as soda is being removed from it in a manner suitable for consumption. It can be seen from the figure that the usable material cap is removed. The container 12 is tipped up and soda 50 is pouring from the usable material passageway 16 into a conventional drinking glass 90.

Figure 1N:
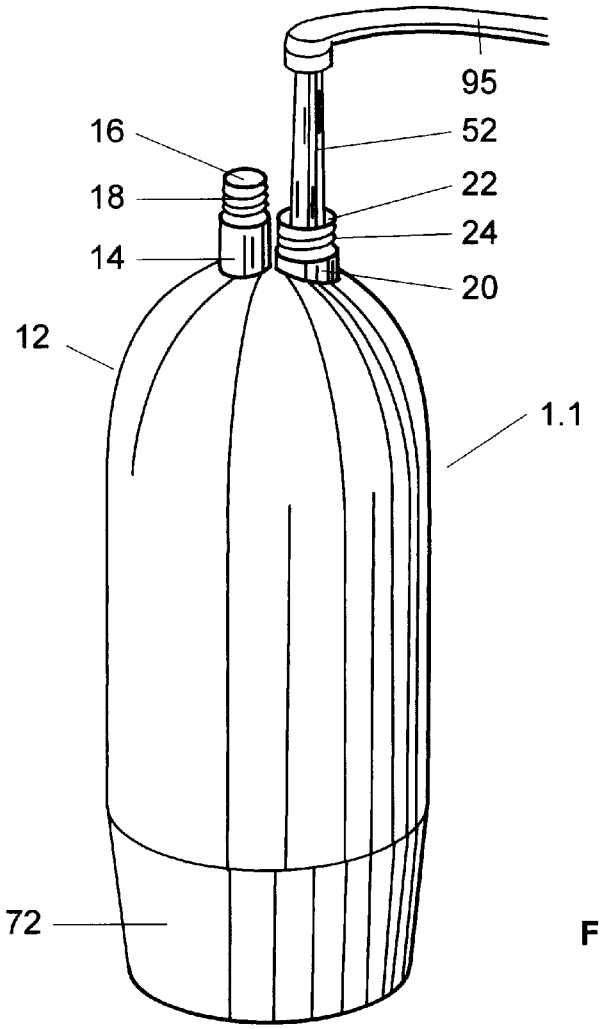
FIG. 1N shows a cap controlled soda saver 1, the device of FIG. 1I, with usable material cap and displacement matter cap removed, having water poured into it.

FIG. 1N shows the soda save 1.1 as it is being prepared for storage of the remaining portion of soda. The soda saver 1.1 is in a vertical position. The usable material cap 60 and the displacement matter cap 66 are now both shown to be removed. Water 52 is pouring into the displacement matter neck passageway 22. In this case, the water 52 is coming from a conventional faucet 95. When full, this water will equilibrate in the two necks of the container. That is, the level of the water and the soda will be approximately the same relative to the earth. The container will be in the full fill state.

The usable material cap 60 and the displacement matter cap 66 are now screwed onto their respective necks. FIG.1I and FIG. 1J once again show the soda saver 1.1 in the full fill state and ready to be stored again.

Other Variation of Soda Saver 1.1

Water 52 can be poured into the displacement matter neck passageway 22 from a variety of sources. The water can be poured from another container such as a glass or pitcher. It can even be poured from another volumetric displacement matter container that is empty of soda, but still has water in it, possible that is already chilled.

It is noted that water used as displacement matter can be reused, in fact, it is energy efficient to use water that is already chilled. The water in the container that has no more consumable soda in it may also be consumed. This water is already chilled and convenient.

Various ridges and placement of the caps can be used to cause interference of the caps rather than by positioning one over the other exactly as shown.

Figure 1O:
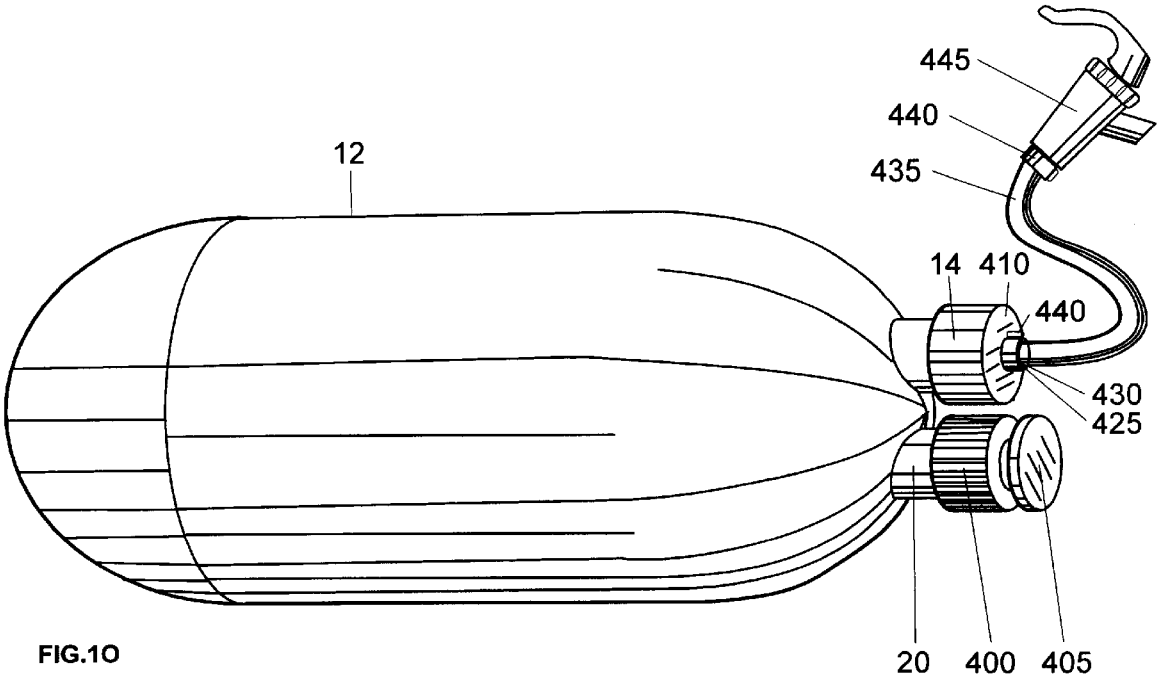
FIG. 1O shows a perspective view of an Air Pump Soda Saver Fountain 1.2, the device shown in FIG. 1K with a conventional soda bottle air pump and a conventional soda fountain faucet nozzle attached.

FIG. 1O shows a perspective view of an Air Pump Soda Saver Fountain 1.2, the device shown in FIG. 1K with a conventional soda bottle air pump and a conventional soda fountain faucet nozzle attached.

Figure 1P:
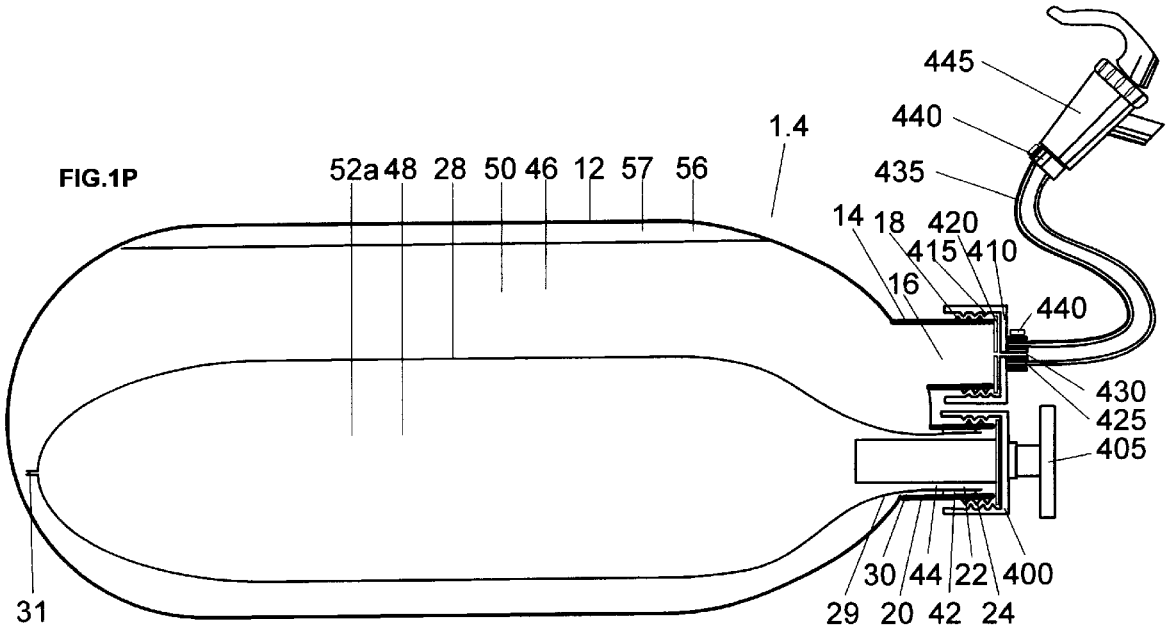
FIG. 1P shows a cross sectional view of the device shown in FIG. 10.

FIG. 1P shows a cross sectional view of the device shown in FIG. 1O.

PET bi-layer construction variation

The soda savers presented in FIG. *** may also be constructed using Blow Molded Bi-Layer PET technology as described in Richter et al U.S. Pat. Nos. 5,433,347, 5,385,269, 5,383,576. This technology describes containers which are formed in multiple layers, bonded at the neck, and allowed to separate utilizing pressure. The main differences between the containers described are that both walls of a two layer pet container must be relatively pas impermeable, the walls need not ever be bonded together, the liquids may be poured from the container with a suitable pouring opening, the displacement matter may be poured into the container with a suitable pouring opening, the displacement matter opening as well as the usable material opening are re-sealable, suction is not required to remove the usable material, other suitable materials beside PET plastic may be used.

Effervescent Beverage Storage and Dispensing. An Air Pump Soda Saver Fountain 1.2

Component Description of Air Pump Soda Saver Fountain 1.2.

FIG. 1O shows a perspective view of a volumetric displacement device, an effervescent beverage storage device, an air pump soda saver fountain 1.2, constructed as an embodiment of the volumetric displacement device, that prevents soda or other carbonated, effervescent beverages from going flat after their container has been opened. The usable material chamber must be opened before the displacement material chamber can be opened because of cap interference. FIG. 1P shows a cutaway view of the device shown in FIG. 1O. Referring to FIG. 1O and FIG. 1P except where noted, the air pump soda saver fountain 1.2 is constructed.

The construction of the air pump soda saver fountain 1.2 is identical to the construction of the cap controlled soda saver with interference lip 1.1*a* except as noted.

A soda bottle fountain adaptor 210 of one piece, is formed of rigid plastic. The displacement matter cap 66 is similar in construction to a conventional plastic soda bottle cap except that it has a passageway though it and a barb for attaching a hose to that passageway.

A set of soda bottle fountain adaptor female threads 68 are formed from the plastic of, and as part of, the soda bottle fountain adaptor 210. The threads are formed in such a manner that they mate securely with the usable material neck male threads 18.

The soda bottle fountain adaptor 210 is fitted with a soda bottle fountain adaptor seal 220, which is a thin disk of silicon rubber. The soda bottle fountain adaptor seal 220 serves to tightly seal the displacement matter neck passageway 22 when the soda bottle fountain adaptor 210 is securely screwed onto the usable material neck 14, as the soda bottle fountain adaptor female threads 68 firmly engage the usable material neck male threads 18.

A soda bottle fountain adaptor barb 225 is formed from the material of the soda bottle fountain adaptor 210, as part of the soda bottle fountain adaptor 210, so that the plastic forms a soda bottle fountain adaptor passageway 230 within the soda bottle fountain adaptor barb 225.

A length of conventional vinyl hose 230 is pressed over the soda bottle fountain adaptor barb 225 secured with a conventional hose clamp 235. A conventional soda fountain faucet nozzle 245 is pressed onto the other end of the conventional vinyl hose 230 and secured with a conventional hose clamp 235. A soda bottle fountain 250 has now been constructed as depicted.

Either at the factory, or by the user at the point of consumption, the displacement matter cap 66 may be removed and replaced with a conventional soda bottle air pump 200. Either at the factory, or by the user at the point of consumption, the usable material cap 60 may be removed and replaced with the soda bottle fountain 250.

Operation of Air Pump Soda Saver Fountain 1.2.

The air pump soda saver can be assembled at the factory, or the soda saver 1.1*a* can be purchased separately and the conventional soda bottle air pump and or the soda bottle fountain screwed on by the user.

The user must first pump up the pressure to deliver soda at the faucet nozzle. The first few drinks will require the user to pump and pour at pretty much the same time until an air reservoir is built up in the container. The user also of course has the option of simply pouring out the first drink or drinks he takes before the conventional soda bottle air pump 200 and/or the soda bottle fountain 250 are attached.

Once attached, the user does not remove the conventional soda bottle air pump 200 and/or the soda bottle fountain 250. Each time a drink is taken via the faucet nozzle, the pressure is built up by operating the pump. If the user forgets to operate the pump, the $CO^2$ gas that accumulates as a bubble in the usable material chamber can be returned to the soda by pumping up the pressure with the conventional soda bottle air pump 200 and either waiting for the $CO^2$ gas to re-enter the beverage over time, or forcing it back in with a vigorous shake of the entire air pump soda saver fountain 1.2.

After the beverage in the air pump soda saver fountain 1.2. is consumed, the conventional soda bottle air pump 200 and/or the soda bottle fountain 250 are removed, cleaned and re-used on another soda save 1.1*a*.

The air pump soda saver fountain 1.2 works best if the $CO^2$ gas bubble is not allowed to exit the soda bottle fountain 250. For example, laying the bottle flat causes the $CO^2$ gas bubble to sit along the side of the container which is now up. The soda bottle fountain adaptor passageway 230 lies under the fluid so that only carbonated soda can exit the container and not any freed $CO^2$ gas.

Ramifications of Air Pump Soda Saver Fountain 1.2.

A marvelous soda fountain dispenser has now been created that has a number of advantages over the soda saver previously described. The first advantage is that it can perform at higher efficiencies. Removing the cap from the soda saver 1 results in some loss of carbonation each time the container is opened. Although this loss is small in relation to a standard soda bottle, it is a loss that accumulates if the container is opened over and over again. In the air pump soda saver fountain 1.2, any $CO^2$ gas that escapes the beverage accumulates in a gas bubble over the beverage. With the soda saver properly positioned, that gas does not exit the bottle when soda is removed. In fact, the air pressure built up in the displacement matter chamber will drive the $CO^2$ gas back into the soda thereby re-carbonating the soda. The result is the delivery of perfect, fully carbonated soda, every time, even if the user takes just a little bit out over and over again. The result has not been previously been achieved in an economical, convenient, and safe manner without the use of a $CO^2$ gas supply.

An air pump used on a standard container of soda is of little value. Although the pressure can easily be raised in the container, the $CO^2$ gas readily escapes the soda and "permeates" the block of compressed air over the soda. When the air is pumped in, it has too low a partial pressure of $CO^2$ gas, and the $CO^2$ gas of the beverage comes out of solution to raise the partial pressure of $CO^2$ gas in the air above the drink. The air pump looks like a good device, but is simply doesn't work very well.

This is all changed with the soda savers and other beverage savers presented in this application. The $CO^2$ gas in the drink is prevented from mixing with the compressed air by the gas impermeable displacement partition. The effective new displacement matter is a block of compressed air that has been isolated from the $CO^2$ gas of the drink. The conventional air pump now works.

Another improvement presented in the use of the conventional hand air pump in a conventional soda bottle is that every time the pump is removed to pour out another drink, all the vacant space must be repumped over and over again making a tedious pumping job. With the air pump soda saver fountain 1.2, only that portion of the container where fresh beverage has been removed, must be pumped up. The pumped air that was previously pumped in is not removed. This results in an enormous amount of saved labor for the user.

Another advantage of the air pump soda saver fountain 1.2 is that it takes less energy to cool the compressed air than it does to cool the water used in the soda save 1.1. Water unless it is chilled first, can warm the soda to some degree. The soda and the water must then be chilled by the refrigerator resulting in a delay for completely chilled soda. This delay is vastly reduced because the heat capacity of the air is so much lower than that of water.

The weight of the air pump soda saver fountain 1.2 is reduced as the beverage is used up. The water added to the soda saver 1 keeps it heavy through out use.

The air pump soda saver fountain 1.2 is convenient to use in dispensation. It lies flat in the refrigerator using up the back space of the refrigerator. Soda can be dispensed directly from the container without removing it from the refrigerator although pumping is required.

An economical means of obtaining good soda is also obtained. In general, the soda saver without the air pump and fountain head is inexpensive and disposable. In addition, the soda saver will work with water as described earlier and is a functional entity without the expense of a pump and soda fountain valve. The pump and fountain valve are more costly, but are reusable from soda saver to soda saver. A generally disposable means has been obtained to distribute the soda, which is in a volumetric disposable container, that is the combination of the outer container and the displacement partition, shipped and distributed with the caps on instead of the pump and fountain valve.

Variations of Air Pump Soda Saver Fountain 1.2.

An air pump will work on the beer saver, with appropriately fitted beer balls, kegs, or with any other effervescent beverage container fitted with a volumetric displacement device.

Many other manners of pumping air will work. An electric air pump provides a convenient automated means for delivering compressed air.

Various configurations of pumps, pressure gauges, and air reservoir tanks can be utilized to supply air pressure to the air pump soda saver fountain. A pressure gauge can be utilized to measure the pressure applied to the displacement matter changer 48. All sorts of hand pumps can be envisioned that make pumping of the air easier or more convenient.

Effervescent Beverage Storage and Dispensing. A Retro-Fit Free Floating Soda Saver 1.3

FIG. 1.3 depicts a soda saver device that can be used in a conventional re-sealable soda container. As such, when inserted into the conventional container and filled with non-compressible matter such as water, it prevents the $CO^2$ gas from exiting the effervescent beverage.

Description of Retro-fit Free Floating Soda Saver 1.3.

Figure 1Q:
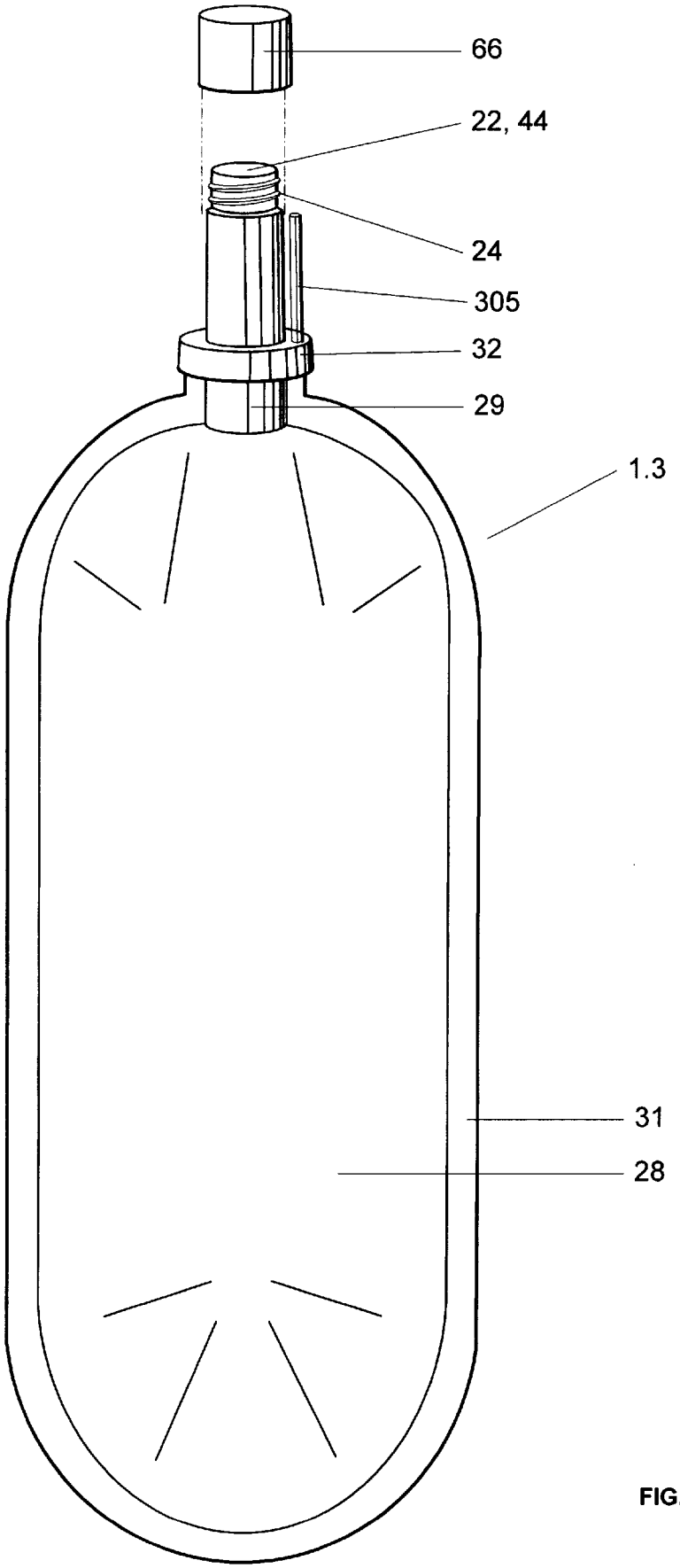
FIG. 1Q shows a perspective view of a Free Floating Retro-Fit Soda Saver 1.3.
Figure 1R:
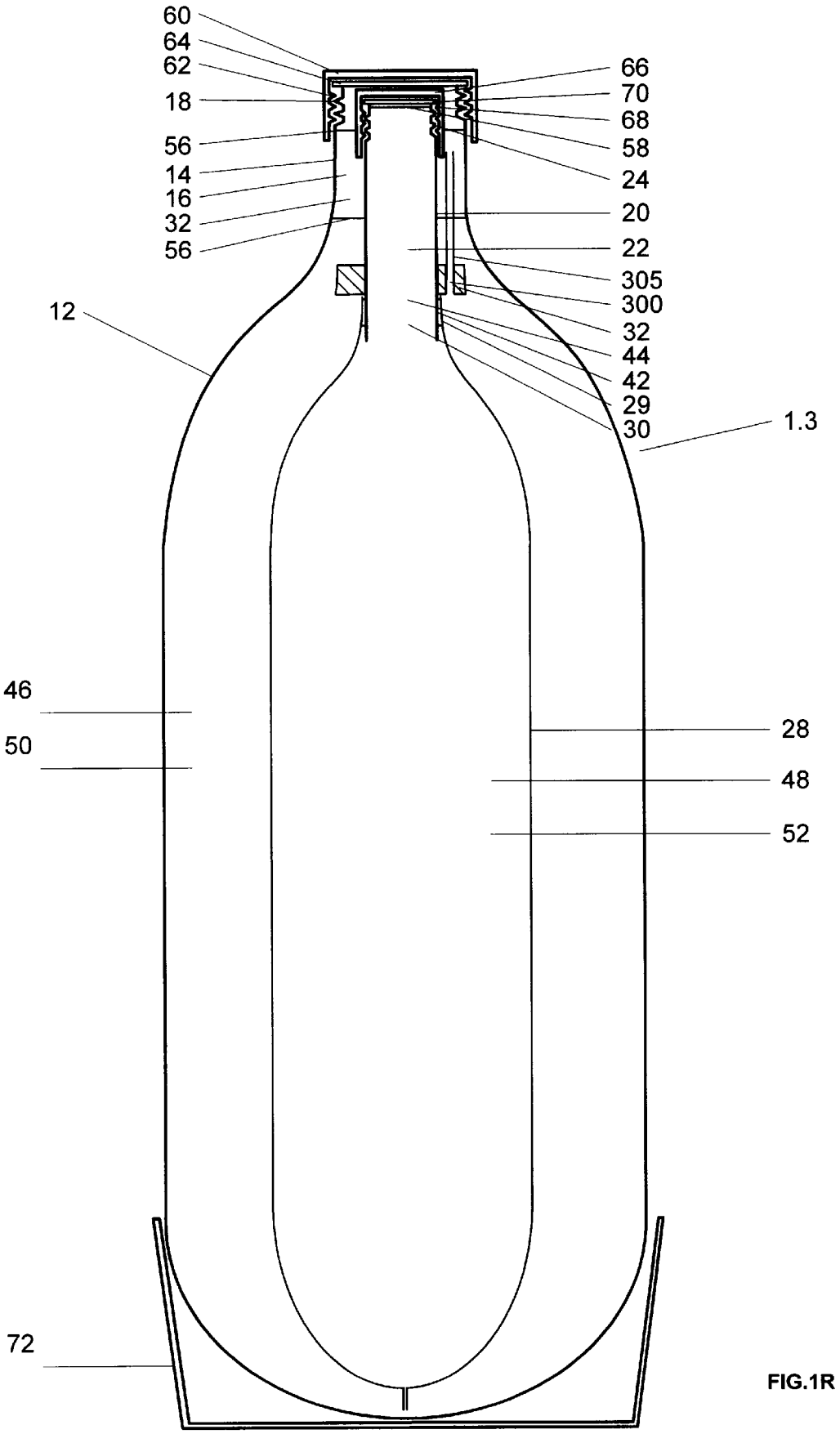
FIG. 1R shows a cross sectional view of the device shown in FIG. 1Q, with usable material chamber sealed and displacement matter chamber sealed.
Figure 1S:
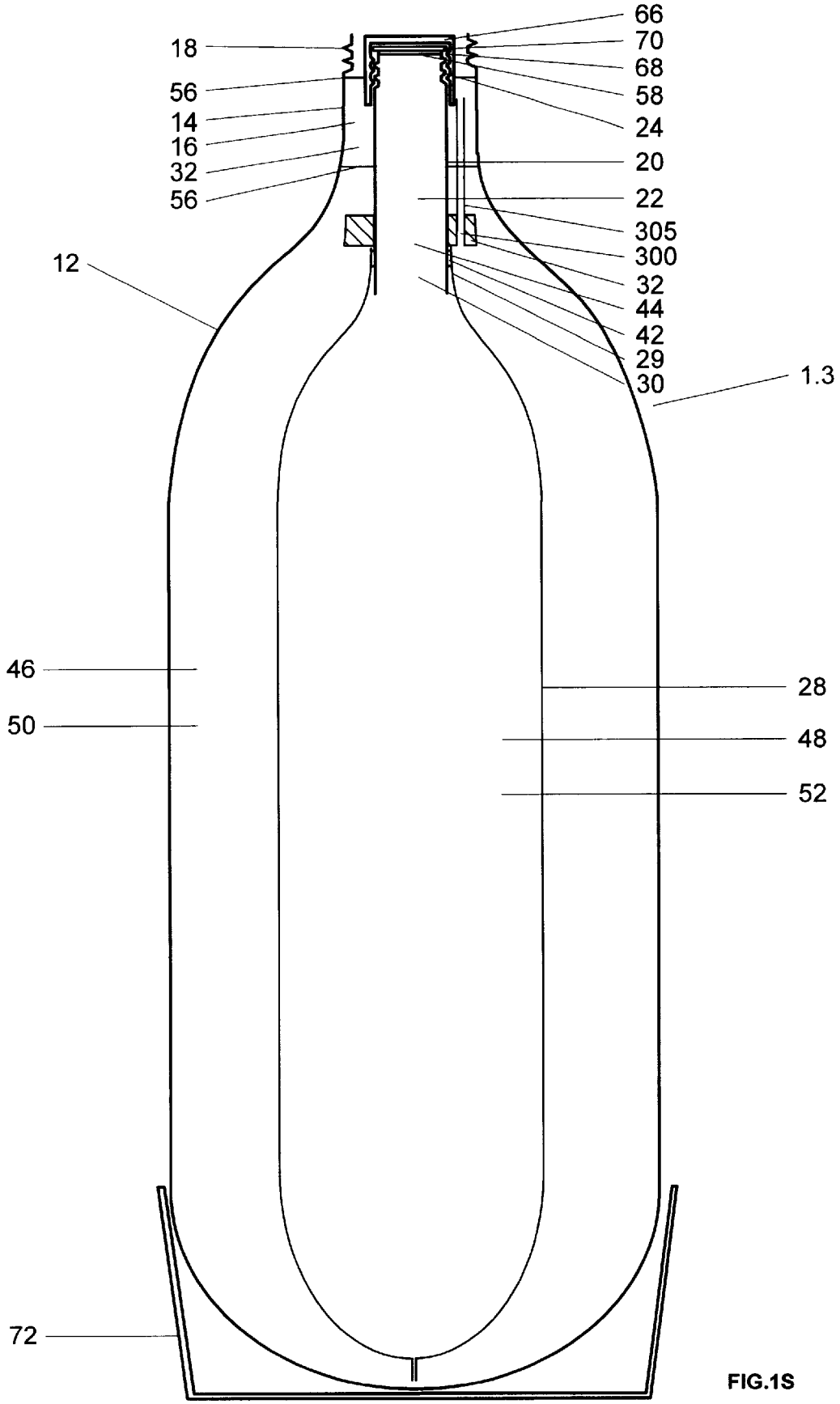
FIG. 1S shows a cross sectional view of the device shown in FIG. 1Q, with usable material chamber open and displacement matter chamber open.
Figure 1T:
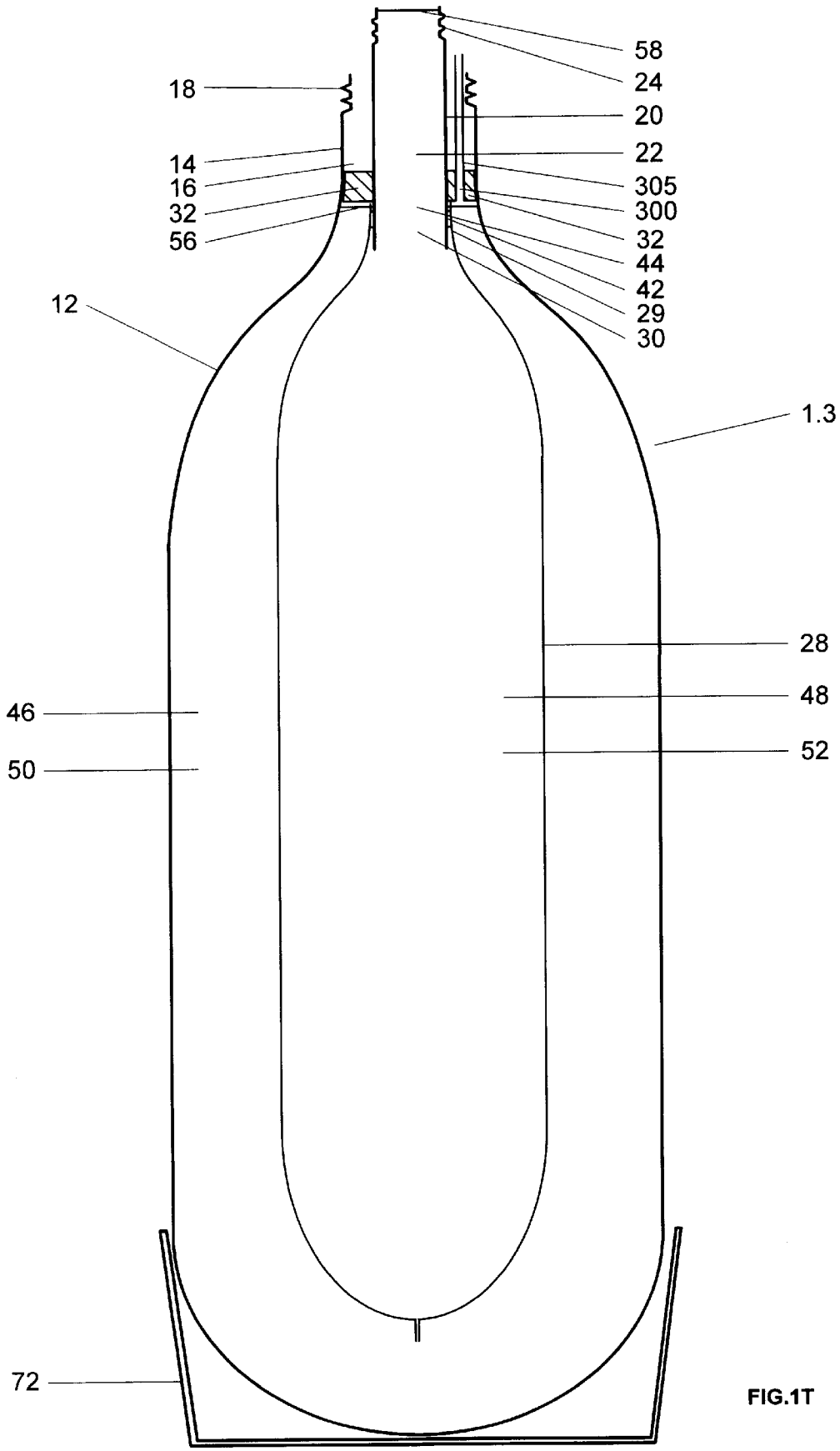
FIG. 1T shows a cross sectional view of the device shown in FIG. 1Q, with usable material chamber open and displacement matter chamber open.

FIG. 1Q shows a perspective view of a volumetric displacement device, an effervescent beverage storage device, Retro-fit Free Floating Soda Save 1.3, constructed as an embodiment of the volumetric displacement device, that prevents soda or other carbonated, effervescent beverages from going flat after their container has been opened. FIG. 1R, FIG. 1S and FIG. 1T show a cutaway views of the device shown in FIG. 1Q gut in differing positions. Referring to FIG. 1Q, FIG. 1R, FIG. 1S, and FIG. 1T except where noted, the soda saver 1.3 is constructed.

A conventional PET plastic soda bottle, container 12 of one piece is utilized.

A conventional usable material neck 14 is formed from the material of the container 12, as part of the container 12, so that the plastic forms a usable material passageway 16 within the usable material neck 14.

A set of usable material neck male threads 18 are formed from the plastic of, and as part of, the usable material neck 14.

A displacement matter neck 20 is formed from plastic in a manner that is similar to conventional PET bottle necks except that there is no container attached during molding. The plastic forms a displacement matter neck passageway 22 within the displacement matter neck 20.

A set of displacement matter neck male threads 24 are formed from the plastic of, and as part of, the displacement matter neck 20.

A displacement membrane, bladder, displacement partition 28 is constructed of an aluminized polyester membrane, marvel seal 360 as produced by Ludlow Corporation. The displacement partition 28 is constructed as an air tight bag, similar in construction to a conventional Mylar$^R$ balloon, in a shape that is roughly the same size and shape as the interior of the container 12. Two pieces of marvel seal 360 are cut out to the shape shown in FIG. 1.3A of the displacement partitions 28. A hot sealing iron at a temperature of approximately 325 degrees Fahrenheit is utilized to produce a displacement partition seal 31. This seal goes about the edges of the marvel seal 360 pieces. The marvel seal 360 pieces form a displacement partition neck 29, which has an opening, displacement partition passageway 30, left at the top of the displacement partitions 28 to accept the end of the displacement matter neck 20, which is glued into the displacement partition passageway 30 with displacement partition adhesive 42. A good adhesive for experimental purposes is Plubmer's Goop, produced by Eclectic Products Inc.

A displacement partition flange 32 is formed from closed cell foam. A vent 300 is formed from the foam. A vent tube of plastic 305 is formed and pressed into the vent 300. The displacement partition flange 32 is bonded to the displacement matter neck 32.

A conventional bottle top, usable material cap, 60 of one piece, is utilized.

A set of usable material cap female threads 62 are formed from the plastic of, and as part of, the usable material cap 60. The threads are formed in such a manner that they mate securely with the usable material neck male threads 18.

The usable material cap 60 is fitted with a usable material cap seal 64, which is a thin disk of silicon rubber. The usable material cap seal 64 serves to tightly seal the usable material passageway 16 when the usable material cap 60 is securely screwed onto the usable material neck 14, as the usable material cap female threads 62 firmly engage the usable material neck male threads 18.

A bottle top, displacement matter cap, 66 of one piece, is formed of non-stretching plastic. The displacement matter cap 66 is similar in construction to a conventional plastic soda bottle cap.

A set of displacement matter cap female threads 68 are formed from the plastic of, and as part of, the displacement matter cap 66. The threads are formed in such a manner that they mate securely with the displacement partition clamp male threads 40.

The displacement matter cap 66 is fitted with a displacement matter cap seal 70, which is a thin disk of silicon rubber. The displacement matter cap seal 70 serves to tightly seal the displacement matter neck passageway 22 when the displacement matter cap 66 is securely screwed onto the displacement partition clamp 34, as the displacement matter cap female threads 68 firmly engage the displacement partition clamp male threads 40.

A displacement matter passageway 44, is now defined which is composed of the displacement partition passageway 30, and the displacement matter neck passageway 22.

The displacement partition 28, when installed in the container, divides the container 12 into two chambers. The first chamber is a usable material chamber 46 which will hold usable material, in this case an effervescent beverage, soda 50. The second chamber is a displacement matter chamber 48 which will hold displacement matter, non-compressible matter, water 52.

The usable material chamber 46 is accessed by the usable material passageway 16, which is used to put soda 50 into and to take soda 50 out of the usable material chamber 46. The volume of space contained in the usable material passageway 16, is part of the space defined by the usable material chamber 46.

The displacement matter chamber 48 is accessed by the displacement matter passageway 44, which is used to put water 52 into and out off the displacement matter chamber 48. The volume of space contained in the displacement matter passageway 44, is part of the space defined by the displacement matter chamber 48.

FIG. 1B depicts the displacement partition 28 that is partially collapsed, being only partially filled with water 52. The usable material chamber 46 is also depicted as being partially filled with soda 50. In all, the soda 50, the water 52, and the displacement partition 28, completely fill the container 12. A usable material full level 56, is shown which demonstrates where the level of the soda 50 will be when the soda saver 1 is in a full fill state. A displacement matter full level 58, is shown which demonstrates where the level of water 52 will be when the container is in a full fill state. With the caps off the soda saver 1, the level of the soda and the level of the water will equilibrate as the mobile partition moves in response to gravitational forces on the water and soda. After soda 50 has been removed from the soda saver 1, if enough water 52 is added to the displacement matter chamber 48, the level of fluid will rise in both chambers, until the soda saver 1 is in a "full fill state". It is only in this full fill state that the effervescence in the soda 50 will be preserved. Soda 50 is preserved in the container having a full fill state although the container is only partially filled with soda 50.

Operation of Retro-fit Free Floating Soda Saver 1.3.

The operation of the Retro-fit Free Floating Soda Saver 1.3 is similar in function to the standard soda saver 1 already described. A standard PET bottle of soda is partially consumed. The soda saver 1.3 is empty, collapsed and the displacement partition 28, rolled up to that the entire device can be inserted into the partially full conventional soda container 12.

The saver 1.3 can not be made completely devoid of air and will have a tendency to float. As the displacement matter neck 20 rises, floating on the soda 50, the user will be able to pull it up out the neck of the container 12. The displacement matter cap 66 can now be removed. The container 12 and the soda saver 1.3 are now in the position as depicted in FIG. 1.3D.

Water is now poured directly into the displacement matter chamber 48 via the displacement matter neck 20 until the container is completely full of both water 52 and soda 50. Air can vent from the usable material chamber 46 via the vent 300 and the vent tube 305. The vent tube prevents water from entering the usable material chamber 46. The displacement matter cap 66 is screwed onto the displacement matter neck male threads 24 to seal the displacement matter chamber 48.

The soda saver 1.3 is forced down by the user submerging it in the soda 50. The saver 1.3 is now in the position shown in FIG. 1.3C. The conventional soda container cap, usable material cap 60 is screwed onto the usable material neck male threads 18 thus sealing the container 12, usable material chamber 46. The device is now in the position shown in FIG. 1.3B. It can now be stored until next utilization without loss of carbonation.

For the user to obtain the next serving of soda, he unscrews the usable material cap 60. The user then uses his finger to hold the soda saver 1.3 down in the position shown in FIG. 1.3C. With the usable material passageway 16 open and the displacement matter passageway 30 closed, the user may pour soda out of the container.

The cycle is repeated as the user now allows the soda saver 1.3 to float up, removes the displacement matter cap 66, and puts more water 52 into the displacement matter chamber 48.

Ramifications of Retro-fit Free Floating Soda Saver 1.3.

It is now possible to save the contents of a conventional container of effervescent beverage. The soda saver 1.3 is reusable and can be used on numerous containers.

Variation of Retro-fit Free Floating Soda Saver 1.3.

The Soda Saver 1.3 will work for any effervescent beverages, in a variety of re-sealable containers.

The soda saver device 1.3 and the container 12 will also work as a reversed chamber device, the claim to which is made by the provisions of the claim section and this portion of the specification. If soda is contained inside the free floating device 1.3 and water or other displacement matter is contained in the container 12, an effective soda saver is also created and utilized.

Effervescent Beverage Storage and Dispensing. Retro-Fit Tube Fit Soda Saver 1.4.

Component Description of Retro-Fit Tube Fit Soda Saver 1.4.

Figure 1U:
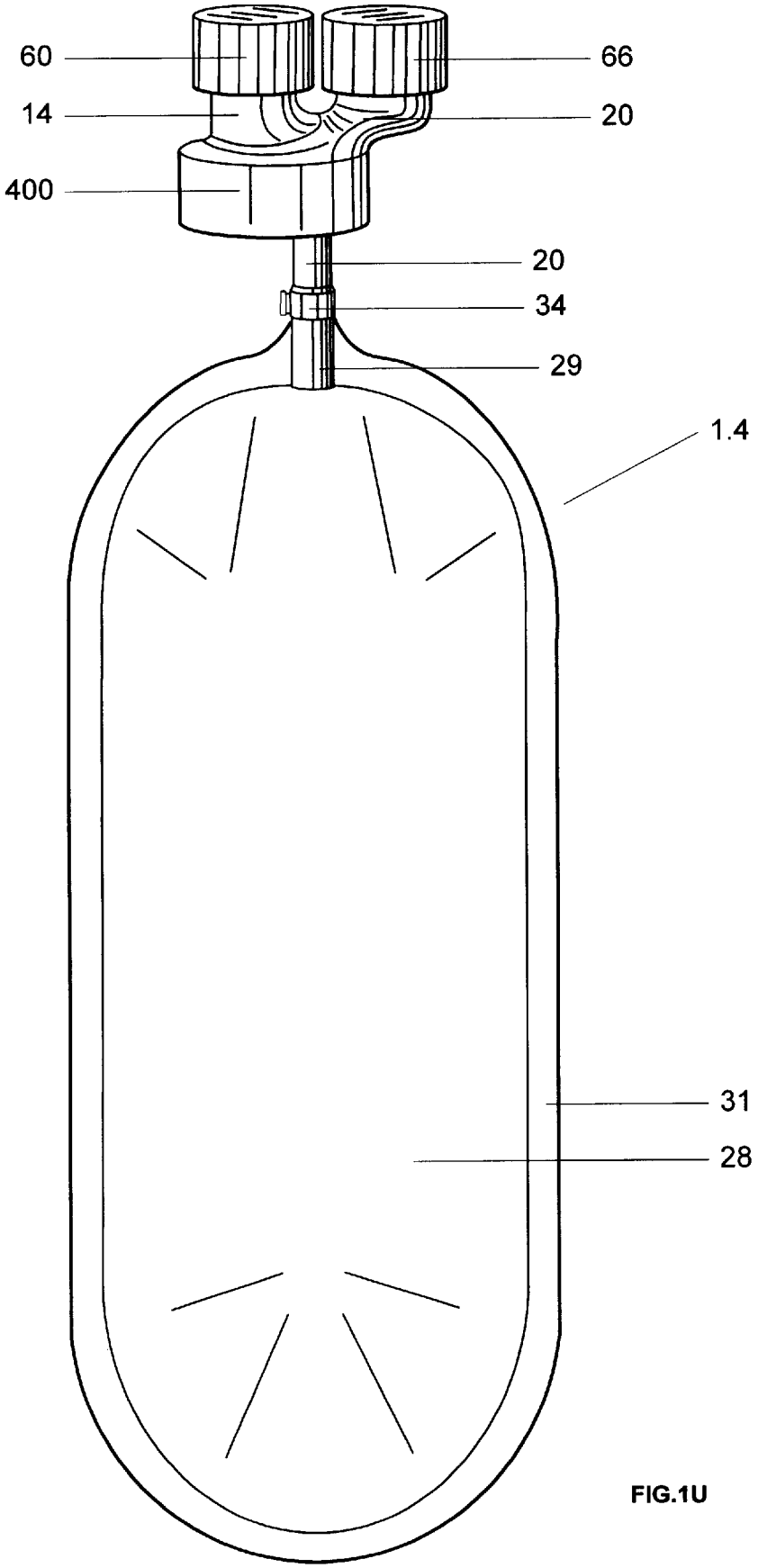
FIG. 1U shows a perspective view of a Retro-Tube Fit Soda Server 1.4.
Figure 1V:
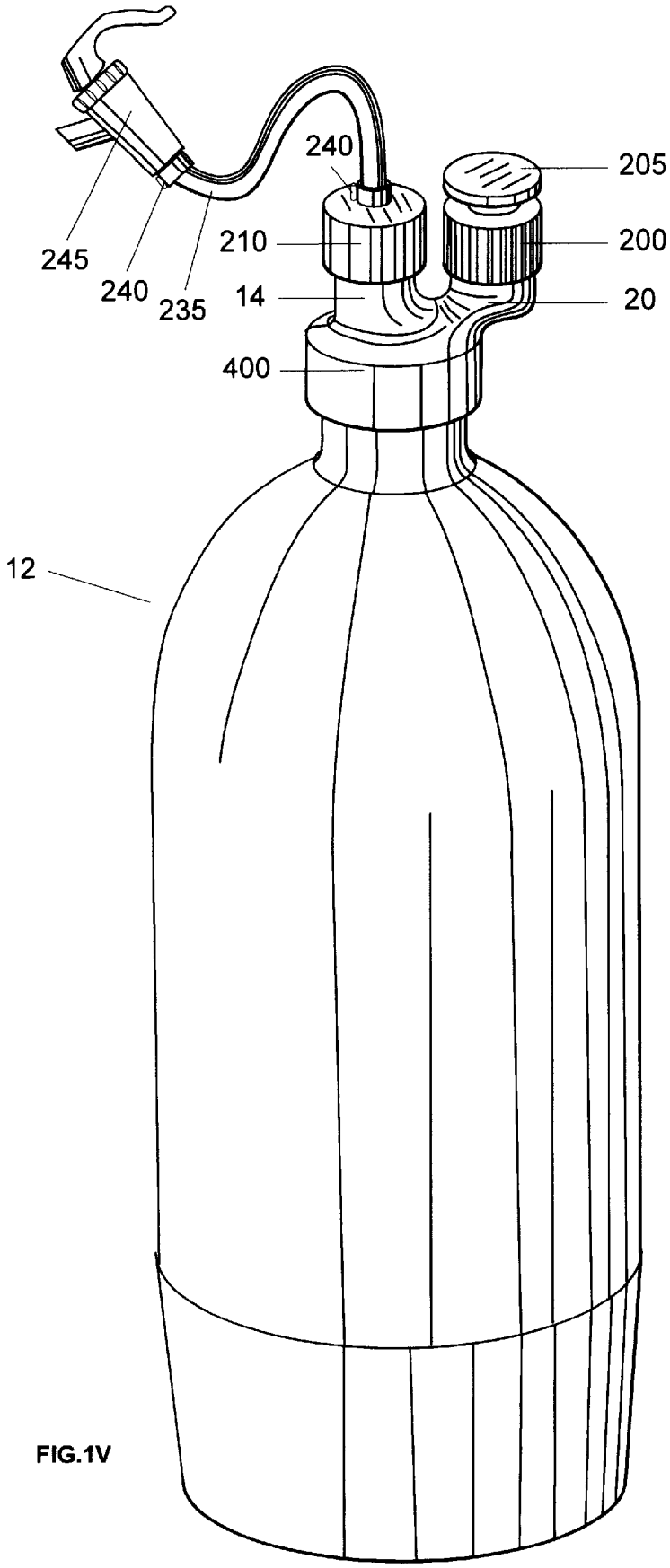
FIG. 1V shows a perspective view of the device shown in FIG. 1U installed in a conventional PET soda bottle, and with a conventional soda bottle air pump and a soda bottle fountain adaptor with a faucet nozzle installed.
Figure 1W:
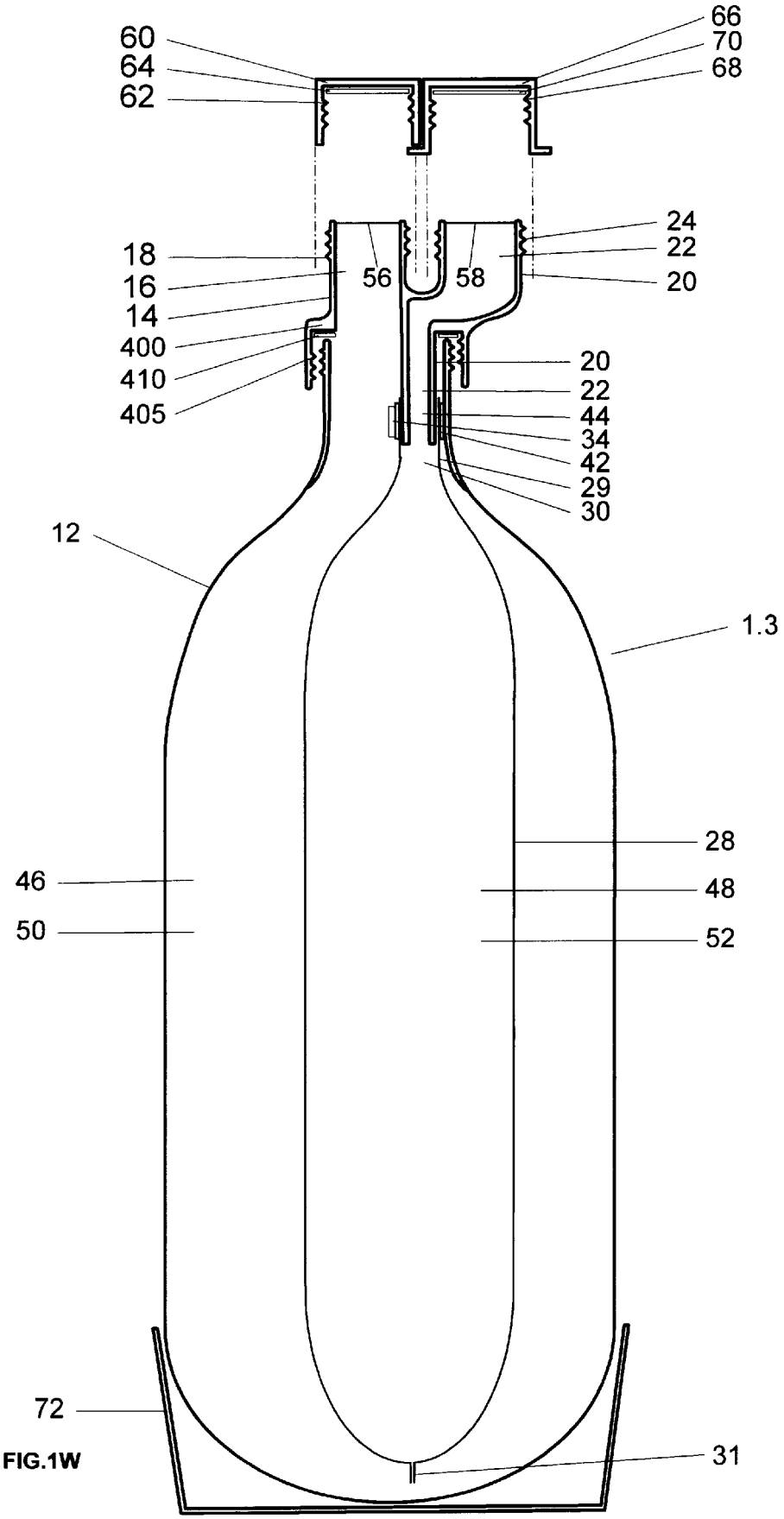
FIG. 1W shows a cross sectional view of the device shown in FIG. 1U, installed in a conventional PET soda bottle, and with caps open.

FIG. 1U shows a perspective view of a volumetric displacement device, an effervescent beverage storage device. Retro-fit Tube Fit Soda Saver 1.4, constructed as an embodiment of the volumetric displacement device, that prevents soda or other carbonated, effervescent beverages from going flat after their container has been opened. FIG. 1V shows the Retro-fit Tube Soda Saver 1.4 installed in a conventional PET soda bottle with a standard air pump and a conventional soda fountain faucet nozzle. FIG. 1W shows a cutaway view of the device shown in FIG. 1V with caps in the off position. Referring to FIG. 1U, FIG. 1V, and FIG. 1W except where noted, the soda saver 1.4 is constructed.

A conventional PET plastic soda bottle, container 12 of one piece is utilized.

A single piece plastic tube to bottle adaptor 400 is formed from plastic. Formed from the plastic is a usable material neck 14, a usable material passageway 16, usable material neck male threads 18, a displacement matter neck 20, a displacement matter neck passageway 22, displacement matter neck male threads 24, tube to bottle adaptor female threads 405, and a displacement matter passageway 44. A tube to adaptor seal 410 of silicon rubber is formed.

A displacement partition 28 is formed as described earlier. It is clamped to the tube to bottle adaptor 400 with a displacement partition clamp 34, and sealed with displacement partition flange adhesive 42.

Device Description of Retro-fit Tube Fit Soda Saver 1.4

The displacement partition of the Retro-fit Tube Fit Soda Save 1.4 is furled and inserted into the conventional PET soda bottle, and the tube to bottle adaptor is screwed onto the bottle. When this is complete, a soda saver is created that is similar in function and operation to the soda savers already discussed.

Ramifications of Retro-fit Tube Fit Soda Saver 1.4

A reusable retro-fit soda saving device has been created which will fit re-usably on a conventional PET soda bottle. The device may be used with pump and faucet nozzle, or simply with water as the displacement matter as described earlier. The displacement partition bladder is disposable or can be used multiple times.

The displacement partition can be made in a removable and disposable fashion such that a new bladder can be attached for each use. Various types of attachments including a threaded adaptor bonded into the partition passageway would accomplish this function.

Effervescent Beverage Storage and Dispensing. A Concentric Soda Saving Device 1.5

Component Description of Reversed Soda Saver 1.5

Figure 1X:
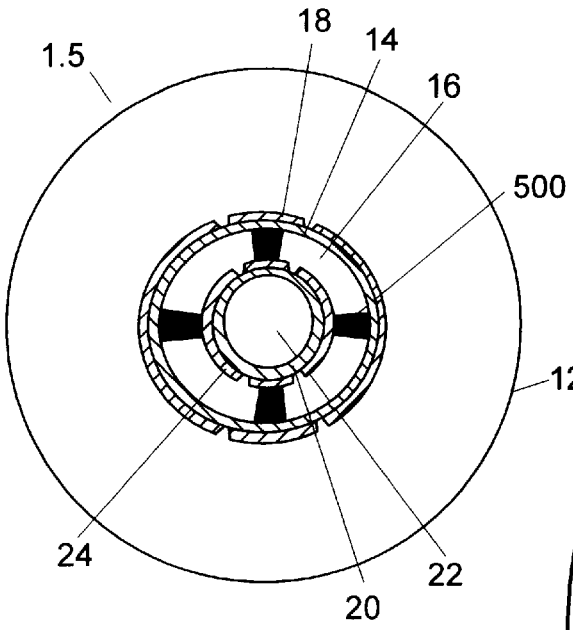
FIG. 1X shows a top view of a Concentric Soda Saver 1.5 with both caps removed.
Figure 1Y:
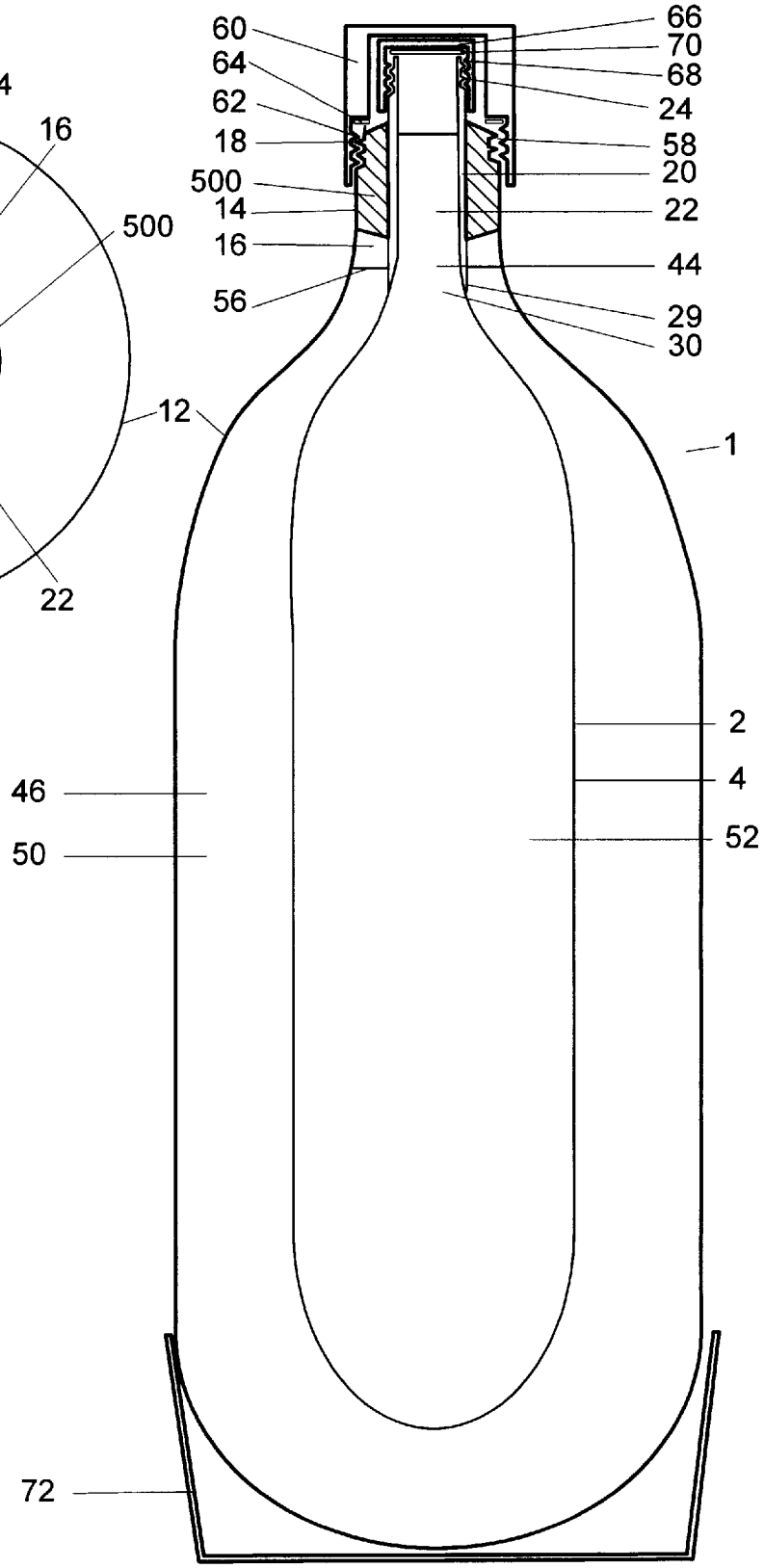
FIG. 1Y shows a cut away view of the device shown in FIG. 1X with both caps installed.

FIG. 1X shows a top view of a volumetric displacement device, an effervescent beverage storage device, Concentric Soda Saver 1.5, constructed as an embodiment of the volumetric displacement device, that prevents soda or other carbonated, effervescent beverages from going flat after their container has been opened. FIG. 1Y shows a cutaway view of the device shown in FIG. 1X. Referring to FIG. 1X, FIG. 1Y, except where noted, the soda saver 1.5 is constructed.

A conventional PET plastic soda bottle, container 12 of one piece is utilized.

A displacement matter chamber 48 is blow molded from a flexible, gas impermeable, PET polymer. A displacement matter neck 20 is formed from plastic in a manner that is similar to conventional PET bottle necks except that there are four displacement matter neck stabilizing members 500 attached, formed from the plastic, as shown. The plastic forms a displacement matter neck passageway 22 within the displacement matter neck 20.

A set of displacement matter neck male threads 24 are formed from the plastic of, and as part of, the displacement matter neck 20.

The plastic that is molded to the description above, is used in a blow mold to form a flexible balloon shaped displacement partition 28.

The displacement matter chamber 48 is inserted into the conventional PET soda bottle 12. The displacement matter neck stabilizing members 500 are impulse fused to the inner wall of the conventional PET soda bottle neck.

A bottle top, displacement matter cap, 66 of one piece, is formed of non-stretching plastic. The displacement matter cap 66 is similar in construction to a conventional plastic soda bottle cap.

A modified conventional bottle top, usable material cap, 60 of one piece, is utilized.

A set of usable material cap female threads 62 are formed from the plastic of, and as part of, the usable material cap 60. The cap is elongated as shown so that it will fit over the displacement matter cap 66 as shown. The threads are formed in such a manner that they mate securely with the usable material neck male threads 18.

The usable material cap 60 is fitted with a usable material cap seal 64, which is a thin disk of silicon rubber. The usable material cap seal 64 serves to tightly seal the usable material passageway 16 when the usable material cap 60 is securely screwed onto the usable material neck 14, as the usable material cap female threads 62 firmly engage the usable material neck male threads 18.

A displacement matter passageway 44, is now defined which is composed of the displacement partition passageway 30, and the displacement matter neck passageway 22.

The displacement partition 28, when installed in the container, divides the container 12 into two chambers. The first chamber is a usable material chamber 46 which will hold usable material, in this case an effervescent beverage, soda 50. The second chamber is a displacement matter chamber 48 which will hold displacement matter, non-compressible matter, water 52.

The usable material chamber 46 is accessed by the usable material passageway 16, which is used to put soda 50 into and to take soda 50 out of the usable material chamber 46. The volume of space contained in the usable material passageway 16, is part of the space defined by the usable material chamber 46.

Device Description of Soda Saver 1.5

The Soda Saver 1.5 is easier to fill at the bottling plant because it is concentric. Soda pours out the usable material passageway 16 and about the closed displacement matter cap 66. The sequence of opening the caps is controlled by the usable material cap 60 fitting over the displacement matter cap 66, making the displacement matter cap impossible to remove first or replace last.

Operation of Soda Saver 1.

Operation of the concentric soda saver is identical to the operation of the cap controlled soda saver 1.1. The cap operation order is firmly controlled by the fact that the usable material cap 60 fits over the displacement matter cap 66.

Variation of Soda Saver 1.

The use of the chambers for displacement matter or usable material may be reversed as before. Valves may be utilized instead of caps.

Air Sensitive Chemicals, Storage and Dispensation. A paint dispensing device that also emits no vapors. Paint Dispenser 2.

Component Description, Paint Dispenser 2.

FIG. 2A shows a perspective view of a volumetric displacement device, chemical dispensing device, air tight chemical dispenser, paint dispenser 2, constructed as an embodiment of the volumetric displacement device, that protects its contents from being exposed to atmospheric air. FIG. 2B shows a cutaway view of the device shown in FIG. 2A. FIG. 2C shows the device shown in FIG. 2A with a cup attached that fills with paint, that is suitable for dipping a brush in. Referring to all of FIG. 2A, FIG. 2B and FIG. 2C, except where noted, a paint dispenser 2 is constructed.

A paint can, container 12, of one piece, is formed from a non-stretching material, metal. The container 12 is similar in construction in both size and material to a conventional metal chemical container except that it has two necks. Construction of the container 12 and its various parts is done in similar fashion to the soda saver 1 already described and depicted in FIG. 1A and FIG. 1B.

A displacement partition 28 and its various parts is constructed in similar fashion to the displacement partition 28 of the soda saver 1 already described and depicted in FIG. 1B.

A displacement partition clamp 34 and its various parts is constructed in similar fashion to the displacement partition 28 of the soda saver 1 already described and depicted in FIG. 1B. The actual shape of the displacement partition clamp 34 is as depicted in FIG. 2B.

An access lid 72 of one piece is formed of metal.

A set of access lid female threads 74 are formed from the metal of, and as part of, the access lid 72. The threads are formed in such a manner that they mate securely with the displacement matter neck male threads 24.

The access lid 72 is fitted with an access lid seal 76, which is a thin disk of silicon rubber. The access lid seal 76 serves to tightly seal the displacement matter passageway 44 when the access lid 72 is securely screwed onto the displacement matter neck 20, as the access lid female threads 74 firmly engage the displacement matter neck male threads 24.

The metal for the access lid 72 forms the access lid passageway 78 within the access lid 72.

A set of access lid clamp female threads 80 are formed within the access lid passageway 78 from the metal of, and as part of, the access lid 72. The threads are formed in such a manner that they mate securely with the displacement partition clamp male threads 40.

An access lid lip 82 is formed from the metal of, and as part of, the access lid 72, at the bottom of the access lid passageway 78.

The displacement partition neck 29 is inserted into the access lid passageway 78 and the displacement partition flange 32 comes to rest on the access lid lip 82, as shown.

The displacement partition clamp 34 is securely screwed onto the access lid passageway 78, as the displacement partition clamp male threads 40 firmly engage the access lid clamp female threads 80.

In so doing, the displacement partition flange 32 is securely clamped between the displacement partition clamp 34 and the access lid lip 82. The joint is permanently sealed with the silicon cement, displacement partition flange adhesive 42, which is applied to both sides of the displacement partition flange 32, and contacts both the access lid lip 82, and the displacement partition clamp 34, creating a secure, air tight junction.

A spout 94 of one piece is formed of metal.

The metal for the spout 94 forms the spout passageway 96 within the spout 94.

A set of spout female threads 98 are formed within the spout passageway 96 from the metal of, and as part of, the spout 94. The threads are formed in such a manner that they mate securely with the usable material neck male threads 18.

A spout lip 100 is formed from the metal of, and as part of, the spout 94, at the top of the spout female threads 98.

The spout 94 is fitted with a spout seal 102, which is a thin disk of silicon rubber. The spout seal 102 serves to tightly seal the spout passageway 96 when the spout 94 is securely screwed onto the usable material neck 14, as the spout female threads 98 firmly engage the usable material neck male threads 18.

A set of spout male threads 106 are formed from the metal of, and as part of, the spout 94.

The delivery end of the spout 94 has a conventional valve 104 installed in it.

A displacement tube 84 of one piece is formed of metal.

The metal for the displacement tube 84 forms the displacement tube passageway 86 within the displacement tube 84.

A set of displacement tube male threads 90 are formed from the metal of, and as a part of, the displacement tube 84. The threads are formed in such a manner that they mate securely with the displacement partition clamp female threads 38.

The displacement tube 84 is fitted with a displacement tube seal 88, which is a thin disk of silicon rubber. The displacement tube seal 88 serves to tightly seal the junction when the displacement tube 84 is securely screwed into the displacement partition clamp 34, as the displacement tube male threads 90 firmly engage the displacement partition clamp female threads 38.

A set of displacement tube male cap male threads 92 are formed from the metal of, and as part of, the displacement tube 84.

A usable material cap 60, a usable material cap seal 64, a displacement matte cap 66, a displacement matter cap seal 68, and their various parts are constructed in similar fashion to the corresponding parts of the soda saver 1 already described and depicted in FIG. 1B. The caps are similar in construction in both size and material to a conventional metal can cap.

The usable material cap 60 is constructed so that it will screw securely onto the spout male threads 106.

The displacement matter cap 66 is designed so that it will screw securely onto the displacement tube cap male threads 96.

A paint brush cup 110 of one piece is formed of metal.

The metal for the paint brush cup 110 forms the cup passageway 112 within the paint brush cup 110.

A set of cup female threads 114 are formed within the cup passageway 112 from the metal of, and as part of, the paint brush cup 110. The threads are formed in such a manner that they mate securely with the displacement partition clamp female threads 38.

The paint brush cup 110 is fitted with a cup seal 116, which is a thin disk of silicon rubber. The cup seal 116 serves to tightly seal the junction when the paint brush cup 110 is securely screwed into the usable material neck 14, as the cup female threads 114 firmly engage the usable material neck male threads 18.

A displacement matter passageway 44, is now defined which is composed of the displacement partition passageway 30, and the displacement partition clamp passageway 36, and the displacement tube passageway 86.

The spout passageway 96 is defined to be a part of the usable material passageway 16.

Assembly Description.

The displacement partition 28 divides, the container 12 into two chambers. The first chamber is a usable material chamber 46 which will hold usable material, in this case an air sensitive chemical, toxic volatile liquid, paint 50. The second chamber is a displacement matter chamber 48 which will hold displacement matter. non-compressible matter, water 52.

chambers, passageways, caps, and container 12 have been constructed which are analogous to their corresponding structures in the soda saver 1. The container 12, and the paint dispenser 2, also work best with a fixed maximum internal volume as describe for the soda saver 1.

FIG. 2B also shows 0.25 liters water 118 that has been measured by a conventional measuring device.

Device Description of Paint Dispenser 2.

A paint dispenser 2 of fixed internal volume has been achieved which has two separate chambers. With the paint dispenser 2 maintained in the full fill state, the sum of the volumes of the chambers will remain roughly constant. In the full fill state the admission of water 52 into the displacement matter chamber 48, will force an equivalent amount of paint 50 from the usable material chamber 46. Since the chambers are tightly sealed from each other, there can be no transfer of matter or material between chambers. In proper operation, no atmosphere can enter the container though the conventional valve 104. The usable material chamber 46 is therefore isolated from the environment and therefore, contamination of the paint 50 by the atmosphere is greatly reduced or eliminated, depending on the efficiency of the valve and its usage.

The displacement tube 84 provides a means to introduce non-compressible matter to the displacement matter chamber 48 under pressure. This pressure will transfer through the mobile displacement partition 38, to the paint 50 stored in the usable material chamber 46. If the usable material cap 64 is removed and the conventional valve 104 is opened, the displacement partition 28 will move as paint 50 is driven from the paint dispenser 2, as the paint 50 goes through and out the attached spout 94. During this dispensing operation, the unused portion of the paint remains isolated from, and not contaminated by, the environment.

The addition of a quantity of 0.25 liters water 118, will cause the dispensation of an equal amount of paint 50, that is, 0.25 liters. Alternatively, with the spout 94 removed, and the paint brush cup 110 screwed securely on, paint exiting the usable material chamber will be forced into the paint brush cup 110 via the cup passageway 112. Exercising the latter option, water 50 removed from the gravity tube will allow the paint 50 to flow back into the container from the paint brush cup 110, creating a non messy way to remove and replace paint 50 from the paint dispenser 2.

Ramifications of Paint Dispenser 2.

The paint dispenser 2 provides means to prevent the stored paint from being exposed to air. This exposure is prevented both during dispensation, and for extended periods of storage. This technology greatly improves the storage life for the unused portion of the paint, once the contents have been partially used. The unused portion is prevented from curing prematurely, hardening, drying out, off gassing, absorbing atmospheric water or air, and skinning over. The paint is not exposed to oxygen, air pollutants, or atmospheric moisture.

The paint dispenser 2 provides for an easy, relatively mess free means of dispensation. A messy lid does not have to be removed for each dispensation of paint as a conventional can requires. Neither does the paint fill the lid attachment grove and run down the side of the can when the paint is poured out, as a conventional can does. The paint can also be delivered directly to an external chamber, paint brush cup 110 where paint brushes can dip into the paint and the unused paint can be caused to return to the paint dispenser 2 from the paint brush cup 110. Another benefit of the paint dispenser 2 is that metered output can be achieved, by metering the water 50 poured into the displacement tube 84.

The device shown in FIG. 2A and FIG. 2B can readily be used as a vapor free vessel and dispenser for volatile liquids. Removing the displacement tube 84 and the displacement matter cap 66, leaves a vapor-less volatile liquid dispenser, that when tipped up, will pour its contents out the spout. Air will fill the displacement partition 28. There will be no contact of the usable material in the container 12 with the atmosphere and the usable material will not evaporate to the atmosphere. Modifications of the size and shape of the container 12 make vessels that look like existing vessels, and are suitable, for the storage of gasoline, liquid chemicals, pesticides, flammable liquids, solvents, petroleum derivatives and other liquids with undesirable vapors. These vessels will be internally vapor free, and will be less prone to burning by fire or explosion. They will pollute the environment less, and will produce less vapors for humans to breath in confined areas. There will be less loss of usable material to evaporation.

It can be expected that the material correctly stored in the displacement matter chamber 48 will slosh and froth up less. The container will have increased stability being in the full fill state in most conventional applications. Containers with this technology will not necessarily need air vents that have to be opened before material can be removed from the container. The displacement matter chamber serves that function. Usable material in the usable material chamber 46 can be chilled with ice placed in the displacement matter chamber 48 without the ice contaminating the usable material.

Variation of Paint Dispenser 2.

Many chemicals are atmosphere sensitive. Fine wines, glues, varnish, shellac, brake fluid, coatings, casting materials, pharmaceutical preparations, are just some. Dispensing of many fine chemicals, in ultra pure environments is now possible with the volumetric displacement device. A large variety of liquid materials have shelf lives that are reduced once the container is opened. These materials in general would be protected and would benefit from having the same shelf life in an opened container, as they did in the unopened container.

In all, their would be less fire risk, less loss of material though evaporation, less environmental damage, and less toxic exposure to humans from volatile liquids, flammable solvents, organic liquids, toxic chemicals, pesticides, petroleum derivatives, gasoline, acetone, ketones, naphtha, toluene, ethylene, methanol, ethanol, ether, lacquer thinner, alcohol, kerosine and many more materials.

The ability of the device to deliver liquids in a neat manner could be applied to many products. Liquid soaps, detergents, cleaners, oils both cooking and machinery, and industrial chemicals are just some of the examples of material that often is associated with a messy container. Gravity driven water will serve as a pump for many materials.

In general, containers of most shapes and sizes could be fit with volumetric displacement devices. Containers are generally made from metal, ceramic, glass, and plastic. Any of these materials would be useful in making the device described. Shapes of containers that now exist can be emulated, or new shapes derived.

A common gas can, fuel transporter, gasoline container suitable for transporting gasoline, or any other volatile material container, is an ideal application for the volumetric displacement device. Installed in a gasoline container, the device provides a container that contains no gasoline fumes. This is a safer container in that it is less flammable and in that it emits less harmful to human gasoline vapors. Used on boats, in automobiles, farm vehicles and for general transport of fuel, it provides a safer container. Filled with air, the displacement chamber will inhibit sloshing, provide vapor protection, and reduce evaporative loses. Filled with water, the displacement partition provides the same benefits and completely prevents sloshing as well.

Installed in large storage tanks, in transport tankers, mounted on trucks, in aircraft, on boats, in refueling equipment, and virtually any other fuel or volatile liquid storage device, this device provides safety, health, conservation and environmental benefits.

Many materials have offensive odors. The device would be suitable for reducing odors emanating from containers. Typically when the consumer opens a container, the air in the container escapes. That air has been collecting vapors that are unpleasant to smell. When the consumer tips up the bottle and pours out the material, out comes a bunch of bad smelling air. With the volumetric displacement devices installed, there is no container air to emit. This is suitable for chlorine bleaches, ammonia, vinegar, epoxy glues, sewage and septic tanks, sewage trucks, fertilizers, and other foul smelling chemicals.

Water or refuse disposal systems, septic tanks, sewage systems, water treatment holding ponds, toilet and septic holding tanks on vehicles, aircraft, boats, and recreational vehicles and portable toilets would have less smell if kept free of air with a volumetric displacement device. They would slosh less as well. Such holding tanks would operate a little differently as they do not deliver usable material but accept usable material. (Although in this utilization the waste might be described as "unusable material", by definition in this application it is still referred to as "usable material". See term section.) In action the waste disposal volumetric displacement device would expel displacement matter as it is filled with waste.

A variation to the paint dispenser 2 is the addition of a spigot and valve combination, tap and valve combination, cock, conventional petcock installed in the container wall of the usable material chamber. Most convenient, although not mandatory, would be to install the conventional petcock near the bottom of the sidewall of the container 12. This would allow most of the usable material in the usable material chamber 46 to drain without tipping the paint device 2. Material could flow from the conventional petcock when it was opened, with displacement matter flowing into the displacement matter chamber 48. Usable material can flow out propelled by the force of gravity while material in the container remains isolated from the environment.

The addition of the conventional petcock allows for the elimination of the usable material neck and passageway. Usable material could be loaded at the factory through the conventional petcock, or through the displacement matter neck passageway before the displacement partition clamp and the displacement partition are installed, or through the access passageway.

Another achievement with this device is the elimination of the need to vent the container for emptying it, or to open and close that vent, as is now done on a conventional container. Many containers have vents to allow air to enter the container as it is being emptied. Often, the vents are capped to prevent evaporation or contamination of the usable material in the container. Usable material is either poured out the container opening, as in a gas can, or out a tube or petcock, cock at the bottom of the container, as in a large coffee dispenser. With the displacement matter chamber installed, the container needs no other vent.

This means that a container can be poured from directly or tapped at the bottom without the need to open a vent.

Although the container has an opening for the displacement matter, this opening need not be shut to prevent evaporation or contamination of the usable material. In many applications, the cap to the displacement matter chamber may be left off with no ill effects, and results in an easier to use container and overall labor savings.

A variation of the paint dispenser 2 is to fit a plug type cap directly to the displacmenet partition clamp 34, so that the displacement tub 84 can be stored separately to save space. Use of the displacement matter cap 66 at the top of the displacement tube 84 is optional. Alternatively, modification of the junction of the displacement tube 84 and the displacement partition clamp 34, would allow the displacement matter cap 66 to fit both on the top of the displacement tube 84, and on the displacement partition clamp 34, so that only one cap need be made, to be used as the consumer chooses.

The external chamber could be shaped as a pan, to use as a paint roller filler. Screens might be employed at various points such as at the spout 50, or in the cup passageway 112. These would provide the user lump free, screened paint.

Simplified Paint Device Variation, Simplified Paint Dispenser 2*d*.

Component Description of Simplified Paint Dispenser 2*d*.

FIG. 2D shows a cutaway view of a volumetric displacement device, modified paint dispenser, simplified paint dispenser 2*d*, constructed as an embodiment of the volumetric displacement device, that accomplishes similar objectives as paint dispenser 2, with simpler apparatus. Referring to FIG. 2D except where noted, a simplified paint dispenser 2*d* is constructed.

A paint container, container 12, of one piece, is formed from a non-stretching material, plastic. The container 12 is similar in construction in both size and material to a conventional plastic household bleach or automotive antifreeze container except that it has two extended necks. Construction of the simplified paint dispenser 2*d* and its various parts is done in similar fashion to the soda saver 1 already described and depicted in FIG. 1A and FIG. 1B except as noted. The container 12 with integral spout 94 and displacement tube 84 is formed as one piece. Caps are constructed in analogous fashion.

A displacement partition 28 and its various parts are constructed in similar fashion to the displacement partition 28 of the soda saver 1 already described and depicted in FIG. 1B, except that it has no displacement partition flange 32.

The displacement partition neck 29 is bonded with adhesive 42 directly to the inner wall of the displacement matter neck 20, within the displacement matter neck passageway 22, eliminating the need for a displacement partition clamp 34.

With a displacement tube 84 that stands considerably higher than the spout 94, the simplified paint dispenser 2*d* works similarly to the paint dispenser 2 except that there is no access lid 72 or conventional valve 104 to operate.

Device Description of Simplified Paint Dispenser 2*d*.

Without a conventional valve installed in the usable material passageway 16, the simplified paint dispenser 2*d* shown does not completely seal the paint 50 from the environment. However, as long as the usable material fill level 56 is kept in the narrow part of the usable material neck 14, the surface area of the material exposed to the environment is greatly reduced, providing greatly improved isolation of the paint 50 from the environment over existing conventional storage devices.

As the diameter of the usable material passageway 16 becomes smaller, the ability of the simplified paint dispenser 2*d* to isolate the paint 50 from the environment becomes greater and greater.

Ramification and Variation of Simplified Paint Dispenser 2*d*.

A flexible spout 94 would provide easier operation in some circumstances. A flexible spout 94 could be achieved with corrugation in the spout 94 material. Manufacturing the usable material neck 14 to the appropriate angle eliminates the need for a flexible spout 94. A flexible displacement matter neck 20 or displacement tube 84 would add convenience.

A petcock, as describe in the paint dispenser 2, could be fit to the simplified paint dispenser 2*d* for more convenient utilization. The usable material neck, passageway and cap can be eliminated. The manufacturer would fill the container through the petcock or through the displacement matter neck passageway before the displacement partition is installed.

Paint Dispenser Pump 2*e* Device Variation.

Component Description of Paint Dispenser Pump 2*e*.

FIG. 2E shows a cutaway view of a volumetric displacement device, modified simplified paint dispenser, paint dispenser pump 2*e*, constructed as an embodiment of the volumetric displacement device, that can readily be used as a simple pump. Referring to FIG. 2E except where noted, paint dispenser pump 2*e* is constructed.

Construction of the paint dispenser pump 2*e* and its various parts is done in similar fashion to the simplified paint dispenser 2*d* already described and depicted in FIG. 2D except as noted.

Instead of a displacement matter cap 66, as depicted in FIG. 2D the displacement matter neck 20 is fitted with a conventional water tap fitting 66*e*, which may be connected to a central water supply, conventional pressurized tap water system 67 such as those found in a typical residential, industrial or business building.

Instead of a usable material cap 60, as depicted in FIG. 2D the usable material neck 14 is fitted with a conventional faucet 60*e*, such as those found in a typical residential, industrial or business building.

The paint device pump 2*e* can be used in other environments. It would work under water, in space, or in baths of other materials. In each case, there would be no contact of the usable material in the container with the environment. Chambers attached to the pump at the faucet or other installed valve could be filled with usable material that is uncontaminated.

Device Description of Paint Dispenser Pump 2*e*.

The paint dispenser pump 2*e* is connected to the conventional pressurized tap water system 67. When the conventional faucet 60*e*, attached to the paint dispenser pump 2*e* is opened, usable material contained within the paint dispenser pump 2*e* will be dispensed. In use, it will seem to the user, that they can draw liquids contained in containers, in the same fashion that they can draw water from an ordinary water faucet.

Ramifications of Paint Dispenser Pump 2*e*.

The paint dispenser pump 2*e* and its variations, provides most of the benefits associated with the of the paint dispenser 2. In particular, it provides for vapor free storage of volatile liquids and it prevents the environment, atmosphere, air from contaminating the partially consumed paint 50 stored in the paint dispenser pump 2*e*.

The paint dispenser pump 2*e* allows usable material to be delivered under pressure. The conventional faucet 60*e* permits the flow of usable material to be controlled. An easy inexpensive means has been created to pump multiple types of liquids without contaminating them, without the need for different types of pumps, and without the need to dirty a pump. In effect, the conventional pressurized tap water system 67 serves as a central power source that allows the pump dispenser pump 2*e* to serve as an inexpensive pump.

Using multiple paint dispenser pumps 2*e*, an entire array of pumped liquids can inexpensively be set up in agricultural, industrial and residential settings, all powered by the conventional pressurized tap water system 67.

The use of a displacement partition clamp, as was done with the soda saver 1 and depicted in FIG 1B, would make a more secure displacement partition attachment and would allow for higher pumping pressures.

Operation Paint Dispenser 2.

The container 12 is filled with paint 50 by the paint manufacturer, paint packaging company in the following manner. The displacement tube 84 is removed from the access lid 72. The spout 50 is removed from the container 12. With the displacement matter passageway 44 clear, air will be expelled from the displacement matter chamber 48 via the displacement matter passageway 44 as paint 50 is poured into the usable material passageway 16 by the paint packing company. When the container 12 is at an appropriate fullness, the displacement tube 84, the displacement matter cap 66, the spout 50, and the usable material cap 60, are screwed onto there respective mounting locations to seal the paint dispenser 2 for delivery to the consumer.

Alternatively, the access lid 72 and attached assemblies may be removed from the container 12. An appropriate amount of usable material, paint 50 is poured into the container 12 until it is approximately filled. The spout 50 and the usable material cap 60 are attached to the paint dispenser 2 in their conventional mounting locations. The displacement partition 28 is collapsed and devoid of most air. The displacement tube 84 is removed from the access lid 72. With the displacement matter passageway 44 now open, the access lid 72, with attached displacement partition 28 is screwed back onto the container 12, as the displacement partition is inserted into the container. Any residual air in the displacement partition 28 will be expelled. The displacement tube 84 and displacement matter cap 66 are screwed to their appropriate attachment points to tightly seal the paint dispenser 2.

In use, the consumer has several options. Removing the usable material cap 60 initiates the process by which paint 50 is dispensed from the paint dispenser 2. With the spout 50 attached, the usable material cap 60 off, the displacement tube 84 attached, and the displacement cap 66 off, water 52 poured into the displacement tube 84 will go into the displacement partition 28, and paint 50 will be dispensed from the spout 50. If the consumer pours 0.25 liters water 52 into the displacement tube, a like quantity of paint 50. 0.25 liters will be dispensed from the paint dispenser 2, when the conventional valve 104 is opened. If the consumer detaches the spout 94 and attaches the paint brush cup 110, the paint 50 will be forced into the paint brush cup 110 as water 52 is added to the displacement matter chamber 48. Removing the water 52 from the displacement tube 84 will allow unused paint 50 to flow back into the paint dispenser 2.

The consumer has the option of not using the water 52 in the displacement matter chamber 48. By tipping the paint dispenser 2 enough to prevent air from entering the conventional valve 104, or even turning it upside down, opening the displacement matter cap 66 and the usable material cap 60, and the conventional valve will allow paint 50 to pour out the spout 50. Air will enter the displacement partition 28, and serves as the displacement matter. Again, a non-messy, non contaminating means has been achieved for dispensing paint 50. If the matter is a volatile liquid, no vapor will be emitted from the container 12. In this use, the consumer may dispense with the displacement tube 84 and displacement matter cap 66 completely, not using them at all.

The user has the option of opening the access lid 72 for other purposes such as stirring or adding colorant, pigment to the paint 50. If the displacement matter chamber 48 is too full of water to allow its passage through the displacement matter neck passageway 22, the user will first pour or pump some of the water out of the displacement matter chamber 48.

Simplified Paint Device Variation. Reversed Simplified Paint Dispenser Pump 2*e*, with Usable Material and Displacement Matter Chambers Reversed.

Description of Reversed Simplified Paint Dispenser Pump 2*e*.

FIG. 2F shows a cutaway view of a volumetric displacement device, modified paint dispenser, reversed simplified paint dispenser pump 2*e*, constructed as an embodiment of the volumetric displacement device.

The construction of the Reversed Simplified Paint Pump 2*e*, is similar to the the simplified paint dispenser pump 2*e* depicted in FIG 2D. In fact it is identical except that displacement partition 28 is bonded to the inside of the usable material neck 14. Other than this modification, it is the same device as depicted in FIG. 2E.

By operating the Reversed Simplified Paint Pump 2*e* in exactly the same fashion as the Simplified Paint Pump 2*e* of FIG. 2E, the paint ends up inside the displacement partition bladder instead of outside it, and the displacement matter water ends up outside the bladder and within the container.

Material Management: Immediate and Complete Delivery, Application Ease, and Upward Delivery. An Improved Toothpaste Tube 3.

Component description of Improved Toothpaste Tube 3.

Figure 3B:
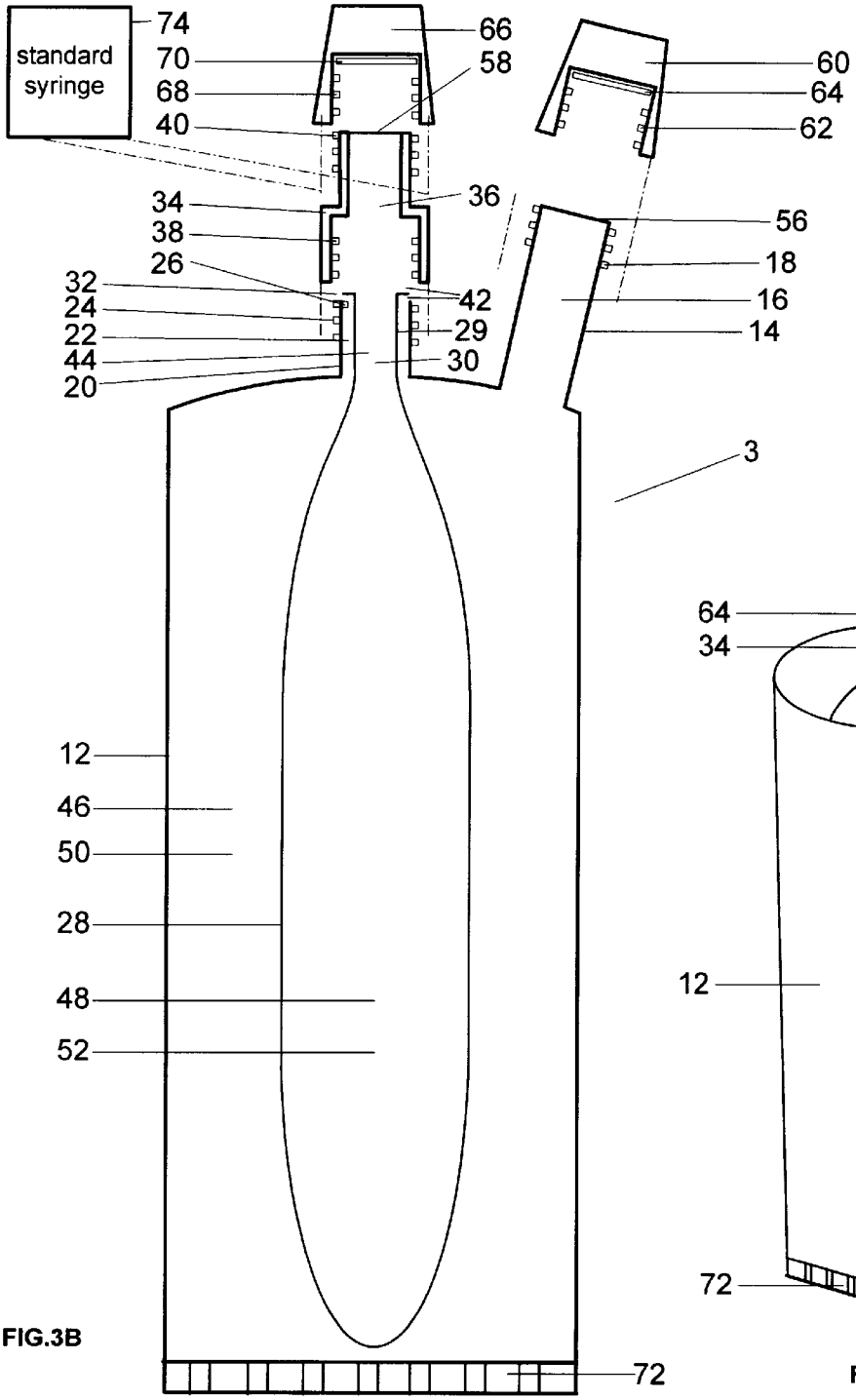
FIG. 3B shows a cross sectional view of the device show in FIG. 3A.
Figure 3A:
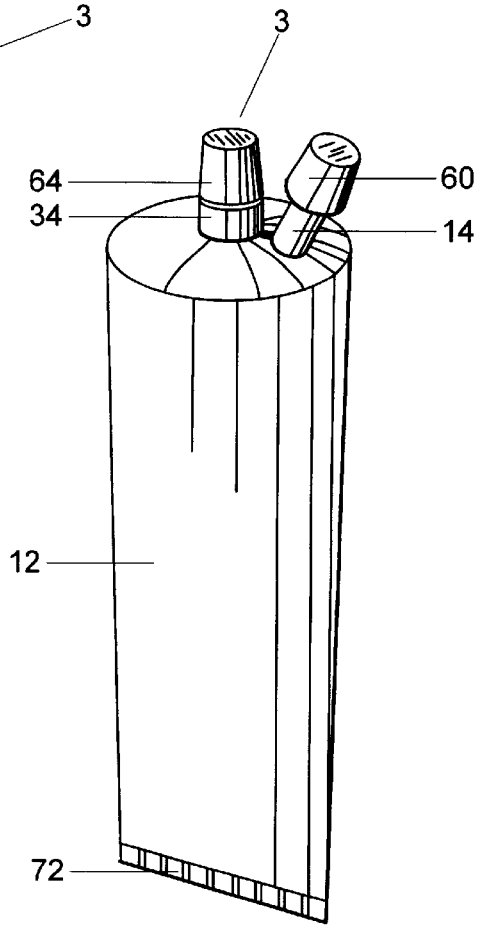
FIG. 3A shows a device for the storage and dispensation of toothpaste, improved toothpaste tube 3, that always squeezes out paste as if the device were full.
Figure 3D:
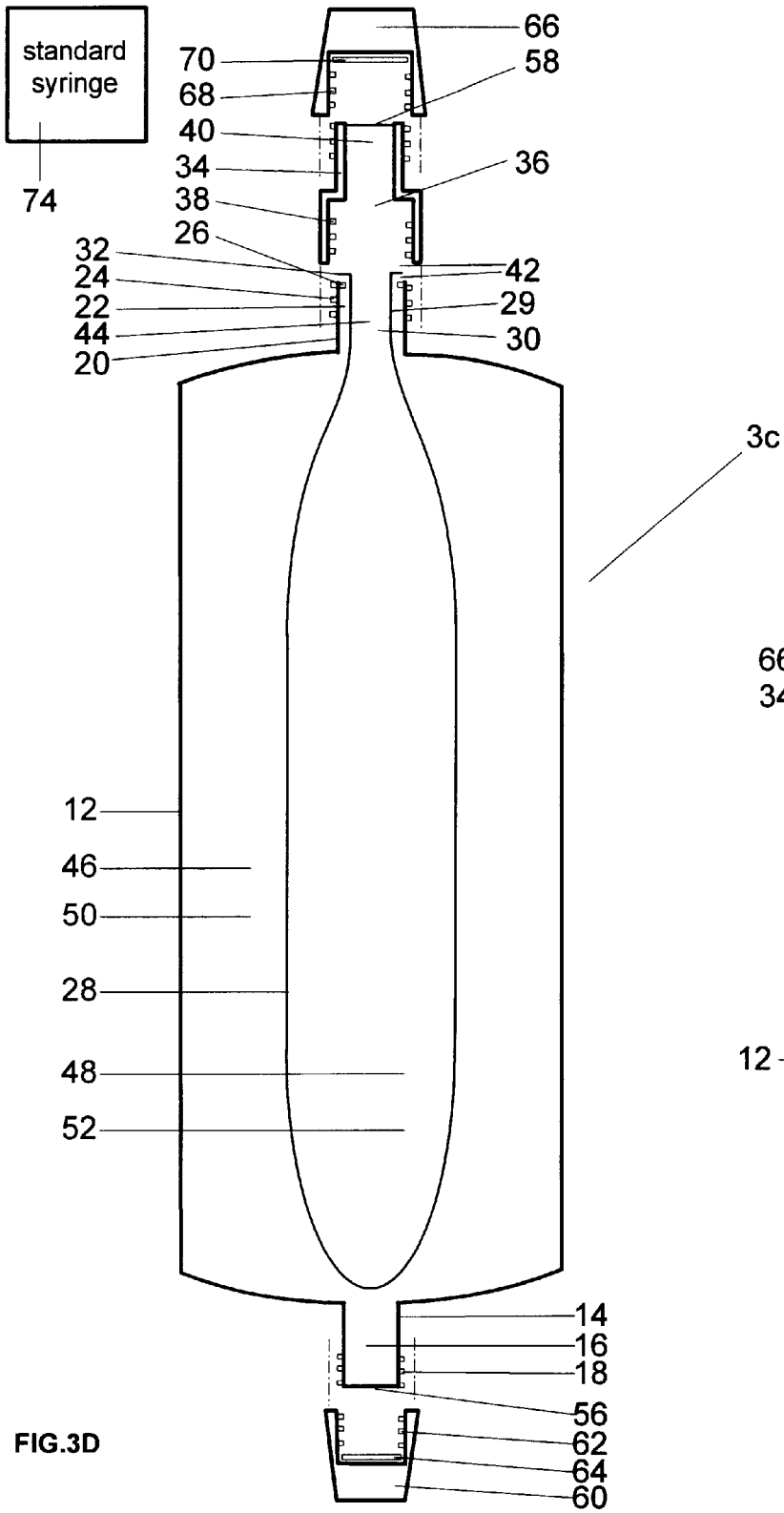
FIG. 3D shows a cross sectional view of the device shown in FIG. 3C.
Figure 3C:
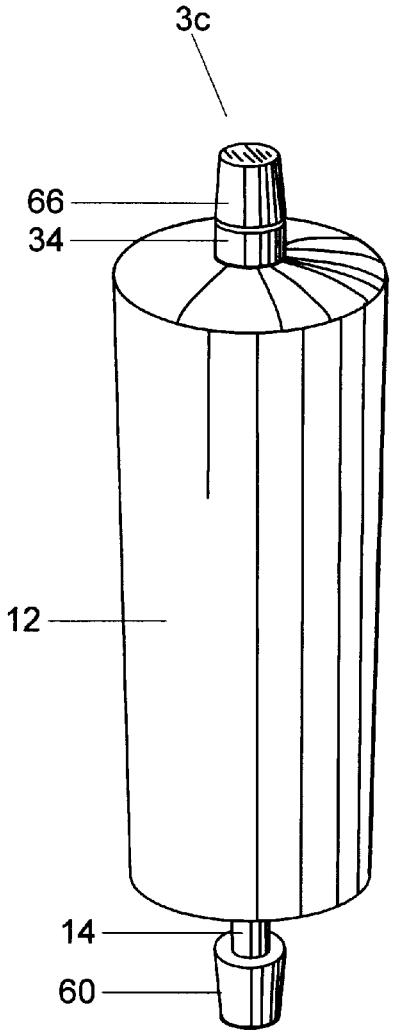
FIG. 3C shows a device for the storage and dispensation of toothpaste, more convenient improved toothpaste tube 3*c*, that always squeezes out paste as if device were full.

FIG. 3A shows a perspective view of a volumetric displacement device, volumetric dispensing and preservation device, improved squeeze tube, improved squeeze bottle, improved toothpaste device 3, constructed as an embodiment of the volumetric displacement device, that delivers contents as if the squeeze tube were always full. FIG. 3B shows a cutaway view of the device shown in FIG. 3A. FIG. 3C shows a perspective view of a more convenient improved toothpaste device 3*c*, constructed as an embodiment of the volumetric displacement device, that delivers contents as if the tuber were always full. FIG. 3D shows a cutaway view of the device shown in FIG. 3C. Referring to all of FIGS. 3A, 3B, 3C, and 3D an improved toothpaste device 3 and a more convenient improved toothpaste device 3*c* are constructed.

Generally, the device is constructed in similar fashion to the soda saver 1 depicted in FIGS. 1A and 1B. Parts shown are similar in construction to the parts described for the soda saver 1 except as noted.

A container 12 is constructed of a flexible material. Toothpaste 50 is the usable material. Referring to the device depicted in FIGS. 1A and 1B, the container 12 is sealed at the bottom in conventional fashion creating a tube bottom seal 72. A conventional syringe 74 is employed to inject water 52 under force into the displacement matter chamber 48.

Device Description of Improved Toothpaste Tube 3.

As conventional toothpaste tubes are emptied, they be more and more unmanageable. They are hard to squeeze material out of and they look wrinkled. The constructed improved toothpaste tube 3 in operation and feel, will always seem full, and if correctly used will squeeze out toothpaste in an easy manner, over the entire life of the product. This effect is achieved by filling the displacement matter chamber 48 of the toothpaste device with enough water 52 to fill the container 12 again, bring it to the full fill state. One of the benefits of a full squeeze tube is that it delivers usable material easily when squeezed. The improved toothpaste tube 3 can easily be kept full. The displacement partition 28, in similar fashion to devices already described, prevents the water 52 from contaminating the toothpaste 50.

Ramifications of Improved Toothpaste Tube 3.

The improved toothpaste device 3 again has the ability to isolate it's contents from the environment. Squeeze bottles and stiff tubes that return to position, can have contents that gain all the benefits previously described for material that is isolated. The usable material will enjoy an extended life, and the environment will have reduced exposure to the contents. These squeeze tubes and bottles will work in other environments, baths, and space as previously described for the paint dispenser 2.

Material stored in sealed squeeze bottle and tubes in the full fill state, with non-compressible displacement matter will not off gas, in the same manner that has been described for the soda saver 1, as it prevents off gassing of effervescent beverages.

The improved toothpaste tube 3 will make it far easier to dispense other types of usable material when the tube is partially empty. When the usable material is almost gone, the device will deliver usable material as easily as when the tube was full. Delicate application will be easier. Material can be dispensed from volumetric displacement squeeze tubes and bottles in an upward direction. The user will always think the container is full and will experience the psychological position of using a full squeeze container rather than wrestling with a half empty one. The user will not have to shake the material in a squeeze bottle to the nozzle end of the bottle before use. The volumetric displacement squeeze tube and bottle in a full fill state will deliver material immediately at first squeeze, without having to shake, role up, or manhandle the container.

Some material is distributed in fairly stiff tubes available on the market, where you squeeze the material out and as a tube returns to its shape, air is sucked into the tube. In some applications, they can be very difficult and time consuming to deal with. The last bit in the tube seems near impossible to remove. But not so difficult with volumetric displacement technology which can make difficult materials easier to apply.

Variation of Improved Toothpaste Tube 3.

Squeeze bottles, functionally equivalent to squeeze tubes, in similar fashion, could also employ this technology. Many materials are shipped in plastic or metal containers that turn upside down and squeeze to dispense material. With volumetric displacement technology, no longer would you have to take the mustard bottle or the glue bottle and shake it upside down until the material got to the opening. Volumetric displacement would make the bottle seem full on use, and the first squeeze would immediately see material come from the container. These squeeze bottle would also be able to dispense material in an upward direction in much easier fashion than a conventional squeeze bottle.

A full squeeze bottle is often more stable then a partially emptied one and has a different feel to it when picked up. The devices as described often will be less easily tipped, and will have a full weight to them.

A more convenient improved toothpaste tube 3*c* can be made by putting the displacement matter neck 20 and the usable material neck 14 at opposite ends of the tube, and is depicted in FIGS. 3C and 3D. With this arrangement, the necks and caps don't interfere with each other, especially on smaller tubes. The displacement partition can be more easily designed to prevent interference with a usable material opening. Such interference could cause the opening to become blocked. By making the displacement partition just shot enough, or with a shape such that it can't interfere, blockage is prevented. This arrangement also will make the tube easier to squeeze at the end of its product life.

Most liquid material could be put into a squeezed bottle of one sort or another. Thick liquid foods, ketchup, mustard, soaps, cosmetics, suntan lotion, body lotions, shampoo, car wax are on an endless list of possible candidates. The improved toothpaste tube can be utilized with the usable material placed in what is presented as the displacement matter chamber and with the displacement matter in what is presented as the usable material chamber. As such, the device will work as described.

Operation of Improved Toothpaste Tube 3.

The improved toothpaste tube 3 is filled in similar fashion to the devices already describe. With both caps off, the toothpaste packaging company would force toothpaste 50 into the usable material chamber 46 via the usable material passageway 16. With the displacement matter chamber 48 collapsed and devoid of air, and the usable material chamber 46 full, both caps are secured on the improved toothpaste tube 3 and it is shipped to the consumer.

Generally, in use, the consumer operates the improved toothpaste tube 3 in similar fashion to any other squeeze tube. The consumer removes the usable material cap 60 and squeezes out toothpaste 50. The toothpaste 50 comes out because pressure applied to the non-stretching material of the container 12 can only be relieved by the toothpaste 52 coming out the usable material passageway 16. After a point, pressure can not be applied easily to the container as it deforms too much.

At this time, the consumer ensures that the usable material cap 60 is firmly secured to the container 12. The consumer then removes the displacement matter cap 66. The conventional syringe 74 with female threads that match the displacement matter neck threads 24 is filled with water 52 and screwed to the displacement matter neck 20. Water is injected into the displacement matter chamber 48 via the displacement matter passageway 44. The improved toothpaste device 3 will fill up. The conventional syringe 74 is detached and the displacement matter cap 66 reinstalled securely. With the usable material cap 60 removed again, finger squeeze pressure on the container 12 will translate directly into toothpaste 50 coming from the usable material passgeway 16. In short, with the improved toothpaste device 3, the user's squeeze does not compress the flexible container 12, but rather the installed and full non-compressible displacement matter chamber 48 fills the container 12 and causes the "squeeze" to directly force toothpaste 50 out of the usable material passageway 16.

Storage or Granular Solids. A dry Cereal, Cracker, Chip, Cereal Saver 4.

Component Description of Cereal Saver 4.

Figure 4A:
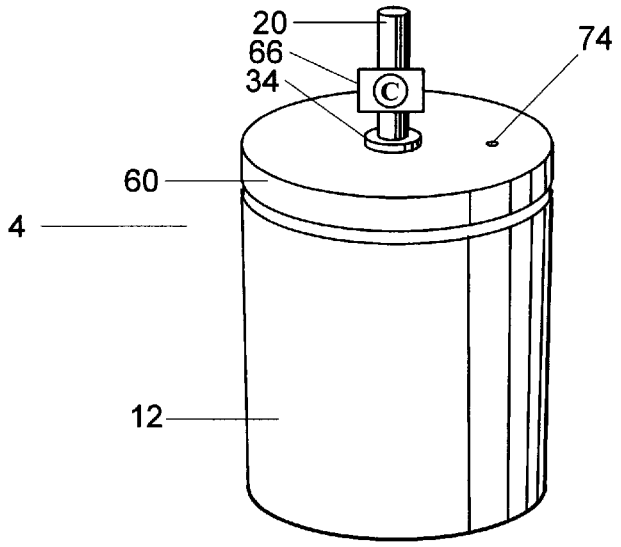
FIG. 4A shows a device for the prolonged storage of dry foodstuffs, cereal saver 4, that would absorb atmospheric water if given the chance.
Figure 4B:
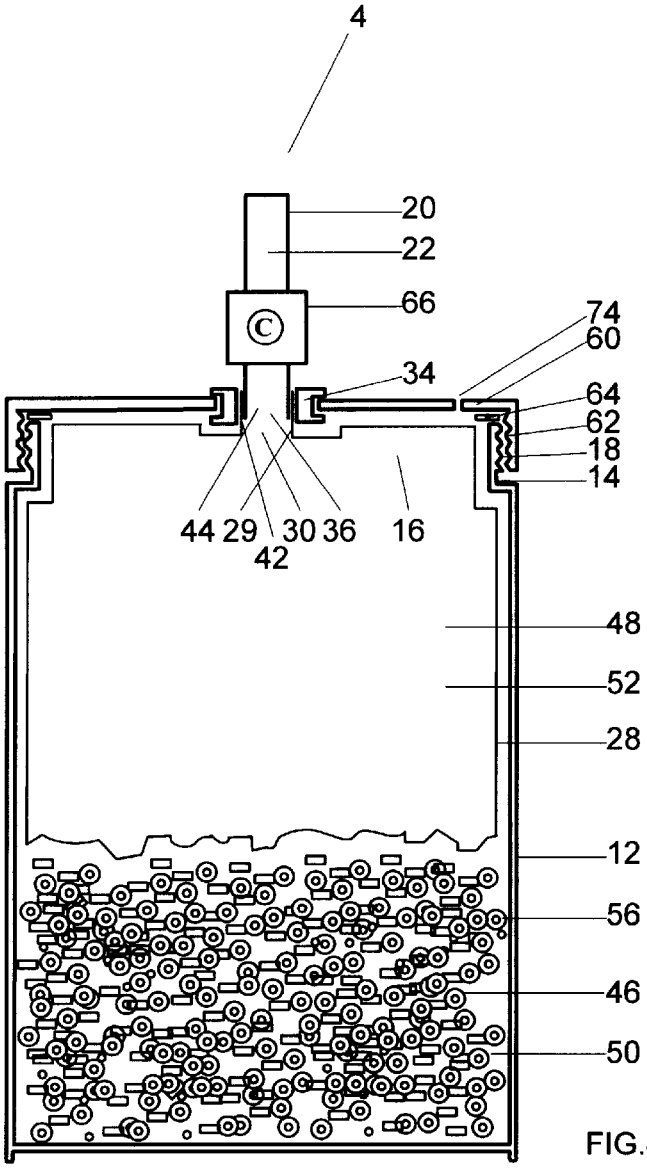
FIG. 4B shows a cross sectional view of the device shown in FIG. 4A.

FIG. 4A shows a perspective view of a volumetric displacement device, cereal saver 4 constructed as an embodiment of the volumetric displacement device, whose contents are partially protected from atmospheric water vapor, which would otherwise tend to make the contents get soggy over a period of time. FIG. 4B shows a cutaway view of the device shown in FIG. 4A. Referring to FIGS. 4A and 4B except as noted, the cereal saver 4 is constructed.

A container 12 of one piece, is formed of non-stretching plastic. The container 12 is similar in construction to a conventional plastic storage container. A usable material neck 14 is formed as part of the container so that the plastic forms a usable material passageway 16. The usable material neck 14 has a set of usable material neck male threads 18.

A usable material cap 60 is formed from plastic, with attached usable material cap female threads 62, which mate with usable material neck male threads 18. The usable material cap is fitted with a usable material cap seal 64, which is a thin disk of silicon rubber which serves to tightly seal the container when the usable material cap 60 is screwed securely onto the usable material neck male threads 18. The plastic of the usable material cap 60 forms a displacement partition passageway 30. The plastic of the usable material cap 60 forms a vent 74.

A displacement membrane, displacement partition 28, is constructed of an elastic, rubber like material. The displacement partition 28 is constructed as an air tight bag, in a shape that is roughly the same size and shape as the interior of the container 11. The material of the displacement partition 28, forms a displacement partition neck 29, and a displacement matter passageway 44.

A displacement matter neck 20 is formed from flexible plastic. The plastic of the displacement matter neck 20 forms a displacement matter neck passageway 22. A grommet 34 is constructed of a rubber like material. The grommet 34 is designed to fit inside the displacement partition passageway 22. The material of the grommet 34 forms a grommet passageway 36. The diameter of the grommet passageway 36 is such that it will tightly fit the displacement partition neck 29 with the displacement matter neck 20 inserted into displacement partition passageway 30. The displacement partition neck 29 is inserted into the grommet passage way 36, and the displacement matter neck 20 is inserted into the displacement partition passagewy 30 as shown. The junctions of the grommet passageway 36, the displacement partition neck 29, and the displacement matter neck 20 are sealed with displacement partition adhesive 42.

A displacement matter passageway 44, is now defined which is composed of the displacement matter neck passageway 22, and the displacement partition passageway 30.

With the addition of the displacement partition 28, the container 11 is divided into two regions. A usable material chamber 46 is created which will hold usable material, in this case a dry cereal 50. Also created is a displacement matter chamber 48 which sill hold the displacement matter 52, which in this case is air 52. FIG. 1B depicts the displacement partition 28 that is expanded to fill the void above the dry cereal 50.

A conventional clamp 66 is employed to squeeze shut the displacement matter neck 20.

Device Description of Cereal Saver 4.

The Devise, as shown in FIGS. 4A and 4B, inhibits a portion of dried cereal 50 from absorbing atmospheric water. Atmospheric air that might contain moisture is displaced from the region of the container 12 above the cry cereal 50, by the displacement partition filled with air, in this case, blown in by a human. The atmospheric air was expelled via the vent 74 when the displacement partition was inflated. The elastic displacement partition, upon inflation, conforms to the interior shape and size of the container 12 sections that are not being used for storage, the top surface of the dry cereal, and it also seals the vent 74. This minimizes the amount of moist atmospheric air in the container 12, reduces the amount of moisture available to be absorbed by the dry cereal, and it prevents the dried cereal from becoming soggy over time.

Ramifications of Cereal Saver 4.

The cereal saver 4 will reduce the exposure of many organic materials to water vapor in the atmosphere that would otherwise make the dry cereal or other usable material become soggy. In larger applications such as storage silo's, the same technology will reduce dusty environments. By displacing the air above powders, grains, and other dusty material, there is no air space for the dust to enter. If the material off gasses, there will not be as much space for a large supply of gas to collect. If the dust or gas is a fire hazard, the hazard is reduced. When the large container is opened, less dust or gas is released to the local environment at the time of opening, which in some cases would be a health benefit. This application has use in fire prevention as dusty, combustible air mixtures in closed environments can be reduced. Small containers of powders and powdered chemicals can be protected.

Drying agents, water absorbing hygroscpoic materials, could be employed to dry the small amounts of air remaining that surrounds the dry cereal device where the displacement membrane can not go. Various compartments can be envisioned that would contain the hygroscopic material.

In the dry cereal embodiment, a satisfactory application could be had with a flexible non-stretching materials as well.

The device can also be used to prevent the accumulation of bad smelling air in waste disposal systems, septic tanks, sewage systems, and in fish, chemical, fertilizer and other unpleasant odor producing storage. The device can be used to reduce oxygen in partially filled compost bins and in bins of other material that should be stored with less air.

The cereal saver 4 can also be used to prevent freezer burn. Freezer burn is caused by the sublimination of water directly into the air. Without an air space for the water to enter, there will be no freezer burn for material stored in temperatures below 0 degrees Celsius.

Operation of Cereal Saver 4.

The conventional clamp 66 is opened allowing the air 52, to leave the displacement matter chamber 48 as necessary. The usable material cap 60 is removed from the container. Dry cereal 50 or to her dry food stock is placed in or removed from the container 12. The usable material cap 60 is returned to the container 12. The displacement matter chamber 48 is inflated with air 52 by a human blowing into the displacement matter neck 20. Atmospheric air in the container will be expelled out the vent 72. When the displacement matter chamber 48 is full of air, the conventional clamp 66 is closed to prevent the displacement matter chamber 48 from collapsing.

Pressurized Delivery Without Gas Propellants, Oil Dispenser 5.

Component Description of Oil Dispenser 5.

Figure 5B:
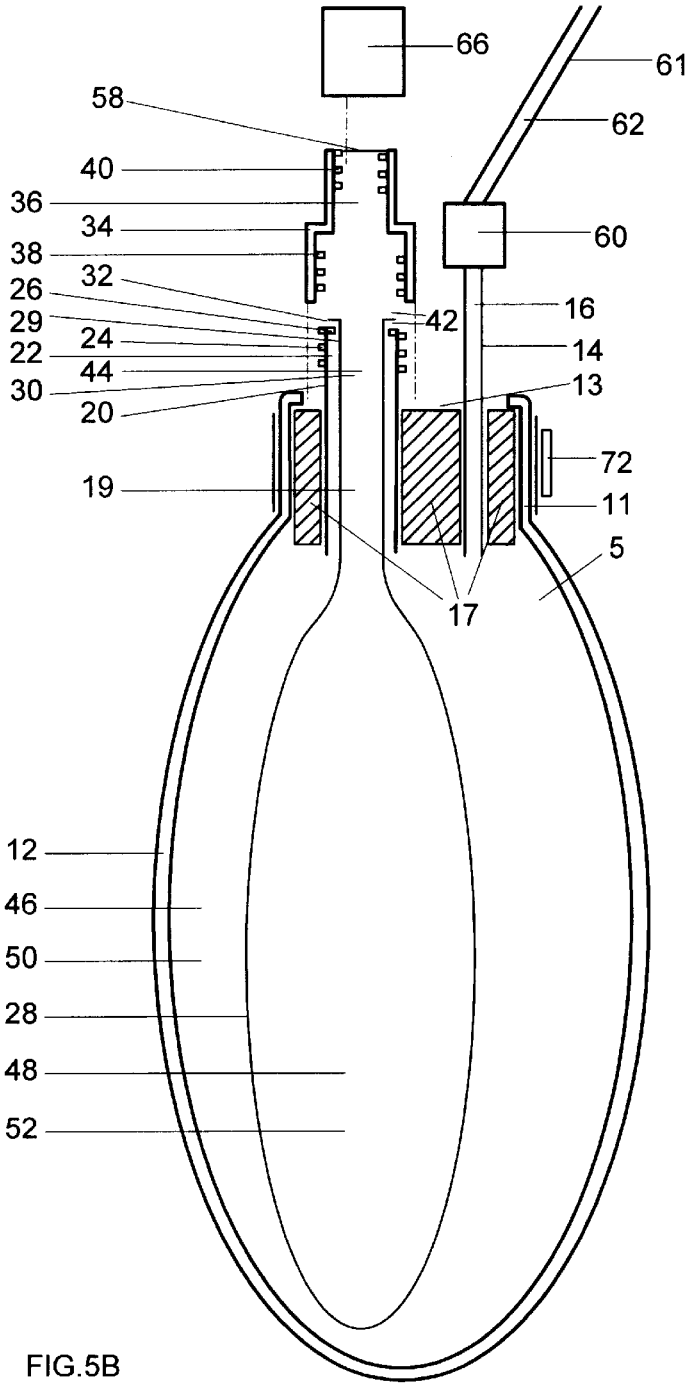
FIG. 5B shows a cross sectional view of the device show in FIG. 5A.
Figure 5A:
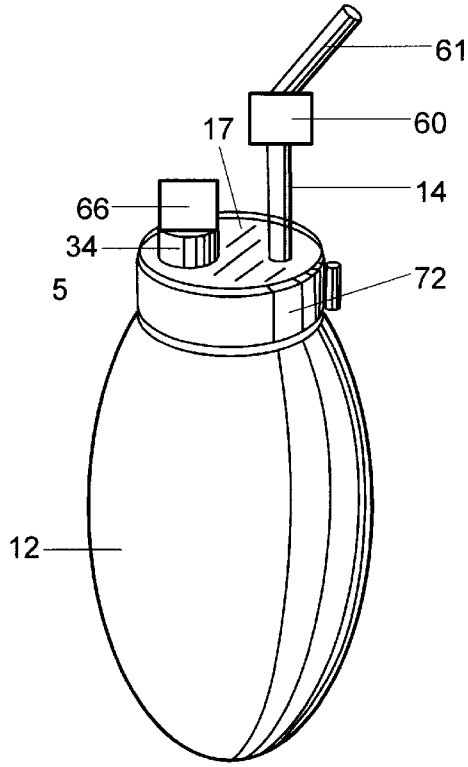
FIG. 5A shows a device for the pressurized dispensation of penetrating oil, oil dispenser 5, in an upward direction and any other direction.

FIG. 5A shows a descriptive view of a pressurized penetrating oil dispenser, oil dispenser 5, constructed as an embodiment of the volumetric displacement device, which will deliver its contents under pressure without environmentally damaging propellants, and will deliver its contents in any direction including straight up. FIG. 5B shows a cutaway view of the device shown in FIG. 5A. Referring to FIGS. 5A and 5B, except as noted, the oil dispenser 5 is constructed.

A bladder, container 12 of one piece, is formed of elastic nitrile rubber. A container neck 11 is formed from the material of the container 12 as part of the container 12, so that the rubber forms a container neck passageway 13 within the container neck 11.

A usable material neck 14 is formed form metal. The metal of the usable material neck 14 forms a usable material passageway 16 within the usable material neck 14. The usable material neck 14 is similar in construction in both size and material to a conventional pipe.

A displacement matter neck 20 is formed for metal. The metal of the displacement matter neck 20 forms a displacement matter passageway 22 within the displacement matter neck 20. The displacement matter neck 20 is similar in construction, in both size and material, to a conventional pipe. A set of displacement matter neck male threads 24 are formed from the metal of, and as part of, the displacement matter neck 20. A displacement matter neck lip 26 is formed from the metal of as part of, and at the top of, the displacement matter neck 20.

A container stopper 17 is constructed of nitrile rubber in such fashion that it fits snuggly inside the container neck passageway 13. The material of the container stopper 17 forms a container stopper usable material passageway 15 and a container stopper displacement matter passageway 19 of such that the usable material neck 14 and the displacement matter neck 20 fit snuggly into the respective passageways, which is accomplished using adhesive to complete a tight seal if necessary.

A displacement membrane, bladder, displacement partition 28 of one piece is constructed of nitrile rubber. The displacement partition 28 is constructed as an air tight bag in a shape that is roughly the same size and shape as the interior of the container 12. The parts of the displacement partition 28 are constructed in similar fashion to the displacement partition 28 of the soda saver 1 depicted in FIG. 1B, as is the displament partition clamp 34. The displacement partition 28, the displacement matter neck 20, and the displacement partition clamp 34 are assembled in similar fashion to the soda saver 1.

The container stopper 17 is fit into the container neck passageway 13, as the displacement partition 28 is inserted into the container 12. The junction of the container stopper 17 and the container neck 11 is secured with a hose clamp, conventional clamp 72.

A push button to open valve conventional valve 60 is attached to the usable material neck 14 as shown.

A nozzle 61 of one piece is formed for metal. The nozzle 61 is similar in construction in both size and material to a piece of pipe.

The material for the nozzle 61 forms the nozzle passageway 62 within the nozzle 61.

The nozzle 61 is attached to the conventional valve 60.

A conventional grease fitting 66 is fit to the displacement matter partition clamp as shown.

Assembly Description of Oil Dispenser 5.

Passageways and chambers are no established within the oil dispenser 5 in similar fashion to the soda saver 1.

Penetrating oil 50 is the usable material stored in the usable material chamber 46. Grease 52 is the displacement matter stored in the displacement matter chamber.

Device Description of Oil Dispenser 5.

The container 12 of the oil dispenser 5 is made of an elastic material. If the outside container 12 is stretched, it attempts to return to its original shape. This force will serve as a propellant for the usable material, penetrating oil 50, in that the penetrating oil 50 will be forced out of the container 12 through the usable material passageway 16 when the conventional valve 60 is opened. Without the displacement matter chamber 48, the internal pressure would decrease as the container 12 contracted, until no more penetrating oil 50 would come out. If, however, grease 52 is forced into the displacement matter chamber 48, via the conventional grease fitting 66, the pressure inside the container 12 would again increase and pressurized dispensing would again occur. This dispensing action can be in any direction including in an upward direction.

Ramifications of Oil Dispenser 5.

An ideal application for the oil dispenser 5 is for vertical application such as applying penetration oil to the underside of a car, or other material that must be put onto the underside of horizontal surfaces such as pre-installed cabinets and ceilings. Glueing can be done in an upward direction. The container will perform well until it is empty, allowing almost all usable material to be delivered from it. The device is suitable for delicate applications.

The device provides the ability to deliver uniform pressure without environmentally damaging gas propellants. Normally, pressurize containers start off with a high pressure which slowly diminishes as the contents of the container are reduced. The injection of more displacement matter into the oil dispenser 5 increases the internal pressure in the device until it is at a satisfactory level.

Variation of Oil Dispenser 5.

Pressure from the stretching container could be augmented with hand pressure to overcome for example, the slight resistance of a valve that opens with increased pressure.

A wide variety of valve actuating devices can be used. Buttons, levers, squeeze, and wheels are just some.

The partition membrane would be eliminated with the application of an immiscible material such as an immiscible calk, instead of the grease.

Line drawing dispensers such as pens, cake decorators, slip and glaze dispensers in ceramics, and other art material dispensers can be built.

To remove grease for reloading the oil dispenser 5, extra valves or other means for passageway regulation could be employed to allow grease 52 to be removed from the displacement matter chamber 48.

The displacement partition 28 can be eliminated if an air valve is installed in place of the grease valve. Pumping air into the container would expand it and the same pressure effect would occur to cause automatic dispensing. There would be some disadvantages with this arrangement, however. Turned upside down from the position of FIG. 5B the device will deliver oil, but it would not work right side up. Extending the usable material neck in length until it reached the bottom of the container would allow the device to deliver material when it was right side up, but not when it was a upside down. With the neck having adjustment to change its location, material could be delivered in different positions, however a more complicated device would result. Volumetric displacement matter, in each of these instances, makes the container behave as if it were full, that is stretched, and allows the device to continue to pump oil within the constraints listed.

A wide range of usable material can be dispensed with the oil dispenser 5. Powdered solids such as talk and chalk can be dispensed as well as other finely granulated material.

Operation of Oil Dispenser 5.

To put penetrating oil 50 into the oil dispenser 5, the device must first be opened. The conventional clamp 72 is loosened and the container stopper 17 removed. Penetrating oil 50 is put into the container 12. The container stopper 17 is put back into the container 12 and the conventional clamp 72 is replaced and tightened to secure the joining of the container 12 and the container stopper 17.

To raise the pressure in the container, grease is pumped into the displacement matter chamber 48 via the conventional grease fitting 66, until the container 12 is properly inflated.

Penetrating oil 50 is released as the actuating means of the usable material conventional valve 60 is actuated. Penetrating oil 50 will be dispensed under pressure in any direction the nozzle 61 of the oil dispenser 5 is pointed.

As the pressure of the container 12 lessens, as penetrating oil 50 is removed from the container 12, more grease 52 is pumped into the displacement matter chamber 48. The pressure once again increases.

When the user wants to reload the entire device, the conventional grease fitting 66 is removed and the grease 52 squeezed out.

Storage and Dispensation of Thick Liquids. A Calk Dispenser 6.

Component Description of Calk Dispenser 6.

Figure 6B:
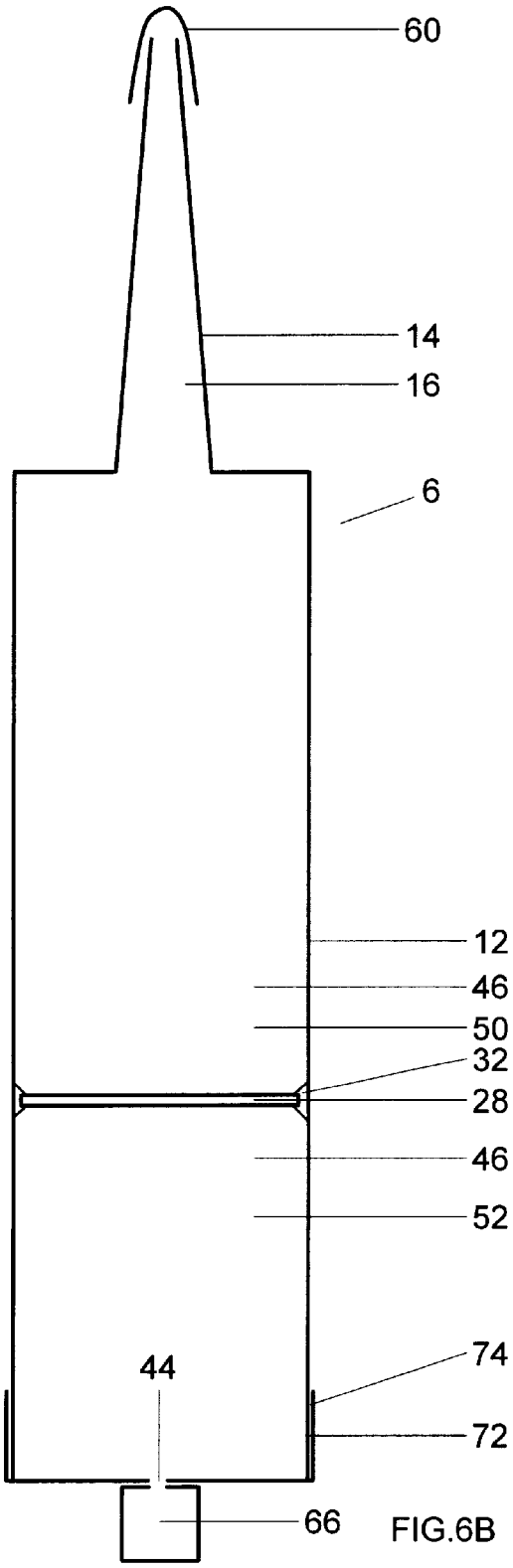
FIG. 6B shows a cross sectional view of the device show in FIG. 6A.
Figure 6A:
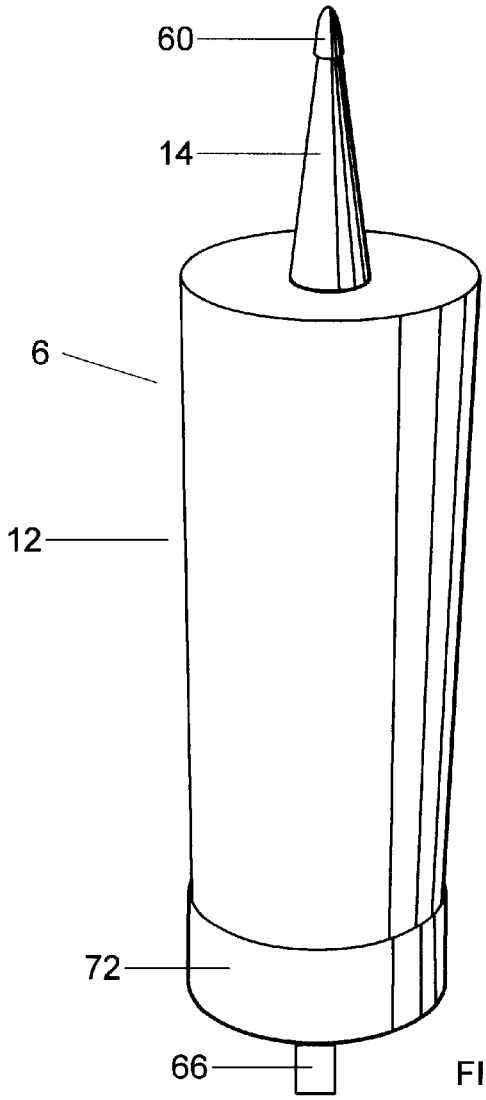
FIG. 6A shows a device for calk, calk dispenser 6, that improves the longevity of the unused portion.

FIG. 6A shows a perspective view of volumetric displacement device, volumetric dispensing and preservation device, calk dispenser 6 constructed as an embodiment of the volumetric displacement device, whose contents will be protected from atmospheric air for extended periods of time. FIG. 6B shows a cutaway view of the device shown in FIG. 6A. Referring to FIGS. 6A and 6B, except as noted, the calk dispenser 6 constructed.

Generally, the calk dispenser 6 is constructed of materials and in size similar to existing calk tubes. A tube, container 12, of one piece, is formed from a non-stretching material, plastic. The container 12 is similar in construction in both size and material to a conventional plastic calk tuber container.

A usable material neck 14 is formed from the material of the container 12 as part of the container 12 so that the plastic forms a usable passageway 16 within the usable material neck 14.

A mobile rigid partition, plunger, displacement partition 28 of one piece is constructed of plastic. A displacement partition seal 32 is constructed. The displacement partition 28 and the displacement seal 32 are similar in construction in size, material and form to a conventional calk tube plunger. They are constructed in a manner such that the displacement partition seal 32 forms a tight seal with the inside walls of the container 12. The displacement partition is free to slide the entire length of the container 12, maintaining a tight seal.

A usable material cap 60 of one piece, is formed on non-stretching plastic. The usable material cap 60 is similar in construction in both size and material to a conventional calk tube cap.

The displacement partition 28 divides the container 12 into two chambers. The first chamber is a usable material chamber 46 which will hold usable material, in this case calk 50. The second chamber is a displacement matter chamber 48 which will hold displacement matter, non-compressible matter, grease 52.

A container end 72 of one piece is formed from plastic. A displacement matter passageway 22 is formed from the material of the container end 72, as part of the container end 72.

A conventional grease fitting 66, which has a securing nut, passes through the displacement matter passageway 44 of the container end 72, and is secured with the securing nut. The junction of the conventional grease fitting 66 and the container end 72 is tightly sealed with adhesive 74.

The containing end 72 is constructed so that it can be permanently bonded to the container 12, with adhesive 74 after the grease 52 and the displacement partition 28 have been installed in the container 12.

Device Description of Calk Dispenser 6.

The advantage of this calk tube is that the grease serves to tightly seal the calk tube. Conventional tubes tend to dry out about the disk that serves as a plunger to force the calk out. The grease 52 of the displacement matter chamber 48 forms an airtight seal between the calk and the outside environment, thereby preserving the calk 50 for extended periods of time. The embodiment has a grease fitting set into the displacement matter chamber 48. Pumping grease 52 through this one way valve would refill the container, and permit easy, controlled dispensing of the material.

Ramifications of Calk Dispenser 6.

A calk device 6 could easily be constructed that would retrofit to existing calk tubes. The container end 72 and conventional grease fitting, as an assembly, could be fastened onto existing calk tubes. Clamps that firmly secure the the container end 72 to the calk tube would allow for greater internal pressure within the calk dispenser 6 as calk is forced from the calk dispesner 6. The user would put grease 52 into the open end of the calk tube before the container end was attached so that the newly formed displacement matter chamber would not contain compressible air to start the operation.

Operation of Calk Dispenser 6.

A conventional grease gun is used to operate the calk dispenser 6. Grease 52, forced into the displacement matter chamber 48 of the calk dispenser 6, will apply pressure to the displacement partition 28, which will in turn apply pressure to the usable material chamber 46, which will force the discharge of the calk 50. Upon completion of the calking job, the usable material cap 60 is replaced.

Volatile Liquid, Storage and Dispensation. A Vapor-less Fuel Tank Device. Fuel Device 7.

Component Description of Fuel Device 7.

Figure 7B:
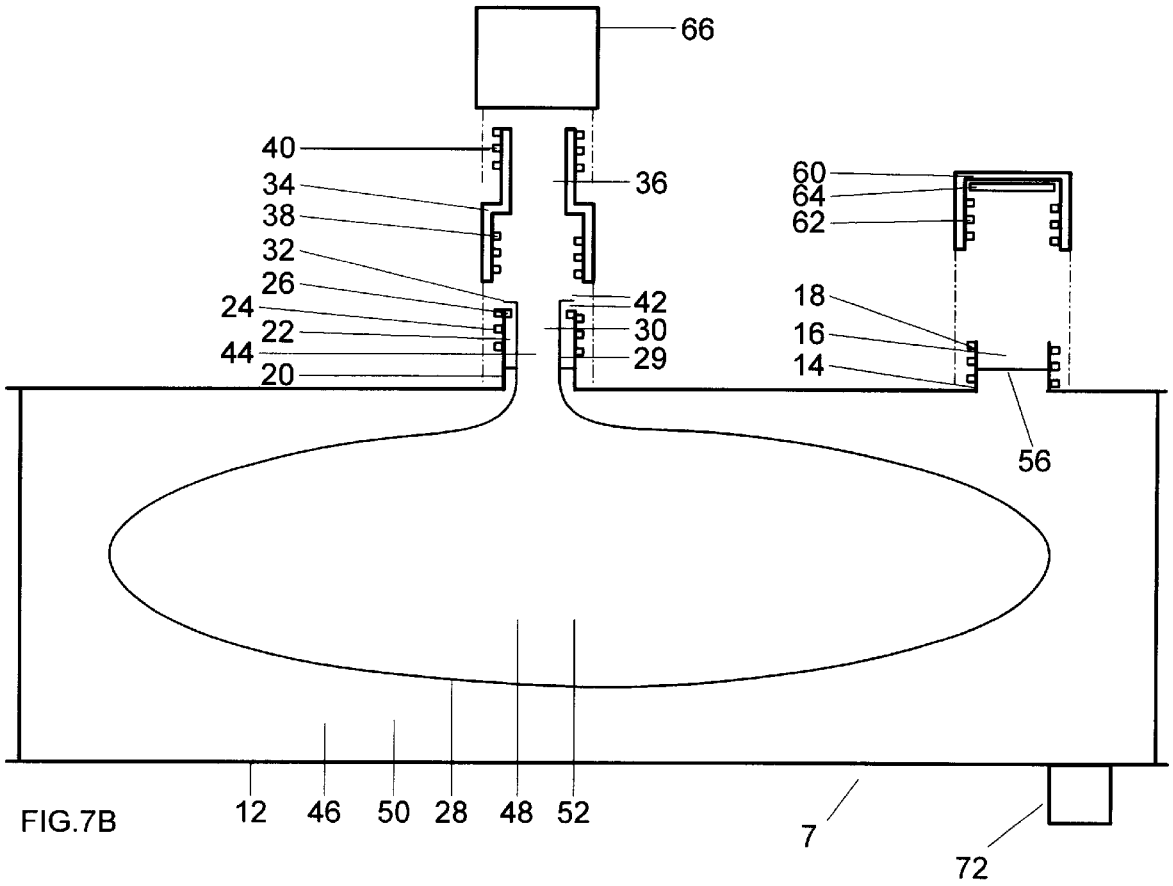
FIG. 7B shows a cross sectional view of the device show in FIG. 7A.
Figure 7A:
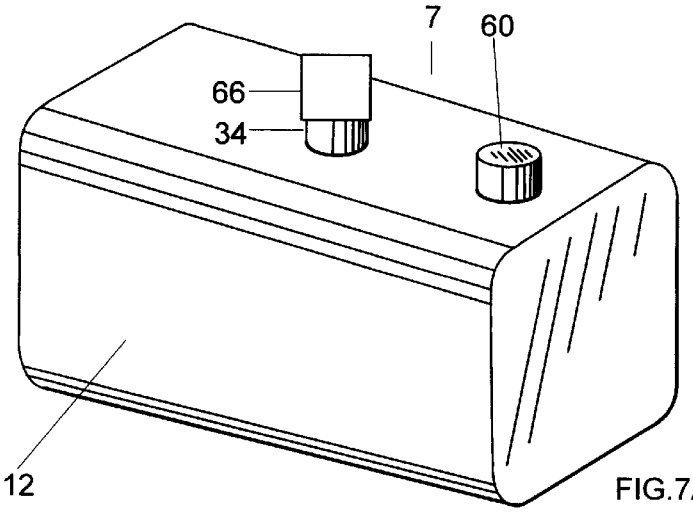
FIG. 7A shows a device for fuel, fuel device 7, that has no explosive air, doesn't slosh, doesn't condense water, and serves as a fuel pump.

FIG. 7A shows a perspective view of a volumetric displacement device, fuel device 7 constructed as an embodiment of the volumetric displacement device, which will not have dangerous and toxic vapors. FIG. 7B shows a cutaway view of the device shown in FIG. 7A. Referring to FIGS. 7A and 7B, except as noted, the fuel device 7 is constructed.

Generally, the device is constructed in similar fashion to the soda saver 1 depicted in FIGS. 1A and 1B. Parts shown are similar in construction to the parts described for the soda saver 1 except as noted.

Generally, the fuel device is constructed of materials and in size similar to existing fuel tanks. A container 12 is constructed of a rigid material, steel. Gasoline 50 is the usable material. The displacement matter partition 28 is formed from a gasoline proof material such as nitrile rubber, as are the various seals for the usable material cap 60 and displacement partition clamp 34. A conventional air pump 66 is employed to inject air 52 under force into the displacement matter chamber 28. A conventional fuel line attachment 72 is employed to deliver gasoline 50 from the fuel device 7 to a gasoline engine.

Device Description of Fuel Device 7.

Gasoline 50 is loaded into the fuel device 7 via the usable material passageway 16 in normal fashion. The conventional air pump 66 is fitted with a purge valve that allows the clean air 52 in the displacement matter chamber 48 to escape. Gasoline 50 leaves the tank headed for the gasoline motor via a conventional fuel line in normal fashion. What is different is the presence of a displacement matter chamber 48. Air 52 pumped into the displacement tank at pressure serves to keep the fuel device 7 full. The cnventional air pump 66 must sense when the pressure is going down and reestablish the proper pressure by pumping more air 52 into the displacement matter chamber 48.

Ramifications of Fuel Device 7.

The most dangerous aspect of the conventional fuel tank is the air fuel vapor mixture in the empty part of the tank.

The fuel device eliminates these vapors. This would have special application in racing applications, aviation, marine applications, and perhaps for every fuel powered motor vehicle on the road.

Many types of fuel could be protected by the volumetric device. Methanol. Ethanol. Gasoline. Diesel Fuel. Aviation Fuel are examples of such fuels.

Many improvements over conventional fuel tanks have been achieved. There is no air in the fuel device 7 that gasoline 50 can evaporate into. There is thus no explosively flammable air fuel mixture in the fuel device 7. There are less fuel vapors to escape when the fuel device 7 is opened for refilling. This reduces environmental pollution. There is no moisture laden air in the fuel device 7 that can cause water condensate to collect in the fuel device 7. The gasoline 50 in the fuel device 7 now requires no baffles. The conventional air pump 66 also serves as the fuel pump, as the pressure of the air in the displacement matter chamber 48 will transfer force through the displacement partition 28 to the usable material chamber 46 and fuel will be driven out the fuel line. Fuel can exit the container in any direction as the tank always seems full. Therefore, the fuel line where fuel leaves the tank can be located at any point, even at the top of the tank.

Eliminating the air pump, a more passive device can be constructed without an air pump. By letting air flow in under atmospheric pressure as the fuel is pumped out, or allowed to flow out by gravity, the displacement matter chamber 48 would fill with air. If a one way valve where employed in the displacement matter passage way to only allow air in, the valve would necessarily have to open to allow air out when refueling the tank. This simple device could see application on portable tanks as well as on containers for volatile toxic liquids. Containers in all sorts of styles, of types, materials, designs and container sizes both large and small could be fit with volumetric displacement devices.

The need to vent the fuel tank is eliminated in a sense, depending on whether the entry of displacement matter into the displacement matter chamber is defined as venting. Other than the intake of displacement matter, the fuel device 7 needs no other venting.

Variation of Fuel Device 7.

The fuel device can be utilized with the usable material placed in what is presented as the displacement matter chamber and with the displacement matter in what is presented as the usable material chamber. The conventional air pump 66 must be attached to what is currently the usable material neck 14 and the usable material cap 60 must be attached to what is currently the displacement matter neck 20. As such, the fuel will be located within the bladder of the displacement partition, and the displacement matter will be located within the container and outside the bladder of the displacement partition.

Operation of Fuel Device 7.

In operation, the user will fill the fuel device 7 just as they would any other automotive fuel tank. In operation, the device will maintain a constant internal pressure. As fuel flows out to the gasoline engine, more air will be pumped into the displacement matter chamber.

Material Management, Complete Removal of Gas From Cylinder, An Emptying Gas Cylinder 8.

Component Description of Emptying Gas Cylinder 8.

FIG. 8A shows a perspective view of a volumetric displacement device, emptying gas cylinder 8 constructed as an embodiment of the volumetric displacement device, which will dispenser completely, valuable gases. FIG. 8B shows a cutaway view of the device shown in FIG. 8A. Referring to FIGS. 8A and 8B, except as noted, the emptying gas cylinder 8 is constructed. Referring to all of FIGS. 8A and 8B, a volumetric displacement device is constructed.

Generally, the device is constructed in similar fashion to the soda saver 1 depicted in FIGS. 1A and 1B. Parts shown are similar in construction to the part described for the soda saver 1 except as noted.

Generally, the gas device is constructed of materials and in size similar to existing gas tanks. A container 12 is constructed of a rigid material, metal. Compressible matter, a gas 50 is the usable material. The displacement material is water 52. The displacement partition 28 is formed from a flexible or elastic material. Use of an elastic membrane as the displacement partition will allow for the removal of all gas from a cylinder of valuable gas, as the membrane conforms to the inside shape of the tank. A conventional regulator 60 is attached to the usable material neck 14, employed to regulate gas flow out of the container 12.

Some gasses produced are expensive. It would be most economical to remove all gas 50 from the cylinder. However, once the gas pressure inside the cylinder reaches atmospheric pressure, the gas 50 will not flow out by it self. Filling the displacement matter chamber 48 with water 52 will, however, force the last remaining valuable gas 52 out of the usable material passageway 16.

Operation of Emptying Gas Cylinder 8.

The emptying gas cylinder 8 is filled by removing the displacement matter cap 60. Gas is pumped into the container 12 via the usable material passageway 16 until the displacement partition 28 collapses completely. At this point the displacement matter cap 60 is securely screwed back onto the emptying gas cylinder 8. Gas 50 is then pumped into the usable material chamber 46 until the desired pressure is reached.

The consumer removes gas 50 normally via the conventional regulator 60. When the internal pressure of the gas 50 is at atmospheric pressure, the displacement material cap 66 is removed. Water 52 is poured into the displacement matter chamber 48 via the displacement matter passageway 44. Gas 50 will flow out the opened conventional regulator 60. Water 52 is poured into the displacement matter chamber 48 until the emptying gas cylinder 8 is devoid of gas 50.

Industrial Management of Air Sensitive Preparations, An Industrial Vat 9.

Component Description of Industrial Vat 9.

Figure 9B:
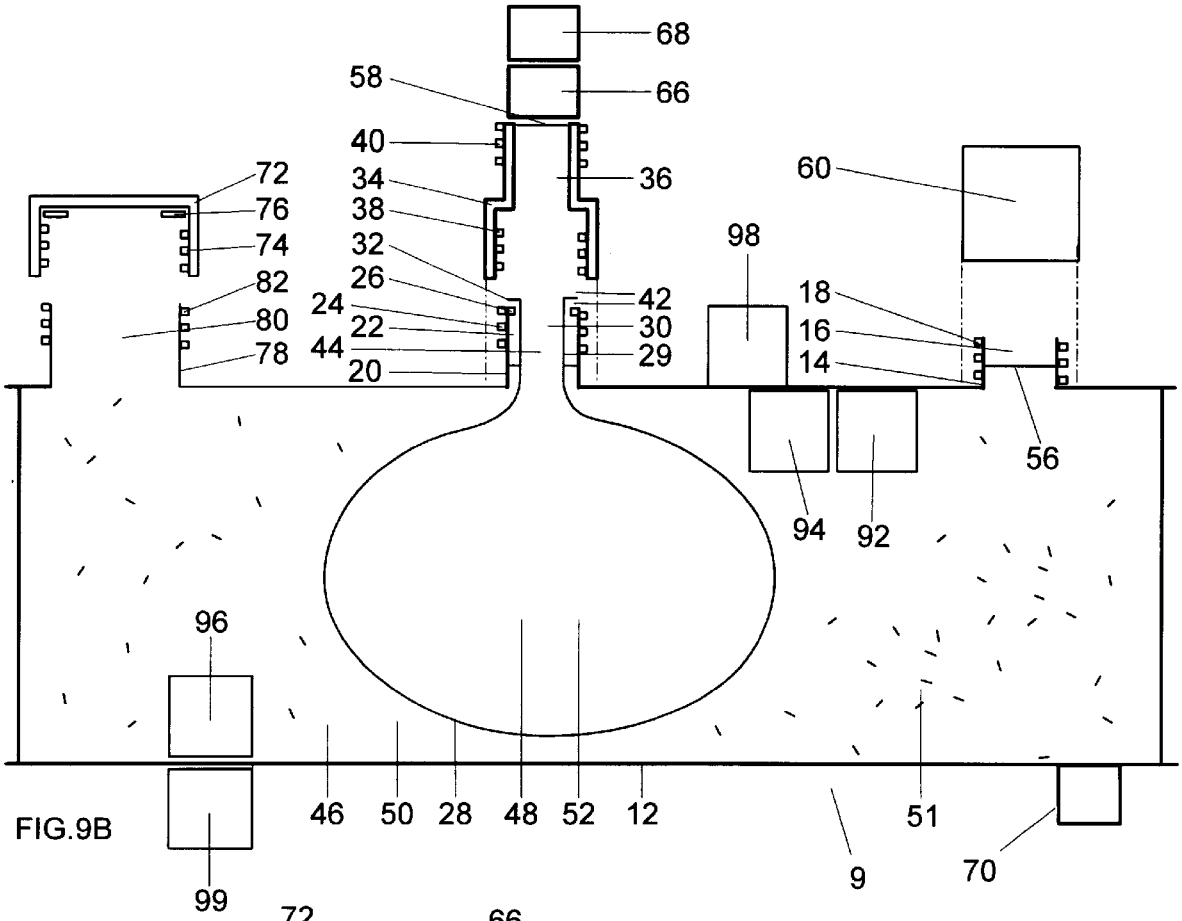
FIG. 9B shows a cross sectional view of the device show in FIG. 9A.
Figure 9A:
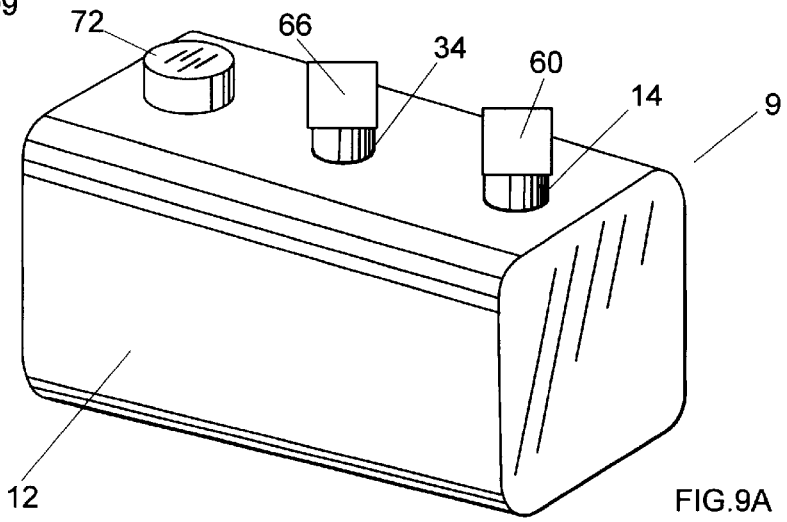
FIG. 9A shows a device, an industrial vat 9, for the preparation and dispensation of pharmaceutical materials that are air sensitive.

FIG. 9A shows a perspective view of a volumetric displacement device, industrial preparation, pharmaceutical preparation device, beer preparation, industrial vat 9, constructed as an embodiment of the volumetric displacement device, which allows industrial size preparations to be produced and dispensed without atmospheric exposure. FIG. 9B shows a cutaway view of the device shown in FIG. 9A. Referring to FIGS. 9A and 9B, except as noted, the industrial vat 9 is constructed.

Generally, the device is constructed in similar fashion to the soda saver 1 depicted in FIGS. 1A and 1B. Parts shown are similar in construction to the parts described for the soda saver 1 except as noted.

Generally, the industrial vat 9 is constructed of materials and in size similar to existing stainless steel vats. A container 12 is constructed of stainless steel. A pharmaceutical preparation 50 that is used to impregnate solid impregnable capsules 51 is the usable material. The displacement matter partition 28 is formed from Mylar ®. Water 52 is used as the displacement matter.

An access neck 78 is formed from the material of the container 12, as part of the container 12, so that the plastic forms an access neck passageway 80 within the access neck 78.

A set of access neck male threads 82 are formed from the material of, and as part of., the access neck 78.

A tank cap, access lid 72 of one piece, is formed of metal. The access lid 72 is similar in construction in both size and material to a conventional metal tank lid.

A set of access female threads 74 are formed from the material of, and as part of the access lid 72. The threads are formed in such a manner that they mate securely with the access neck male threads 82.

The access lid 72 is fitted with an access lid seal 76, which is a thin disk of silicon rubber. The access lid seal 76 serves to tightly seal the access passageway 80 when the access lid 72 is securely screwed onto the access neck 78, as the access lid female threads 74 firmly engage the access neck male threads 82.

A conventional material pump 60 is fitted to the usable material neck 14 which will serve to pump pharmaceutical preparations 50 into the usable material chamber 46.

A conventional one way valve 66 is fitted to the displacement partition clamp 34. A conventional water reservoir 68 is fitted to the conventional one way valve 66. The one way valve 60 is positioned so that water 52 placed in the conventional water reservoir 68 may flow into the displacement matter passageway 44, but water 52 flow is restricted in the opposite direction.

A conventional petcock 70 is fit to the tank for the purpose of removing the usable material.

An electric mixing device, conventional submersible impeller 92 is installed in the container 12 to be used to stir and mix the usable material. A conventional submersible heater 94 and a conventional cooling device 96 are installed in the container 12 to control the temperature of the usable material.

A pair of conventional through container pipe fittings and pipes 99 are installed in the container for the purpose of bringing cold water into the industrial vat 9 to run through the coils of the conventional cooling device 96 to which the pipes are attached.

A conventional through container wire fitting and wires 98 are installed in the container 12 for the purpose of bringing electrical power into the industrial vat 9. The wires are run to the conventional submersible heater 94 and the conventional submersible impeller 92.

Device description of Industrial Vat 9.

An industrial vat 9 has been created that can protect and produce air sensitive material that will never touch the air. Portions of the material can be removed and the remaining usable material left in the industrial vat 9 will not touch the air either. Neither will the chemicals of the usable material pollute the air. The usable material can be mixed, heated and cooled in the preparation process.

The chambers and passageways of the device function in a manner that is similar to the devices already described.

Ramifications of Industrial Vat 9.

The industrial vat 9 on modification could be used for the industrial preparation of a wide range of materials. Fermenting and other growing products that require anaerobic conditions or that need to be isolated from contaminates can be contained in containers that are only partially filled with usable material for use in beverage making, pharmaceutical production, food stuffs, chemical production and other applications. Other types of devices coudd be installed in the vats for industrial control and regulation. Devices that read pH, temepratire, concentrations of various materials, and mixing speed are just some of the monitoring devices that could be installed.

Industrial vats 9 can be connected by piping or other means so that material can be transferred from one container to the next without becoming contaminated. Containers of precursor materials are fitted with volumetric displacement devices so that they too can transfer materials to the system without the material becoming exposed to the environment. Various vats in the industrial process can be connected to each other, the other vats containing volumetric displacement devices. Piping or other means can be employed to transfer material from the industrial vat 9 to the final container which can then be sealed and made ready for shipment.

An extremely conventional "conventional" pump 60, that will actually soon be conventional, would be the material pump, paint dispenser pump **2*e*, depicted in FIG. 2E. By connecting with a hose, or other suitable means, the standard faucet 60*e* of the paint dispenser pump 2*e* to the usable material neck 14 of the industrial vat 9**, fresh material can be brought directly into the vat.

A bleed value at the top of the usable material chamber could be used to bleed off residual gas in the usable material chamber. In this manner, the usable material container can be kept full at all times.

In all, entire processes can be set up where the material in the processes can be stored in vats, processed in vats, removed from the vats, transferred to final containers for delivery to the consumer without the material, usable material ever being exposed to the atmospheric, air or environment.

Air can be used instead of water as the displacement matter. Pressure applied to the displacement matter would power the transfer of material about the industrial system. Pressure could be supplied by any of the previously mentioned pressure sources including the conventional pressurized tap water system, pumps and gravity displacement tubes.

Operation of Industrial Vat 9.

The access lid 72 may be removed for bi-directional transfer of solid material between the environment and the container 12 during the phases of the operation that are not air sensitive. Access to the devices installed in the container 12 is also provided.

In phases of the operation where the usable material is air sensitive, usable material is pumped into the usable material chamber 46 by the conventional material pump 60, via the usable material passageway 16. If the usable material is sensitive to micro organisms, the industrial vat 9 may be sterilized prior to or after the introduction of the usable material. A conventional heating device, or steam, that will supply sufficient temperature may be utilized to heat the interior of the industrial vat 9 to sufficient temperature. Metal foil displacement partitions and high temperature plastics and rubbers would not be damaged by the heat.

Materials introduced to the industrial vat 9 may be stored in their own volumetric displacement devices which protect them from contamination. In this manner, a series of containers may be connected with piping, for example, so that material may be transferred from one container to the next without the various usable materials being contaminated.

Usable material is allowed to flow from the container 12 via the conventional valve petcock 70 or directly into piping for transfer to the next part of the operations or directly into containers of shipping. In all, the process can be set up so that no stage of the operation will see the usable material exposed to air. Industrial vats 9, containers of precursor materials, containers along the process pathways where sub processing, alternate processing, and additional processing occur and containers of finished product are all maintained without exposure to atmospheric air and environmental contamination.

As usable material leaves the container 12, water 52 will flow from the conventional water reservoir 68 through the conventional one way valve 66, through the displacement matter passageway 44 and into the displacement matter chamber 48. Water 52 is prevented from flowing backward into the conventional water reservoir 68 by the conventional one way valve 66. The swirling action of the conventional submersible impeller 92 might otherwise drive water 52 out of the displacement partition 28 and into the conventional water reservoir 68.

Electricity supplied through the conventional through container wire fitting and wires 98 and on to the conventional submersible impeller 92 and the conventional submersible heater 94 will power those devices so that the usable material can be mixed or heated. Cold medium pumped through the conventional through container pipe fittings and pipes 99 and through the conventional cooling device 96 can be used to cool the usable material Retrofit Volumetric Displacment Device 10.

Component Description of Retrofit Volumetric Displacment Device 10

Figure 10B:
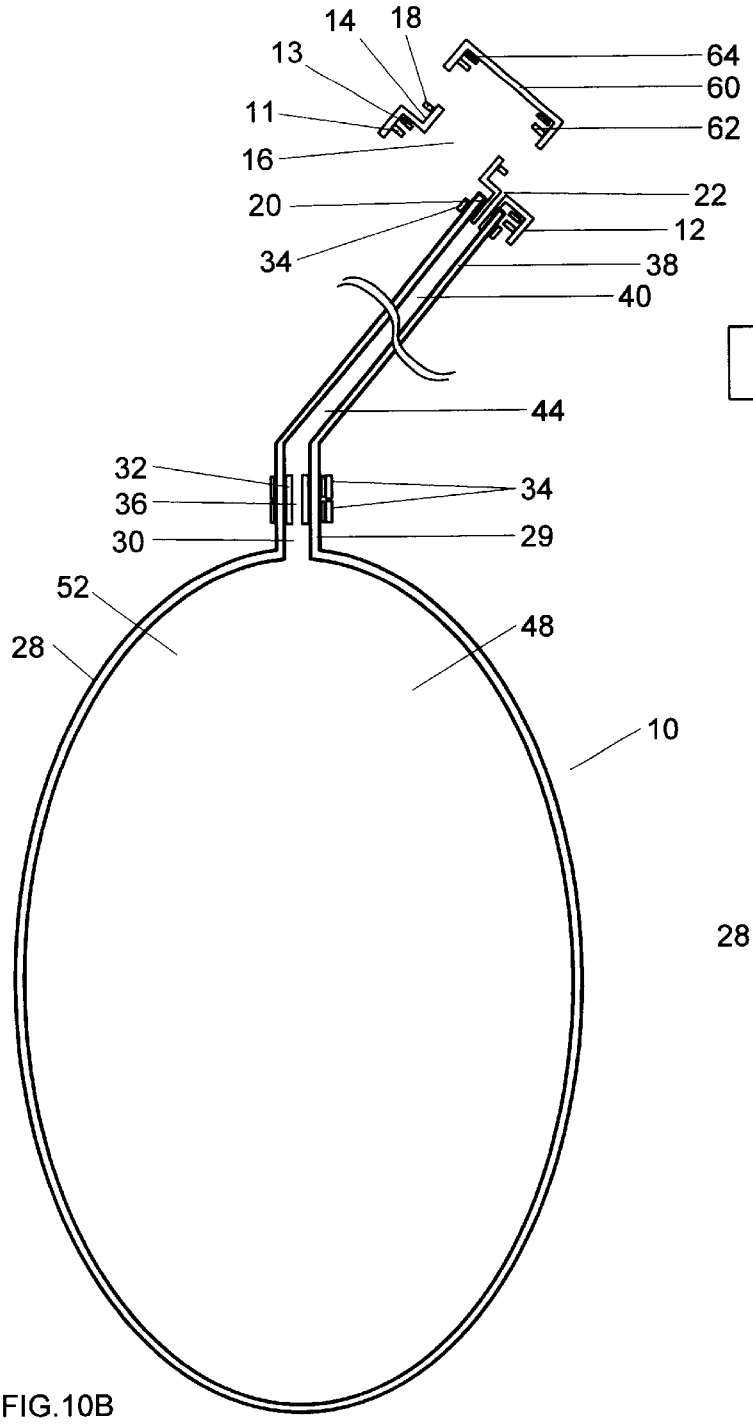
FIG. 10B shows a cross sectional view of the device show in FIG. 10A.
Figure 10A:
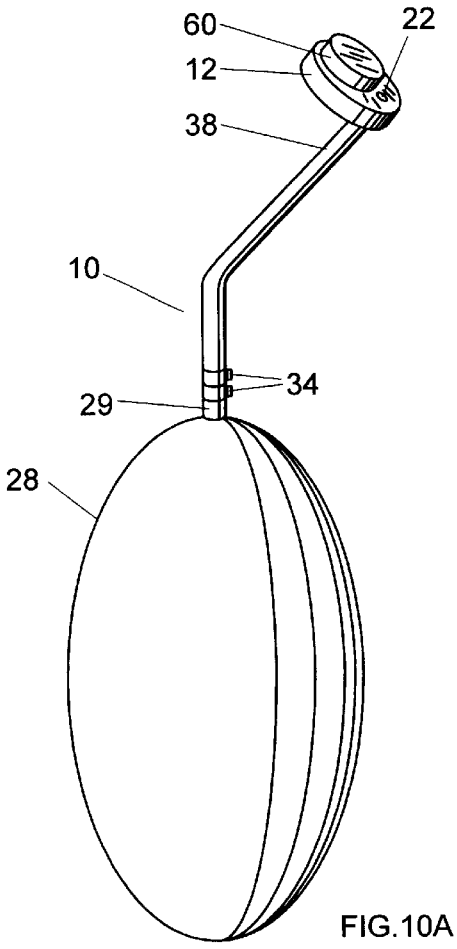
FIG. 10A shows a retrofit volumetric displacement device 10 for preventing volatile liquids from vaporizing in their containers.

FIG. 10A shows a perspective view of a volumetric displacement device, a retrofit volumetric displacement device 10, constructed as an embodiment of the volumetric displacement device that fits into a pre-existing container. FIG. 10B shows a cutaway view of the device shown in FIG. 10A. Referring to FIGS. 10A and 10B except as noted, the retrofit volumetric displacement device 10 is constructed.

A tank cap 12 of one piece, is formed of metal. The tank cap 12 is similar in construction in both size and material to a conventional fuel tank cap except that it has two necks formed into it.

A set of tank cap female threads 11 are formed from the metal of, and as part of, the tank cap 12. The tank cap female threads 11 are formed in such a manner that they mate securely with a conventional fuel tank 72, such as the tank that can be found on a conventional automobile.

The tank cap 12 is fitted with a tank cap seal 12, which is a thin disk of silicon rubber. The tank cap seal 13 serves to tightly seal the passageway leading to the conventional fuel tank 72 when the tank cap 12 is securely screwed onto the conventional fuel tank 72 as the tank cap female threads 11 firmly engage the threads of conventional fuel tank 72.

A usable material neck 14 is formed from the material of the tank cap 12, as part of the tank cap 12, so that the metal forms a usable material passageway 16 within the usable material neck 14.

A set of usable material neck male threads 18 are formed from the material of, and as part of, the usable material neck 14.

A displacement matter neck 20 is formed from the material of the tank cap 12, as part of the container 12, so that the material forms a displacement matter neck passageway 22 within the displacement matter neck 20.

A displacement membrane, displacement partition 28 of one piece is constructed of a gas proof nitrile rubber. The displacement partition 28 is constructed as air tight bag in a shape that is roughly the same size and shape as the interior of the conventional gas tank 72.

A displacement partition neck 29 is formed from the material of, and a part of, the displacement partition 28. The size of the displacement partition neck is such that it will fit within the displacement matter neck passageway 22.

The Material of the displacement partition neck 29 forms a displacement partition passageway 30 within the displacement partition neck 29.

A displacement partition connector 32 of one piece is formed from metal. The displacement partition connector 32 is similar in construction in both size and material to a piece of pipe.

The material for the displacement partition connector 32 forms the displacement partition connector passageway 36 within the displacement partition connector 32.

The displacement partition container 32 is inserted into the displacement partition passageway 30 as shown.

A displacement partition extension 38 of one piece is created by cutting off an appropriate length of conventional gas proof hose. The length of the hose should be such that when the final assembly is put into the automobile, the hose should run from the installed tank cap 12 to the displacement partition connector 32 when the displacement partition 28 is properly installed in the conventional fuel tank 72. The material of the displacement partition extension 38 forms a displacement partition extension passageway 40.

One end of the displacement partition extension 38 is fit over the displacement partition connector 32. The other end is fit over the displacement matter neck 20.

The ends of the displacement extension 38 are secured with conventional hose clamps 34, as is the displacement partition neck 29, as shown.

A usable material cap 60 of one piece, is formed of metal. The usable material cap 60 is similar in construction in both size and material to a conventional fuel tank cap.

A set of usable material cap female threads 62 are formed from the metal of, and as part of, the usable material cap 60. The threads are formed in such a manner that they mate securely with the usable material neck male threads 18.

The usable material cap 60 is fitted with a usable material cap seal 64, which is a thin disk of nitrile rubber. The usable material cap seal 64 serves to tightly seal the usable material passageway 16 when the usable material cap 60 is securely screwed onto the usable material neck 14, as the usable material cap female threads 62 firmly engage the usable material neck male threads 18.

A displacement matter passageway 44, is now defined which is composed of the displacement partition passageway 30, and the displacement partition connector passageway 36, the dsiplacvment partition extension passageway 40, and the displacement matter neck passageway 22.

The displacement partition 28, when inserted into the conventional fuel tank 72, divides the conventional fuel tank 72 into two chambers. The first chamber is a usabale material chamber which will hold usable material, in this case a fuel, gasoline. The second chamber is a diplacement matter chamber 48 which will hold displacement matter, air 52.

The usable material chamber is accessed by the usable material passageway 16, which is sued to put gas into the conventional fuel tank 72.

The displacement matter chamber 48 is accessed by the displacement matter passageway 44, from which air 52 will be expelled as gasoline is put into the conventional fuel tank 72, and to which air will flow, from the environment, as the gasoline is used up.

Device Description of Retrofit Volumetric Displacement Device 10.

Gasoline is loaded into the retrofit volumetric displacement device 10 via the usable material passageway in normal fashion. Gasoline leaves the tank headed for the gasoline motor via a conventional fuel line in normal fashion. What is different is the presence of a volumetric displacement matter chamber 48. Air flows passively into the displacement matter chamber 48, via the displacement matter passageway 44, as the gasoline is removed from the conventional fuel tank 72.

The benefits of the retrofit volumetric displacement device 10 are similar to the fuel device 7. The conventional fuel tank 72 does require a conventional fuel pump, as the flow of air 52 into the displacement matter chamber 48 in this case is passive.

Ramifications of Retrofit Volumetric Displacement Device 10.

The retrofit volumetric displacement device 10 can be adapted to fit a wide range of preexisting containers. This is valuable for those applications where the manufacturer does not install a volumetric device, but the consumer of the material desires the benefit of the device. Retrofit devices would in many cases be reusable and could be transferred from container to container.

Variation of Retrofit Volumetric Displacment Device 10.

Similarly constructed, retrofit volumetric displacement devices 10, of suitable design, material and size could be constructed to fit conventional containers to create effervescent beverage dispensers and savers, vapor-less paint and chemical dispensers, vapor-less volatile liquid vessels, squeeze bottles, cereal and other dry goods savers, chemical canisters, portable fuel containers, and gas cylinders. These device would go into specific preexisting bottles such as champagne, beer, wine, soda, transportable gas cans, liquid cans, many in configurations similar to the devices already described. Various retrofit devices are screwed, clamped, bonded, pressure fit to pre-existing containers. A champagne or wine bottle could be fit with a clamp on style cap that contains appropriately constructed necks and passageways.

Such devices could be constructed as caps that fit conventional containers. Narrow displacement matter passageways and narrow usable material passageway's constructed of tubular material, can pass through these caps which then screw on, clamp on, or fit into the existing opening of conventional containers. Large containers such as silos can be retrofit as well as vats, kegs and tanks of all sizes. The displacement partition might rolled up for insertion into the container. It is possible to envision a retrofit volumetric displacement device variation that would in general, fit into most preexisting containers available today.

A simpler device could be constructed that has no usable material passageway installed in the cap. The deflated displacement partition should be inserted into the container, the cap secured, displacement matter put into the displacement matter chamber, and the displacement matter chamber sealed for storage. In use, the displacement matter would be poured out of the displacement matter chamber, the cap and displacement partition removed or pressed to the side of the existing container passageway, and the usable material poured out of the existing container passageway. Alternately, the container could be fit with a petcock, spigot or other tapping device for draining usable material form the usable material chamber.

An even simpler device, although somewhat unwieldy, is an ordinary Mylar® balloon. If the container opening is small, the balloon is collapsed and put into a conventional partially consumed container with just the balloon neck sticking out of the container neck opening. The balloon is then filled with water, air, or other displacement matter. When the container is full, the balloon is sealed and may be allowed to float freely. The full container is sealed and the container will now receive all the benefits of a container in the full fill state, including the ability, if done properly, to protect effervescent beverages from going flat.

Operation of Retrofit Volumetric Displacement Device 10.

The retrofit volumetric displacement device 10 is fit into an existing fuel tank. The displacement partition 28 is deflated, rolled up and inserted into the fuel tank passageway. The tank cap 12 is then screwed onto the existing threads of the fuel tank neck. Pre-existing vents to the fuel tank are sealed.

Operation of the retrofit volumetric displacement device 10 is generally analogous to the fuel device 7 already describe.

Industrial Applicability

A volumetric displacement device has been described that is far simpler than those previously described. The soda savers presented in their simplest embodiment have no pipes, reservoirs of water, water pressure sources, taps, spigots or valves. This means that these devices can be produced very economicaly, to the point of complete disposability, and are extremely easy to operate, needing no extra equipment or special hook ups.

Accordingly, besides the objects and advantages of the volumetric displacement devices described in the above patent, several objects and advantages of the volumetric displacement device follow.

(1) Embodiment of the volumetric displacement device, especially beer saver 1*c*, wine saver 1*d*, paint dispenser 2, simplified paint dispenser 2*d*, paint dispenser pump 2*e*, improved toothpaste tube 3, more convenient improved toothpaste tube 3*c*, cereal saver 4, calk dispenser 6, a fuel device 7 and industrial vat 9, provide an inexpensive and easy means to dispense usable material from containers with out the remaining unused portion of the usable material being exposed to atmospheric air either during or after the dispensing operation. Air contains oxygen, water vapor and contaminates which can damage usable materials.

(2) Embodiment of the volumetric displacement device, especially paint dispenser 2, paint dispenser pump 2*e*, improved toothpaste tube 3, more convenient improved toothpaste tube 3*c*, fuel device 7 and industrial vat 9, provides means to dispense usable material from containers underwater, in space or in other material baths from being exposed to those environments.

(3) Embodiment of the volumetric displacement device, as stated in ramification 1 and 2, as a result of the above, greatly extends the life of materials stored in opened and partially used container, in preventing premature curing, degradation, oxidation, hardening, or skinning, for atmospherically cured materials.

(4) Embodiment of the volumetric displacement device, especially paint dispenser 2, paint dispenser pump 2*e*, improved toothpaste tube 3, more convenient improved toothpaste tube 3*c*, cereal saver 4, fuel device 7, industrial vat 9, and retrofit volumetric displacement device 10, provides means to prevent moisture condensation in fuel tanks and other storage containers.

(5) Embodiment of the volumetric displacement device, especially cereal saver 4, provides means for limiting the absorption of atmospheric water by dried food stuffs such as crackers, dry cereal, snack chips, dried fruit, candy, and other organic material.

(6) Embodiment of the volumetric displacement device. especially soda saver 1. beer saver 1*c*. paint dispenser 2. simplified paint dispenser 2*d*. and paint dispenser pump 2*e*. provides means to prevent off gassing of usable materials stored in partially consumed containers. so as to prevent premature curing or aging damage.

(7) Embodiment of the volumetric displacement device. especially paint dispenser 2. simplified paint dispenser 2*d*. and paint dispenser pump 2*e*. and fuel device 7. provides means to successfully limit evaporation of usable materials stored in partially consumed containers.

(8) Embodiment of the volumetric displacement device. especially cereal saver 4. provides means for limiting freezer burn to usable materials stored in partially emptied containers that are placed in frozen storage.

(9) Embodiment of the volumetric displacement device. especially paint dispenser 2. simplified paint dispenser 2*d*. paint dispenser pump 2*e*. fuel device 7. and retrofit volumetric displacement device 10. provides means to prevent dangerous air fuel mixtures from developing in partially empty fuel tanks and to prevent flammable air mixtures from developing in other partially empty flammable volatile liquid containers.

(10) Embodiment of the volumetric displacement device. especially variations of cereal saver 4. provides means to eliminate combustible dust air mixtures.

(11) Embodiment of the volumetric displacement device. especially paint dispenser 2. simplified paint dispenser 2*d*. paint dispenser pump 2*e*. cereal saver 4. and fuel device 7. provides means to reduce the amount of toxic or unpleasant smelling vapors that are emitted from containers by reducing the amount of air space in the container and the surface area of the material exposed to the atmosphere. reducing environmental pollution and health risks.

(12) Embodiment of the volumetric displacement device. as exemplified by the technology shown in paint dispenser 2. simplified paint dispenser 2*d*. paint dispenser pump 2*e*. cereal saver 4. and fuel device 7. provides means to reduce odors in waste disposal and septic systems with holding tanks.

(13) Embodiment of the volumetric displacement device. especially soda saver 1 and beer saver 1*c*. provides an inexpensive and easy means to prevent effervescent beverages from going flat after their container has been opened and partially consumed.

(14) Embodiment of the volumetric displacement device. especially soda saver 1 and beer saver 1*c*. provides means to replenish effervescence in valuable beverages that have already gone flat.

(15) Embodiment of the volumetric displacement device. especially soda saver 1 and beer saver 1*c*. provides means to conveniently cool drinks and other material with ice while the ice does not dilute the drink or other material with water.

(16) Embodiment of the volumetric displacement device. especially the improved toothpaste tube 3. more convenient improved toothpaste tube 3*c*. and oil dispenser 5. provides a means to make squeexe tubes and bottles deliver usable material as if they were full.

(17) Embodiment of the volumetric displacement device. especially the improved toothpaste tube 3. more convenient improved toothpaste tube 3*c*. and oil dispenser 5. provides means for easier and more controllable delivery or liquid or semi-liquid decorations and material administrations. such as cake icing. artist's preparations. glue.

(18) Embodiment of the volumetric displacement device. especially the improved toothpaste tube 3. more convenient improved toothpaste tube 3*c*. oil dispenser 5. and fuel device 7. provides means to deliver material in squeeze tubes and squeeze bottles (such as glue or mustard) readily in an upward direction even when container is mear empty of usable material.

(19) Embodiment of the volumetric displacement device. especially soda saver 1. beer saver 1*c*. paint dispenser 2. paint dispenser pump 2*e*. oil dispenser 5. fuel device 7 and industrial vat 9. provides means for containers with simple taps. spigots. stopcocks. petcocks or fittings to have the tap at any location in the container eliminating the need to have gravity bring the usable material to the bottom of the tanl for exit at that low point.

(20) Embodiment of the volumetric displacement device. especially the improved toothpaste tube 3 and more convenient improved toothpaste tube 3*c* provides means to nearly empty a squeeze tube without undo effort.

(21) Embodiment of the volumetric displacement device. especially the emptying gas cylinder 8. provides means to almost completely empty valuable gas stored in cylinders.

(22) Embodiment of the volumetric displacement device. especially fuel device 7. provides means to prevent fuel in tanks from sloshing (shifting) without baffles.

(23) Embodiment of the volumetric displacement device. especially soda saver 1. beer saver 1*c*. wine saver 1*d*. and paint dispenser 2. provides means to reduce frothing of liquids in containers caused by sloshing.

(24) Embodiment of the volumetric displacement device. especially paint dispenser 2. and industrial vat 9. provides means to reduce labor in opening and closing air vents on containers in some instances.

(25) Embodiment of the volumetric displacement device. especially paint dispenser 2. provides means for the dispensation of usable material in metered (measured) allotments without exposing the unused material to the atmosphere.

(26) Embodiment of the volumetric displacement device. especially soda saver 1. beer saver 1*c*. wine saver 1*d*. paint dispenser 2. simplified paint dispenser 2*d*. paint dispenser pump 2*e*. and the squeeze bottle variation of the improved toothpaste tube 3. provides means for extra stability by providing full containers which don't tip over so easily. even when the contents are partially consumed.

(27) Embodiment of the volumetric displacement device. especially the improved toothpaste tube 3 and more convenient improved toothpaste tube 3*c*. provides means to positive human psychological effects from using containers that seem full.

(28) Embodiment of the volumetric displacement device. especially paint dispenser 2. provides means to take paint. and other materials out of a can. use it for brush dipping or paint rolling. and to return the paint neatly to the can.

(29) Embodiment of the volumetric displacement device. especially paint dispenser pump 2*e*. and fuel device 7. provides means to tnexpensively pump materials. That means also provides isolation of the usable material from the atmosphere. pollutants in the atmosphere. and water vapor in the atmosphere: extended life of the stored material by isolation from the atmosphere: reduced pollution of the environment by toxic volatile material stored in the container of the pump device: and vapor free storage of volatile flammable liquids.

(30) Embodiment of the volumetric displacement device. especially oil dispenser 5 and its variations. provides means to deliver material from pressurized containers generally at a uniform pressure. even as the usable material in the container is depleted.

(31) Embodiment of the volumetric displacement device. especially soda saver 1. beer saver 1*c*. wine saver 1*d*. paint dispenser 2. simplified paint dispenser 2*d*. paint dispenser pump 2*e*. cereal saver 4. calk dispenser 6. fuel device 7 and containment for industrial apparatus 9. provides means to conserve natural resource and energy by making larger containers which have a greater usable material to container material ratio. and to make fewer containers.

(32) Embodiment of the volumetric displacement device. especially soda saver 1. beer saver 1*c*. wine saver 1*d*. paint dispenser 2. simplified paint dispenser 2*d*. paint dispenser pump 2*e*. cereal saver 4. calk dispenser 6. fuel device 7 and industrial vat 9. provides means to conserve natural resource and energy through increased product life.

(33) Embodiment of the volumetric displacement device. especially oil dispenser 5. provides means to deliver material from pressurized containers generally at a uniform pressure. even as the usable material in the container is depleted. with non-environmentally damaging propellant gas.

Summary of Variation Ramifications.

While the above description contains many specifications, these should not be construed as limitations on the scope of the invention, but rather as an exemplification of the preferred embodiment thereof. Many variations presented on particular described embodiment are applicable to the other described embodiment as well as to embodiment not presented. Many other variations are possible. Some of these variations are presented in the following ramifications section.

Device Variation Ramifications.

The volumetric displacement may be inexpensive enough to be sold with each container made, on a disposable basis.

The embodiment shown and others produced in accordance with this convention might also be produced independently for storage of material by the consumer. As such, they would be sold as an independent unit into which partially consumed usable material could be transferred.

Size Variation Ramifications, Industrial to Consumable.

Volumetric displacement devices can be built in a wide range of sizes. Virtually any size container for material could benefit in some applications with is technology. Industrial size storage containers, large consumer sizes, and even individual small consumption sized containers could be set up as volumetric displacement devices.

Variations have previously been presented of large storage tanks, tankers and silo's. Effervescent beverages are created in industrial size vats, shipped n kegs, distributed in containers of size enough to serve many people, a few people, or for individual consumption. Air sensitive materials are stored in a wide range of sizes from industrial size containers to individual consumption size. Generally, these sizes of containers could be made or retrofit with the volumetric displacement device, thus gaining the advantages of the device after partial consumption of the usable material in the container.

Shape and Material Variation Ramifications.

The variabiltiy in shape for volumetric storage device is greater than the number of shapes for storage devices available today. Barrels, bottles, cans, carafes, casks, drums, flagons, flasks, holding tanks, tanks, supertankers, vats, vessels all have shapes as well as material and size that are suitable for volumetric displacement devices.

A wide variety of materials could be used including plastic, glass, metal and ceramic.

The locations for the necks of the containers is variable. It is possible to envision containers with different sorts of movable partitions and different arrangements of openings and bag locations.

All of the presented embodiment can be utilized with the usable material placed in what is presented as the displacement matter chamber and with the displacement matter in what is presented as the usable material chamber. For this reversing of the function of the usable material chamber and the displacement matter chamber, some of the embodiment require no modification from what is presented. Others require minor modifications such as moving a spout or valve.

Usable Material Ramifications Variation Ramifications.

The materials than can benefit from volumetric displacement devices are numerous. A partial list is presented here.

The soda saver 1 would work with virtually any effervescent beverage, carbonated drink. Beer, ale, lager, champagne, seltzer, sparking wines, sparkling water, mineral water, hard apple cider, carbonated wine coolers, spritzers, carbonated fruit drinks and punch, quinine water, root beer and effervescent beverages sold or known by other names would be protected from going flat in the soda saver and its variations.

Many chemicals are atmosphere sensitive. Fine wines, paints, glues, varnish, shellac, brake fluid, coatings, casting materials, pharmaceutical preparations, are just some.

In all, their would be less fire risk, less loss of material through evaportaion, less environmental damage, and less toxic exposure to humans from volatile liquids, flammable solvents, organic liquids, toxic chemicals, pesticides, petroleum derivatives, gasoline, acetone, ketones, naphtha, toluene, etyhlene, methanol, ethanol, ether, lacquer thinner, alcohol, kerosine and many more materials.

The ability of the device to deliver liquids in a neat manner could be applied to many products. Liquid soaps, detergents, cleaners, oils both cooling and machinery, and industrial chemicals are just some of the examples of materials that often are associated with a messy container. In fact, gravity driven water will serve as a pump for many materials.

With the volumetric displacement devices installed, smells from containers are reduced. This is suitable for chlorine bleaches, ammonia, vinegar, epoxy glues, sewage and septic tanks, sewage trucks, fertilizers, and other foul smelling chemicals.

Artists paints in tubes, foods, cosmetics, chemicals, dyes, calk, glues, putty, runny stuffs, lubricationg and penetrating oil, and many more materials would benefit from a tube or bottle that always seems full.

The volumetric displacement technology can be applied to granular solids and powders. Granular solids are found in many places including grain silos, dusty bins, packaging in small to large applications. Many minerals and chemicals are shipped as powders. Volumetric displacement technology can be used to reduce dust from these sources.

The number of materials that the technology could be employed in to prevent water absorption are numerous. Organic material such as cookies: crackers: snack foods such as potato chips. pretzels. cheese twists. corn chips. and popcorn are just a few that would benefit.

Diplacement Matter Variation Ramifications.

Displacement matter can be a wide variety of substances. In general, virtually any matter in one instance of another could serve as displacement matter. Air and water are the two most common examples. Pressurized gases can serve as displacement matter. $CO^2$ cartridges, pressurized gas cylinders, and pumps can be attached appropriately to the displacement matter passageway to provide compressed gas to the displacement matter chamber. In a sealed displacement matter chamber, these gases will not contaminate the usable material and neither will the gasses produced by the usable material be able to enter the displacement matter chamber.

Water can be introduced to the displacement matter chamber under pressure supplied by a pump, gravity or a conventional pressurized tap water system. This pressure can be used to compress a volume of gas in the usable material chamber, or to drive, dispense usable material from the container.

Ice, in some instances will serve as displacement matter because many usable materials could be chilled with ice in the displacement matter chamber. Material that is chilled with ice in the displacement matter chamber is not contaminated with the water that the ice produces as it melts. Ice can be added to the usable material chamber as well.

A pump could pump air into the displacement matter chamber instead of water. Alternatively, air could passively enter the displacement partition. The constraint of having to keep the material from being contaminated can also be relaxed in some applications. For example, exposing the toothpaste to the air for brief periods of time might not damage it. Therefore, it would be possible to open up the back end of the toothpaste tube, stuff objects into it and re-close the tube.

The technology can prevent liquids from sloshing in half empty containers by filling the interiors with non-compressible material. Fuel tanks in mobile vehicles could have well contained liquids onn board. An extremely slosh proof application would have water injected into the displacement matter chamber.

With proper adaptation, air could be blown into the displacement matter chamber of the paint dispenser by a human, instead of water, as it could be with other embodiment of the volumetric displacement device. Many materials both compressible and non-compressible could be used as displacement matter.

Neck and Passageway Variation Ramifications.

By extending the length of the usable material neck, making it taller, the ease with which the fill level of the usable material could be brought up into the narrow usable material neck would be increased. This is beneficial in preventing the usable material from being exposed to the atmosphere. As the passageway becomes narrower, the surface area of the liquid that is exposed to the atmosphere is smaller. As the surface area of that interface between the usable material and the atmosphere diminishes, so does the contamination of the usable material and the contamination of the environment. If the interface is small enough, the contamination effects become negligible. For many applications, and for most painting applications, this would be perfectly acceptable. The benefits of this have already been explained.

A narrow displacement matter passageway, that is with a small inside diameter, would prevent the membrane of the displacement partition from ballooning out of the opening.

Flexible necks can be incorporated on the volumetric devices. Appropriate offset angles for the neck or flexible necks, make its use easier and more convenient.

Devices without separate usable material passageways are possible, where the displacement partition is inserted and removed from the same neck of the container that serves as a passageway for the usable material. This is discussed more fully in the description of the retrofit volumetric displacement device 10.

Displacement Partition Variation Ramifications.

There are numerous materials for displacement partitions used in different applications. Already discussed is Mylar®, but metal foils without plastic backing would work in satisfactory manner in many instances. Aluminum foil can make a tough membrane that resists tears and punctures if not folded. As the material for the displacement partition, in a disposable package, it would withstand the small amount of wear it would be subjected to.

Many materials such as plastics, rubber, and metal will form membranes, foils or can be made into generally flat forms. Plastics and rubbers such as butyl, CPE, cross linked polyethylene, EPDM, fluorocarbon, latex natural rubber, neoprene, nitrile, nylon, polyester, polyethylene, pvc, teflon, thermoplastic urethane, vinyl and others can be utilized to make displacement partitions. These materials can be used sometimes by themselves, or in combination with other materials. Material combinations are selected so as to be impervious to the compound, usable material, displacement matter they are required to be next to. For almost any chemical, there can usually be found a rubber, plastic, displacement partitiom material combination, that willnot be damaged by that chemical.

Displacement partitions in various embodiment can be made from materials that are rigid, flexible, or elastic.

Some applications will have ddisplacement partitions that can be rolled up for insertion into the container. The displacement partitions will later unfurl. The displacement partition in some applications can be eliminated. Already describe in the soda saver description is a method for using conventional glass marbles as the displacement matter. An agent, immiscible with the container's contents, would eliminate the need for a physical barrier between the contents of the container and the displacement matter chamber. For example, if one poured oil into the soda container, and it did not contaminate the soda, it would provide the necessary volume to fill the container and prevent degassing of the soda. This would prove to be an acceptable solution, and would fall under the protection of the claims in this patent application.

In a squeeze container, the introduction of air, if it were immiscible with the contents, would provide a way to "keep the container full". Forcing fully immiscible, self drying calk into a tube of toothpaste would fill the tube allowint the container to be full, without contaminating the toothpaste, Oil in a sealed vinegar bottle will fill the bottle, not mix with the vinegar, protect the vinegar from the atmosphere's deleterious effects, and prevent the vinegar from off gassing.

The shape of the displacement partition contributes is many instance to the efficiency of the volumetric displacement device. If the container has an extensive usable material neck, the designer of the displacement partition might include the shape of the usable material neck in the shape of the displacement partition. This would more effectively fill the container when it is nearly empty of usable material.

A refinement is to shape the displacement partition and the container as well at to control the location of the necks so that the displacement partition would not block the usable material passageway as the effervescent beverage poured out. Various interior ridges, members and channels added to either the displacement partition or the interior of the container would also accomplish this purpose.

A design feature is the addition of a vent between the contents chamber and the top to the non compressible matter chamber. This vent could be valved. Off gassing pressure in the contents chamber would force the non-compressible material out an improperly sealed displacement matter passageway. If, however, the gas vented to the top of the displacement matter passageway, the gas would escape the leak rather then the displacement matter, thus preventing a messy overflow. A level sensor could be employed to activate the valve.

Clamp, Flange, and Adhesive Variation Ramifications.

The displacement partition clamp with proper design can be eliminated from much of the embodiment depicted. By bonding the displacement partition neck directly to the inside wall of the displacement matter neck a simpler device is created without need for a displacement partition clamp. In the soda saver 1, internal pressure would press the displacement partition neck into the bond that holds it to the inner wall of the displacement matter neck making the bond very effective.

Various adhesives, glues, hot melts, heat bond or welds could be employed to make the attachment.

The displacement partition neck can also be bonded directly to the displacement partition clamp without sandwiching it between the displacement partition clamp and the displacement matter neck lip. The displacement partition neck can be clamped in a two piece displacement partition clamp which attaches to the container. This variation provides an easy way to remove and replace the displacement partition. With this variation usable material can can be transferred in a bi-directional manner between the usable material chamber and the environment in a container that only has one neck and passageway. The displacement matter neck passageway and the usable material neck passageway are one. With the displacement partition clamp and the displacement partition installed, the passageway serves as the displacement matter neck passageway. With the displacement partition clamp and the displacement partition removed or sufficiently loosened, the passageway now serves as the usable material neck passageway.

Modifications of the displacement partition clamp that allow the displacement partition clamp and the displacement partition to be removed from the container, allow for easy cleaning of the container and the displacement partition. Such modifications include the above as well as two piece displacement portion clamps that hold or securely clamp the displacement partition flange. Such modification allows for more ready reuse of the volumetric displacement device.

Cap and Valve Variation Ramifications.

Manufacturing conventions may develop that clearly delineate which cap goes on which neck. For example a hexagonal or red displacement matter cap exterior would make it look and feel different from the usable material cap. Manufacturers would add tamper proof caps.

Caps with simple valves are currently used on conventional containers such as those found on conventional shampoo bottles and body lotions. By pressing a spot on the cap, the valve opens and material can be delivered by turning the bottle upside down and squeezing. these simple cap balves and the variolus styles of them can be fitted to volujmetric displacement devices.

One piece caps can be made that do no require a separate seal to be made. Conventional toothpaste tubes currently are nade this way, that is, with a one piece cap.

Caps would have a variety of attachment mechanisms. Caps can pressure fit into the neck opening as corks in wine bottle do. They can be clamped on.

There is an enormous variety of valves available that would work at the various valved locations on the devices presented. Caps that tightly seal, valves, ball valves, controllable valves, spigots, faucets, cocks, petcocks, atopcocks, caps with with valves, and one way valves are some examples.

Valves can be fit to spigots, taps installed at virtually any location in the container wall, serving to drain or fill either the displacement matter chamber or the usable material chamber. They can be installed at the top or at the bottom of the container. Exit and entrance location for volumetric displacement devices are largely irrelevant since the chambers, when in the full state, act as if they are full. Fluid folws out openings in virtually any direction at any location that the container has beeen tapped.

A variety of valves can be envisioned at the spout. One way valves, and valves that open upon activation, might each prove to be useful. The spout can be made and used with no valve in it. With no valve, the material would wimply folw out in proportion to the amount of displacement matter added, although no specific seal wwould exist to prevent slight air contamination of the unused usable material.

With a user controlled on/off valve, higher water pressure could be maintained and the flow of paint would be quicker. A completely contaminant free usable material could be maintained. Many sorts and styles of valve control are possible including buttons, levers, faucets, stopcocks, electric control and more.

Spout and Displacement Tube Variation Ramifications

The spout passageway could be made very narrow. If it were narrow enough, the need for a valve would be reduced as no atmspheric air could enter the spout passageway to displace the usable material in the passageway. The effect described here is the same as when a finger is held over the upper end of a filled soda straw, or pipette tube. No air can enter the narrow passageway with material present in it.

The displacement tube can be made taller to increase the delivery pressure of the usble material out the spout of the paint saver device. The spout can also be made with a very wide mouth to admit water easily. It can be made funnel like.

Container Vent Variations Ramifications.

Containers that pour their contents, frequently have vents that allow air into the container as the usable material is poured out. This prevents the container from "glugging" as the material tries to exit, at the same time air is trying to get in. The incoming air and the fluid compete for th opening. A typical way to avoid this problem is exhibited by a gas container with two openings, one to pour gas out, the other to admit air. An otherwise sealed container with a cock at the bottom, will necessarily require a vent, generally at the top of the container to admit air.

In general, the volumetric displacement device is admitting displacement material in operation, whether air, water or some other matter. The admittance of the displacement matter eliminates the need for an extra vent, other than what has already been installed for th displacement device.

The volumetric displacement device alters the need for the air vent in a container.

Extra Variation Ramifications.

Appropriate mixing devices incorporated into containers would allow for mixing the contents and never allowing any contamination to enter the usable material chamber. A sealed entrance into the usable material chamber, either for electric wire or impeller crank, would provide a means to mix the contents of the container. An extremely neat and mess free operation could thus be achieved.

Environment Variation Ramifications.

Not only will this device protect usable material from air, a device employing this technology might be emptied in a bath of other materials without the materials of the bath contaminating the chemical. Dispensing of material underwater, in other material baths and in space are examples.

The technology can be used in containers for the prevention of freezer burn. That is, materials stored in partially full containers that are placed in freezing environments, will not loose water to the atmosphere, if the volumetric displacement device is installed in the container.

Scope.

Thus the scope of the invention should be determined by the appended claims and their legal equivalents, rather than by the examples given.

What is claimed is:

1. A volumetric displacement device for maintaining a substantially full-fill state and thereby preventing usable material (50, 50*c*, 50*d*) from degrading due to atmospheric exposure, comprising:

a usable material chamber (46);

a displacement matter chamber (48);

displacement partition means (28) separating said usable material chamber (46) from said displacement matter chamber (48) comprising a flexible membrane;

usable material passageway means (16) for removing said usable material (50, 50*c*, 50*d*) stored in said usable material chamber (46), from said usable material chamber (46); and displacement matter passageway means (44) for introducing displacement matter (52, 52*a*, 52*d*) into said displacement matter chamber (48); wherein:

in an initial state, a positive initial volume of usable material (50, 50*a*, 50*d*) occupies said usable material chamber (46) and a non-negative initial volume of displacement matter (52, 52*a*, 52*d*) is introduced into said displacement matter chamber (48) so as to substantially fill said device and substantially remove atmospheric air from said device and particularly from contact with said usable material (50, 50*c*, 50*d*), wherein the sum of said initial volume of usable material (50, 50*c*, 50*d*) plus said initial volume of displacement matter (52, 52*a*, 52*d*) defines a total initial material volume;

at least some volume of said usable material (50, 50*c*, 50*d*) is removed from said usable material chamber (46), leaving a remaining volume of said usable material (50, 50*c*, 50*d*);

a volume of new displacement matter (52, 52*a*, 52*d*) substantially equivalent to the volume of said usable material (50, 50*c*, 50*d*) so-removed from said usable material chamber (46) is introduced into said displacement matter chamber (48) resulting in a subsequent volume of displacement matter (52, 52*a*, 52*d*), so as to again substantially fill said device and substantially remove atmospheric air from said device and particularly from contact with said usable material (50, 50*c*, 50*d*), wherein the sum of said remaining volume of usable material (50, 50*c*, 50*d*) plus said subsequent volume of displacement matter (52, 52*a*, 52*d*) is substantially equal to said total initial material volume; and said usable material (50, 50*c*, 50*d*) is repeatedly so-removed from said usable material chamber (46) and new displacement matter (52, 52*a*, 52*d*) is repeatedly so-introduced into said displacement matter chamber (48), to substantially continuously maintain said device in a substantially-full state and substantially remove atmospheric air from said device and particularly from contact with said usable material (50, 50*c*, 50*d*), as often as desired, until substantially all of said usable material (50, 50*c*, 50*d*) has been removed from said device.

2. The device of claim 1, configured as an effervescent beverage container (1, 1.1, 1.1*a*, 1.2, 1.3, 1.4, 1.5), further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted; and removable displacement matter closure means (66) for closing and sealing said displacement matter passageway means (44) and preventing said displacement matter (52, 52*a*, 52*d*) from spilling out from said displacement matter chamber (48) when said device is substantially inverted: wherein:

said usable material (50, 50*c*, 50*d*) is a carbonated, effervescent beverage;

said displacement matter (52, 52*a*, 52*d*) is a liquid;

in said initial state, said usable material closure means (60) closes and seals said usable material passageway means (16) and hence said usable material chamber (46), said displacement matter closure means (66) closes and seals said displacement matter passageway means (44) and hence said displacement matter chamber (48), and said device is oriented in a substantially upright position;

said usable material passageway means (16) comprises a usable material opening proximate a top of said device when said device is in said upright position;

said displacement matter passageway means (44) comprises a displacement matter opening also proximate said top of said device when said device is in said upright position;

to so-remove said usable material (50, 50*c*, 50*d*) from said usable material chamber (46), said usable material closure means (60) is removed from said usable material passageway means (16), said usable material closure means (60) is removed from said usable material passageway means (16), said device is substantially inverted sufficiently to enable said beverage to pour out from said usable material chamber (46) through said usable material opening, a desired amount of said beverage is poured out of said usable material chamber (46) through said usable material opening while said displacement matter closure means (66) closes and seals said displacement matter passageway means (4) and hence said displacement matter chamber (48) and so-prevents said displacement matter (52, 52*a*, 52*d*) from spilling out from said displacement matter chamber (48);

to so-introduce said volume of new displacement matter (52, 52*a*, 52*d*) into said displacement mater chamber (48), said device is restored to said upright position, said displacement matter closure means (66) is removed from said displacement matter passageway means (44), and said new displacement matter (52, 52*a*, 52*d*) is poured into said displacement matter chamber (48) through said displacement matter opening, without applying pressure to said new displacement matter (52, 52*a*, 52*d*), until said device is again substantially filled and atmospheric air is substantially removed; and said usable material closure means (60) is then replaced onto said usable material passageway means (16) and said displacement mater closure means (66) is then replaced onto said displacement matter passageway means (44).

3. The device of claim 2, configured as a soda fountain container (1.2, 1.4), further comprising:

soda fountain faucet nozzle means (245) attaching to and sealing said usable material passageway means (16) and providing a conduit for said beverage to pass from said usable material chamber (46), through said usable material passageway means (16), and out of said soda fountain faucet nozzle means (245);

soda bottle air pump means (200) attaching to and sealing said displacement matter passageway means (44) and enabling air to be pumped into said displacement matter chamber (48); wherein said displacement matter (52, 52*a*, 52*d*) is pressurized atmospheric air;

said removable usable material closure means (60) is removed from said usable material passageway means (16) and replaced with said soda fountain faucet nozzle means (245);

said displacement matter closure means (66) is removed from said displacement matter passageway means (44) and replaced with said soda bottle air pump means (200);

to so-remove said usable material (50, 50*c*, 50*d*) from said usable material chamber (46), said soda bottle air pump means (200) is used to pump said pressurized atmospheric air into said displacement mater chamber (48) and exert pressure on said beverage via said displacement partition means (28), said soda fountain faucet nozzle means (245) is set to enable said flow of said usable material (50, 50*c*, 50*d*) out of said usable material chamber (46) through said usable material passageway means (16), a desired amount of said beverage is released out of said device through said soda fountain faucet nozzle means (145), and said soda fountain faucet nozzle means (245) is reset to disable said flow of said usable material (50, 50*c*, 50*d*) out of said usable material chamber (46) through said usable material passageway means (16) once a desired amount of said usable material (50, 50*c*, 50*d*) has been released;

to so-introduce said volume of new displacement matter (52, 52*a*, 52*d*) into said displacement matter chamber (48), said soda bottle air pump means (200) is used to pump additional pressurized atmospheric air into said displacement matter chamber (48).

4. The device of claim 1, configured as an alcoholic beverage container (1*c*), further comprising:

petcock means (60*c*) for enabling and disabling a flow of said usable material (50, 50*c*, 50*d*) out of said usable material chamber (46) via said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said petcock means (60*c*) is set to so-disable said flow of said usable material (50, 50*c*, 50*d*) out of said usable material chamber (46);

removable displacement matter closure means (66) for closing and sealing said displacement matter passageway means (44); wherein:

said usable material (50, 50*c*, 50*d*) is an alcoholic beverage;

said displacement matter (52, 52*a*, 52*d*) is a liquid;

in said initial state, said petcock means (60*c*) is set to so-disable said flow of said usable material (50, 50*c*, 50*d*) out of said usable material chamber (46), said displacement matter closure means (66) closes and seals said displacement matter passageway means (44) and hence said displacement matter chamber (48), and said device is oriented in an upright position;

said usable material passageway means (16) comprises said petcock means (60*c*), located proximate a lower region of said device when said device is in said upright position;

said displacement matter passageway means (44) comprises a displacement matter opening proximate said top of said device when said device is in said upright position;

to so-remove said usable material (50, 50*c*, 50*d*) from said usable material chamber (46), said displacement matter closure means (66) is removed from said displacement matter passageway means (44) to open said displacement matter passageway means (44) and allow atmospheric air to enter said displacment matter chamber (48) through said displacement matter passageway means (44), said petcock means (60*c*) is set to enable said flow of said usable material (50, 50*c*, 50*d*) out of said usable material chamber (46) through said usable material passageway means (16), a desired amount of said beverage is released out of said device through said petcock means (60*c*) while said atmospheric air enters said displacement matter chamber (48) through said open displacement matter passageway means (4), and said petcock means (60*c*) is reset to disable said flow of said usable material (50, 50*c*, 50*d*) has been so-released;

to so-introduce said volume of new displacement matter (52, 52*a*, 52*d*) into said displacement matter chamber (48), said new displacement matter (52, 52*a*, 52*d*) is poured into said displacement matter chamber (48) through said open displacement matter opening without applying pressure to said new displacement matter (48) through said open displacement matter opening without applying pressure to said new displacement matter (52, 52*a*, 52*d*), until said displacement matter chamber (48) is again substantially filled with said displacement matter (52, 52*a*, 52*d*) and said atmospheric air is substantially removed therefrom; and said displacement matter closure means (66) is then replaced onto said displacement matter passageway means (44).

5. The device of claim 4, wherein said alcoholic beverage is selected from the alcoholic beverage group consisting of carbonated alcoholic beverages, beer, champagne, sparkling wines, wine coolers, wine spritzers, ale, lager, ale, lager, and hard apple cider.

6. The device of claim 1, configured as a chemical-dispensing container (2), further comprising:

spout means (94) sealably attached to said usable material passageway means (16), vertically oriented above said usable material passageway means (16) at the position of attachment thereto;

elongated displacemetn tube means (84) sealably attached to said displacement matter passageway means (4) and therethrough to said displacement partition means (28), vertically oriented above said displacement matter passageway means (44) at the position of attachment thereto, with a top of said displacement tube means (84) being at a higher elevation than a top of said spout means (94);

a chemical container (12); and a chemical container lid (72) sealably attached to a top of said chemical container (12), said chemical container lid (72) further comprising said usable material passageway means (16) and said displacement matter passageway means (44) to which is so-attached said spout means (94), said elongated displacement tube means (84), and said displacement partition means (28); wherein:

said usable material (50, 50*c*, 50*d*) is a chemical compound;

said displacement matter (52, 52*a*, 52*d*) is a liquid;

said usable material chamber is bounded outwardly by said chemical container (12) and inwardly by an exterior of said displacement partition means (28);

to so-remove said usable material (50, 50*c*, 50*d*) from said usable material chamber (46), a predetermined volume of displacement matter (50, 50*c*, 50*d*) is poured into said elongated displacement tube means (84), through said usable material passageway means (16), and into said displacement matter chamber (48), without applying pressure to said displacement matter (52, 52*a*, 52*d*), to thereby displace a volume of said chemical compound substantially equal to said predetermined volume of displacement matter (50, 50*c*, 50*d*) and force said volume of said chemical compound to exit from said usable material chamber (46) through said spout means (94), by virtue of said higher elevation of said top of said displacement tube means (84) over said top of said spout means (94) and said sealable attachments.

7. The device of claim 6, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

8. The device of claim 1, configured as a chemical-dispensing container (2), further comprising:

paint brush cup means (110) sealably attaching to said usable material passageway means (16), vertically oriented above said usable material passageway means (16) at the position of attachment thereto;

elongated displacement tube means (84) sealably attached to said displacement matter passageway means (44) and therethrough to said displacement partition means (28), vertically oriented above said displacement matter passageway means (44) at the position of attachment thereto, with a top of said displacement tube means (84) being at a higher elevation than a top of said paint brush cup means (110);

a chemical container (12); and a chemical container lid (72) sealably attached to a top of said chemical container (12), said chemical container lid (72) further comprising said usable material passageway means (16) and said displacement matter passageway means (44) to which is so-attached said paint brush cup means (110), said elongated displacement tube means (84), and said displacement partition means (28); wherein:

said usable material (50, 50*c*, 50*d*) is a chemical compound;

said displacement matter (52, 52*a*, 52*d*) is a liquid;

said usable material chamber is bounded outwardly by said chemical container (12) and inwardly by an exterior of said displacemetn partition means (28);

to so-remove said usable material (50, 50*c*, 50*d*) from said usable material chamber (46), a predetermined volume of displacement matter (50, 50*c*, 50*d*) is poured into said elongated displacement tube means (84), through said usable material passageway means (16), and into said displacement matter chamber (48), without applying pressure to said displacement matter (52, 52*a*, 52*d*), to thereby displace a volume of said chemical compound substantially equal to said predetermined volume of displacement matter (50, 50*c*, 50*d*) and force said volume of said chemical compound to exit from said usable material chamber (46) through said paint brush cup means (110) and to pool within said paint brush cup means (110), by virtue of said higher elevation of said top of said desplacemnt tube means (84) over said top of said paint brush cup means (110) and said releasable attachments.

9. The device of claim 8, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

10. The device of claim 1, configured as a chemical-pouring container (2*a*, 2*e*), further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially tipped; and removable displacement matter closure means (66) for closing and sealing said displacement matter passageway means (44) and preventing said displacement matter (52, 52*a*, 52*d*) from spilling out from said displacement matter chamber (48) when said device is substantially tipped; wherein:

said usable material (50, 50*c*, 50*d*) is a chemical compound;

said displacement matter (52, 52*a*, 52*d*) is a liquid;

in said initial state, said usable material closure means (60) closes and seals said usable material passageway means (16) and hence said usable material chamber (46), said displacement matter closure means (66) closes and seals said displacement matter passageway means (44) and hence said displacement matter chamber (48), and said device is oriented in a substantially upright position;

said usable material passageway means (16) and said displacement matter passageway means (44) both emanate proximate a top of said device when said device is in said upright position, oriented at an angle with respect to one another such that when said device is substantially tipped sufficiently to enable said chemical compound to pour out from said usable material chamber (46), said displacement matter passageway means (44) orientation retains a sufficient vertical component such that said displacement matter (52, 52*a*, 52*d*) does not pour out from said displacement matter passageway means (44) even if said displacement matter closure means (66) has been removed from said displacement matter passageway means (4);

to so-remove said usable material (50, 50*c*, 50*d*) from said usable material chamber (46), said usable material closure means (60) is removed from said usable material passageway means (16), said displacement matter closure means (66) is optionally removed from said displacement matter passageway means (4); said device is substantially tipped sufficiently to enable said chemical compound to pour out from said usable material chamber (46) through said usable material opening, and a desired amount of said chemical compound is poured out of said usable material chamber (46) through said usable material opening while said displacement matter passageway means (44) orientation retains a sufficient vertical component such that said displacement matter (52, 52*a*, 52*d*) does not pour out from said displacement matter passageway means (44) even if said displacement matter closure means (66) has been removed from said displacement matter passageway means (44);

to so-introduce said volume of new displacement matter (52, 52*a*, 52*d*) into said displacement matter chamber (48), said device is restored to said upright position, said displacement matter closure means (66) is removed from said displacement matter passageway means (44) if it was not already removed while said chemical compound was so-poured out of said usable material chamber (46), and said new displacement matter (52, 52*a*, 52*d*) is poured into said displacement matter chamber (48) through said displacement matter opening, without applying pressure to said new displacement matter (52, 52*a*, 52*d*), until said device is again substantially filled and atmospheric air is substantially removed; and said usable material closure means (60) is then replaced onto said usable material passageway means (16) and said displacement matter closure means (66) is then replaced onto said displacement matter passageway means (44).

11. The device of claim 10, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

12. The device of claim 1, configured as a flowable ointment container (3, 3*c*), further comprising:

removable usable material closure means (60) for closing and sealing said usable material passageway means (16), preventing atmospheric air from entering said usable material chamber (46) via said usable matter passageway means (16) and from contacting said usable material (50, 50*c*, 50*d*), and preventing said usable material (50, 50*c*, 50*d*) from discharging out from said usable material chamber (46);

removable displacement matter closure means (66) for closing and sealing said displacement matter passageway means (44) and preventing said displacement matter (52, 52*a*, 52*d*) from discharging out from said displacement matter chamber (48);

a flexible flowable ointment container (12); and syringe means (74) sealably mating with said displacement matter passageway means (44) for applying pressure to the introduction of said displacement matter (52, 52*a*, 52*d*) into said displacement matter chamber (48); wherein:

said usable material (50, 50*c*, 50*d*) is flowable ointment;

said displacement matter (52, 52*a*, 52*d*) is a liquid;

said usable material chamber is bounded outwardly by said flowable ointment container (12) and inwardly by an exterior of said displacement partition means (28);

in said initial state, said usable material closure means (6) closes and seals said usable material passageway means (16) and hence said usable material chamber (46), said displacement matter closure means (66) closes and seals said displacement matter passageway means (44) and hence said displacement matter chamber (48);

to so-remove said usable material (50, 50*c*, 50*d*) from said usable material chamber (46), said usable material closure means (60) is removed from said usable material passageway mean (16), and said flowable ointment container (12) is squeezed until a desired amount of said flowable ointment is discharged;

to so-introduce said volume of new displacement matter (50, 50*c*, 50*d*) into said displacement matter chamber (48), said usable material closure means (60) is replaced onto said usable material passageway means (16), said displacement mater closure means (66) is removed from said displacement matter passageway means (44), said new displacement matter is introduced into said syringe means (74), said syringe means (74) is sealably mated to said displacement matter passageway means (44), and pressure is applied to said syringe thereby introducing said displacement matter (50, 50*c*, 50*d*) into said displacement matter chamber (48) until said flowable ointment container (12) is restored to an expanded substantially full-fill state; and said displacement matter closure means (66) is then replaced onto said displacement matter passageway means (44).

13. The device of claim 12, wherein said flowable ointment is selected from the flowable ointment group consisting of toothpaste, mustard, ketchup, artists paints, glue, calk application, cake icing, cosmetic preparations, thick liquid foods, soaps, suntan lotion, body lotion, shampoo, and car wax.

14. The device of claim 12, wherein said usable material passageway means (16) and said displacement matter passageway means (44) are substantially located on a same end of said flowable ointment container (12) as one another.

15. The device of claim 12, wherein said usable material passageway means (16) and said displacement matter passageway means (44) are substantially located on opposite ends of said flowable ointment container (12) from one another.

16. The device of claim 1, configured as an organic grain material storage container (4), further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted;

removable displacement matter closure means (66) comprising clamp means affixed to said displacement matter passageway means (44) to enable and disable a flow of displacement matter into and out of said displacement matter chamber (48) through said displacement matter passageway means (44);

a cereal container (12) suitable for storing organic grain material; and vent means (74) enabling atmospheric air to vent from said cereal container; wherein said usable material (50, 50*c*, 50*d*) is an organic grain material;

said displacement matter (52, 52*a*, 52*d*) is atmospheric air;

in said initial state, said usable material closure means (60) closes and seals said usable material passageway means (16) and hence said usable material chamber (46), said displacement matter closure means (66) is clamped shut seals said displacement matter passageway means (44) and hence said displacement matter chamber (48), and said device is oriented in a substantially upright position;

to so-remove said usable material (50, 50*c*, 50*d*) from said usable material chamber (46), said clamp means of said displacement matter closure means (66) is opened to enable said atmospheric air displacement matter (52, 52*a*, 52*d*) to exit said displacement matter chamber (48) as necessary, said usable material closure means (60) is removed from said usable material passageway means (16), said device is inverted sufficiently to enable said organic grain material to pour out from said usable material chamber (46) through said usable material opening, and a desired amount of said organic grain material is poured out of said usable material chamber (46) through said usable material opening;

to so-introduce said volume of new displacement matter (52, 52*a*, 52*d*) into said displacement matter chamber (48), said device is restored to said upright position, and said atmospheric air comprising said displacement matter (52, 52*a*, 52*d*) is blown through said displacement matter passageway means (44) into said displacment matter chamber (48) thereby expanding said displacement partition means (28) and substantially expelling atmospheric air out of said usable material chamber (46) through said vent means 74; and said usable material closure means (60) is then replaced onto said usable material passageway means (16) and said displacement matter closure means (66) is then clamped closed.

17. The device of claim 16, wherein said organic grain material is selected from the organic grain group consisting of dried food stuffs, crackers, dry cereal, snack chips, dried fruit, candy, and organic material.

18. The device of claim 1, configured as an oil container (5), further comprising:

oil valve means (60) attaching to and sealing said usable material passageway means (16) and providing a conduit for said usable material (50, 50*c*, 50*d*) to pass form said usable material chamber (46), through said usable material passageway means (16), and out of said oil valve means (60);

grease fitting and pump means (66) attaching to and sealing said displacment mater passageway means (44) and preventing said displacement matter (52, 52*a*, 52*d*) form spilling out from said displacement matter chamber (48) when said grease fitting means (66) is substantially closed, and enabling said displacment matter (52, 52*a*, 52*d*) to be pumped into said displacement matter chamber (48) under pressure; wherein said usable material (50, 50*c*, 50*d*) is penetrating oil;

said displacement matter (52, 52*a*, 52*d*) is pressurized grease;

to so-remove said usable material (50, 50*c*, 50*d*) form said usable material chamber (46), said grease fitting and pump means (66) is used to pump said pressurized grease into said displacement matter chamber (48) and exert pressure on said penetrating oil via said displacement partition means (38), said oil valve means (60) is actuated to enable said flow of said usable material (50, 50*c*, 50*d*) out of said usable material chamber (46) through said usable material passageway means (16), a desired amount of said penetrating oil is released out of said device through said oil valve means (60), and said oil valve means (60) is deactuated to disable said flow of said usable material (50, 50*c*, 50*d*) out of said usable material chamber (46) through said usable material passageway means (16) once a desired amount of said usable material (50, 50*c*, 50*d*) has been released;

to so-introduce said volume of new displacment matter (52, 52*a*, 52*d*) into said displacement matter chamber (48); said grease fitting and pump means (66) is again used to pump additional pressurized grease into said displacement matter chamber (48) and so-exert pressure on said penetrating oil.

19. The device of claim 1, configured as a calk dispenser (6), further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from discharging out from said usable material chamber (46);

removable displacment matter closure means (66) for closing and sealing said displacement matter passageway means (44) and preventing said displacement matter (52, 52*a*, 52*d*) from discharging out from said displacement matter chamber (48);

a calk container (12); and grease gun means sealably mating with said displacment matter passageway means (44) for applying pressure to the introduction of said displacemetn matter (52, 52*a*, 52*d*) into said displacement matter chamber (48); wherein:

said usable material (50, 50*c*, 50*d*) is calk;

said displacement matter (52, 52*a*, 52*d*) is pressurized grease;

said usable material chamber is bounded outwardly by said calk container (12) and inwardly by an exterior of said displacement partition means (28);

in said initial state, said usable material closure means (60) closes and seals said usable material passageway means (16) and hence said usable material chamber (46), said displacement matter closure means (66) closes and seals said displacement matter passageway means (44) and hence said displacement matter chamber (48);

to so-remove said usable material (50, 50*c*, 50*d*) from said usable material chamber (46) and to so-introduce said volume of new displacment matter (52, 52*a*, 52*d*) into said displacment matter chamber (48), said usable material closure means (60) is removed from said usable material passageway means (16), said grease gun means is activated to force said pressurized grease into said displacement matter chamber (48) and thereby exert pressure on said calk via said displacement partition means (28), said calk is discharged until a desired amount of said calk has been discharged, said grease gun is deactivated; and said displacment matter closure means (66) is then replaced onto said displacement matter passageway means (44).

20. The device of claim 1, configured as a fuel tank (7), further comprising:

fuel tank container means (12) for storing fuel and providing said fuel as needed to a fuel-powered engine connected thereto;

air pump means (66) attaching to and sealing said displacment matter passageway means (44) and enabling air to be pumped into said displacment matter chamber (48), further comprising a purge valve allowing air in said displacment matter chamber to escape; and sensing means to monitor a fuel pressure inside of said fuel tank container means (12); wherein:

said usable material passageway means (16) comprises a fuel line (72);

said usable material passageway means (16) further comprises a fuel entry opening separate from said conventional fuel line to load said usable material (50, 50*c*, 50*d*) into said device;

said usable material (50, 50*c*, 50*d*) is a fuel;

said displacment matter (52, 52*a*, 52*d*) is pressurized air;

said usable material chamber is bounded outwardly by said fuel tank container means (12) and inwardly by an exterior of said displacement partition means (28);

said fuel is loaded via said fuel entry opening into said usable material chamber (46) of said device, while said purge valve so-allows air in said displacment matter chamber to escape;

to so-remove said usable material (50, 50*c*, 50*d*) from said usable material chamber (46), said loaded fuel in said usable material chamber (46) exits via said fuel line (72) and is provided as needed to said fuel-powered engine; and to so-introduce said volume of new displacment matter (52, 52*a*, 52*d*) into said displacment matter chamber (48), said air pump means (66) is activated to pump said pressurized air into said displacement matter chamber (48) when said pressure inside of said fuel tank container means is sensed to fall below a first desired predetermined tank pressure, and said air pump means (66) is deactivated from so-pumping when said pressure inside of said fuel tank container means is sensed to rise above a second desired predetermined tank pressure.

21. The device of claim 1, configured as a gas storage container (8), further comprising:

regulator means (60) for closing and sealing said usable material passageway means (16), enabling a gas to be pumped under pressure into said usable material chamber (46) via said usable material passageway means (16), and enabling and disabling said usable material (50, 50*c*, 50*d*) form being emitted from said usable material chamber (46), as desired; and removable displacment matter closure means (66) for closing and sealing said displacment matter passageway means (44) and preventing said displacment matter (52, 52*a*, 52*d*) from spilling out from said displacement matter chamber (48); wherein:

said usable material (50, 50*c*, 50*d*) is a gas;

said displacment matter (52, 52*a*, 52*d*) is a liquid;

to fill said usable material chamber (46) with said gas, said displacement matter closure means (66) is removed, said regulator means (60) is set to allow said gas to be so-pumped under pressure into said usable material chamber (46), said gas is pumped into said usable material chamber (46) via said usable material; passageway means (16) until said displacment partition means (28) is substantially collapsed, said displacement matter closure means (66) is replaced and sealed onto said displacement matter passageway means (44), said gas is further pumped into said usable material chamber (46) until a desired predetermined pressure of said gas within said usable material chamber (46) has been reached, and said regulator means (60) is then set to disable and seal against further gas passage into and out of said usable material chamber (46);

to so-remove said gas from said usable material chamber (46), said regulator means (60) is set to allow said gas to exit said usable material chamber (46) via said via said usable material passageway means (16), a desired amount of said gas is emitted out of said usable material chamber (46), and said regulator means (60) is then set to again disable and seal against further gas passage into and out of said usable material chamber (46); and to remove any remaining gas from said usable material chamber (46) once the pressure of said gas within said usable material chamber (46) has dropped below atmospheric pressure, and said regulator means (60) is again set to allow said gas to exit said usable material chamber (46), and said displacement matter (52, 52*a*, 52*d*) is then poured into said displacement matter chamber thereby expelling said remaining gas.

22. The device of claim 1, configured as an anaerobic industrial vat (9), further comprising:

industrial vat container means (12) for containing said usable material (50, 50*c*, 50*d*); and material pump means for pumping said usable material into said usable material chamber (46) via said usable material passageway means (16); wherein:

said usable material passageway means (16) comprises petcock means (70) for enabling and disabling a movement of said usable material (50, 50*c*, 50*d*) out of said usable material chamber (46);

said usable material passageway means (16) further comprises an entry opening separate from said petcock means (70);

said usable material (50, 50*c*, 50*d*) comprises a pharmaceutical preparation used to impregnate impregnable capsules (51);

said displacement matter (52, 52*a*, 52*d*) is a liquid;

to prevent air contact with said usable material (50, 50*c*, 50*d*), said usable material (50, 50*c*, 50*d*) is pumped into said usable material chamber (46) via said usable material passageway means (16);

to so-remove said usable material (50, 50*c*, 50*d*) from said usable material chamber (46), said usable material (50, 50*c*, 50*d*) is released through said petcock means; and to so-introduce said volume of new displacement matter (52, 52*a*, 52*d*) into said displacement matter chamber (48), said displacement matter (52, 52*a*, 52*d*) is flowed through said displacement matter passageway means (44) and into said displacement matter chamber (48).

23. The device of claim 1, further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted; and removable displacement matter closure means (66) for closing and sealing said displacement matter passageway means (44) and preventing said displacement matter (52, 52*a*, 52*d*) from spilling out from said displacement matter chamber (48) when said device is substantially inverted.

24. The device of claim 1, wherein:

to so-remove said usable material (50, 50*c*, 50*d*) from said usable material chamber (46), usable material closure means (60) is removed from said usable material passageway means (16), said device is substantially inverted sufficiently to enable said usable material (50, 50*c*, 50*d*) to pour out from said usable material chamber (46) through said usable material opening, and a desired amount of said usable material (50, 50*c*, 50*d*) is poured out of said usable material chamber (46) through said usable material opening while displacement matter closure means (66) closes and seals said displacement matter passageway means (44) and hence said displacement matter chamber (48) and so-prevents said displacement matter (52, 52*a*, 52*d*) from spilling out from said displacement matter chamber (48);

to so-introduce said volume of new displacement mater (52, 52*a*, 52*d*) into said displacement matter chamber (48), said device is restored to said upright position, said displacement matter closure means (66) is removed from said displacement matter passageway means (44), and said new displacement matter (52, 52*a*, 52*d*) is poured into said displacement matter chamber (48) through said displacement matter opening, without applying pressure to said new displacement matter (52, 52*a*, 52*d*), until said device is again substantially filled and atmospheric air is substantially removed.

25. The device of claim 1, wherein a usable material neck of said usable material passageway means (16) resides within a displacement matter neck of said displacement mater passageway means (44).

26. The device of claim 25, wherein said usable material neck and said displacement matter neck are affixed to and held in place by a neck stabilizing member (500).

27. The device of claim 1, wherein said usable material neck and said displacement matter passageway means (44) resides within a usable material neck of said usable material passageway means (16).

28. The device of claim 27, wherein said usable material neck and said displacement matter neck are affixed to and held in place by a neck stabilizing member (500).

29. The device of claim 1, wherein said usable material passageway and said displacement matter passageway are oriented substantially parallel to one another.

30. The device of claim 1, further comprising equilibration means for levels of liquid displacement matter (52, 52*a*, 52*d*) and of liquid usable material (50, 50*c*, 50*d*) to rise to the same height due to gravitational forces.

31. The device of claim 30, wherein said equilibration means further prevents the formation of a gas bubble at the top of said device.

32. The device of claim 31, wherein said equilibration means comprises providing said usable material passageway and said displacement mater passageway is substantially parallel orientation to one another.

33. The device of claim 32, wherein said closure order control means comprises positioning said usable materials closure and said displacement matter closure such that the usable material closure must be removed before the displacement mater closure.

34. The device of claim 32, wherein one of said closure means is placed at least partially over the other of said closure means, such that said one of said closures must be removed before said other of said closures, and said other of said closures must be replaced before said one of said closures.

35. The device of claim 30, wherein said equilibration means further comprises providing said usable material passageway and said displacement matter passageway with sufficiently narrow necks such a level of said usable material (50, 50*c*, 50*d*) rises up into relatively narrow regions of said necks so as to minimize the amount of air in the container and to minimize the surface area of said usable material in contact with said air.

36. The device of claim 1, further comprising a gas bubble prevention means to prevent the formation of a gas bubble at the top of said device; wherein said usable material passageway is proximate the top of said usable material chamber; and the entry of displacement matter into said displacement matter chamber drives an upper level of said usable material into a relatively narrow region of the usable material neck, while the rising usable material level drives air out of an exterior opening of said usable material neck passageway and out from said device; and thereby, the amount of air in the usable material neck is minimized, the amount of air in the usable material chamber is minimized, and the surface area of said usable material in contact with said air is minimized.

37. The device of claim 1, further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted;

removable displacement matter closure means (66) for closing and sealing said displacement matter passageway means (44) and preventing said displacement matter (52, 52*a*, 52*d*) from spilling out from said displacement matter chamber (48) when said device is substantially inverted; further comprising; and closure order control means for regulating the sequence of opening said closing said usable material passageway (16) and said displacement matter passageway (44), wherein an opening order is enforced as among the possibilities of opening the usable material passageway before opening the displacement matter passageway, opening the displacement matter passageway before the usable material passageway, or opening both passageways simultaneously.

38. The device of claim 37, wherein one of said closure means has an interfering member interfering with the other of said closure means, thereby forcing said closure means to be removed and replaced in an order determined thereby.

39. The device of claim 1, wherein:

an exterior opening of said displacement matter passageway means (4) for entry and exit of displacement matter (52, 52*a*, 52*d*) from outside of said device into said displacement matter chamber (48) has a cross sectional area large enough to accommodate, without spilling, a stream of water poured from a member of the group consisting of a conventional water pitcher and a conventional sink water faucet; and said cross sectional area is large enough to enable atmospheric air flowing back out of said displacement matter chamber (48) chamber to be substantially replaced by a portion of said displacement matter (52, 52*a*, 52*d*) entering said displacement matter chamber (48), at the same time the displacement matter (52, 52*a*, 52*d*) is entering, when said usable material chamber (46) is sealed and when said usable material chamber (46) is opened.

40. The device of claim 1, wherein:

an exterior opening of said usable material passageway means (16) for entry and exit of usable material (50, 50*c*, 50*d*) into and out from said usable material chamber (46) of said device, and said usable material passageway opening, has a cross sectional area large enough to accommodate, without spilling, a stream of water poured from a member of the group consisting of a conventional water pitcher and a conventional sink water faucet; and when said device is substantially inverted sufficiently to enable said usable material (50, 50*c*, 50*d*) to pour out from said usable material chamber (46) through said exterior opening of usable material passageway means (16), said cross sectional area is large enough to enable atmospheric air flowing back out of said usable material chamber (46) and through usable material passageway means (16) to substantially replace a portion of said usable material (50, 50*c*, 50*d*) as it is being removed from said usable material chamber (46).

41. The device of claim 1, wherein:

an exterior opening of said displacement matter passageway means (44) for entry and exit of displacement matter (52, 52*a*, 52*d*) transferring between the environment and said displacement matter chamber (49) and in a manner that is directly to and from said displacement matter chamber (48) has a relatively larger cross-sectional area than the cross sectional area of means for removing the displacement matter (52, 52*a*, 52*d*) from the displacement matter chamber (48); wherein when said device is substantially inverted sufficiently to enable said displacement matter (52, 52*a*, 52*d*) to pour out from said displacement matter chamber (48) through said exterior opening of said displacement matter passageway means (44) a desired amount of said displacement matter (52, 52*a*, 52*d*) is poured out of said displacement matter chamber (48) and through said opening of displacement matter passageway means (44), atmospheric air may flow back into the displacement matter chamber (48) to substantially replace a portion of said displacement matter (52, 52*a*, 52*d*) removed from said displacement matter chamber (48) at the same time the displacement matter (52, 52*a*, 52*d*) is being removed, when said usable material chamber (46) is sealed and when said usable material chamber (46) is open; whereby a device selected from the group consisting of a soda straw, suction device, sipping means, and pouring means which has a cross sectional area that is less than the cross sectional area of the exterior opening to the displacement matter passageway means (44), can be used while air enters the displacement matter chamber (48) as the displacement matter (52, 52*a*, 52*d*) is removed, and the user may have the opportunity to drink displacement matter when it is chilled water.

42. The device of claim 1, wherein:

an exterior opening of said displacement matter passageway means (44) for entry and exit of displacement matter (52, 52*a*, 52*d*) from outside of said device into said displacement matter chamber (48) has a cross sectional area large enough to accommodate, without spilling, a stream of water poured form a member of the group consisting of a conventional water pitcher and a conventional sink water faucet;

an exterior opening of said usable material passageway means (16) for entry and exit of usable material (50, 50*c*, 50*d*) into and out from said usable material chamber (46) of said device, and said usable material passageway opening, has a cross sectional area large enough to accommodate, without spilling, a stream of water poured from a member of the group consisting of a conventional water pitcher and a conventional sink water faucet;

said cross sectional area is large enough to enable atmospheric air flowing back out of said displacement matter chamber (48) chamber to be substantially replaced by a portion of said displacement matter (52, 52*a*, 52*d*) entering said displacement matter chamber (48), at the same time the displacement matter (52, 52*a*, 52*d*) is entering, when said usable amterial chamber (46) is sealed and when said usable material chamber (46) is open; and when said device is substantially inverted sufficiently to enable said usable material (50*a*, 50*c*, 50*d*) to pour out from said usable material chamber (46) through said exterior opening of usable material passageway means (16), said cross sectional area is large enough to enable atmospheric air flowing back out of said usable material chamber (46) and through usable material passageway means (16) to substantially replace a portion of said usable material (50, 50*c*, 50*d*) as it is being removed from said usable material chamber (46).

43. The device of claim 1, further comprising:

a usable material neck (20) extending upwardly to an opening mouth of said usable material passageway means (16), said opening mouth defined by an upper rim through which usable material (50, 50*c*, 50*d*) may pass when said device is substantially inverted sufficiently to enable said usable material (50, 50*c*, 50*d*), to pour out from said usable material chamber (46) through said usable material passageway means (16) opening mouth, and through which, when a desired amount of said usable material (50, 50*c*, 50*d*) is poured out of said usable material chamber (46), atmospheric air may flow back into the usable material chamber to substantially replace a portion of said usable material (50, 50*c*, 50*d*) removed from said usable material chamber (46), at the same time the usable material (50, 50*c*, 50*d*) is being removed, when said usable material chamber (46) is sealed and when said usable material chamber (46) is open; whereby a usable material (50, 50*c*, 50*d*), pouring structure comprising an extended container neck and pour mouth has been created extending above the device to serve as a convenient pouring means for the user.

44. The device of claim 1, further comprising:

a displacement matter neck (14) extending upwardly to a mouth opening of said displacement matter passageway means (44), said mouth opening defined by an upper rim through which said displacement matter (52, 52*a*, 52*d*) may pass through when said device is substantially inverted sufficiently to enable said displacement matter (52, 52*a*, 52*d*) to pour out from said displacement matter chamber (48) through said displacement matter passageway means (44) opening mouth, and through which atmospheric air may flow back into the displacement matter chamber (48) to substantially replace a portion of said displacemetn matter (52, 52*a*, 52*d*) removed from said displacement matter chamber (48) at the same time the displacement matter (52, 52*a*, 52*d*) is being removed, when said usable material chamber (46) is sealed and when said usable material chamber (46) is open; whereby a pouring structure comprising an extended container neck and pour mouth has been created extending above the device to serve as a convenient pouring means for the user to remove the displacement matter (52, 52*a*, 52*d*) from the container for consumption or container disposal.

45. The device of claim 1, further comprising;

a usable material neck (20) extending upwardly to an opening mouth of said usable material passageway means (16), said opening mouth defined by an upper rim through which usable material (50, 50*c*, 50*d*) may pass when said device is substantially inverted sufficiently to enable said usable material (50, 50*c*, 50*d*), to pour out from said usable material chamber (46) through said usable material passageway means (16) opening mouth, and through which, when a desired amount of said usable material (50, 50*c*, 50*d*) is poured out of said usable material chamber (46), atmospheric air may flow back into the usable material chamber to substantially replace a portion of said usable material (50, 50*c*, 50*d*) removed from said usable material chamber (46), at the same time the usable material (50, 50*c*, 50*d*) is being removed, when said usable material chamber (46) is sealed and when said usable material chamber (46) is open; and a displacement matter neck (14) extending upwardly to a mouth opening of said displacement matter passageway means (44), said mouth opening defined by an upper rim through which said displacement matter (52, 52*a*, 52*d*) may pass through when said device is substantially inverted sufficiently to enable said displacement matter (52, 52*a*, 52*d*) to pour out from said displacement matter chamber (48) through said displacement matter passageway means (44) opening mouth, and through which atmospheric air may flow back into the displacement matter chamber (48) to substantially replace a portion of said displacement matter (52, 52*a*, 52*d*) removed from said displacement matter chamber (48) at the same time the displacement matter (52, 52*a*, 52*d*) is being removed, when said usable material chamber (46) is sealed and when said usable material chamber (46) is open; whereby a usable material (50, 50*c*, 50*d*), pouring structure comprising an extended container neck and pour mouth has been created extending above the device to serve as a convenient pouring means for the user; and a pouring structure comprising an extended container neck and pour mouth has been created extending above the device to serve as a convenient pouring means for the user to remove the displacement matter (52, 52*a*, 52*d*) from the container for consumption or container disposal.

46. The device of claim 1 or claim 43, said usable material neck further comprising neck male threads (24) used to secure a closure means to said usable material neck (20).

47. The device of claim 1 or claim 44, said displacement mater neck further comprising male threads (18) used to secure a closure means to said displacement matter neck (14).

48. The device of claim 1 or claim 43 or claim 44, said usable material neck further comprising neck male threads (24) used to secure a closure means to said usable material neck (20); and said displacement matter neck further comprising male threads (18) used to secure a closure means to said displacement matter neck (14).

49. The device of claim 1, further comprising:

removable usable material closure means (60) for closing and sealing said usable amterial passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted; wherein:

said displacement partition means (28) is affixed to an interior wall of said usable material chamber (46) and is not removed from said device when said removable usable material closure means (60) is removed from said device.

50. The device of claim 1, further comprising:

removable displacement matter closure means (66) for closing and sealing said displacement matter passageway means (44) and preventing said displacement matter (52, 52*a*, 52*d*) from spilling out from said displacement matter chamber (48) when said device is substantially inverted; wherein:

said displacement partition means (28) is affixed to the interior wall of said displacement matter chamber (48) and is not removed from said device when said displacement matter closure means (66) is removed from said device.

51. The device of claim 1 further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted; and removable displacement matter closure means (66) for closing and sealing said displacement matter passageway means (44) and preventing said displacement matter (52, 52*a*, 52*d*) from spilling out from said displacement matter chamber (48) when said device is substantially inverted; wherein:

said displacement partition means (28) is not affixed to, and is separate from ,said removable usable material closure means (60), and is not affixed to, and is separate from, said removable displacement matter closure means (66), such that said displacement partition means (28) is not removed from said usable material chamber (46) when said usable material closure means (60) is removed, and said displacement partition means (28) is not removed from said displacement matter chamber (48) when said removable displacement matter closure means (66) is removed.

52. The device of claim 1, wherein said displacement matter (52, 52*a*, 52*d*) is relatively non-compressible.

53. The device of claim 1, wherein said displacement matter (52, 52*a*, 52*d*) is water.

54. The device of claim 1, wherein said usable material is an air sensitive material.

55. The device of claim 1, wherein said usable material is a liquid material with a gas content such that said gas is released to the atmosphere if said liquid material contacts the atmosphere.

56. The device of claim 1, wherein said usable material (50, 50c, 50d) is a liquid.

57. The device of claim 1, wherein said usable material (50, 50c, 50d) is a beverage.

58. The device of claim 1, wherein said usable material (50, 50c, 50d) is an effervescent beverage.

59. The device of claim 1, wherein said usable material (50, 50c, 50d) is a carbonated soft drink.

60. The device of claim 1, wherein said usable material (50, 50c, 50d) is beer.

61. The device of claim 1, wherein said usable material (50, 50c, 50d) is champagne.

62. The device of claim 1, wherein said usable material (50, 50c, 50d) is wine spritzer.

63. The device of claim 1, wherein said usable material (50, 50c, 50d) is sparking water.

64. The device of claim 1, wherein said displacement matter (52, 52a, 52d) is relatively non-compressible and is a liquid.

65. The device of claim 1, wherein said displacement matter (52, 52a, 52d) is relatively non-compressible and is a solid.

66. The device of claim 1, wherein said displacement matter (52, 52a, 52d) is relatively non-compressible and is a non-rigid solid.

67. The device of claim 1, wherein said displacement matter (52, 52a, 52d) is relatively non-compressible and is an off gassing material.

68. The device of claim 1, wherein said displacement matter (52, 52a, 52d) is relatively non-compressible and is an effervescent liquid.

69. The device of claim 1, wherein said displacement matter (52, 52a, 52d) is relatively non-compressible and is a compressed gas already compressed to a degree to which further compression in negligible.

70. The device of claim 1, wherein said displacement matter (52, 52a, 52d) is relatively non-compressible and is heated.

71. The device of claim 1, wherein said displacement matter (52, 52a, 52d) is relatively non-compressible and is chilled.

72. The device of claim 1, wherein said usable amterial chamber (46) is composed of relatively gas impermeable material.

73. The device of claim 1, wherein said usable material chamber (46) is composed of relatively rigid material.

74. The device of claim 1, wherein usable material chamber (46) is composed of relatively flexible material.

75. The device of claim 1, wherein said displacement partition means (28) is relatively gas impermeable.

76. The device of claim 1, wherein said usable material chamber (46) is substantially sealed from the environment thereby preventing substantial material exchange between the usable material chamber (46) and the environment.

77. The device of claim 76, wherein said usable material chamber is constructed of relatively gas impermeable material wherein the usable material chamber can hold significant internal pressure for a time period of several months.

78. The device of claim 1, wherein said displacement matter chamber (48) is tightly sealed.

79. The device of claim 1, wherein said displacement matter (52, 52a, 52d) is relatively non-compensable and said usable material (50, 50c, 50d) is an air sensitive material.

80. The device of claim 1, wherein said displacement matter (52, 52a, 52d) is relatively non-compensable and said usable material (50, 50c, 50d) is an effervescent beverage.

81. The device of claim 1, further comprising:

removable usable material closure means (60) for capping and sealing said usable material passageway means (16), preventing atmospheric air from entering said usable material chamber (46) via said usable material passageway means (16) and from contacting said usable material (50, 50c, 50d), and preventing said usable material (50, 50c, 50d) from spilling out from said usable material chamber (46) when said device is substantially inverted; wherein:

said displacement matter (52, 52a, 52d) is relatively non-compensable.

82. The device of claim 1, further comprising a gas impermeable displacement partition means (28); wherein said displacement matter (52, 52a, 52d) is relatively non-compensable.

83. The device of claim 1, further comprising:

removable usable material closure means (60) for capping and sealing said usable material passageway means (16), preventing atmospheric air from entering said usable material chamber (46) via said usable material passageway means (16) and from contacting said usable material (50, 50c, 50d), and preventing said usable material (50, 50c, 50d) from spilling out from said usable material chamber (46) when said device is substantially inverted; wherein:

said displacement matter (52, 52a, 52d) is relatively non-compensable and said usable material (50, 50c, 50d) is an air sensitive material.

84. The device of claim 1, further comprising:

removable usable material closure means (60) for capping and sealing said usable material passageway means (16), preventing atmospheric air from entering said usable material chamber (46) via said usable material passageway means (16) and from contacting said usable material (50, 50c, 50d), and preventing said usable material (50, 50c, 50d) from spilling out from said usable material chamber (46) when said device is substantially inverted; wherein said displacement matter (52, 52a, 52d) is relatively non-compressible and said usable material (50, 50c, 50d) is an effervescent beverage.

85. The device of claim 1, further comprising:

removable usable material closure means (60) for capping and sealing said usable material passageway means (16), preventing atmospheric air from entering said usable material chamber (46) via said usable material passageway means (16) and from contacting said usable material (50, 50c, 50d), and preventing said usable material (50, 50c, 50d) from spilling out from said usable material chamber (46) when said device is substantially inverted; wherein said displacement matter (52, 52a, 52d) is relatively non-compensable and said usable material chamber (46) is capable of holding substantial gas pressure for a period of months.

86. The device of claim 1, further comprising:

gas impermeable displacement partition means (28); and removable usable material closure means (60) for capping and sealing said usable material passageway means (16), preventing atmospheric air from entering said usable material chamber (46) via said usable material passageway means (16) and from contacting said usable material (50, 50c, 50d), and preventing said usable material (50, 50c, 50d) from spilling out from said usable material chamber (46) when said device is substantially inverted; wherein said displacment matter (52, 52*a*, 52*d*) is relatively non-compensable.

87. The device of claim 1, further comprising gas impermeable displacement partition means (28), wherein said displacement matter (52, 52*a*, 52*d*) is relatively non-compensable and said usable material (50, 50*c*, 50*d*) is an air sensitive material.

88. The device of claim 1, further comprising gas impermeable displacement partition means (28), wherein said displacement matter (52, 52*a*, 52*d*) is relatively non-compensable and said usable material chamber (46) is capable of holding substantial gas pressure for a period of months.

89. The device of claim 1, further comprising gas impermeable displacement partition means (28), wherein said displacement matter (52, 52*a*, 52*d*) is relatively non-compensable and said usable material chamber (46) is capable of holding substantial gas pressure for a period of months.

90. The device of claim 1, further comprising:

removable usable material closure means (60) for capping and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted; and a gas impermeable membrane; wherein said displacement matter (52, 52*a*, 52*d*) is relatively non-compressible and said usable material (50, 50*c*, 50*d*) is an effervescent beverage.

91. A volumetric displacement device (10) for retrofitting a preexisting container to maintain a substantially full-full state and thereby preventing usable material (50, 50*c*, 50*d*) within said container from degrading due to atmospheric exposure, comprising:

displacement partition means (28) defining an outer boundary of a displacement matter chamber (48) and comprising a flexible membrane;

container closure means (12) for sealably attaching to a top of said preexisting container;

usable material passageway means (16) passing through said container closure means (12), for removing said usable material (50, 50*c*, 50*d*) from within said container while said container closure means (12) is sealably so-attached to said top of said preexisting container;

displacement matter passageway means (44) also passing through said container closure means (12), for introducing displacement matter (52, 52*a*, 52*d*) into said displacement matter chamber (48) from outside of said container while said container closure means (12) is sealably so-attached to said top of said preexisting container.

92. The device of claim 91, wherein, in a retrofitted configuration:

said displacment partition means (28) is fitted into and enclosed within said preexisting container;

said enclosing of said displacement partition means (28) within said preexisting container defines a usable material chamber bounded outwardly by said preexisting container and inwardly by an exterior of said displacement partition means (28); and said container closure means (12) is sealably attached to a top of said preexisting container.

93. The device of claim 92, wherein:

in an initial state, a positive initial volume of usable material (50, 50*c*, 50*d*) occupies said usable material chamber (46) and a non-negative initial volume of displacement matter (50, 50*c*, 50*d*) is introduced into said displacement matter chamber (48) so as to substantially fill said device and substantially remove atmospheric air from said device and particularly from contact with said usable material (50, 50*c*, 50*d*), wherein the sum of said initial volume of usable material (50, 50*c*, 50*d*) plus said initial volume of displacement matter (52, 52*a*, 52*d*) defines a total initial material volume;

at least some volume of said usable material (50, 50*c*, 50*d*) is removed from said usable material chamber (46), leaving a remaining volume of said usable material (50, 50*c*, 50*d*);

a volume of new displacement matter (52, 52*a*, 52*d*) substantially equivalent to the volume of said usable material (50, 50*c*, 50*d*) so-removed from said usable material chamber (46) is introduced into said displacement matter chamber (48) resulting in a subsequent volume of displacment matter (52, 52*a*, 52*d*), so as to again substantially fill said device and substantially remove atmospheric air from said device and particularly from contact with said usable material (50, 50*c*, 50*d*), wherein the sum of said remaining volume of usable material (50, 50*c*, 50*d*) plus said subsequent volume of displacement matter (52, 52*a*, 52*d*) is substantially equal to said total initial material volume; and usable material (50, 50*c*, 50*d*) is repeatedly so-removed from said usable material chamber (46) and new displacement matter (52, 52*a*, 52*d*) is repeatedly so-introduced into said displacement matter chamber (48) so as to substantially continuously maintain said device in a substantially-full state and substantially remove atmospheric air from said device and particularly from contact with said usable material (50, 50*c*, 50*d*), as often as desired, until substantially all of said usable material (50, 50*c*, 50*d*) has been removed from said device.

94. The device of claim 92, configured for use in combination with an effervescent beverage container (1, 1.1, 1.1*a*, 1.2, 1.3, 1.4, 1.5), further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted; and removable displacement matter closure means (66) for closing and sealing said displacement matter passageway means (44) and preventing said displacement matter (52, 52*a*, 52*d*) from spilling out from said displacement matter chamber (48) when said device is substantially inverted; wherein:

said preexisting container is an effervescent beverage container;

said usable material (50, 50*c*, 50*d*) is a carbonated, effervescent beverage;

said displacement matter (52, 52*a*, 52*d*) is a liquid;

in said initial stage, said usable material closure means (60) closes and seals said usable material passageway means (16) and hence said usable material chamber (46), said displacement matter closure means (66) closes and seals said displacement matter passageway means (44) and hence said displacement matter chamber (48), and said device is oriented in a substantially upright position;

said usable material passageway means (16) comprises a usable material opening proximate a top of said device when said device is in said upright position;

said displacement matter passageway means (44) comprises a displacement matter opening also proximate said top of said device when said device is in said upright position;

to so-remove said usable material (50, 50*c*, 50*d*) form said usable material chamber (46), said usable material closure means (60) is removed from said usable material passageway means (16), said device is substantially inverted sufficiently to enable said beverage to pour out from said usable material chamber (46) through said usable material opening, a desired amount of said beverage is poured out of said usable material chamber (46) through said usable material opening while said displacement matter closure means (66) closes and seals said displacment matter passageway means (4) and hence said displacement matter chamber (48) and so-prevents said displacement matter (52, 52*a*, 52*d*) from spilling out from said displacement matter chamber (48);

to so-introduce said volume of new displacement matter (52, 52*a*, 52*d*) into said displacement matter chamber (48), said device is restored to said upright position, said displacement matter closure means (66) is removed from said displacement matter passageway means (44), and said new displacement matter (52, 52*a*, 52*d*) is poured into said displacement matter chamber (48) through said displacement matter opening, without applying pressure to said new displacement matter (52, 52*a*, 52*d*), until said device is again substantially filled and atmospheric air is substantially removed; and said usable material closure means (60) is then replaced onto said usable material passageway means (16) and said displacement matter closure means (66) is then replaced onto said displacement matter passageway means (44).

95. The device of claim 94, configured as a soda fountain container (1.2, 1.4), further comprising:

soda fountain faucet nozzle means (245) attaching to and sealing said usable material passageway means (16) and providing a conduit for said beverage to pass from said usable material chamber (46), through said usable material passageway means (16), and out of said soda fountain faucet nozzle means (245);

soda bottle air pump means (200) attaching to and sealing said displacement matter passageway means (44) and enabling air to be pumped into said displacement mater chamber (48); wherein said displacement matter (52, 52*a*, 52*d*) is pressurized atmospheric air;

said removable usable material closure means (60) is removed from said usable material passageway means (16) and replaced with said soda fountain faucet nozzle means (245);

said displacement matter closure means (66) is removed from said displacement matter passageway means (44) and replaced with said soda bottle air pump means (200);

to so-remove said usable material (50, 50*c*, 50*d*) from said usable material chamber (46), said soda bottle air pump means (200) is used to pump said pressurized atmospheric air into said displacement matter chamber (48) and exert pressure on said beverage via said displacement partition means (28), said soda fountain faucet nozzle means (245) is set to enable said flow of said usable material (50, 50*c*, 50*d*) out of said usable material chamber (46) through said usable material passageway means (16), a desired amount of said beverage is released out of said device through said soda fountain faucet nozzle means (245), and said soda fountain faucet nozzle means (245) is reset to disable said flow of said usable material (50, 50*c*, 50*d*) out of said usable material chamber (46) through said usable material passageway means (16) once a desired amount of said usable material (50, 50*c*, 50*d*) has been released;

to so-introduce said volume of new displacement matter (52, 52*a*, 52*d*) into said displacement matter chamber (48), said soda bottle air pump means (200) is used to pump additional pressurized atmospheric air into said displacement matter chamber (48).

96. The device of claim 92, configured for use as a chemical-dispensing container (2), further comprising:

spout means (94) sealably attached to said usable material passageway means (16), vertically oriented above said usable material passageway means (16) at the position of attachment thereto; and elongated displacement tube means (84) sealably attached to said displacement matter passageway means (44) and therethrough to said displacement partition means (28), vertically oriented above said displacement matter passageway means (44) at the position of attachment thereto, with a top of said displacement tube means (84) being at a higher elevation than a top of said spout means (94); wherein said preexisting container is a chemical container (12); and said container closure means (12) is a chemical container lid (72) sealably attached to a top of said chemical container (12), said chemical container lid (72) further comprising said usable material passageway means (16) and said displacement matter passageway means (44) to which is so-attached said spout means (94), said elongated displacement tube means (84), and said displacement partition means (28); wherein:

said usable material (50, 50*c*, 50*d*) is a chemical compound;

said displacement matter (52, 52*a*, 52*d*) is a liquid;

said usable material chamber is bounded outwardly by said chemical container (12) and inwardly by an exterior of said displacement partition means (28);

to so-remove said usable material (50, 50*c*, 50*d*) from said usable material chamber (46), a predetermined volume of displacment matter (50, 50*c*, 50*d*) is poured into said elongated displacement tube means (84), through said usable material passageway means (16, and into said displacement matter chamber (48), without applying pressure to said displacement matter (52, 52*a*, 52*d*), to thereby displace a volume of said chemical compound substantially equal to said predetermined volume of displacement matter (50, 50*c*, 50*d*) and force said volume of said chemical compound to exit from said usable material chamber (46) through said spout means (94), by virtue of said higher elevation of said top of said displacement tube means (84) over said top of said spout means (94) and said sealable attachments.

97. The device of claim 96, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

98. The device of claim 92, configured as a chemical-dispensing container (2), further comprising:

paint brush cup means (110) sealably attaching to said usable material passageway means (16), vertically oriented above said usable material passageway means (16) at the position of attachment thereto; and elongated displacement tube means (84) sealably attached to said displacement matter passageway means (44) and therethrough to said displacement partition means (28), vertically oriented above said displacement matter passageway means (44) at the position of attachment thereto, with a top of said displacement tube means (84) being at a higher elevation than a tip of said paint brush cup means (110); wherein said preexisting container is a chemical container (12); and said container closure means (12) is a chemical container lid (72) sealably attached to a top of said chemical container (12), said chemical container lid (72) further comprising said usable material passageway means (16) and said displacement matter passageway means (44) to which is so-attached said paint brush cup means (110), said elongated displacement tube means (84), and said displacement partition means (28); wherein:

said usable material (50, 50*c*, 50*d*) is a chemical compound;

said displacement matter (52, 52*a*, 52*d*) is a liquid;

said usable material chamber is bounded outwardly by said chemical container (12) and inwardly by an exterior of said displacement partition means (28);

to so-remove said usable material (50, 50*c*, 50*d*) from said usable material chamber (46), a predetermined volume of displacement matter (50, 50*c*, 50*d*) is poured into said elongated displacement tube means (84), through said usable material passageway means (16), and into said displacement matter chamber (48), without applying pressure to said displacement matter (52, 52*a*, 52*d*), to thereby displace a volume of said chemical compound substantially equal to said predetermined volume of displacement matter (50, 50*c*, 50*d*) and force said volume of said chemical compound to exit form said usable material chamber (46) through said paint brush cup means (110) and to pool within said paint brush cup means (110), by virtue of said higher elevation of said top of said displacment tube means (84) over said tip of said paint brush cup means (110) and said sealable attachments.

99. The device of claim 98, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

100. The device of claim 92, configured as an organic grain material storage container (4), further comprising:

removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted;

removable displacement matter closure means (66) comprising clamp means affixed to said displacement matter passageway means (44) to enable and disable a flow of displacement matter into and out of said displacement matter chamber (48) through said displacement matter passageway means (44); and vent means (74) enabling atmospheric air to vent from said preexisting container; wherein said preexisting container is a cereal container (12) suitable for storing organic grain material said usable material (50, 50*c*, 50*d*) is an organic grain material;

said displacement matter (52, 52*a*, 52*d*) is atmospheric air;

in said initial state, said usable material closure means (60) closes and seals said usable material passageway means (16) and hence said usable material chamber (46), said displacement matter closure means (66) is clamped shut seals and displacement matter passageway means (44) and hence said displacement matter chamber (48), and said device is oriented in a substantially upright position;

to so-remove said usable material (50, 50*c*, 50*d*) from said usable material chamber (46), said clamp means of said displacement matter closure means (66) is opened to enable said atmospheric air displacment matter (52, 52*a*, 52*d*) to exit said displacement matter chamber (48) as necessary, said usable material closure means (60) is removed from said usable material passageway means (16), said device is inverted sufficiently to enable said organic grain material to pour out from said usable material chamber (46) through said usable material opening, and a desired amount of said organic grain material is poured out of said usable material chamber (46) through said usable material opening;

to so-introduce said volume of new displacement matter (52, 52*a*, 52*d*) into said displacement matter chamber (48), said device is restored to said upright position, and said atmospheric air comprising said displacement matter (52, 52*a*, 52*d*) is blown through said displacement partition means (28) and substantially expelling atmospheric air out of said usable material chamber (46) through said vent means 74; and said usable material closure means (60) is then replaced onto said usable material passageway means (16) and said displacement matter closure means (66) is then clamped closed.

101. The device of claim 100, wherein said organic grain material is selected from the organic grain material group consisting of dried food stuffs, crackers, dry cereal, snack chips, dried fruit, candy, and organic materials.

102. The device of claim 92, configured as a fuel tank (7), wherein said preexisting container is a fuel tank container means (12) for storing fuel and providing said fuel as needed to a fuel-powered engine connected thereto; further comprising:

air pump means (66) attaching to and sealing said displacemetn matter passageway means (44) and enabling air to be pumped into said displacement matter chamber (48), further comprising a purge valve allowing air in said displacement matter chamber to escape; and sensing means to monitor a fuel pressure inside of said fuel tank container means (12); wherein:

said usable material passageway means (16) comprises a fuel line (72);

said usable material passageway means (16) further comprises a fuel entry opening separate from said conventional fuel line to load said usable material (50, 50*c*, 50*d*) into said device;

said usable material (50, 50*c*, 50*d*) is a fuel;

said displacement matter (52, 52*a*, 52*d*) is pressurized air;

said usable material chamber is bounded outwardly by said fuel tank container means (12) and inwardly by an exterior of said displacement partition means (28);

said fuel is loaded via said fuel entry opening into said usable material chamber (46) of said device, while said purge valve so-allows air in said displacement matter chamber to escape;

to so-remove said usable material (50, 50*c*, 50*d*) from said usable material chamber (46), said loaded fuel in said usable material chamber (46) exits via said fuel line (72) and is provided as needed to said fuel-powered engine; and to so-introduce said volume of new displacment matter (52, 52*a*, 52*d*) into said displacement matter chamber (48), said air pump means (66) is activated to pump said pressurized air into said displacement matter chamber (48) when said pressure inside of said fuel tank container means is sensed to fall below a first desired predetermined tank pressure, and said air pump means (66) is deactivated from so-pumping when said pressure inside of said fuel tank container means is sensed to rise above a second desired predetermined tank pressure.

103. The device of claim 92, configured as a gas storage container (8), further comprising:

regulator means (60) for closing and sealing said usable material passageway means (16), enabling a gas to be pumped under pressure into said usable material chamber (46) via said usable material passageway means (16), and enabling and disabling said usable material (50, 50*c*, 50*d*) from being emitted from said usable material chamber (46), as desired; and removable displacment matter closure means (66) for closing and sealing said displacement matter passageway means (44) and preventing said displacement matter (52, 52*a*, 52*d*) from spilling out from said displacement matter chamber (48); wherein:

said usable material (50, 50*c*, 50*d*) is a gas;

said displacement matter (52, 52*a*, 52*d*) is a liquid;

to fill said usable material chamber (46) with said gas, said displacement matter closure means (66) is removed, said regulator means (60) is set to allow said gas to be so-pumped under pressure into said usable material chamber (46), said gas is pumped into said usable material chamber (46) via said usable material passageway means (16) until said displacement partition means (28) is substantially collapsed, said displacement matter closure means (66) is replaced and sealed onto said displacement matter passageway means (44), said gas is further pumped into said usable material chamber (46) until a desired predetermined pressure of said gas within said usable material chamber (46) has been reached, and said regulator means (60) is then set to disable and seal against further gas passage into and out of said usable material chamber (46);

to so-remove said gas from said usable material chamber (46), said regulator means (60) is set to allow said gas to exit said usable material chamber (46) via said via said usable material passageway means (16), a desired amount of said gas is emitted out of said usable material chamber (46), and said regulator means (60) is then set to again disable and seal against further gas passage into and out of said usable material chamber (46); and to remove any remaining gas from said usable material chamber (46) once the pressure if said gas within said usable material chamber (46) has dropped below atmospheric pressure, said regulator means (60) is again set to allow said gas to exit said usable material chamber (46), and said displacement matter (52, 52*a*, 52*d*) is then poured into said displacement matter chamber thereby expelling said remaining gas.

104. The device of claim 92, configured as an anaerobic industrial vat (9), wherein said preexisting container is an industrial vat container means (12) for containing said usable material (50, 50*c*, 50*d*); further comprising:

material pump means for pumping said usable material into said usable material chamber (46) via said usable material passageway means (16); wherein:

said usable material passageway means (16) comprises petcock means (70) for enabling and disabling a movement of said usable material (50, 50*c*, 50*d*) out of said usable material chamber (46);

said usable material passageway means (16) further comprises an entry opening separate from said petcock means (70);

said usable material (50, 50*c*, 50*d*) comprises a pharmaceutical preparation used to impregnate impregnable capsules (51);

said displacement matter (52, 52*a*, 52*d*) is a liquid;

to prevent air contact with said usable material (50, 50*c*, 50*d*), said usable material (50, 50*c*, 50*d*) is pumped into said usable amterial chamber (46) via said usable material passageway means (16);

to so-remove said usable material (50, 50*c*, 50*d*) from said usable material chamber (46), said usable material (50, 50*c*, 50*d*)is released through said petcock means; and to so-introduce said volume of new displacement matter (52, 52*a*, 52*d*) into said displacement matter chamber (48), said displacement matter (52, 52*a*, 52*d*) is flowed through said displacement matter passageway means (44) and into said displacement matter chamber (48).

105. A method for preventing usable material (50, 50*c*, 50*d*) from degrading due to atmospheric exposure, using a volumetric displacement device for maintaining a substantially full-fill state of a container said usable material (50, 50*c*, 50*d*), comprising the steps of:

in an initial stage, occupying a usable material chamber (46) with a positive initial volume of usable material (50, 50*c*, 50*d*), and introducing a non-negative initial volume of displacement matter (52, 52*a*, 52*d*) into a displacement matter chamber (48) separated from said displacement matter chamber (48) using displacement partition means (28) comprising a flexible membrane, thereby substantially filling said device and substantially removing atmospheric air from said device and particularly from contact with said usable material (50, 50*c*, 50*d*), the sum of said initial volume of usable material (50, 50*c*, 50*d*) plus said initial volume of displacement matter (52, 52*a*, 52*d*) defining a total intial material volume;

removing at least some volume of said usable material (50, 50*c*, 50*d*) from said usable material chamber (46), leaving a remaining volume of said usable material (50, 50*c*, 50*d*);

introducing into said displacement matter chamber (48), a volume of new displacement matter (52, 52*a*, 52*d*) substantially equivalent to the volume of said usable material (50, 50*c*, 50*d*) so-removed from said usable material chamber (46), resulting in a subsequent volume of displacement matter (52, 52*a*, 52*d*), thereby again substantially filling said device and substantially removing atmospheric air from said device and particularly from contact with said usable material (50, 50*c*, 50*d*), the sum of said remaining volume of usable material (50, 50*c*, 50*d*) plus said subsequent volume of displacment matter (52, 52*a*, 52*d*) substantially equaling said total initial material volume; and repeatedly so-removing usable material (50, 50*c*, 50*d*) from said usable material chamber (46) and repeatedly so-introducing new displacement matter (52, 52*a*, 52*d*) into said displacement matter chamber (48), thereby substantially continuously maintaining said device in a substantially-full state and substantially removing atmospheric air from said device and particularly from contact with said usable material (50, 50*c*, 50*d*), as often as desired, until substantially all of said usable material (50, 50*c*, 50*d*) has been removed from said device.

106. The method of claim 105, used for preventing atmospheric degradation of an effervescent beverage, further comprising the steps of:

locating a usable material opening of said usable material passageway means (16) proximate a top of said device when said device is in said upright position;

locating a displacement matter opening of said displacement mater passageway means (44) proximate said top of said device when said device is in an upright position in said initial state, orienting said device in a substantially upright position;

in said initial state, further closing and sealing said usable material passageway means (16) and hence said usable material chamber (46) using removable usable material closure means (60), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted;

in said initial state, further closing and sealing said displacement matter passageway means (44) and hence said displacement matter chamber (48) using removable displacement matter closure means (66) preventing said displacement matter (52, 52*a*, 52*d*), and preventing said usable material (50, 50*c*, 50*d*) from spilling out from said usable material chamber (46) when said device is substantially inverted;

in said initial state, further closing and sealing said displacement matter passageway means (44) and hence said displacement matter chamber (48) using removable displacement matter closure means (66) preventing said displacement matter (52, 52*a*, 52*d*) from spilling out from said displacement matter chamber (48) when said device is substantially inverted;

so-removing said usable material (50, 50*c*, 50*d*) from said usable material chamber (46), comprising the further steps of removing said usable material closure means (60) from said usable material passageway means (16), substantially inverting said device sufficiently enabling said beverage to pour out from said usable material chamber (46) through said usable material opening, pouring a desired amount of said beverage out of said usable material chamber (46) through said usable material opening while said displacement matter closure means (66) is closing and sealing said displacement matter passageway means (44) and hence said displacement matter chamber (48) and is so-preventing said displacement matter (52, 52*a*, 52*d*) from spilling out from said displacement matter chamber (48);

so-introducing said volume of new displacement matter (52, 52*a*, 52*d*) into said displacment matter chamber (48), comprising the further steps of restoring said device to said upright position, removing said displacement matter closure means (66) from said displacement matter passageway means (44), and pouring said new displacement matter (52, 52*a*, 52*d*) into said displacement matter (52, 52*a*, 52*d*), until said device is again substantially filled and atmospheric air is substantially removed; and replacing said usable material closure means (60) onto said usable material passageway means (16) and replacing said displacement matter closure means (66) onto said displacement matter passageway means (44); wherein:

said usable material (50, 50*c*, 50*d*) is a carbonated, effervescent beverage;

said displacment matter (52, 52*a*, 52*d*) is a liquid.

107. The method of claim 106, used in a soda fountain (1.2, 1.4) configuration, further comprising the steps of:

removing said removable usable material closure means (60) from said usable material passageway means (16);

replacing said removable usable material closure means (60) by attaching soda fountain faucet nozzle means (245) to, and sealing therewith, said usable material passageway means (16), thereby providing a conduit for said beverage to pass from said usable material chamber (46), through said usable material passageway means (16), and out of said soda fountain faucet nozzle means (245);

removing said displacement matter closure means (66) from said displacment matter passageway means (44);

replacing said displacement matter closure means (66) by attaching soda bottle air pump means (200) to, and sealing therewith, said displacement matter passageway means (44), thereby enabling air to be pumped into said displacement matter chamber (48); wherein so-removing said usable material (50, 50*c*, 50*d*) from said usable material chamber (46), comprising the further steps of pumping pressurized atmospheric air into said displacement matter chamber (48) using said soda bottle air pump means (200) thereby exerting pressure on said beverage via said displacement partition means (28), setting said soda fountain faucet nozzle means (245) to enable said flow of said usable material (50, 50*c*, 50*d*) out of said usable material chamber (46) through said usable material passageway means (16), releasing a desired amount of said beverage out of said device through said soda fountain faucet nozzle means (245), and resetting said soda fountain faucet nozzle means (245) to disable said flow of said usable material (50, 50*c*, 50*d*) out of said usable material chamber (46) through said usable material passageway means (16) once a desired amount of said usable material (50, 50*c*, 50*d*) has been released;

so-introducing said volume of new displacement matter (52, 52*a*, 52*d*) into said displacement matter chamber (48), comprising the further step of pumping additional pressurized atmospheric air into said displacement matter chamber (48) using said soda bottle air pump means; wherein said displacment matter (52, 52*a*, 52*d*) comprises said pressurized atmospheric air.

108. The method of claim 105, used for preventing atmospheric degradation of an alcoholic beverage, further comprising the steps of:

locating petcock means (60*c*) of said usable material passageway means (16) proximate a lower region of said device when said device is in an upright position;

locating a displacement matter opening of said displacement mater passageway means (44) proximate a top of said device when said device is in said upright position;

orienting said device in said upright position;

in said initial state, further setting said petcock means (60*c*) to disable a flow of said usable material (50, 50*c*, 50*d*) out of said usable material chamber (46) via said usable material passageway means (16), prevent atmospheric air from entering said usable material chamber (46) via said usable material passageway means (16) and from contacting said usable material (50, 50*c*, 50*d*), and prevent said usable material (50, 50*c*, 50*d*) from spilling out from said usable material chamber (46)

in said initial state, further closing and sealing said displacement matter passageway means (44) and hence said displacement matter chamber (48) using removable displacement matter closure means (66), so-removing said usable material (50, 50*c*, 50*d*) from said usable material chamber (46), comprising the further steps of removing said displacement matter closure means (66) from said displacement matter passageway means (44) thereby opening said displacement matter passageway means (44) and allowing atmospheric air to enter said displacement matter chamber (48) through said displacement matter passageway means (44), setting said petcock means (60*c*) to enable said flow of said usable material (50, 50*c*, 50*d*) out of said usable material chamber (46) through said usable material passageway means (16), releasing a desired amount of said beverage out of said device through said petcock means (60*c*) while said atmospheric air enters said displacement matter chamber (48) through said open displacement matter passageway means (44), and resetting said petcock means (60*c*) to disable said flow of said usable material (50, 50*c*, 50*d*) out of said usable material chamber (46) through said usable material passageway means (16) once a desired amount of said usable material (50, 50*c*, 50*d*) has been so-released;

so-introducing said volume of new displacement matter (52, 52*a*, 52*d*) into said displacement matter chamber (48), comprising the further step of pouring said new displacement matter (52, 52*a*, 52*d*) into said displacement matter chamber (48) through said open displacement matter opening without applying pressure to said new displacement matter (52, 52*a*, 52*d*), until said displacement matter chamber (48) is again substantially filled with said displacement matter (52, 52*a*, 52*d*) and said atmospheric air is substantially removed therefrom; and replacing said displacement matter closure means (66) onto said displacment matter passageway means (44); wherein said usable material (50, 50*c*, 50*d*) is an alcoholic beverage;

said displacement matter (52, 52*a*, 52*d*) is a liquid.

109. The method of claim 108, wherein said alcoholic beverage is selected from the alcoholic beverage group consisting of carbonated alcoholic beverages, beer, champagne, sparkling wines, wine coolers, wine spritzers, ale, lager ale, lager, and hard apple cider.

110. The method of claim 105, used for preventing atmospheric degradation of a chemical compound, further comprising the steps of:

providing spout means (94) sealably attached to said usable material passageway means (16), vertically oriented above said usable material passageway means (16) at the position of attachment thereto;

further providing elongated displacement tube means (84) sealably attached to said displacement matter passageway means (44) and therethrough to said displacement partition means (28), vertically oriented above said displacement matter passageway means (44) at the position of attachment thereto, with a top of said displacement tube means (84) being at a higher elevation than a top of said spout means (94);

sealably-attaching a chemical container lid (72) to a top of a chemical container (12), said chemical container lid (72) further comprising said usable material passageway means (16) and said displacement matter passageway means (44) to which is so-attached said spout means (94), said elongated displacement tube means (84), and said displacement partition means (28);

so-removing by said chemical container (12) and inwardly by an exterior of said displacement partition means (28), comprising the further steps of pouring a predetermined volume of displacement matter (50, 50*c*, 50*d*) into said elongated displacement tube means (84), through said usable material passageway means (16), and into said displacement matter chamber (48), without applying pressure to said displacement matter (52, 52*a*, 52*d*), thereby displacing a volume of said chemical compound substantially equal to said predetermined volume of displacement matter (50, 50*c*, 50*d*) and forcing said volume of said chemical compound to exit from said usable material chamber (46) through said spout means (94), by virtue of said higher elevation of said top of said displacement tube means (84) over said top of said spout means (94) and said sealable attachments; wherein said usable material (50, 50*c*, 50*d*) is a chemical compound; and said displacement matter (52, 52*a*, 52*d*) is a liquid.

111. The method of claim 110, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

112. The method of claim 105, used for preventing atmospheric degradation of a chemical compound, further comprising the steps of:

providing paint brush cup means (110) sealably attached to said usable material passageway means (16), vertically oriented above said usable material passageway means (16) at the position of attachment thereto;

further providing elongated displacement tube means (84) sealably attached to said displacement matter passageway means (44) and therethrough to said displacement partition means (28), vertically oriented above said displacement matter passageway means (44) at the position of attachment thereto, with a top of said displacement tube means (84) being at a higher elevation than a top of said paint brush cup means (110);

sealably-attaching a chemical container lid (72) to a top of a chemical container (12), said chemical container lid (72) further comprising said usable material passageway means (16) and said displacement matter passageway means (44) to which is so-attached said paint brush cup means (110), said elongated displacment tube means (84), and said displacement partition means (28);

so-removing said usable material (50, 50*c*, 50*d*) from said usable material chamber (46) bounded outwardly by said chemical container (12) and inwardly by an exterior of said displacement partition means (28), comprising the further steps of pouring a predetermined volume of displacement matter (50, 50*c*, 50*d*) into said elongated displacement tube means (84), through said usable material passageway means (16), and into said displacement matter chamber (48), without applying pressure to said displacement matter (52, 52*a*, 52*d*), thereby displacing a volume of said chemical compound substantially equal to said predetermined volume of displacement matter (50, 50*c*, 50*d*) and forcing said volume of said chemical compound to exit from said usable material chamber (46) through said paint brush cup means (110) and to pool within said paint brush cup means (110), by virtue of said higher elevation of said top of said displacement tube means (84) over said top of said paint burhs cup means (110) and said sealable attachments; wherein said usable material (50, 50*c*, 50*d*) is a chemical compound; and said displacment matter (52, 52*a*, 52*d*) is a liquid.

113. The method of claim 112, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

114. The method of claim 105, used for preventing atmospheric degradation of a chemical compound, further comprising the steps of:

in said initial state, orienting said device in a substantially upright position;

in said initial state, further closing and sealing said usable material passageway means (16) and hence said usable material chamber (46) using removable usable material closure means (6) for preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially tipped;

in said initial state, further closing and sealing said displacement matter passageway means (44) and hence said displacement matter chamber (48) using displacement matter closure means (66) for closing and sealing said displacement matter passageway means (44) and preventing said displacement matter (52, 52*a*, 52*d*) from spilling out from said displacement matter chamber (48) when said device is substantially tipped;

providing said usable material passageway means (16) and said displacmenent matter passageway means (44) such that both emanate proximate a top of said device when said device is in said upright position, oriented at an angle with respect to one another such that when said device is substantially tipped sufficiently to enable said chemical compound to pour out from said usable material chamber (46), said displacement matter passageway means (44) orientation retains a sufficient vertical component such that said displacement matter (52, 52*2*, 52*d*) does not pour out from said displacement matter passageway means (44) even if said displacement matter closure means (66) has been removed from said displacement matter passageway means (44);

so-removing said usable material (50, 50*c*, 50*d*) form said usable material chamber (46) comprising the further steps of removing said usable material closure means (60) from said usable material passageway means (16), optionally removing said displacement mater closure means (66) from said displacement matter passageway means (44), substantially tipping said device sufficiently to enable said chemical compound to pour out from said usable material chamber (46) through said usable material opening, and pouring a desired amount of said chemical compound out of said usable material chamber (46) through said usable material opening while said displacement matter passageway means (44) orientation retains a sufficient vertical component such that said displacement matter (52, 52*a*, 52*d*) does not pour out from said displacement matter passageway means (44) even if said displacement closure means (66) has been removed from said displacment matter passageway means (44);

so-introducing said volume of new displacment matter (52, 52*a*, 52*d*) into said displacement matter chamber (48) comprising the further steps of restoring said device to said upright position, removing said displacement matter closure means (66) from said displacment matter passageway means (4) if it was not already removed while said chemical compound was so-poured out of said usable material chamber (46), and pouring said new displacement matter (52, 52*a*, 52*d*) into said displacement matter chamber (48) through said displacement matter opening, without applying pressure to said new displacement matter (52, 52*a*, 52*d*), until said device is again substantially filled and atmospheric air is substantially removed; and replacing said usable material closure means (60) onto said usable material passageway means (16) and replacing said displacement matter closure means (66) onto said displacement matter passageway means (44); wherein said usable material (50, 50*c*, 50*d*) is a chemical compound; and said displacement matter (52, 52*a*, 52*d*) is a liquid.

115. The method of claim 114, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

116. The method of claim 105, used for preventing atmospheric degradation of a flowable ointment and enabling substantially all of said ointment to be squeezed out of a container (3, 3*c*) containing said flowable ointment, further comprising the steps of:

closing and sealing said usable material passageway means (16);

closing and sealing said displacement matter passageway means (44) using removable displacement matter closure means (66);

in said initial state, closing and sealing said usable material passageway means (16) and hence said usable material chamber (46) using usable material closure means (60) for preventing atmospheric air from entering said usable material chamber (46) via said usable material passageway means (16) and from contacting said usable material (50, 50*c*, 50*d*), and preventing said usable material (50, 50*c*, 50*d*) from discharging out from said usable material chamber (46);

in said initial state, further using removable usable material closure means (60), and closing and sealing said displacement matter passageway means (44) and hence said displacement matter chamber (48) and preventing said displacement matter (52, 52*a*, 52*d*) from discharging out from said displacment matter chamber (48);

so-removing said usable material (50, 50*c*, 50*d*) from said usable material chamber (46), comprising the further steps of removing said usable material closure means (60) removed from said usable material passageway means (16), and squeezing said flowable ointment container (12) until a desired amount of said flowable ointment is discharged;

so-introducing said volume of new displacement matter (52, 52*a*, 52*d*) into said displacement mater chamber (48), comprising the further stapes of replacing said usable material closure means (60) onto said usable material passageway means (16), removing said displacement matter closure means (66) from said displacment matter passageway means (44), introducing said new displacment matter into said syringe means (74), sealably-mating syringe means (74) to said displacement matter passageway means (44), and applying pressure to said syringe thereby introducing said displacment matter (52, 52*a*, 52*d*) into said displacement matter chamber (48) until said flowable ointment container (12) is restored to an expanded, substantially full fill state; and replacing said displacement matter closure means (66) onto said displacement matter passageway means (44); wherein:

said container is a flexible flowable ointment container (12)

said usable material (50, 50*c*, 50*d*) is flowable ointment;

said displacment matter (52, 52*a*, 52*d*) is a liquid;

said usable material chamber is bounded outwardly by said flowable ointment container (12) and inwardly by an exterior of said displacment partition means (28).

117. The method of claim 116, wherein said flowable ointment is selected from the flowable ointment group consisting of toothpaste, mustard, ketchup, artists paints, glue, calk application, cake icing, cosmetic preparations, thick liquid foods, soaps, suntan lotion, body lotion, shampoo, and car wax.

118. The method of claim 116, wherein said usable material passageway means (16) and said displacement matter passageway means (44) are substantially located on a same end of said flowable ointment container (12) as one another.

119. The method of claim 116, wherein said usable material passageway means (16) and said displacement matter passageway means (44) are substantially located on opposite ends of said flowable ointment container (12) from one another.

120. The method of claim 105, used for preventing atmospheric degradation of organic grain material storage container (4), further comprising the steps of:

in said initial state, orienting said device in a substantially upright position;

in said initial state, closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) form spilling out from said usable material chamber (46) when said device is substantially inverted, using usable material closure means (60);

in said initail state, closing shut and sealing said displacement matter closure means (66), and thereby said displacement matter passageway means (44) and hence said displacement matter chamber (48), using clamp means affixed to said displacement matter passageway means (44) to enable and disable a flow of displacement matter into and out of said displacement matter chamber (48) through said displacement matter passageway means (44);

so-removing said usable material (50, 50*c*, 50*d*) from said usable material chamber (46), comprising the further steps of opening said clamp means of said displacement matter closure means (66) is opening thereby enabling said atmospheric air displacement matter (52, 52*a*, 52*d*) to exit said displacement matter chamber (48) as necessary, removing said usable material closure means (60) from said usable material passageway means (16), inverting said device sufficiently to enable said organic grain material to pour out from said usable material chamber (46) through said usable material opening, and pouring a desired amount of said organic grain material out of said usable material chamber (46) through said usable material opening;

so-introducing said volume of new displacment matter (52, 52*a*, 52*d*) into said displacement matter chamber (48), comprising the further steps of restoring said device to said upright position, and blowing said atmospheric air comprising said displacement matter (52, 52*a*, 52*d*) through said displacement matter passageway means (44) into said displacement matter chamber (48) thereby expanding said displacement partition means (28) and substantially expelling atmospheric air out of said usable material chamber (46) through vent means (74) enabling atmospheric air to vent from said cereal container; and replacing said usable material closure means (60) is onto said usable material passageway means (16) and clamping closed said displacment matter closure means (66); wherein:

said container is a cereal container (12) suitable for storing organic grain material; and said usable material (50, 50*c*, 50*d*) is an organic grain material;

said displacment matter (52, 52*a*, 52*d*) is atmospheric air.

121. The method of claim 120, wherein said organic grain material is selected from the organic grain group consisting of dried food stuffs, crackers, dry cereal, snack chips, dried fruit, candy, and organic materials.

122. The method of claim 105, used for preventing atmospheric degradation of penetrating oil, further comprising the steps of:

so-remove said usable material (50, 50*c*, 50*d*) from said usable material chamber (46), further comprising the steps of pumping grease fitting and pump means (66) attaching to and sealing said displacement matter passageway means (44) and preventing said displacement matter (52, 52*a*, 52*d*) from spilling out from said displacement matter chamber (48) when said grease fitting means (66) is substantially closed, and enabling said displacment matter (52, 52*a*, 52*d*) to be pumped into said displacement matter chamber (48) under pressure, thereby pumping said pressurized grease into said displacement matter chamber (48) and exerting pressure on said penetrating oil via said displacement partition means (38), actuating oil valve means (60) attaching to and sealing said usable material passageway means (16) and providing a conduit for said usable material (50, 50*c*, 50*d*) to pass from said usable material chamber (46), through said usable material passageway means (16), and out of said oil valve means (60), to enable said flow of said usable material (50, 50*c*, 50*d*) out of said usable material chamber (46) through said usable material passageway means (16), releasing a desired amount of said penetrating oil out of said device through said oil valve means (60), and deactuating said oil valve means (60) to disable said flow of said usable material (50, 50*c*, 50*d*) out of said usable material chamber (46) through said usable material passageway means (16) once a desired amount of said usable material (50, 50*c*, 50*d*) has been released;

so-introducing said volume of new displacment matter (52, 52*a*, 52*d*) into said displacement matter chamber (48), comprising the further step of again pumping said grease fitting and pump means (66) to pump additional pressurized grease into said displacment matter chamber (48) and so-exert pressure on said penetrating oil; wherein:

said usable material (50, 50*c*, 50*d*) is penetrating oil;

said displacment matter (52, 52*a*, 52*d*) is pressurized grease.

123. The method of claim 105, used for preventing atmospheric degradation of calk in a calk container (12), further comprising the steps of:

in said initial state, closing and sealing said usable material passageway means (16) and hence said usable material chamber (46), using removable usable material closure means (60) for closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from discharging out from said usable material chamber (46);

in said initial state, closing and sealing said displacement matter passageway means (44) and hence said displacement matter chamber (48) using removable displacement matter closure means (66) for closing and sealing said displacement matter passageway means (44) and preventing said displacement matter (52, 52*a*, 52*d*) from discharging out from said displacement matter chamber (48);

so-removing said usable material (50, 50*c*, 50*d*) from said usable material chamber (46) so-introducing said volume of new displacement matter (52, 52*a*, 52*d*) into said displacement matter chamber (48), comprising the further steps of removing said usable material closure means (60) from said usable material passageway means (16), activating grease gun means sealably mating with said displacment matter passageway means (44) for applying pressure to the introduction of said displacement matter (52, 52*a*, 52*d*) into said displacement matter chamber (48) to force said pressurized grease into said displacment matter chamber (48) and thereby exert pressure on said calk via said displacement partition means (28), discharging said calk until a desired amount of said calk has been discharged, and deactivating said grease gun; and replacing said displacement matter closure means (66) onto said displacement matter passageway means (44); wherein said usable material (50, 50*c*, 50*d*) is calk;

said displacement matter (52, 52*a*, 52*d*) is pressurized grease;

said usable material chamber is bounded outwardly by said calk container (12) and inwardly by an exterior of said displacement partition means (28).

124. The method of claim 105, used for preventing atmospheric degradation of fuel, further comprising the steps of:

loading said fuel via a fuel entry opening into said usable material chamber (46) of said device, while a purge valve of air pump means (66) so-allows air in said displacement matter chamber to escape;

so-removing said usable material (50, 50*c*, 50*d*) from said usable material chamber (46) of said device, while a purge valve of air pump means (66) so-allows air in said displacement matter chamber to escape;

so-introducing said volume of new displacement matter (52, 52*a*, 52*d*) into said displacement matter chamber (48), comprising the further steps of attaching said air pump means (66) to and therewith sealing said displacement matter passageway means (44) and enabling air to be pumped into said displacement matter chamber (48), activating a purge valve allowing air in said displacment matter chamber to escape, to pump said pressurized air into said displacement matter chamber (48) when said pressure inside of fuel tank container means for storing fuel and providing said fuel as needed to a fuel-powered engine connected thereto is sensed by sensing means to monitor a fuel pressure inside of said fuel tank container means (12) to fall below a first desired predetermined tank pressure, and deactivating said air pump means (66) from so-pumping when said pressure inside of said fuel tank container means is sensed to rise above a second desired predetermined tank pressure; wherein:

said usable material passageway means (16) comprises a fuel line (72);

said usable material passageway means (16) further comprises a fuel entry opening separate from said conventional fuel line to load said usable material (50, 50*c*, 50*d*) into said device;

said usable material (50, 50*c*, 50*d*) is a fuel;

said displacement matter (52, 52*a*, 52*d*) is pressurized air;

said usable material chamber is bounded outwardly by said fuel tank container means (12) and inwardly by an exterior of said displacement partition means (28).

125. The method of claim 105, used for preventing atmospheric degradation of a gas and for enabling substantially all of such gas to be emitted from a container containing said gas, further comprising the steps of:

fueling said usable material chamber (46) with said gas, comprising the further steps of removing displacement matter closure means (66) for closing and sealing said displacement matter passgaeway means (44) and preventing said displacement matter (52, 52*a*, 52*d*) from spilling out from said displacement matter chamber (48), setting regulator means (60) for closing and sealing said usable material passageway means (16), enabling a gas to be pumped under pressure into said usable material chamber (46) via said usable material passageway means (16), and enabling and disabling said usable material (50, 50*c*, 50*d*) from being emitted from said usable material chamber (46), as desired, to allow said gas to be so-pumped under pressure into said usable material chamber (46), pumping said gas into said usable material chamber (46) via said usable material passageway means (16) until said displacement partition means (28) is substantially collapsed, replacing and sealing said displacement matter closure means (66) onto said displacement mater passageway means (4), further pumping said gas into said usable material chamber (46) until a desired predetermined pressure of said gas within said usable material chamber (46) has been reached, and setting said regulator means (60) to disable and seal against further gas passage into and out of said usable material chamber (46);

so-removing said gas from said usable material chamber (46), comprising the further steps of setting said regulator means (60) to allow said gas to exit said usable material chamber (46) via said via said usable material passageway means (16), emitting a desired amount of said gas out of said usable material chamber (46), and setting said regulator means (60) again disable and seal against further gas passage into and out of said usable material chamber (46); and removing any remaining gas from said usable material chamber (46) once the pressure of said gas within said usable material chamber (46) has dropped below atmospheric pressure, comprising the further steps of again setting said regulator means (60) to allow said gas to exit said usable material chamber (46), and pouring said displacement matter (52, 52*a*, 52*d*) into said displacement matter chamber thereby expelling said remaining gas; wherein:

said usable material (50, 50*c*, 50*d*) is a gas;

said displacement matter (52, 52*a*, 52*d*) is a liquid.

126. The method of claim 105, used for preventing atmospheric degradation of pharmaceutical preparations, further comprising the steps of:

containing said usable material (50, 50*c*, 50*d*) in industrial vat container means (12); and to prevent air contact with said usable material (50, 50*c*, 50*d*), pumping said usable material (50, 50*c*, 50*d*) into said usable material chamber (46) via said usable material passageway means (16) using material pump means for pumping said usable material into said usable material chamber (46) via said usable material passageway means (16);

so-removing said usable material (50, 50*c*, 50*d*) form said usable material chamber (46), comprising the further step of releasing said usable material (50, 50*c*, 50*d*) through petcock means (70) of said usable material passageway means (16) for enabling and disabling a movement of said usable material (50, 50*c*, 50*d*) out of said usable material chamber (46); and so-introducing said volume of new displacement matter (52, 52*a*, 52*d*) into said displacement matter chamber (48), comprising the further step of flowing said displacement matter (52, 52*a*, 52*d*) through said displacement matter passageway means (44) and into said displacement matter chamber (48); wherein:

said usable material passageway means (16) further comprises an entry opening separate from said petcock means (70);

said usable material (50, 50*c*, 50*d*) comprises a pharmaceutical preparation used to impregnate impregnable capsules (51);

said displacement matter (52, 52*a*, 52*d*) is a liquid.

127. A method for preventing usable material (50, 50*c*, 50*d*) from degrading due to atmospheric exposure, by retrofitting a volumetric displacement device for maintaining a substantially full-fill state to a preexisting container containing said usable material (50, 50*c*, 50*d*), comprising the steps of:

fitting displacement partition means (28) comprising a flexible membrane and defining an outer boundary of a displacment matter chamber (48) into, and enclosing said displacement partition means (28) within, said preexisting container, said enclosing of said displacement partition means (28) into said preexisting container defining a usable material chamber (46) bounded outwardly by said preexisting container and inwardly by an exterior of said displacement partition means (28); and sealably-attaching container closure means (12) to a top of said preexisting container, said container closure means (12) comprising:

usable material passageway means (16) passing through said container closure means (12), for removing said usable material (50, 50*c*, 50*d*) form within said usable material chamber (46) of said container while said container closure means (12) is sealably so-attached to said top of said preexisting container;

displacement matter passageway means (44) also passing through said container closure means (12), for introducing displacement matter (52, 52*a*, 52*d*) into said displacement matter chamber (48) from outside of said container while said container closure means (12) is sealably so-attached to said top of said preexisting container.

128. The method of claim 127, comprising the further steps of:

in an initial state, occupying said usable material chamber (46) with a positive initial volume of usable material (50, 50*c*, 50*d*) and introducing a non-negative initial volume of displacement matter (52, 52*a*, 52*d*) into said displacement matter chamber (48), thereby substantially filling said retrofitted container and substantially removing atmospheric air from said retrofitted container and particularly from contact with said usable material (50, 50*c*, 50*d*), the sum of said initial volume of usable material (50, 50*c*, 50*d*) plus said initial volume of displacement matter (52, 52*a*, 52*d*) defining a total initial material volume;

removing at least some volume of said usable material (50, 50*c*, 50*d*) from said usable material chamber (46), leaving a remaining volume of said usable material (50, 50*c*, 50*d*);

introducing a volume of new displacement matter (52, 52*a*, 52*d*) substantially equivalent to the volume of said usable material (50, 50*c*, 50*d*) so-removed from said usable material chamber (46) into said displacement matter chamber (48) resulting in a subsequent volume of displacement matter (52, 52*a*, 52*d*), thereby again substantially filling said retrofitted container and substantially remove atmospheric air from said retrofitted container and particularly from contact with said usable material (50, 50*c*, 50*d*), the sum of said remaining volume of usable material (50, 50*c*, 50*d*) plus said subsequent volume of displacement matter (52, 52*a*, 52*d*) substantially equaling said total initial material volume; and repeatedly so-removing usable material (50, 50*c*, 50*d*) from said usable material chamber (46) and repeatedly so-introducing new displacement matter (52, 52*a*, 52*d*) into said displacement matter chamber (48), thereby substantially continuously maintaining said retrofitted container in a substantially-full state and substantially removing atmospheric air from said retrofitted container and particularly from contact with said usable material (50, 50*c*, 50*d*), as often as desired, until substantially all of said usable material (50, 50*c*, 50*d*) has been removed from said retrofitted container.

129. The method of claim 128, used for preventing atmospheric degradation of an effervescent beverage, further comprising the steps of:

locating a usable material opening of said usable material passageway means (16) proximate a top of said retrofitted container when said retrofitted container is in said upright position;

locating a displacement matter opening of said displacement matter passageway means (44) proximate said top of said retrofitted container when said retrofitted container is in an upright position in said initial state, orienting said retrofitted container in a substantially upright position;

in said initial state, further closing and sealing said usable material passageway means (16) and hence said usable material chamber (46) using removable usable material closure means (60), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said retrofitted container is substantially inverted;

in said initial state, further closing and sealing said displacement matter passageway means (44) and hence said displacement matter chamber (48) using removable displacment matter closure means (66) preventing said displacement matter (52, 52*a*, 52*d*) from spilling out from said displacement matter chamber (48) when said retrofitted container is substantially inverted;

so-removing said usable material (50, 50*c*, 50*d*) from said usable material chamber (46), comprising the further steps of removing said usable material closure means (60) form said usable material passageway means (16), substantially inverting said retrofitted container sufficiently enabling said beverage to pour out from said usable material chamber (46) through said usable material opening, pouring a desired amount of said beverage out of said usable material chamber (46) through said usable material opening while said displacement matter closure means (66) is closing and sealing said displacement matter passageway means (44) and hence said displacement matter chamber (48) and is so-preventing said displacement matter (52, 52*a*, 52*d*) from spilling out from said displacement matter chamber (48);

so-introducing said volume of new displacement matter (52, 52*a*, 52*d*) into said displacement matter chamber (48), comprising the further steps of restoring said retrofitted container to said upright position, removing said displacement mater closure means (66) from said displacement matter passageway means (44), and pouring said new displacement mater (52, 52*a*, 52*d*) into said displacement matter chamber (48) through said displacement matter opening, without applying pressure to said new displacement matter (52, 52*a*, 52*d*), until said retrofitted container is again substantially filled and atmospheric air is substantially removed; and replacing said usable material closure means (60) onto said usable material passageway means (16) and replacing said displacement matter closure means (66) onto said displacement matter passageway means (44); wherein:

said preexisting container is a carbonated beverage container;

said usable material (50, 50*c*, 50*d*) is a carbonated, effervescent beverage;

said displacement matter (52, 52*a*, 52*d*) is a liquid.

130. The method of claim 129, used as a soda fountain (1.2, 1.4), further comprising the steps of:

removing said removable usable material closure means (60) from said usable material passageway means (16);

replacing said removable usable material closure means (6) by attaching soda fountain faucet nozzle means (245) to, and sealing therewith, said usable material passageway means (16), thereby providing a conduit for said beverage to pass from said usable material chamber (46), through said usable material passageway means (16), and out of said soda fountain faucet nozzle means (245);

removing said displacement matter closure means (66) from said displacement matter passageway means (44);

replacing said displacement matter closure means (66) by attaching soda bottle air pump means (200) to, and sealing therewith, said displacement mater passageway means (44), thereby enabling air to be pumped into said displacement matter chamber (48); wherein so-removing said usable material (50, 50*c*, 50*d*) from said usable material chamber (46), comprising the further steps of pumping pressurized atmospheric air into said displacement matter chamber (48) using said soda bottle air pump means (200) thereby exerting pressure on said beverage via said displacement partition means (28), setting said soda fountain faucet nozzle means (245) to enable said flow of said usable material (50, 50*c*, 50*d*) out of said usable material chamber (46) through said soda fountain faucet nozzle means (245), and resetting said soda fountain faucet nozzle means (245) to disable said flow of said usable material (50, 50*c*, 50*d*) out of said usable material chamber (46) through said usable material passageway means (16) once a desired amount of said usable material (50, 50*c*, 50*d*) has been released;

so-introducing said volume of new displacement matter (52, 52*a*, 52*d*) into said displacement matter chamber (48), comprising the further step of pumping addition pressurized air into said displacement matter chamber (48) using said soda bottle air pump means; wherein said displacement matter (52, 52*a*, 52*d*) comprises said pressurized atmospheric air.

131. The method of claim 127, used for preventing atmospheric degradation of a chemical compound, wherein said preexisting container is a chemical container, further comprising the steps of:

providing spout means (94) sealably attached to said usable material passageway means (16), vertically oriented above said usable material passageway means (16) at the position of attachment thereto;

further providing elongated displacement tube means (84) sealably attached to said displacement matter passageway means (4) and therethrough to said displacement partition means (28), vertically oriented above said displacement matter passageway means (44) at the position of attachment thereto, with a top of said displacement tube means (84) being at a higher elevation than a top of said spout means (94);

sealably-attaching a chemical container lid (72) to a top of a chemical container (12), said chemical container lid (72) further comprising said usable material passageway means (16) and said displacement matter passageway means (44) to which is so-attached said spout means (94), said elongated displacement tube means (84), and said displacement partition means (28);

so-removing said usable material (50, 50*c*, 50*d*) from said usable material chamber (46) bounded outwardly by said chemical container (12) and inwardly by an exterior of said displacement partition means (28), comprising the further steps of pouring a predetermined volume of displacment matter (50, 50*c*, 50*d*) into said elongated displacement matter chamber (48), without applying pressure to said displacement matter (52, 52*a*, 52*d*), thereby displacing a volume of said chemical compound substantially equal to said predetermined volume of displacement matter (50, 50*c*, 50*d*) and forcing said volume of said chemical compound to exit from said usable material chamber (46) through said spout means (94), by virtue of said higher elevation of said top of said displacement tube means (84) over said top of said spout means (94) and said sealable attachments; wherein said usable material (50, 50*c*, 50*d*) is a chemical compound; and said displacement matter (52, 52*a*, 52*d*) is a liquid.

132. The method of claim 131, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

133. The method of claim 127, used for preventing atmospheric degradation of a chemical compound, wherein said preexisting container is a chemical container, further comprising the steps of:

providing paint brush cup means (110) sealably attached to said usable material passageway means (16), vertically oriented above said usable material passageway means (16) at the position of attachment thereto;

further providing elongated displacement tube means (84) sealably attached to said displacement matter passageway means (44) and therethrough to said displacement partition means (28), vertically oriented above said displacement matter passageway means (4) at the position of attachment thereto, with a top of said displacement tube means (84) being at a higher elevation than a top of said paint brush cup means (110);

sealably-attaching a chemical container lid (72) to a top of a chemical container (12), said chemical container lid (72) further comprising said usable material passageway means (16) and said displacement mater passageway means (44) to which is so-attached said paint brush cup means (110), said elongated displacement tube means (84), and said displacement partition means (28);

so-removing said usable material (50, 50*c*, 50*d*) from said usable material chamber (46) bounded outwardly by said chemical container (12) and inwardly by an exterior of said displacement partition means (28), comprising the further steps of pouring a predetermined volume of displacement matter (50, 50*c*, 50*d*) into said elongated displacement tube means (84), through said usable material passageway means (16), and into said displacement matter chamber (48), without applying pressure to said displacement matter (52, 52*a*, 52*d*), thereby displacing a volume of said chemical compound substantially equal to said predetermined volume of displacement matter (50, 50*c*, 50*d*) and forcing said volume of said chemical compound to exit from said usable material chamber (46) through said paint brush cup means (110) and to pool within said paint brush cup means (110), by virtue of said higher elevation of said top of said displacement tube means (84) over said top of said paint brush cup means (110) and said sealable attachments; wherein said usable material (50, 50*c*, 50*d*) is a chemical compound; and said displacement matter (52, 52*a*, 52*d*) is a liquid.

134. The method of claim 83, wherein said chemical compound is selected from the chemical compound group consisting of paint, fine chemicals, fine wines, glues, varnish, shellac, brake fluid, coatings, casting materials, pharmaceutical preparations, cooking oils, and olive oil.

135. The method of claim 127, used for preventing atmospheric degradation of an organic grain material, wherein said preexisting container is an organic grain container, further comprising the steps of:

in said initial state, orienting said device in a substantially upright position;

in said initial state, closing and sealing said usable material passageway means (16), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted, using usable material closure means (60);

in said initial state, closing shut and sealing said displacement matter closure means (66), and thereby said displacement matter passageway means (44) and hence said displacement matter chamber (48), using clamp means affixed to said displacement matter passageway means (44) to enable and disable a flow of displacement matter into and out of said displacement matter chamber (48) through said displacement matter passageway means (44);

so-removing said usable material (50, 50*c*, 50*d*) form said usable material chamber (46), comprising the further steps of opening said clamp means of said displacement matter closure means (66) is opened thereby enabling said atmospheric air displacement matter (52, 52*a*, 52*d*) to exit said displacement matter chamber (48) as necessary, removing said usable material closure means (60) from said usable material passageway means (16), inverting said device sufficiently to enable said organic grain material to pour out from said usable material chamber (46) through said usable material opening, and pouring a desired amount of said organic grain material out of said usable material chamber (46) through said usable material opening;

so-introducing said volume of new displacement matter (52, 52*a*, 52*d*) into said displacement matter chamber (48), comprising the further steps of restoring said device to said upright position, and blowing said atmospheric air comprising said displacement matter (52, 52*a*, 52*d*) through said displacement matter passageway means (4) into said displacement matter chamber (48) thereby expanding said displacement partition means (28) and substantially expelling atmospheric air out of said usable material chamber (46) through vent means (74) enabling atmospheric air to vent from said cereal container; and replacing said usable material closure means (60) is onto said usable material passageway means (16) and clamping closed said displacement matter closure means (66); wherein:

said container is a cereal container (12) suitable for storing organic grain material; and said usable material (50, 50*c*, 50*d*) is an organic grain material;

said displacement matter (52, 52*a*, 52*d*) is atmospheric air.

136. The method of claim 135, wherein said organic grain material is selected from the organic grain group consisting of dried food stuffs, crackers, dry cereal, snack chips, dried fruit, candy, and organic materials.

137. The method of claim 127, used for preventing atmospheric degradation of a fuel, comprising the further steps of:

loading said fuel via a fuel entry opening into said usable material chamber (46) of said device, while a purge valve of air pump means (66) so-allows air in said displacement matter chamber to escape;

so-removing said usable material (50, 50*c*, 50*d*) from said usable material chamber (46), comprising the further steps of removing said loaded fuel in said usable material chamber (46) via said fuel line (72) and providing said fuel as needed to a fuel-powered engine; and so-introducing said volume of new displacement matter (52, 52*a*, 52*d*) into said displacement matter chamber (48), comprising the further steps of attaching said air pump means (66) to and therewith sealing said displacement matter passageway means (44) and enabling air to be pumped into said displacement matter chamber (48), activating a purge valve allowing air in said displacement matter chamber to escape, to pump said pressurized air into said displacement matter chamber (48) when said pressure inside of fuel tank container means for storing fuel and providing said fuel as needed to a fuel-powered engine connected thereto is sensed by sensing means to monitor a fuel pressure inside of said fuel tank container means (12) to fall below a first desired predetermined tank pressure, and deactivating said air pump means (66) from so-pumping when said pressure inside of said fuel tank container means is sensed to rise above a second desired predetermined tank pressure; wherein:

said usable material passageway means (16) comprises a fuel line (72);

said usable material passageway means (16) further comprises a fuel entry opening separate from said conventional fuel line to load said usable material (50, 50*c*, 50*d*) into said device;

said usable material (50, 50*c*, 50*d*) is a fuel;

said displacement matter (52, 52*a*, 52*d*) is pressurized air;

said usable material chamber is bounded outwardly by said fuel tank container means (12) and inwardly by an exterior of said displacement partition means (28).

138. The method of claim 127, used for preventing atmospheric degradation of a gas and for enabling substantially all of such gas to be emitted from a container containing said gas, further comprising the steps of:

filling said usable material chamber (46) with said gas, comprising the further steps of removing displacement matter closure means (66) for closing and sealing said displacement matter passageway means (44) and preventing said displacement matter (52, 52*a*, 52*d*) from spilling out from said displacement matter chamber (48), setting regulator means (60) for closing and sealing said usable material passageway means (16), enabling a gas to be pumped under pressure into said usable material chamber (46) via said usable material passageway means (16), and enabling and disabling said usable material (50, 50*c*, 50*d*) from being emitted from said usable material chamber (46), as desired, to allow said gas to be so-pumped under pressure into said usable material chamber (46), pumping said gas into said usable material chamber (46) via said usable material passageway means (16) until said displacement partition means (28) is substantially collapsed, replacing and sealing said displacement matter closure means (66) onto said displacement matter passageway means (44), further pumping said gas into said usable material chamber (46) until a desired predetermined pressure of said gas within said usable material chamber (46) has been reached, and setting said regulator means (60) to disable and seal against further gas passage into and out of said usable material chamber (46);

so-removing said gas from said usable material chamber (46), comprising the further steps of setting said regulator means (60) to allow said gas to exit said usable material chamber (46) via said via said usable material passageway means (16), emitting a desired amount of said usable material chamber (46), and setting said regulator means (60) again disable and seal against further gas passage into and out of said usable material chamber (46); and removing any remaining gas from said usable material chamber (46) once the pressure of said gas within said usable material (46) has dropped below atmospheric pressure, comprising the further steps of again setting said regulator means (60) to allow said gas to exit said usable material chamber (46), and pouring said displacement matter (52, 52*a*, 52*d*) into said displacement matter chamber thereby expelling said remaining gas; wherein:

said usable material (50, 50*c*, 50*d*) is a gas;

said displacement matter (52, 52*a*, 52*d*) is a liquid.

139. The method of claim 127, used for preventing atmospheric degradation of pharmaceutical preparations, wherein said preexisting container is an industrial vat container; further comprising the steps of:

containing said usable material (50, 50*c*, 50*d*) in industrial vat container means (12); and to prevent air contact with said usable material (50, 50*c*, 50*d*), pumping said usable material (50, 50*c*, 50*d*) into said usable material chamber (46) via said usable material passageway means (16) using material pump means for pumping said usable material into said usable material chamber (46) via said usable amterial passageway means (16);

so-removing said usable material (50, 50*c*, 50*d*) form said usable material chamber (46), comprising the further step of releasing said usable material (50, 50*c*, 50*d*) through petcock means (70) of said usable material passageway means (16) for enabling and disabling a movement of said usable material (50, 50*c*, 50*d*) out of said usable material chamber (46); and so-introducing said volume of new displacement matter (52, 52*a*, 52*d*) into said displacement matter chamber (48), comprising the further step of flowing said displacement matter (52, 52*a*, 52*d*) through said displacement matter passageway means (44) and into said displacement matter chamber (48); wherein:

said usable material passageway means (16) further comprises an entry opening separate from said petcock means (70);

said usable material (50, 50*c*, 50*d*) comprises a pharmaceutical preparation used to impregnate impregnable capsules (51);

said displacement matter (52, 52*a*, 52*d*) is a liquid.

140. The method of claim 105, further comprising the steps of:

so-removing said usable material (50, 50*c*, 50*d*) from said usable material chamber (46), comprising the further steps of substantially inverting said device sufficiently enabling said beverage to pour out from said usable material chamber (46) through said usable material opening, pouring a desired amount of said beverage out of said usable material chamber (46) through said usable material opening while displacement matter closure means (66) is closing and sealing said displacement matter passageway means (44) and hence said displacement matter chamber (48) and is so-preventing said displacement matter (52, 52*a*, 52*d*) from spilling out from said displacement matter chamber (48);

so-introducing said volume of new displacement matter (52, 52*a*, 52*d*) into said displacement matter chamber (48), comprising the further steps of removing said displacement matter closure means (66) from said displacement matter passageway means (44), and pouring said new displacement matter (52, 52*a*, 52*d*) into said displacement matter chamber (48) through said displacement matter opening, without applying pressure to said new displacement matter (52, 52*a*, 52*d*), until said device is again substantially filled and atmospheric air is substantially removed.

141. The method of claim 105, further comprising the steps of:

in said initial state, orienting said device in a substantially upright position;

in said initial state, further closing and sealing said usable material passageway means (16) and hence said usable material chamber (46) using removable usable material closure means (60), preventing atmospheric air from entering said usable material chamber (46) via said usable material passageway means (16) and from contacting said usable material (50, 50*c*, 50*d*), and preventing said usable material (50, 50*c*, 50*d*) from spilling out from said usable material chamber (46) when said device is substantially inverted;

in said initial state, further closing and sealing said displacement matter passageway means (44) and hence said displacement matter chamber (48) using removable displacement matter closure means (66) preventing said displacement matter (52, 52*a*, 52*d*) from spilling out from said displacement matter chamber (48) when said device is substantially inverted;

so-removing said usable material (50, 50*c*, 50*d*) from said usable material chamber (46), comprising the further steps of removing said usable material closure means (60) from said usable material passageway means (16), substantially inverting said device sufficiently enabling said beverage to pour out from said usable material chamber (46) through said usable material opening, pouring a desired amount of said beverage out of said usable material chamber (46) through said usable material opening while said displacement matter chamber (48) and is so-preventing said displacement matter (52, 52*a*, 52*d*) from spilling out from said displacement matter chamber (48);

so-introducing said volume of new displacement matter (52, 52*a*, 52*d*) into said displacement matter chamber (48), comprising the further steps of restoring said device to said upright position, removing said displacement matter closure means (66) from said displacement matter passageway means (44), and pouring said new displacement mater (52, 52*a*, 52*d*) into said displacement matter chamber (48) through said displacement matter opening, without applying pressure to said new displacement matter (52, 52*a*, 52*d*), until said device is again substantially filled and atmospheric air is substantially removed; and replacing said usable material closure means (60) onto said usable material passageway means (16) and replacing said displacement matter closure means (66) onto said displacement matter passageway means (44).

* * * * *